US009702619B2

(12) United States Patent
Kendall et al.

(10) Patent No.: US 9,702,619 B2
(45) Date of Patent: Jul. 11, 2017

(54) CONTROLLED, DYNAMIC LIGHTING OF INTERIOR OF APPLIANCE

(71) Applicant: Whirlpool Corporation, Benton Harbor, MI (US)

(72) Inventors: James W. Kendall, Mt. Prospect, IL (US); Randell L. Jeffery, Stevensville, MI (US); Michael S. Seeley, South Haven, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 284 days.

(21) Appl. No.: 13/955,018

(22) Filed: Jul. 31, 2013

(65) Prior Publication Data

US 2015/0035432 A1 Feb. 5, 2015

(51) Int. Cl.
*F25D 27/00* (2006.01)

(52) U.S. Cl.
CPC ..... *F25D 27/005* (2013.01); *F25D 2327/001* (2013.01)

(58) Field of Classification Search
CPC ..... F25D 27/00; F25D 27/005; F24C 7/088
See application file for complete search history.

(56) References Cited

U.S. PATENT DOCUMENTS 4,851,662 A 7/1989 Ott et al.
4,855,721 A * 8/1989 Hallett et al. ..... 340/585
5,063,372 A * 11/1991 Gillett ..... 340/547
5,450,297 A 9/1995 Akashi et al.
6,210,013 B1 4/2001 Bousfield
6,804,974 B1 * 10/2004 Voglewede et al. ..... 62/264
7,984,997 B1 * 7/2011 Sandberg ..... 362/101
8,031,164 B2 * 10/2011 Herz et al. ..... 345/102
8,109,301 B1 2/2012 Denise
8,239,073 B2 * 8/2012 Fausak et al. ..... 700/295
2004/0025389 A1 2/2004 Peterson
2004/0051860 A1 * 3/2004 Honda et al. ..... 356/4.01
2004/0239519 A1 * 12/2004 Midlang ..... 340/815.45
2005/0155372 A1 * 7/2005 Dentella et al. ..... 62/441
2006/0023199 A1 * 2/2006 Stierle et al. ..... 356/4.01
2007/0268682 A1 * 11/2007 Kim et al. ..... 362/92
2009/0021927 A1 1/2009 Hall et al.
2009/0097227 A1 4/2009 Kim et al.
2009/0161349 A1 6/2009 Smith
2010/0313595 A1 * 12/2010 Seo ..... 62/344
2010/0319383 A1 12/2010 Kim
2010/0326115 A1 12/2010 Pae
2010/0327720 A1 * 12/2010 Pae ..... 312/405
2011/0005258 A1 * 1/2011 Audet ..... 62/264
2011/0006789 A1 * 1/2011 Cooper et al. ..... 324/663
2011/0023511 A1 2/2011 Lee et al.
(Continued)

OTHER PUBLICATIONS

'Human Proximity Sensing and Reduction of Power Consumption' ECE 480 Design Team 5 for Whirlpool Corporation, Michigan State University, Dec. 9, 2009.*

*Primary Examiner* — Douglas W Owens
*Assistant Examiner* — Jonathan G Cooper
(74) *Attorney, Agent, or Firm* — Nyemaster Goode, P.C.

(57) ABSTRACT

An apparatus, system, and method of illumination relative to an appliance. A programmable controller activates one or more light sources automatically based on a trigger or sensed condition. The controller dynamically adjusts the one or more light sources in a closed loop fashion.

21 Claims, 120 Drawing Sheets

(56) References Cited

U.S. PATENT DOCUMENTS

| | | | | |
|---|---|---|---|---|
| 2011/0174008 | A1* | 7/2011 | Kim | 62/264 |
| 2011/0266275 | A1* | 11/2011 | Rateiczak | 219/538 |
| 2011/0307098 | A1* | 12/2011 | Ennis | 700/275 |
| 2012/0230015 | A1* | 9/2012 | Zhu et al. | 362/94 |
| 2012/0260684 | A1 | 10/2012 | Wimbert et al. | |
| 2012/0262093 | A1 | 10/2012 | Recker et al. | |
| 2014/0251987 | A1* | 9/2014 | Reay | 219/756 |
| 2014/0320040 | A1* | 10/2014 | Katu | F25D 27/00 315/292 |

* cited by examiner

CONTROLLED, DYNAMIC LIGHTING OF INTERIOR OF APPLIANCE

BACKGROUND OF THE INVENTION

Field of the Invention

The present invention relates to exterior and interior illumination schemes for appliances.

State of the Art

Many appliances, although not all, are for indoor use. Depending on ambient light conditions, it can be desirable and even necessary to provide illumination relative the appliance.

For example, an enclosed cabinet of a refrigerated appliance typically has some automatic illumination when a door or drawer is opened to assist the user with visual identification of contents.

The prototypical illumination is what will be called "active" in the sense that it either requires user selection or some manual activity to instigate it. An example is opening a refrigerator door. That selected and manual activity triggers a light source or sources on. Closing the door turns them off. This is seen, of course, as convenient to the user. An alternative would be like a light switch on the wall. The user selects when the lights are on and when to turn them off.

Conventional light sources comprise incandescent or sometimes fluorescent or HID lamps. In a refrigerator environment, competing factors must be considered when deciding location and access to such lamps. For example, it is usually desirable to maximize storage capacity of the interior compartments of an appliance such as a refrigerator. Incandescent, fluorescent, and many HID sources require a socket. Because they have relatively limited life spans, they also require access for replacement. They also have a substantial size (usually on the order of an inch or more in longest dimension).

Another factor is protection against the refrigerator environment. There can be liquids or other substances that could adversely affect a light source and its electrical connection. Cold temperatures can also be a factor. It can also be a challenge to control light output from these sources to effectively illuminate what is desired.

Therefore, at least space, power, durability, effectiveness of illumination, and other considerations must be balanced by the designer.

As mentioned, one solution is a single relatively large incandescent source, exposed sufficiently to illuminate a substantial part of each major compartment of the refrigerated appliance, but protected in the liner or under an enclosed cover that is removable for replacement of the light source. The light source turns on when the refrigerator door is opened by responding to a switch that closes the circuit when the door is open and it turns the light off when the door is closed.

However, as can be appreciated by the foregoing, such an arrangement provides one illumination scheme. An incandescent source in the side wall or under a cover that must be removable either occupies substantial space in the refrigerator or tends to limit the effectiveness of the illumination of the whole cabinet.

Lighting can be functional but also highly aesthetic. A primary example is with theatrical lighting. Not only does it allow the audience to visually perceive the stage, it can add drama, mood, direct attention, or otherwise provide a combination of functional aesthetic benefits.

Such lighting is under the expert control of a professional lighting engineer or at least a human that again actively controls the lighting schemes as they change. This involves not only resources, but some complexity and monitoring to make sure the lighting scheme tracks the required changes of the script.

Of course, such things as consumer appliances have another factor that must be considered. Cost and economy of components, features, and operations come into play. This includes not only design, component, and assembly cost, but operational costs to the end user.

These types of issues also relate to other appliances and to other devices or structures that can benefit from illumination.

In more modern times, a variety of lighting or illumination options have been developed including consumer appliances. For example, the assignee of the present invention has patented a photosensitive switch to dim an in-door external water/ice dispenser light at night. The desirable consumer feature of an exterior water and/or ice dispenser is illuminated at a dimmer intensity when a sensor indicates ambient light has dropped below a threshold. When the user activates either the ice or water dispenser by pushing a button with a finger or with a cup or container, the intensity is automatically raised. In both situations, however, a single lighting effect is instigated and then requires manual activity to remove it. See, for example, U.S. Pat. No. 4,851,662, incorporated by reference herein.

The assignee of the present invention has also patented a system to measure a condition and regulate intensity of lighting. The monitored condition can be ambient light, motion, sound, moisture, or proximity of a user. Any of those things can trigger a light on. See U.S. Pat. No. 6,804,974 incorporated by reference herein. Again, however, this is a monitoring and then single action response.

It has therefore been discovered that the predominant methodology with appliances that have lighting interiorly or exteriorly is to activate illumination on a single trigger such as opening a door or some detection. As mentioned above, this might turn lighting on. A problem is whether or not the lighting is effective and/or aesthetic.

A need has been recognized in the art for improvement in providing good lighting interiorially or exteriorally for an appliance or other device that benefits from lighting.

A need has also been recognized for providing lighting effects or a sequence of lighting effects based on consumer engagement distance or interaction points, or response to movement. A need has also been identified for allowing high flexibility, for example, recalibration or automatic adjustment, of sensors relative to changed environment around the appliance.

SUMMARY OF THE INVENTION

It is therefore a principal object, feature, aspect or advantage of the present invention to provide lighting interiorially or exteriorally on an appliance or analogous apparatus that is dynamic and passive. The term "passive" is meant to mean that the lighting scheme does not rely on manual activity for it to be controlled or changed.

Other objectives, aspects, features or advantages of the present invention include a dynamic and at least partially passive lighting method, apparatus, and system which:

a) provides at least one change of lighting scheme automatically;

b) is at least in part passive in the sense that it does not require manual activity for that particular aspect;

c) can provide both or either functional and aesthetic illumination benefits;

d) can utilize some preprogramming of an intelligent control to facilitate the dynamic illumination;
e) can optionally include user selection or preset default functions;
f) can have one dynamic illumination scheme or several that act in series in relation to one another or can act separately, independently, and concurrently.
g) can present one or more lighting events or sequence of lighting events or features by engagement distances, interaction points, or response to movement at and around appliances;
h) allows recalibration or user change of sensors that trigger lighting events including based on temporary or non-user-related obstructions or rearrangement of the environment around an appliance;
i) designates zones for priority, engagement, or use scenarios related to users at and around an appliance;
j) provides an enhanced level of product interaction and perception of quality;
k) can link or coordinate plural appliances;
l) can confirm and emphasize consumer/appliance interaction or interactions;
m) can operate lighting events or effects for exterior, interior, or control lighting related to appliances.

These and other objects, features, aspects, and advantages of the present invention will become apparent with reference to the accompanying specification and claims.

One aspect of the invention comprises an apparatus which includes an illumination source, a trigger or monitor, and an intelligent control that reads the trigger or monitor and instigates a dynamic, passive illumination scheme or plural schemes in response.

In another aspect of the invention, a method comprises a programmable intelligent control monitoring one or more triggers, one or more lighting assemblies operatively connected to the intelligent control and activated and controlled by the intelligent control according to at least two preprogrammed lighting schemes.

A further aspect of the invention comprises a system for a refrigerated appliance that includes at least one illumination source, an intelligent controller having inputs from at least one trigger; and a program to dynamically control lighting based on the trigger in a controlled loop or closed control fashion.

BRIEF DESCRIPTION OF THE DRAWINGS

FIG. 17E also shows optional learning loops that can inform a change in a lighting event or sequence of events.

DETAILED DESCRIPTION OF EXEMPLARY EMBODIMENTS OF THE INVENTION

Overview

Figure 1A:
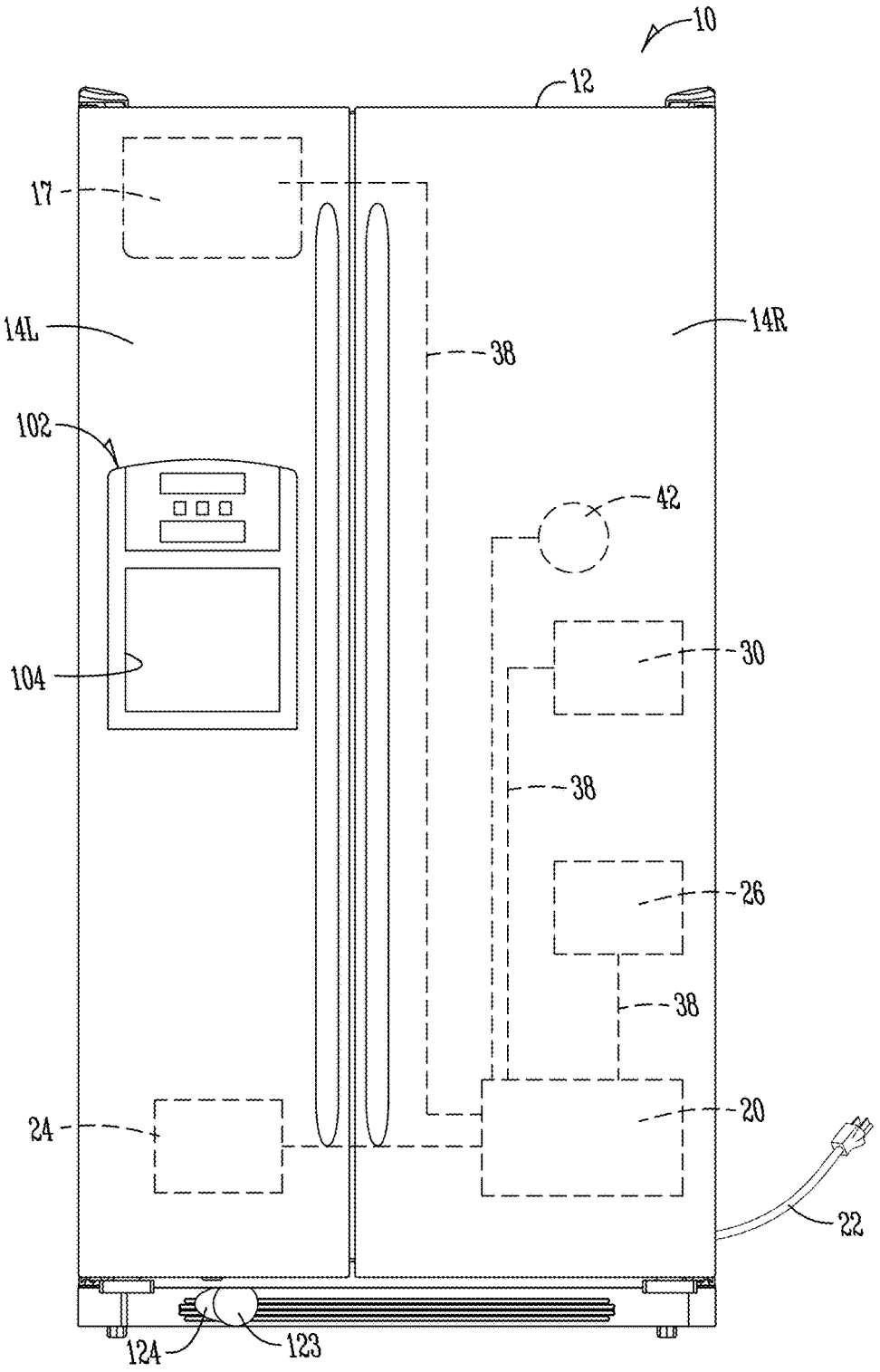
FIG. 1A is a diagrammatic perspective view of a refrigerated appliance as can be configured with an exemplary embodiment of the present invention.
Figure 1B:
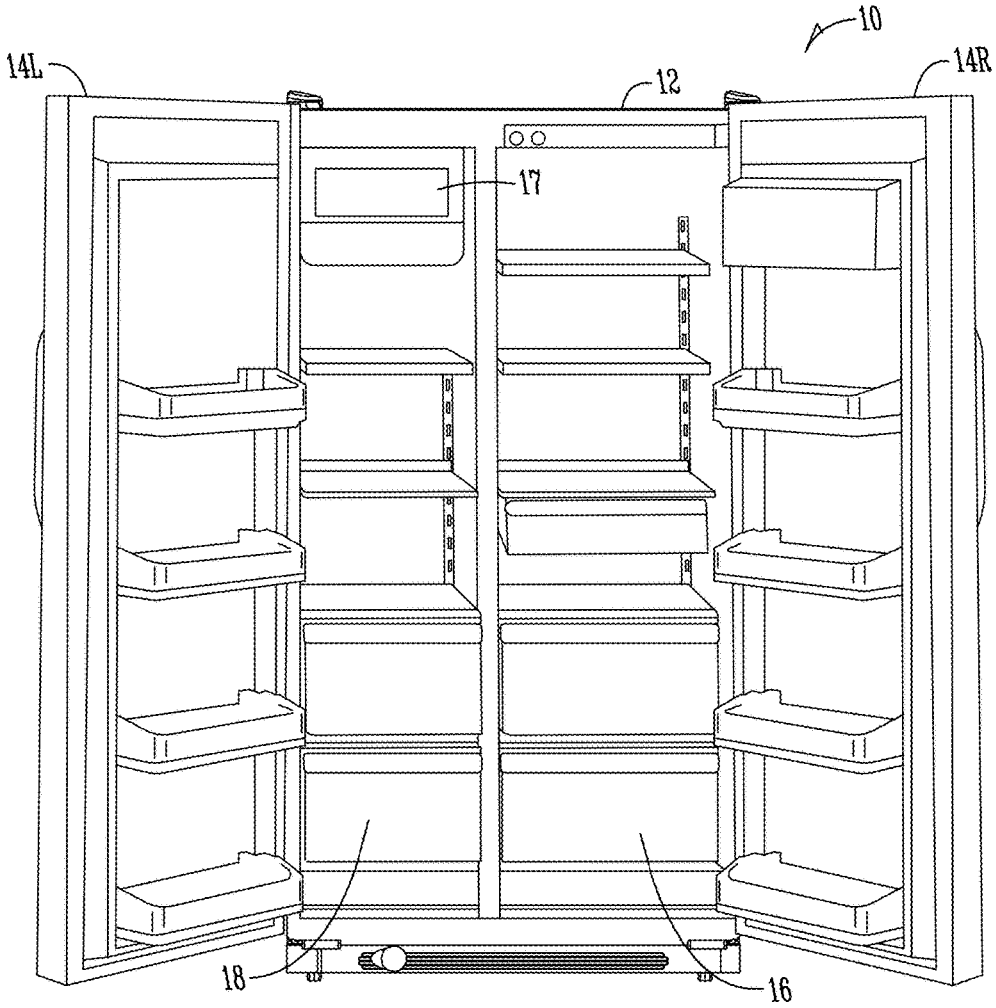
FIG. 1B is similar to FIG. 1A but with the refrigerator doors open showing the interior thereof.

For a better understanding of the invention, several examples of forms and configurations the invention can take will now be described in detail. These embodiments are illustrative only and neither exclusive nor inclusive of all the forms and embodiments the invention can take.

The embodiments will be described in the context of lighting in a refrigerated appliance such as a refrigerator, refrigerator/freezer, or the like for homeowners and mass market consumers. Refrigerator 10 shown in the drawings is a side-by-side refrigerator freezer. Aspects of the invention can be applied to any configuration of a refrigerated or refrigerator/freezer appliance. Moreover, it can be applied to other appliances and cabinets. It is to be understood, however, that the invention can be applied in analogous ways to other apparatus and in other contexts.

First Generalized Exemplary Embodiment

With reference to FIGS. 1A-E, a refrigerator 10 has one or more lighting subassemblies 30 in operative position and operatively connected via an electrical bus or wire bundle 38 to a controller/power source 20 (which connects by cord 22 to an electrical power outlet). Controller/power source 20 can be of any number of types and configurations. Examples are described at U.S. Pat. No. 7,765,819, incorporated by reference herein, and pending U.S. Application Publication No. 2009/0277210, incorporated by reference herein.

Figure 1C:
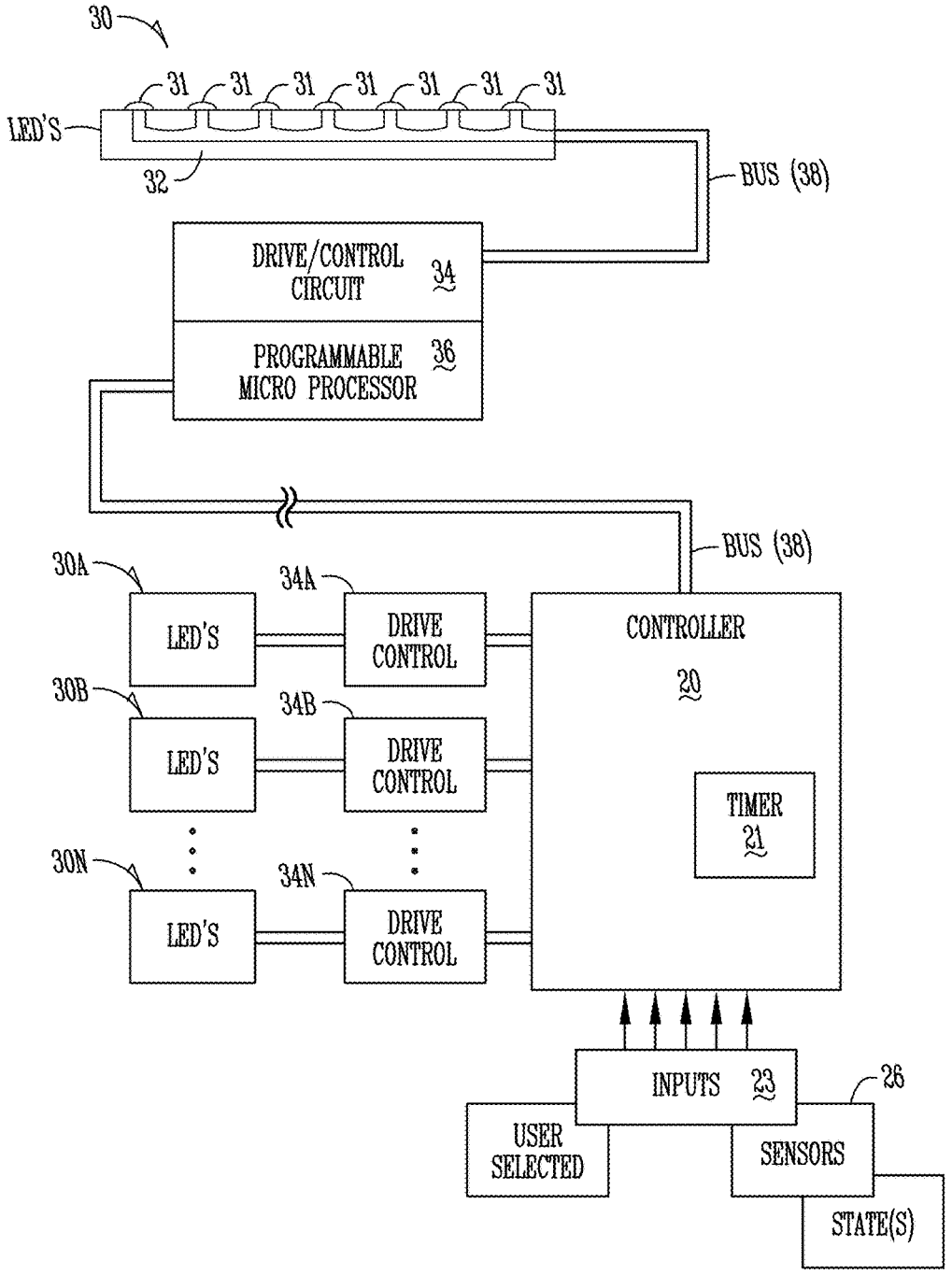
FIG. 1C is a diagrammatic illustration of a plurality of LED light subassemblies from the refrigerator of FIGS. 1A and 1B and a connection to driver circuits that can be controlled by a refrigerator controller.

Controller 20 and/or an optional programmable microprocessor 36 associated with the drive/control circuit 34 for the array of plural LEDs 31 on LED board 32 supply not only electrical power but control instructions for the operation of LEDs 31 (see FIG. 1C). Controller can control other things such as cooling system 24. Controller 20 can include a timer 21. A further optional feature under control of controller 20 would be an audio output device 42 (FIG. 1A). Audio device 42 could output an audio effect in an analogous way to a lighting effect. For example, upon a trigger, a prerecorded message could be played to the user. A further alternative would be music or other sound.

Figure 1D:
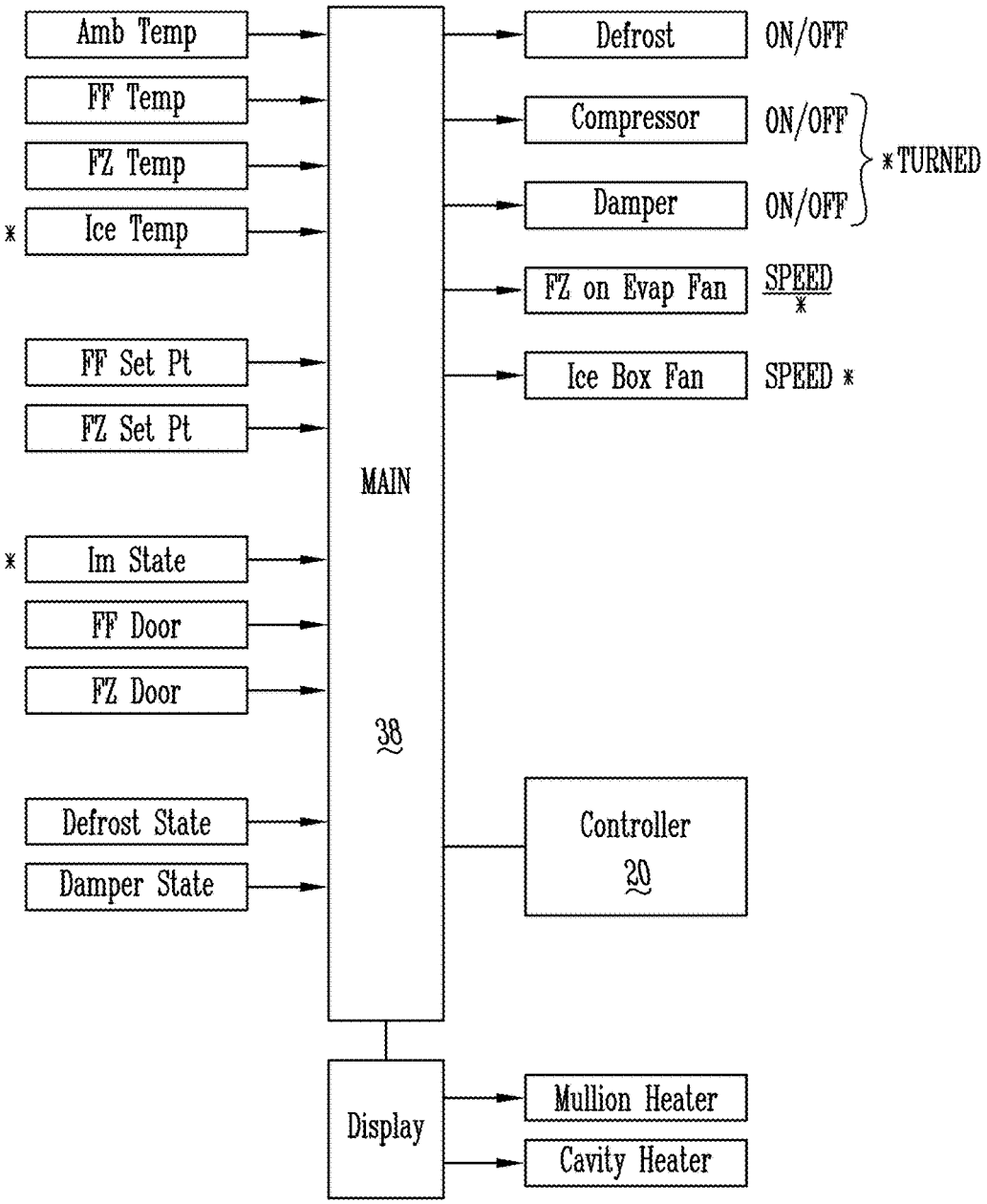
FIG. 1D is a diagrammatic illustration of a communications bus sending power and data signals to and from the controller and LED subassemblies, including inputs and outputs from the controller.
Figure 1E:
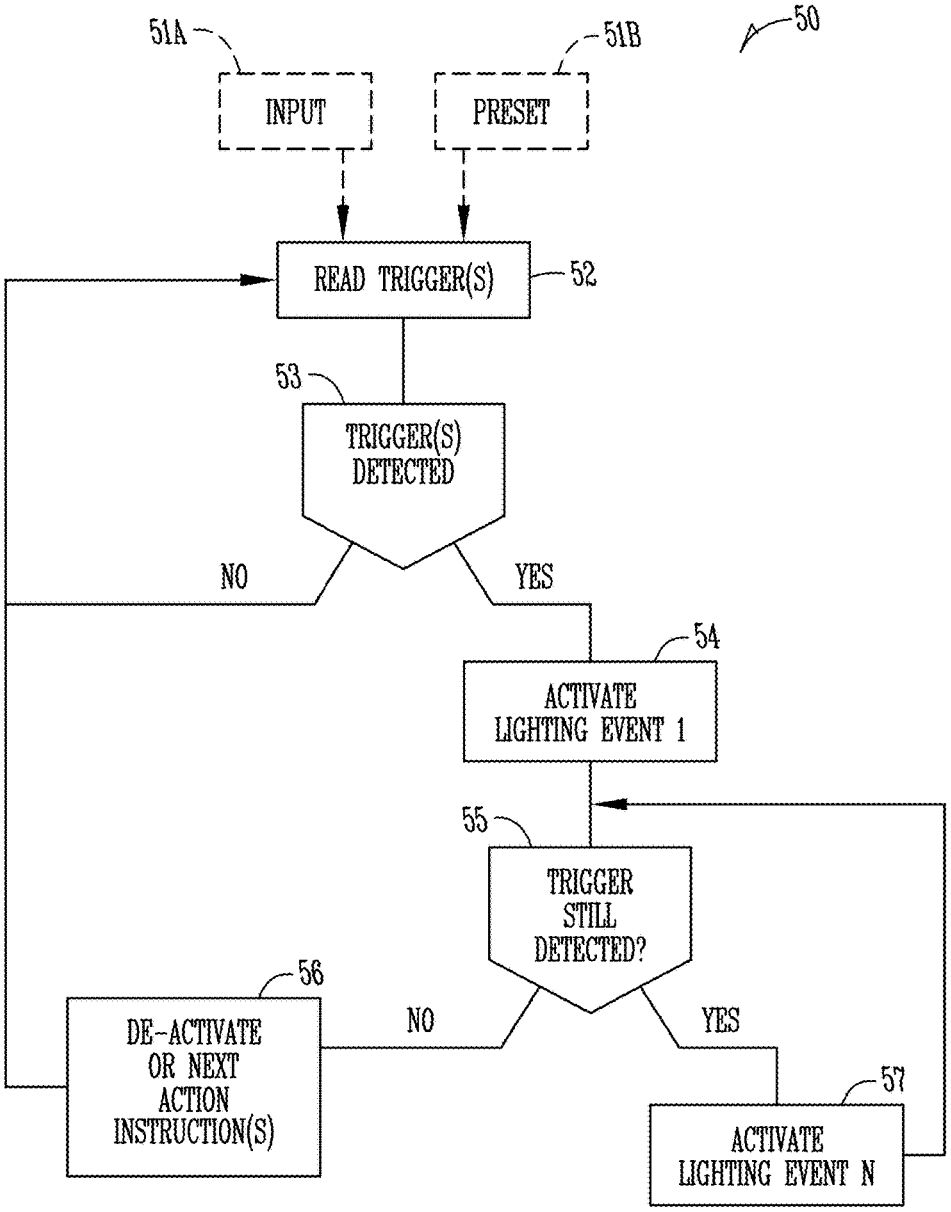
FIG. 1E is a block diagram flow chart illustrating a general methodology according to aspects of the present invention.

FIG. 1E illustrates an operational scheme for the configuration of FIGS. 1A-D. Controller 20 reads one or more triggers for a dynamic lighting closed control loop 50 (FIG. 1E). See Step 52.

If a trigger or triggers is/are detected (Step 53), a first lighting event 1 (Step 54) is activated by controller 20. If no triggers are detected, controller 20 simply loops around and continues to read the triggers.

An example of a lighting event 1 is turning on LED subassembly 30 to a first state or intensity. An example would be a steady state but dim intensity. Control loop 50 checks if the trigger for event 1 is still detected (Step 55). If not, LEDs 31 of LED assembly 30 are turned off or their state or intensity is changed (Step 56). Then control loop 50 again reads for the trigger.

If the trigger is still detected (Step 55), the control loop 50 activates a lighting event "n" (Step 57). Lighting event "n" can be anywhere from event 2, 3, 4, up to any practical number. Control loop 50 can simply keep changing the lighting effect from LEDs 31 for each iteration.

Thus, as can be seen, the arrangement of FIGS. 1A-E monitors for a trigger or some sensed parameter, state or other characteristic and then automatically controls one or more LEDs 31 according to a programmed algorithm. If event 1 is turning the LEDs on at a low intensity, event 2 might be raising the intensity. The raise in intensity could be timed by an internal timer 21 of controller 20. Or it could simply be some later time. Another example would be to change from steady state dim intensity event 1 to flashing or flickering of the LEDs as a second lighting event 2.

Once the triggering event is not detected or removed, the LEDs 31 are deactivated or turned off and control loop watches for the next triggering event.

As can be appreciated by FIGS. 1C and 1D, controller 20 can have a number of inputs 23. They can include inputs from any of a variety of sensors 26 or states of the refrigerator. As described in and incorporated by reference U.S. Publication No. 2009/0277210, sensors could be temperature sensors, photo detectors or light sensors of either light intensity, or ambient lighting around the appliance 10, or some type of proximity sensor (such as sensing within-range-proximity of a person, or a person's hand or foot) others are possible. These examples are neither exclusive nor inclusive of the possibilities. For further understanding, another example is sound or audio. A level, frequency, or type of sound could be monitored by some sort of sensor to create a trigger for a lighting effect or sequence of lighting effects. Also, as previously mentioned, an audio effect could also be triggered. When a person enters a room, a sensor could trigger based on some aspect of sound. That incorporated by reference application also describes how states could include such things as whether the refrigerator door is ajar or open, whether the cooling system fan is running, whether the ice maker is making ice or not, etc. The designer can utilize one or more of these inputs.

Additionally, it is possible that inputs 23 could include user selectable inputs. An example would be, as in U.S. Publication No. 2009/0277210, temperature set points for any of the compartments (including a range of set points defining desired top and bottom temperatures for a compartment). Another example would be setting a timed event or set of events. One example would be when external illumination (e.g., the ice/water dispenser well) would be illuminated during night time and when it would then be turned off in daylight.

Other user inputs could include selecting between different colors of light (e.g., if lighting subassembly 30 includes different independently controllable colored LEDs 31).

FIG. 1E illustrates that the triggers can be inputs (Step 51A) or preset or factory set (Step 51B). The factory or preset settings could be default settings that would be utilized unless overwritten by any of the inputs 51A.

As can be appreciated, this generalized embodiment achieves at least one or more objects of the present invention. It is dynamic in the sense that it presents several lighting schemes or changes if the control loop 50 runs through all stages. It is passive in the sense that transfer from stage to stage is automatic or does not necessarily require any trigger or manual input. It can be functional, aesthetic or both. It can be informed by presets, preprogramming, or user input in certain situations.

As intimated by FIGS. 1A-E, refrigerator 10 could have plural sets of LEDs (LED subassemblies 30, 30A, 30B, . . . , 30N). There could be multiple and different sensors.

In this example, refrigerator 10 includes a cabinet 12 with a freezer compartment 18, an ice compartment 17 within that freezer compartment 18, and a refrigerator of fresh food compartment 16. Left door 14L closes over freezer/ice compartments 18 and 17. Door 14R closes over fresh food compartment 16.

Refrigerator 10 can have various inputs of state or sensors of FIG. 1D, or less, more, or different ones.

A separate control loop algorithm such as FIG. 1E could be programmed for each light assembly 30, 30A, 30B . . . 30N. Alternatively, one algorithm could control two or more of the light assemblies. Each light assembly could have a drive circuit or control (e.g., 34A, 34B, . . . 34N).

Control algorithms could be triggered by separate triggers or the same trigger.

This paradigm allows the designer to program lighting schemes that are dynamic for any number of purposes. Therefore, as a general matter, a closed loop dynamic but passive effect or sequence of effects are possible. By "closed loop" it is intended to mean that upon some sort of triggering event, the system instigates an algorithm that goes through a sequence or loop of steps. Thus, it is passive in that the algorithm controls the sequence of steps as opposed to a user hitting a switch or selecting some selection. It is dynamic in that at least with most embodiments the effects can change.

Some specific examples of lighting schemes are set forth in the exemplary embodiments that follow.

Exemplary Embodiment 2

Figure 2A:
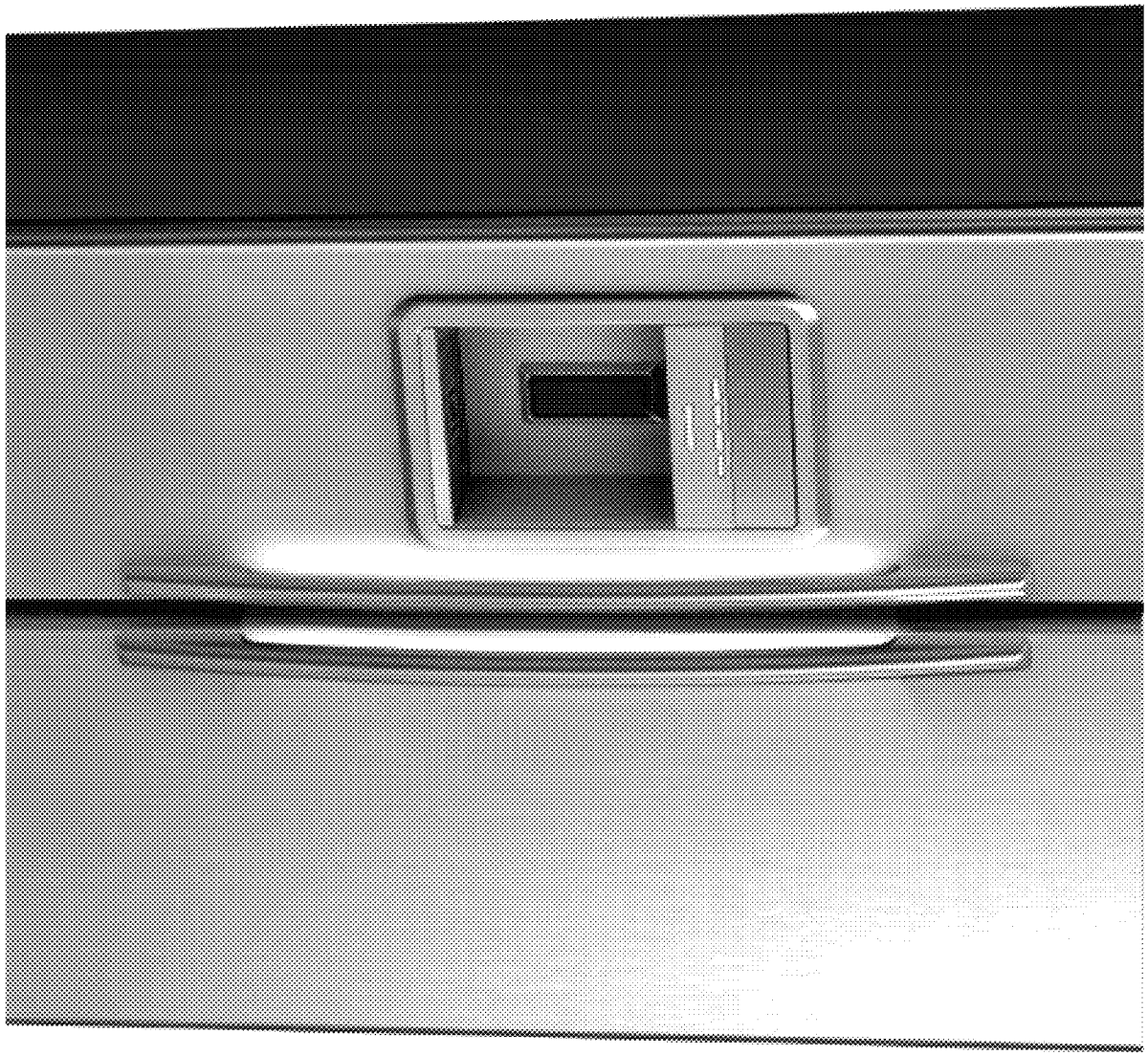
FIGS. 2A-C are in sequence of photographs illustrating a first specific exemplary embodiment according to the present invention.
Figure 2B:
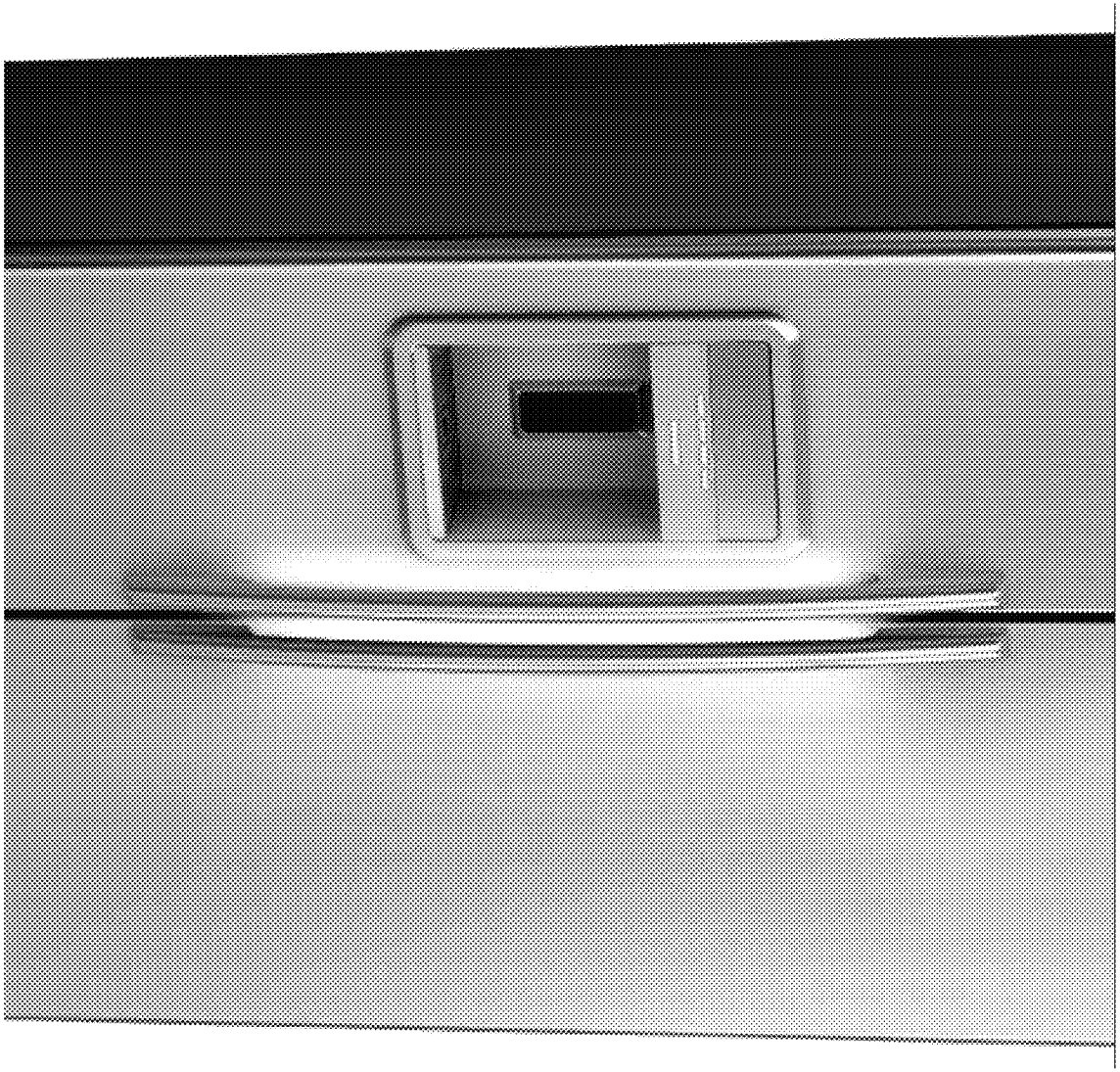
Figure 2C:
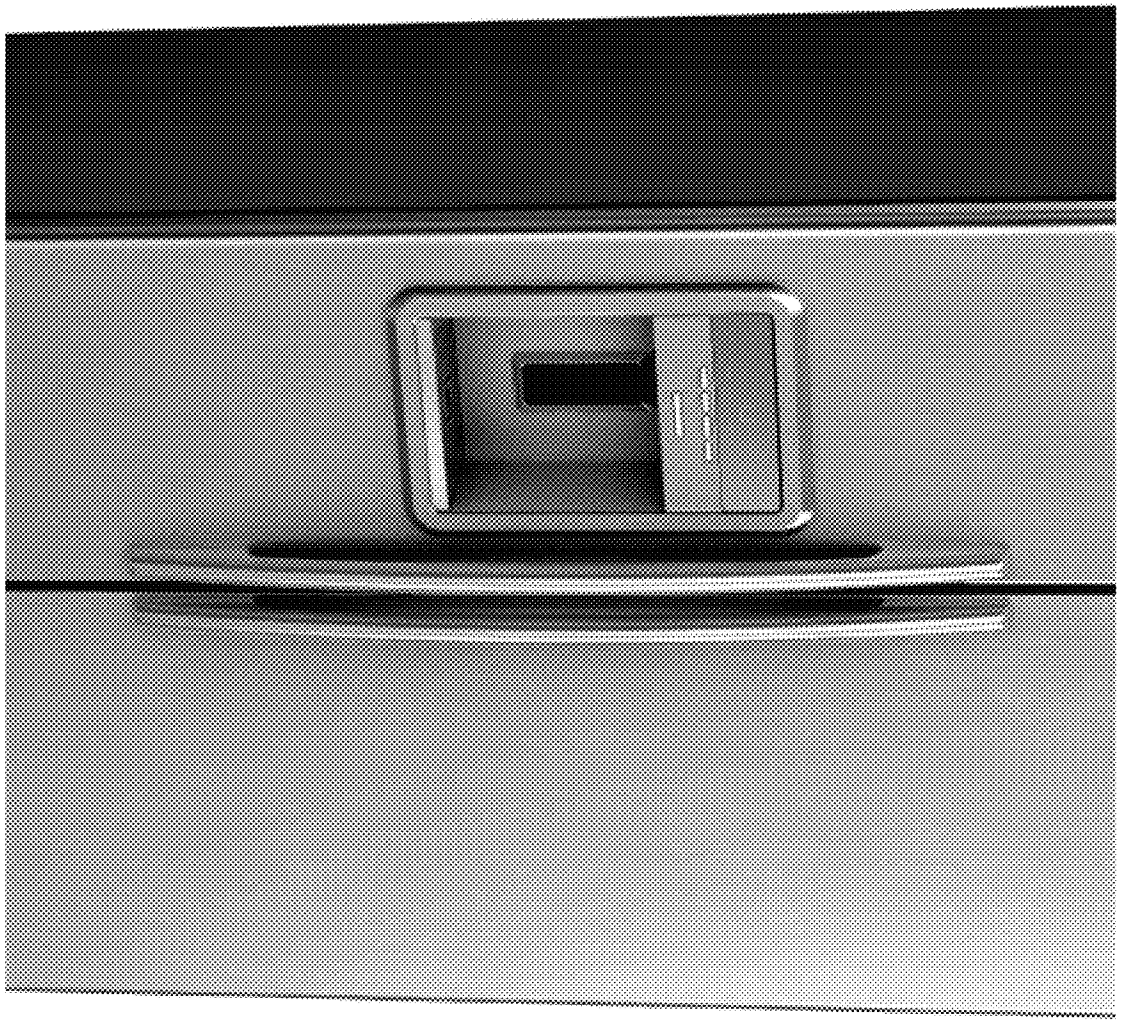

By referring to FIGS. 2A-C (as will be similar to other specific embodiments), photographs that illustrate a specific dynamic control loop lighting scheme are set forth.

If refrigerator door 14R is left ajar, LEDs along one (or both) door handles are triggered by controller 20 knowing a door switch has not been closed. This lighting event 1 flickers or dimly flashes the lights. This is intended to signal anyone within view that the door is ajar (FIG. 2A).

FIG. 2B is intended to indicate that after the door is closed (controller 20 would know from the door switch input) the event 1 dim flicker or flash of the LEDs changes to a solid steady state for a preset short period of time (lighting event 2).

Once the couple of seconds has expired in lighting event 2, so long as door 14R remains closed, controller 20 would turn off the LEDs in the handles (FIG. 2C).

Figure 2D:
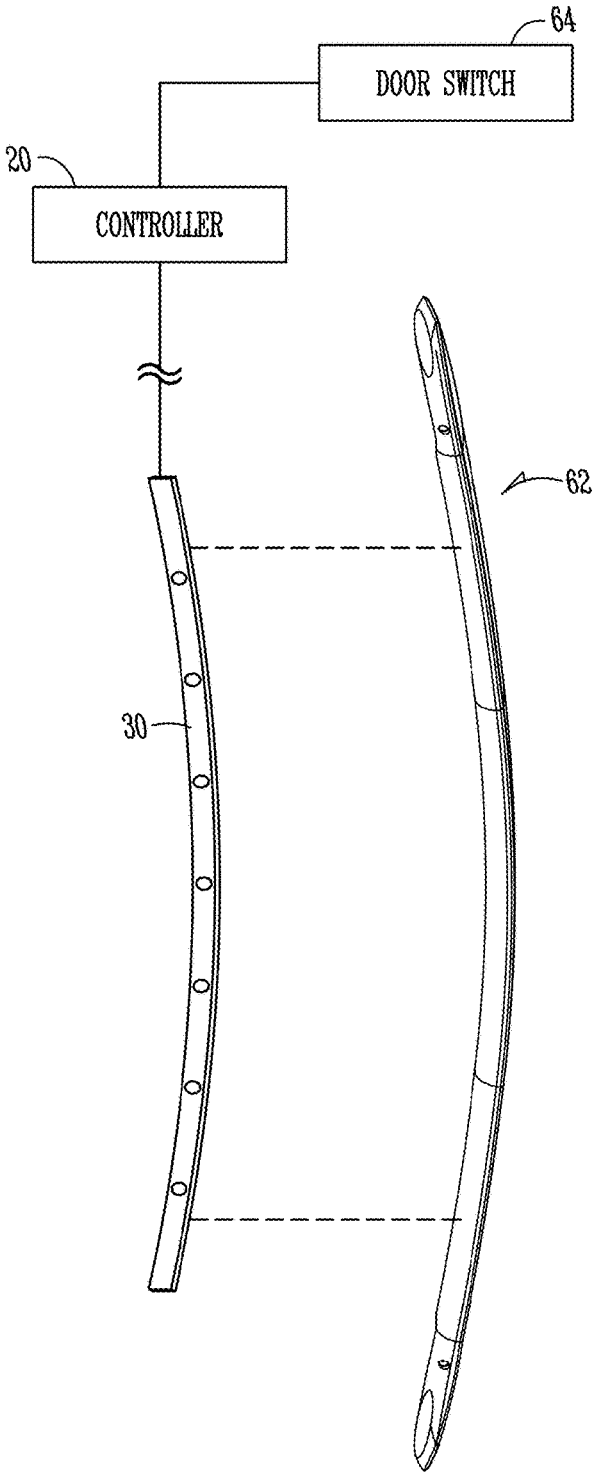
FIG. 2D is an exploded and diagrammatic view of a refrigerator handle and light subassembly connected to the controller and used with the embodiment of FIGS. 2A-C.
Figure 2E:
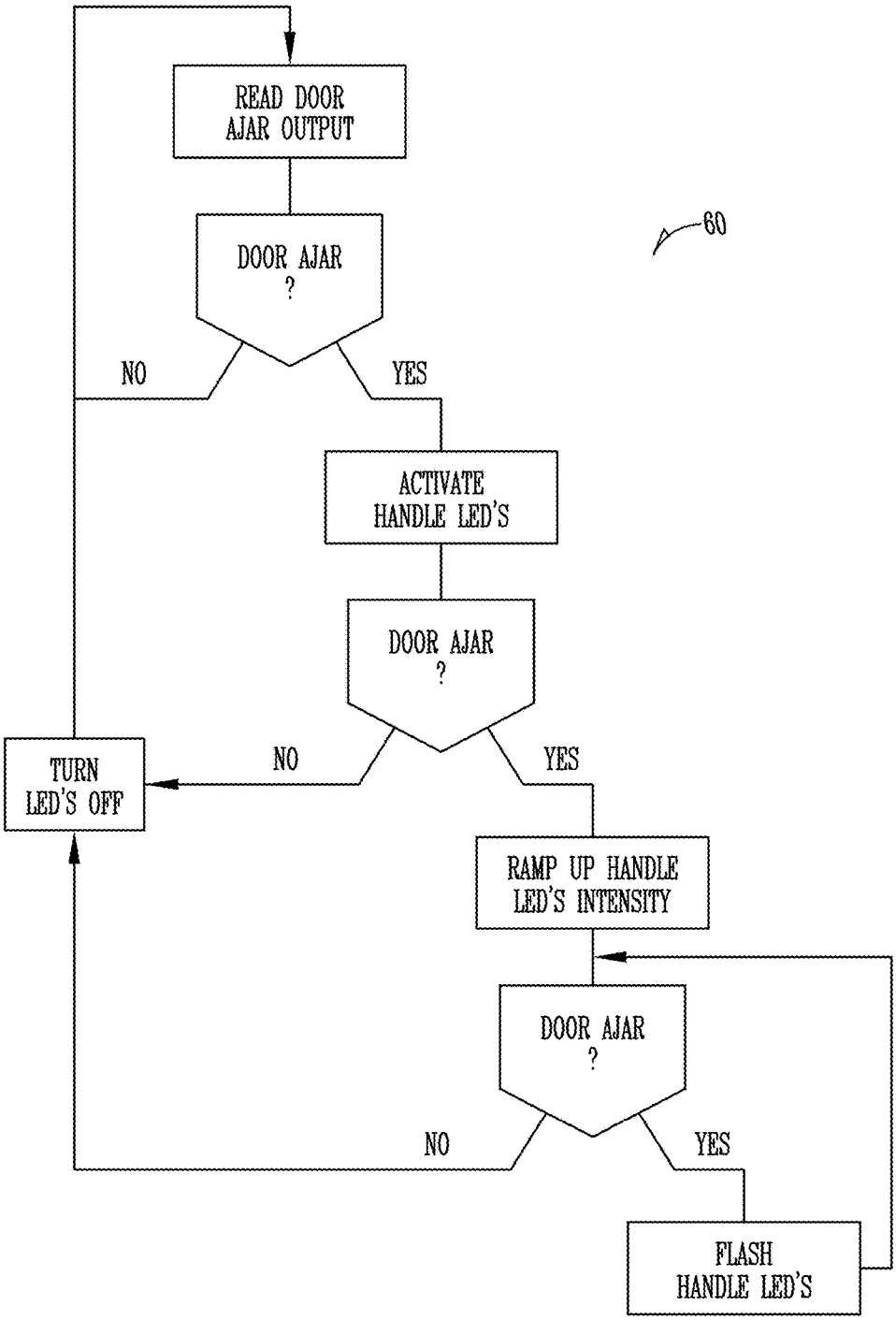
FIG. 2E is a control loop algorithm for operation of the embodiment of FIGS. 2A-D.

FIGS. 2D and 2E illustrate how the foregoing lighting scheme might be implemented. An LED subassembly 30 would be mounted on the inside of handle 62 of refrigerator 10. LED subassembly 30 could be encased in a transparent or translucent material or have a cover of similar characteristics so that they would essentially be a part of the handle grips 62. The drive circuit for the LEDs would be connected to controller 20. Door switch 64 would be monitored by controller 20.

As set forth in control loop 60 of FIG. 2E, controller 20 would read switch 64 and activate the LEDs that flash or flicker for event 1. If the door is still ajar, it could ramp up intensity and/or speed up the flash or change to steady state "on" for event 2. If at any time the door is closed, controller 20 would know it by reading switch 64, the trigger would be removed, and LEDs would be turned off. The control loop 60 would go back to the monitoring state.

This embodiment is dynamic, and has at least one passive step, and performs a notice or alarm function for better operation of appliance 10. It can also simply serve as a visual notice that the door is open at any time. Flashing or flickering can indicate the door is open for a time deemed to be inordinate such that it could cause temperature rise inside the refrigerator and cause undue energy loss or even food spoilage.

Such lighting effects also have aesthetic features. It is an exterior illumination at one point of the appliance.

Embodiment 3

FIGS. 3A-F are photographs of the following dynamic lighting scheme.

Figure 3A:
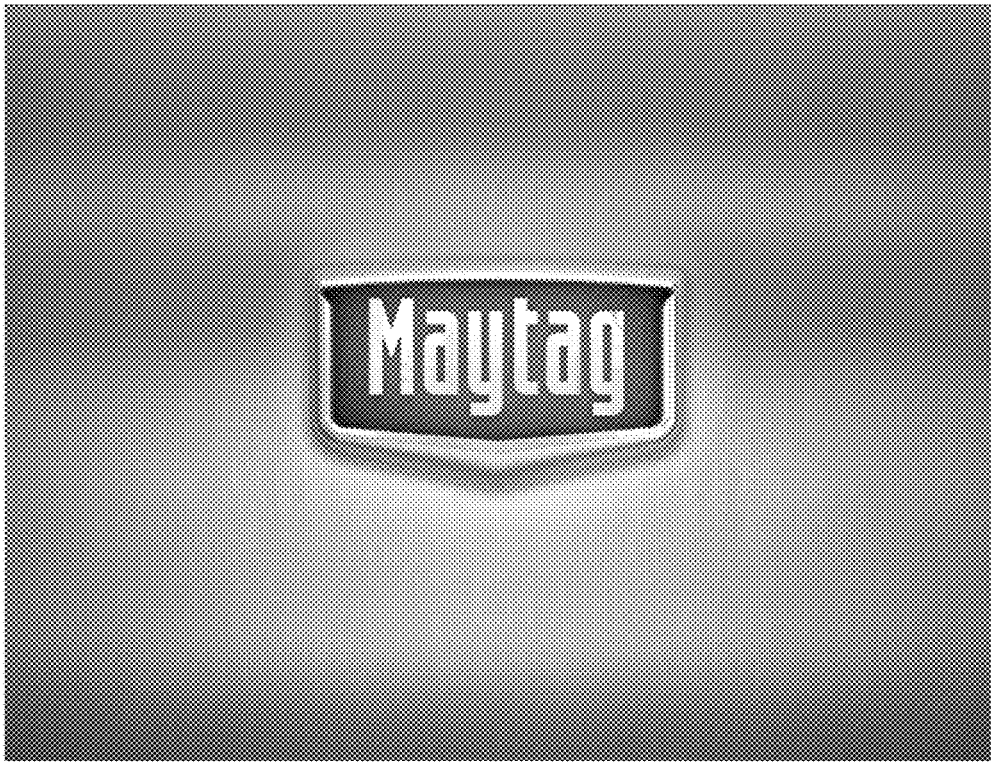
FIGS. 3A-F are photographs of a sequence of dynamic lighting affects according to a second exemplary embodiment of the present invention.
Figure 3B:
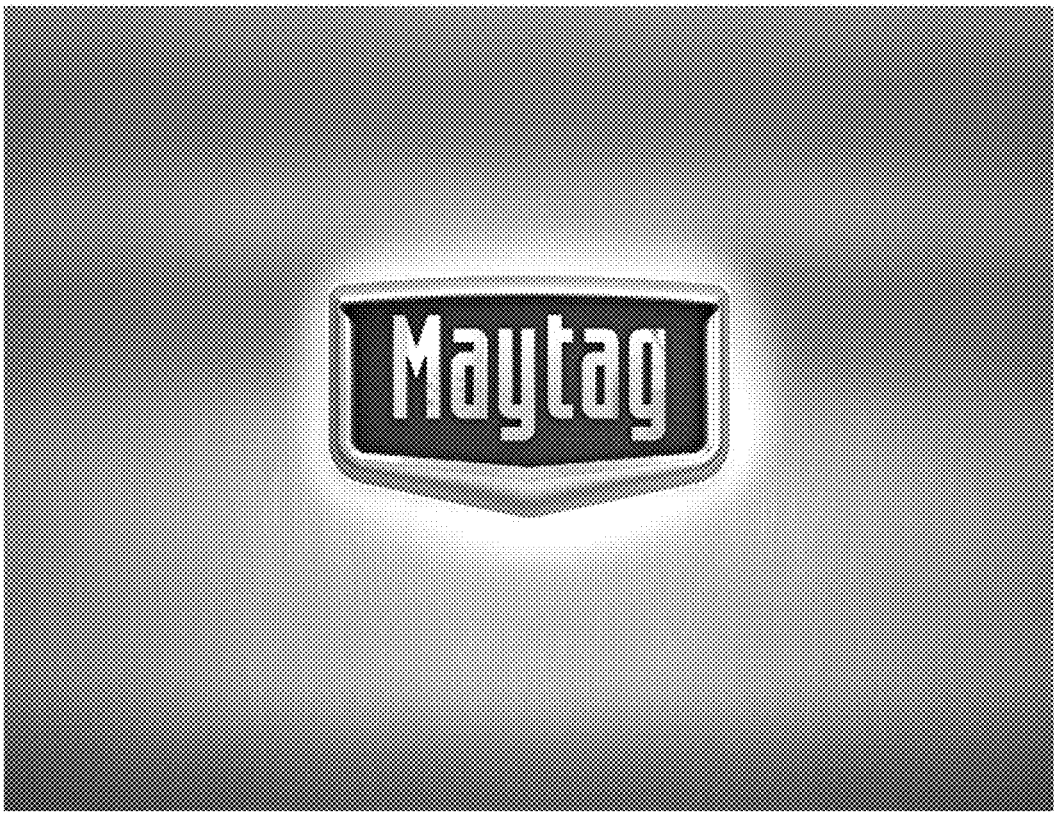
Figure 3C:
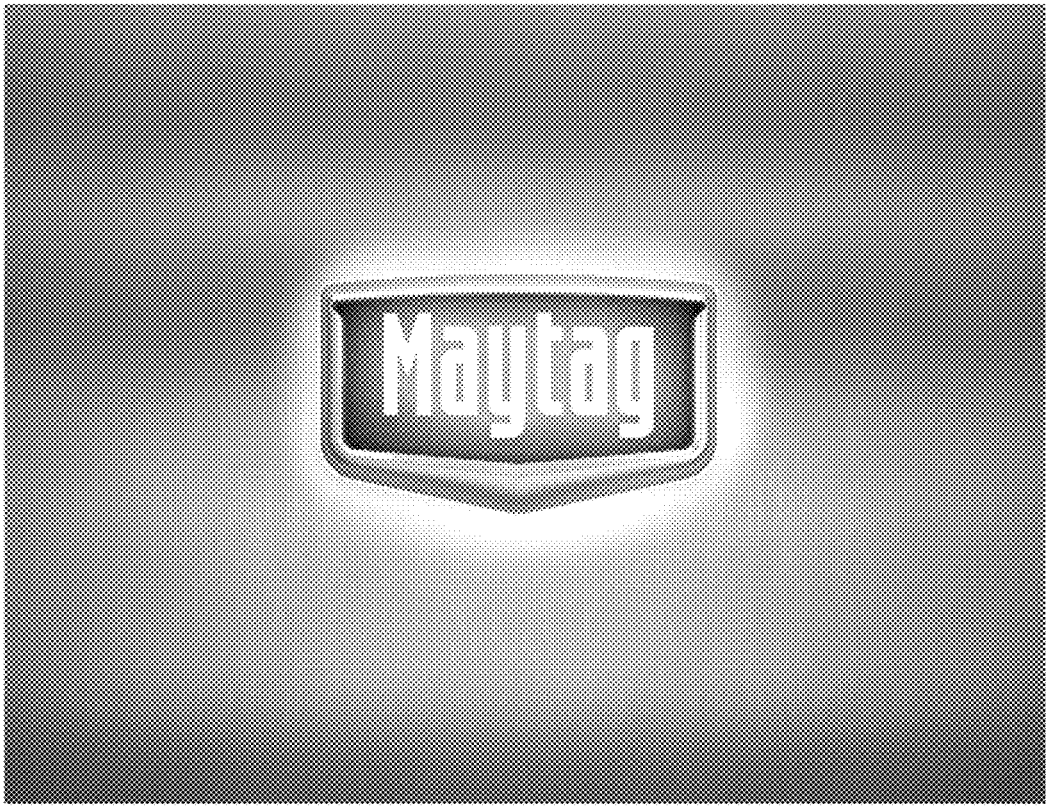

An external badge (e.g., brand name plate) on a door or front surface of appliance 10 is unlit in one state (FIG. 3A). Based on a trigger (e.g., simply a repeating periodic time or, for example, based on a proximity sensor that senses the approach and presence of a person) would instigate a lighting event 1—a low intensity white glow around the perimeter of the LEDs behind the badge (FIG. 3B). After a preset timed interval (e.g., from a fraction of a second to perhaps a couple seconds), LEDs behind the letters of the brand name illuminate those letters (FIG. 3C). Also, the intensity of both the perimeter lighting and letter lighting can increase. Still further, another possible aspect of the lighting event could be a flash of high intensity. After the flash, a perimeter glow in letters could be diminished but still illuminated (another lighting event) (FIG. 3B). This could be after a predetermined short time. And then, either after a further short time period or removal of the proximity trigger, all illumination could be shut off (FIG. 3A).

Figure 3D:
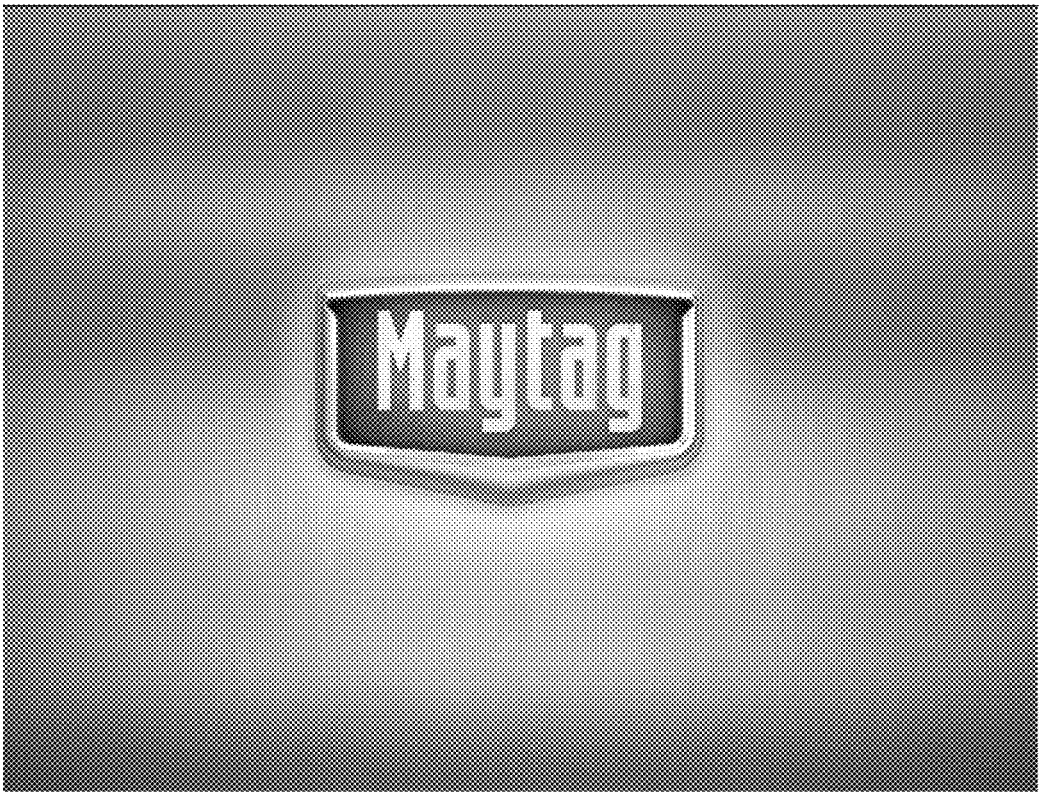
Figure 3E:
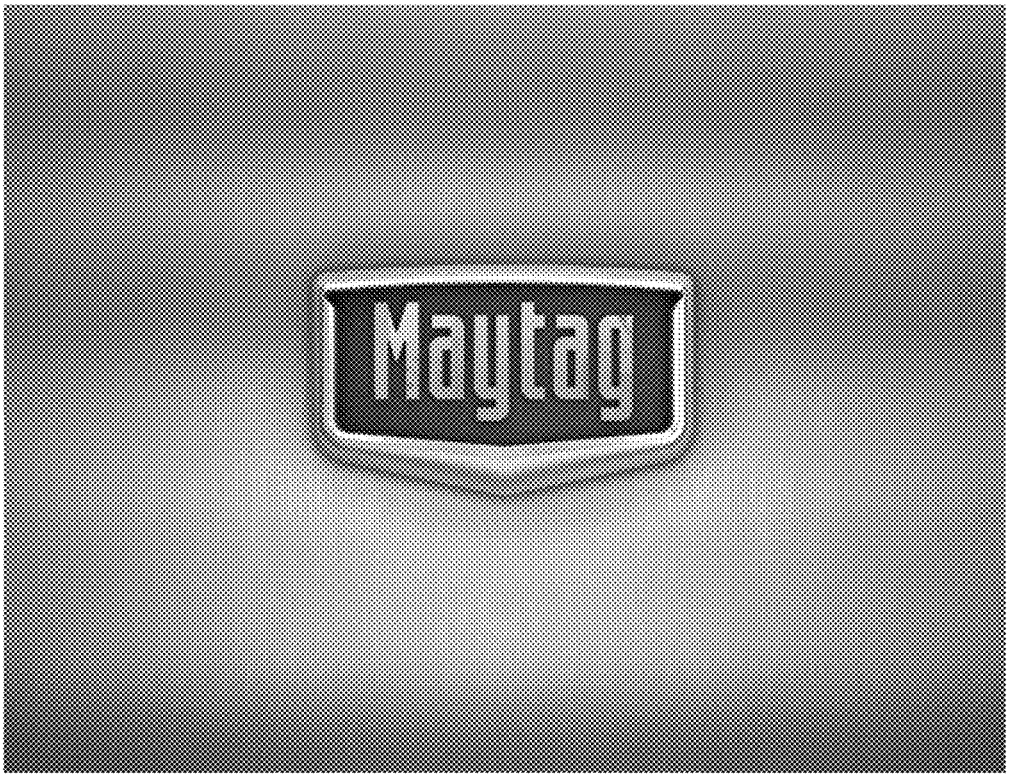
Figure 3F:
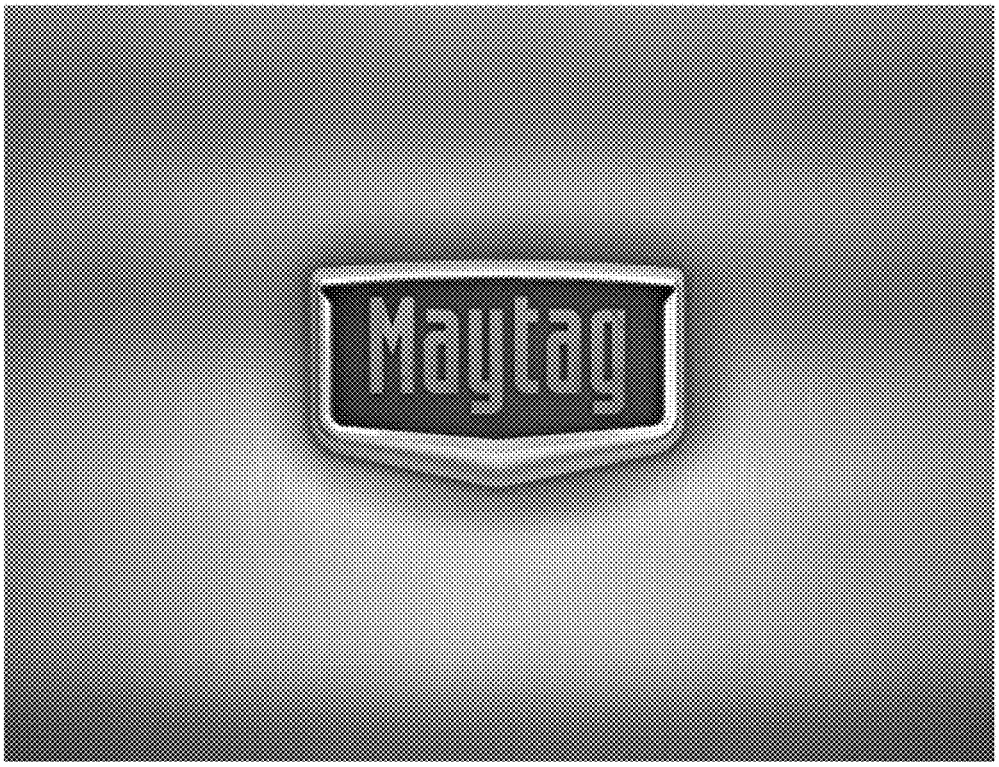

FIGS. 3D-F illustrate that alternatively, or additionally, the color of lighting could be different. This could be based on user selection input from a variety of color choices based on several different colored LEDs individually controllable behind the badge or it could be by preprogramming or default. FIG. 3D shows yellow glow. FIG. 3E shows red glow. FIG. 3F shows red glow plus red letters, both at higher intensity.

Thus, a user could select a preferred color. Additionally, the user could select from a variety of different lighting animations. Similar to a variety of animations known in such things as PowerPoint™ programming, badge lighting could fade in, fade out, flicker, change flicker rates, sparkle, fade in and then flash quickly and fade out, etc.

The sequence of lighting events is dynamic and at least some events are passive.

Figure 3G:
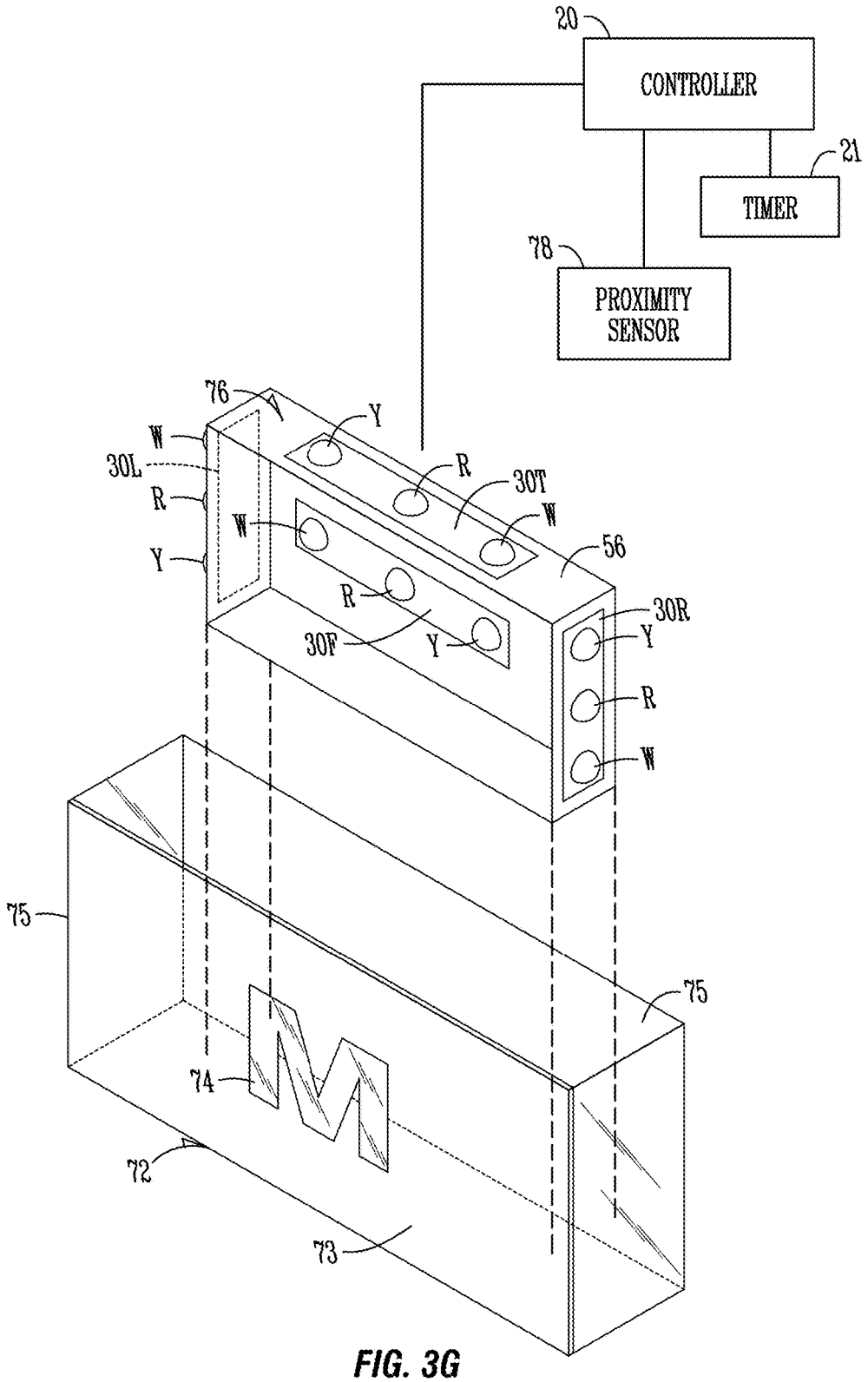
FIG. 3G is an enlarged and exploded view of a refrigerator external badge illuminated subassembly connected to a controller and proximity sensor according to the second exemplary embodiment.

FIG. 3G illustrates diagrammatically (and not to scale) one possible configuration for the apparatus. Badge 72 has a front wall 73 which is opaque except for letter(s) 74 (only one is shown for simplicity) which could be translucent or transparent or in some way light transmissive. Side walls 75 extending backwardly from front plate 73 can be light transmissive. A box 76 encloses one array 30F of LEDs of different colors (W is white, R is red, Y is yellow). Top, left, and right LED arrays 30T, 30L and 30R could be on the exterior side walls of box 76 and also contain different colored LEDs. When assembled into the back of badge 72, LEDs 30F would light up letter(s) 74. The other LEDs would provide the perimeter or glow lighting around the perimeter of badge 72. Controller 20 can be hooked up to each LED on each LED array. Timer 21 and a proximity sensor 78 could be inputs to allow controller 20 to issue the appropriate instructions.

Figure 3H:
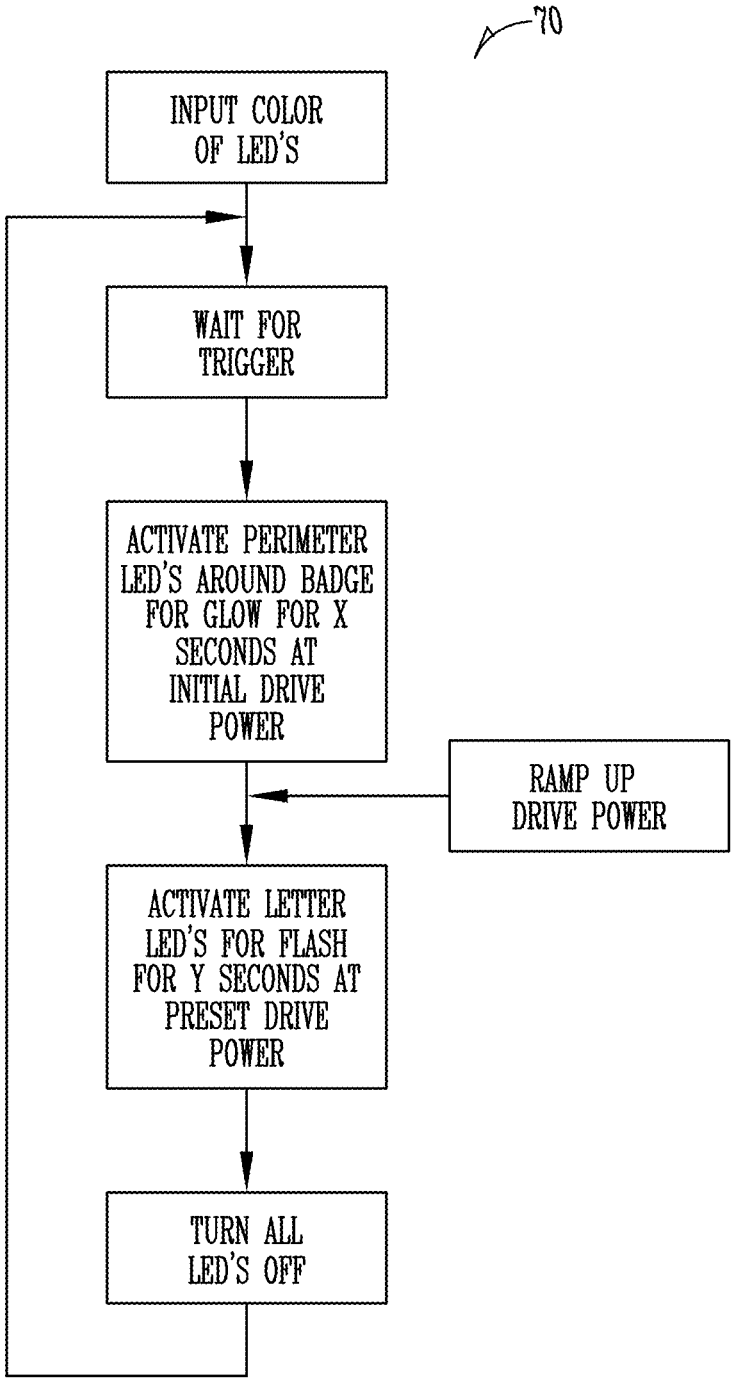
FIG. 3H is a block diagram flow chart of a method according to the illumination scheme of FIGS. 3A-E.

FIG. 3H provides control loop algorithm 70 for this embodiment.

It can therefore be seen that not only can a user have some selection (e.g., color selection) based on preference for aesthetic appeal, it can be changed from time to time. Aesthetically it can enhance the attractiveness of the appliance by essentially presenting a "sparkle", a glow, or lighting effect(s) to the user (or anyone in the room) and highlight the brand name badge. It is dynamic and has at least some passive aspects.

Embodiment 4

Figure 4A:
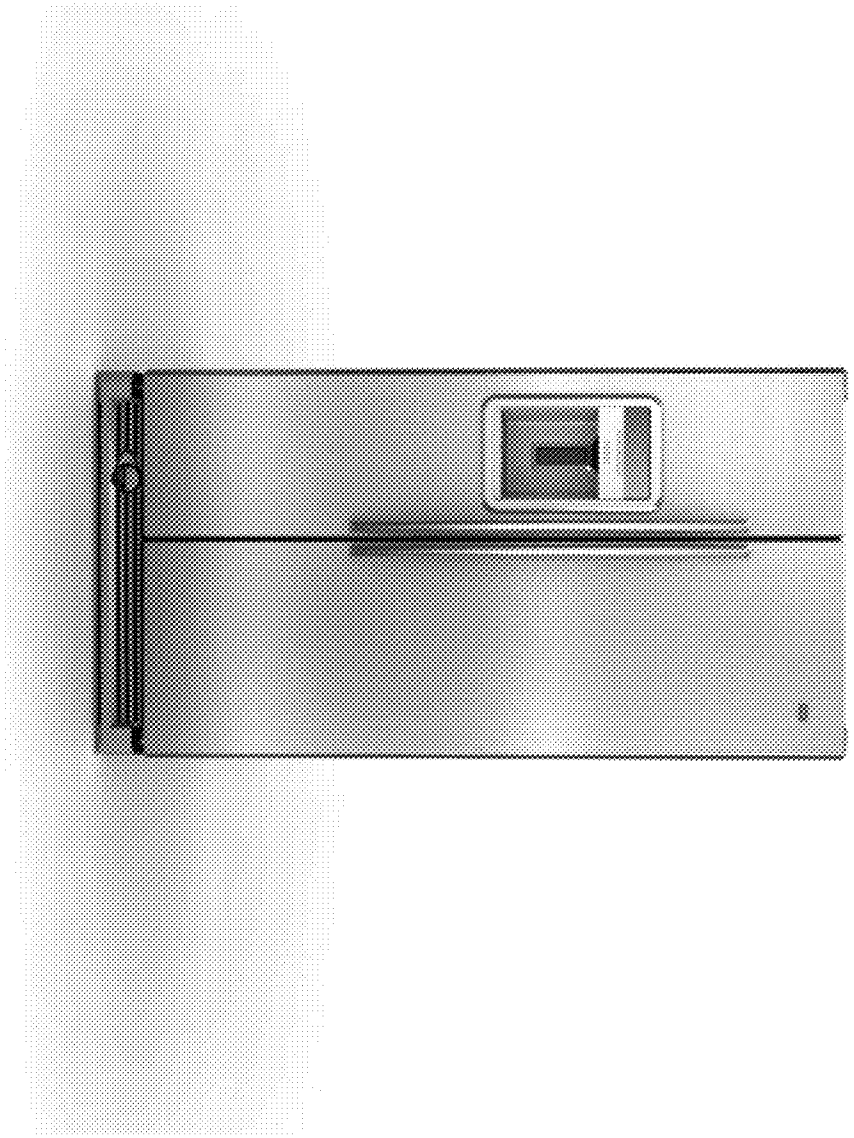
FIGS. 4A-B are photographs related to a third exemplary embodiment of a light scheme for ground effect lighting of a refrigerator.

FIGS. 4A and B illustrate this lighting scheme.

No external lighting along the bottom or ground level in front of appliance 10 exists if a photo detector sensor does not trigger, such as during daylight or ambient light levels in the room above a certain level (FIG. 4A).

Figure 4B:
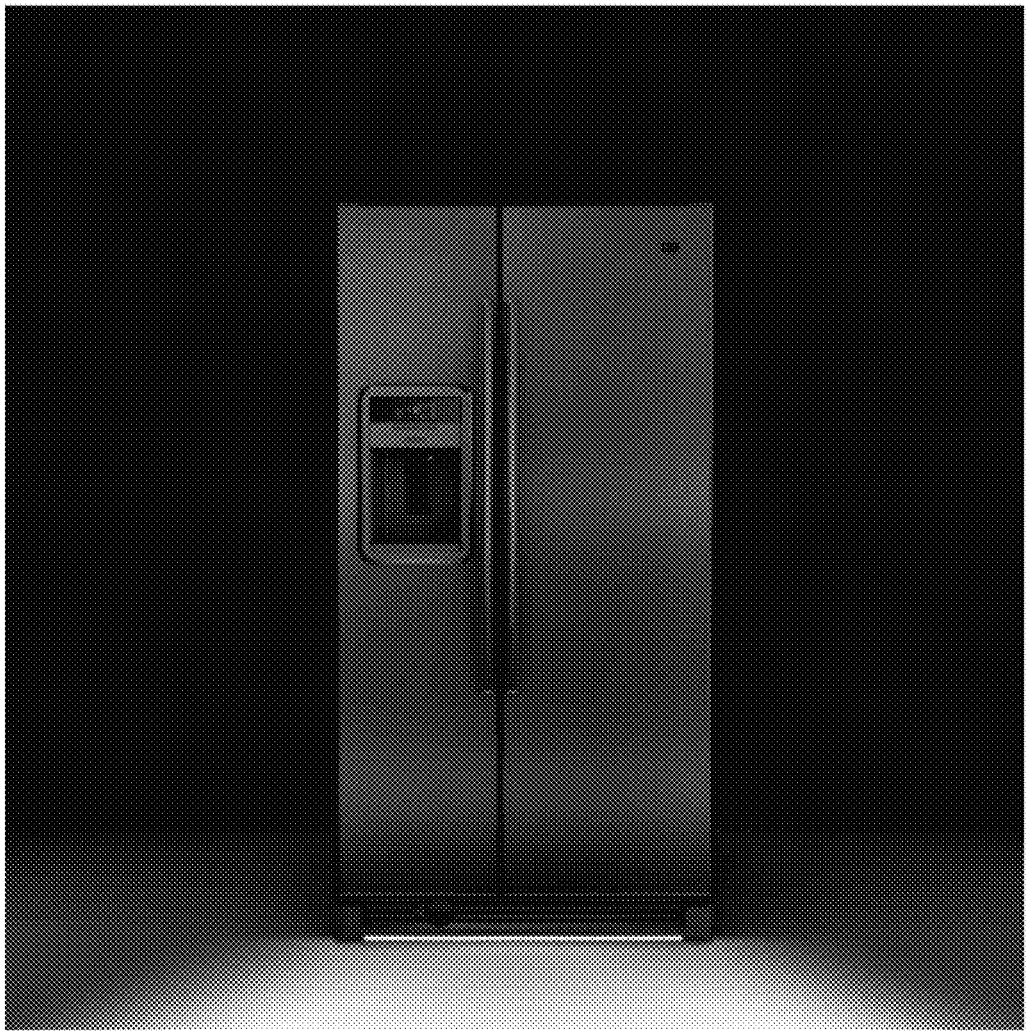

However, when the light level drops below the threshold, the light source or plural light sources automatically turn on to illuminate the ground level around the front of the appliance (FIG. 4B).

Figure 4C:
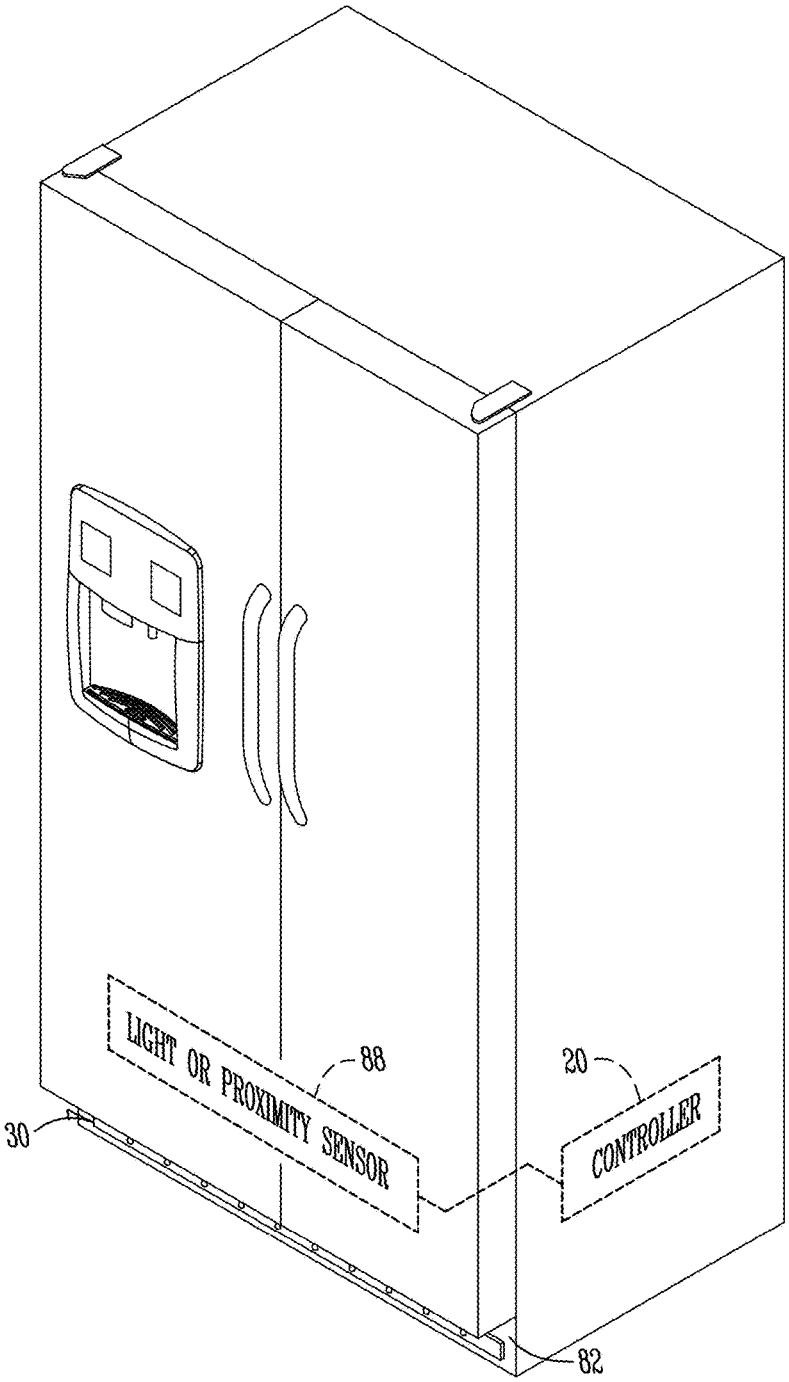
FIG. 4C is a diagrammatic view of a refrigerator and lighting subassembly for ground effect lighting.

FIG. 4C diagrammatically illustrates an LED array 30, a light sensor 88 and their connection to controller 20. LED array 30 is placed in a setback 82 along bottom front of the refrigerator. Light sensor 88 can be any of a variety of commercially available systems.

Figure 4D:
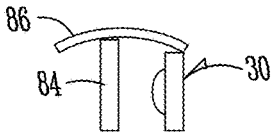
FIG. 4D is an enlarged isolated sectional view of the light subassembly of FIG. 4C.

FIG. 4D illustrates a diagrammatic (not to scale), illustration that some sort of optical lens or diffuser 84 could extend across the LEDs 31 of assembly 30 to diffuse light for evenness and a soft glow in front of the refrigerator. Also, other optics such as reflector 86 could direct light down to the floor.

Figure 4E:
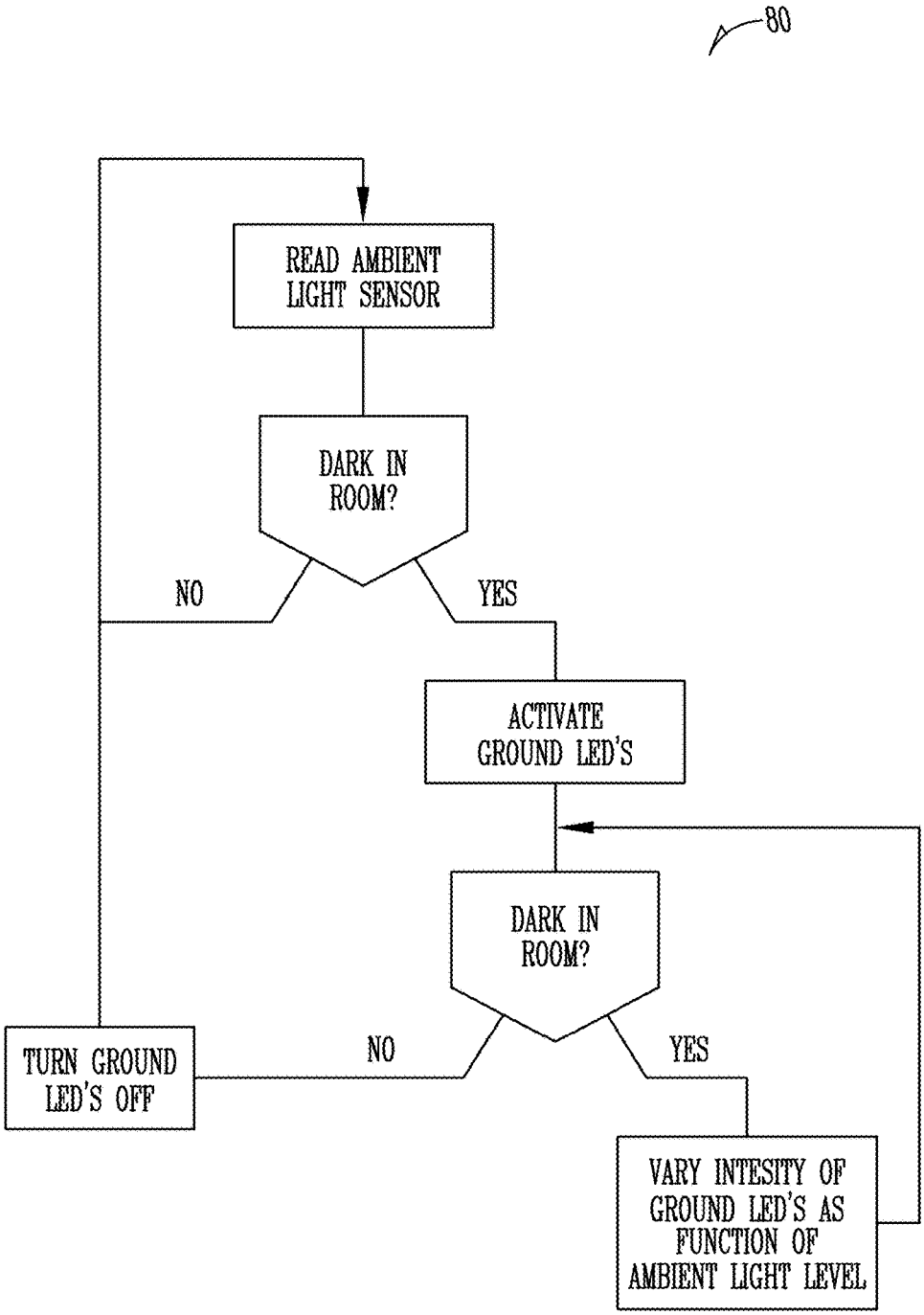
FIG. 4E is a flow chart diagram of a control algorithm relating to the lighting effect of FIGS. 4A-B.

FIG. 4E is an exemplary control loop algorithm 80 for such a lighting scheme. As can be seen, the trigger is signaled from an ambient light sensor. Ground illumination LEDs are activated, ambient light level is continued to be monitored and when the trigger is no longer valid, controller 20 turns the ground lights off.

In this embodiment, the algorithm can simply be on/off of the lights. It also could be a ramp up from an initial lower intensity to a higher intensity based on time. It could also ramp down based on time or some other parameter.

Embodiment 5

Figure 5A:
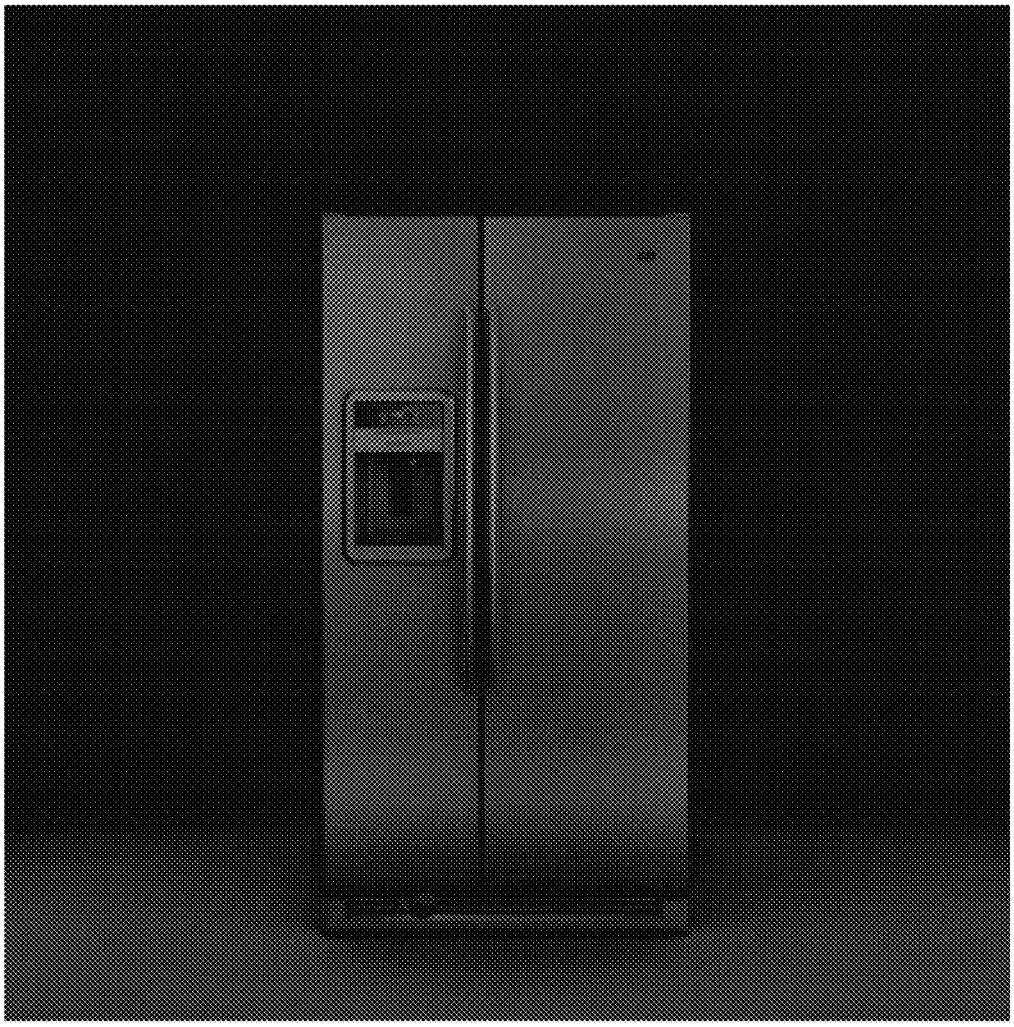
FIGS. 5A-C are photographs of a fifth exemplary embodiment according to the present invention showing photographic depictions of a lighting sequence for ground lighting of a refrigerator.
Figure 5B:
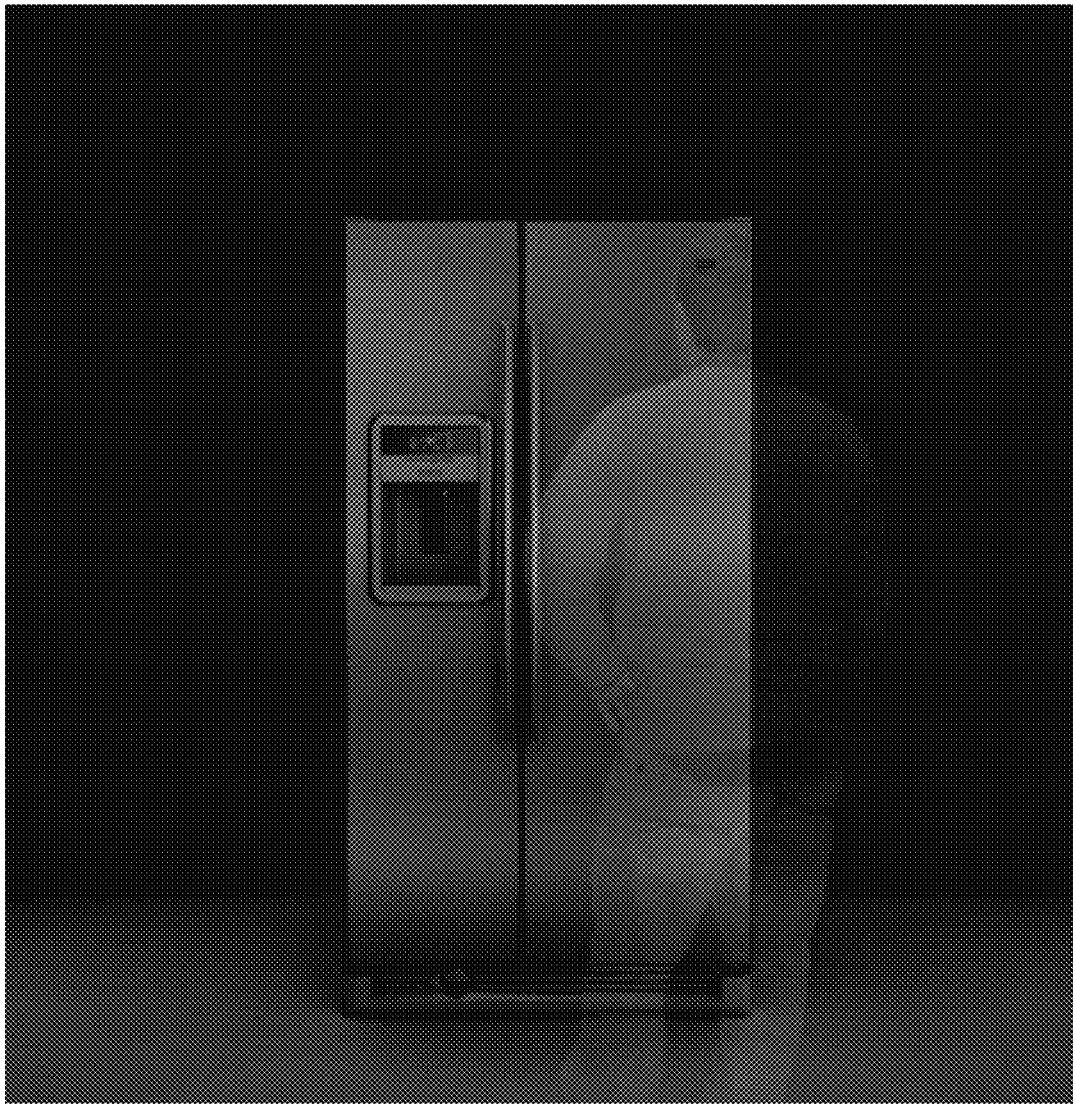
Figure 5C:
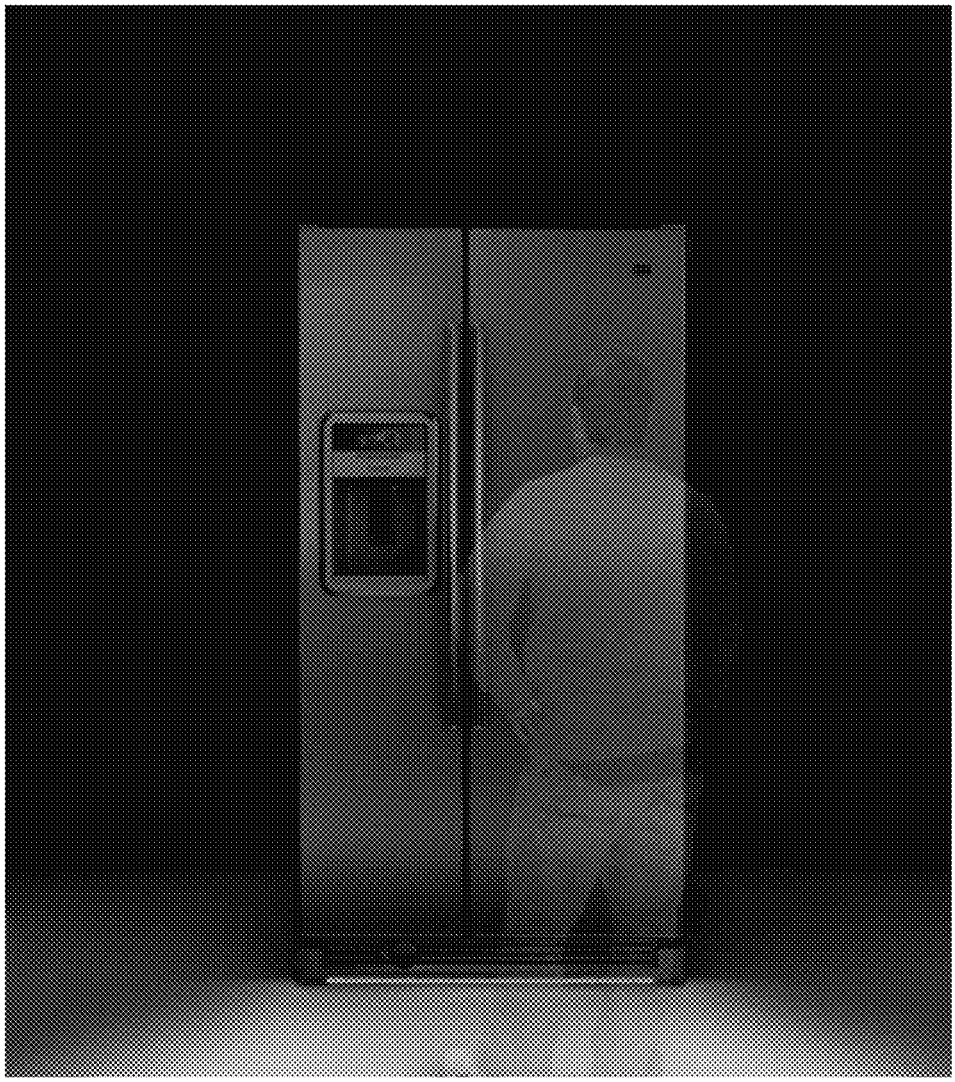

FIGS. 5A-C show another embodiment of a lighting scheme according to the invention. In this case, the trigger is approach of a user. In a normal state (regardless of ambient light) (FIG. 5A), there is no ground illumination. A proximity sensor 88 (FIG. 4C) monitors an area around at least the bottom of the appliance. It is calibrated not to trigger (FIG. 5B) if a person is beyond certain a general distance away. But it is calibrated to trigger (e.g., turn LED lights 30 on) if that person approaches within its range (FIG. 5C). Proximity sensors are commercially available and can be calibrated as to range and detection sensitivity. As can be appreciated by those skilled in the art, certain proximity sensors can be calibrated to give at least a rough estimation of how close to the sensor the object or person is that is being monitored for proximity. The calibration could therefore, as an option, sense when a person is within a first larger range of distance (e.g., 20 feet away) and turn on a lighting effect light ground illumination at a first (e.g., lower) intensity; but then as the person reaches another closer distance (e.g., roughly 10 feet) the ground lighting intensity could be increased. Alternatively, plural proximity sensors could be used so that each one triggers at a different distance. Variations on this are of course possible. Instead of increasing intensity, the first lighting affect could be a subset of all the LEDs turned on, and the second lighting affect could be all LEDs turned on. Also, different colored LEDs could turn on based on different proximities of the person approaching the appliance, etc.

Figure 5D:
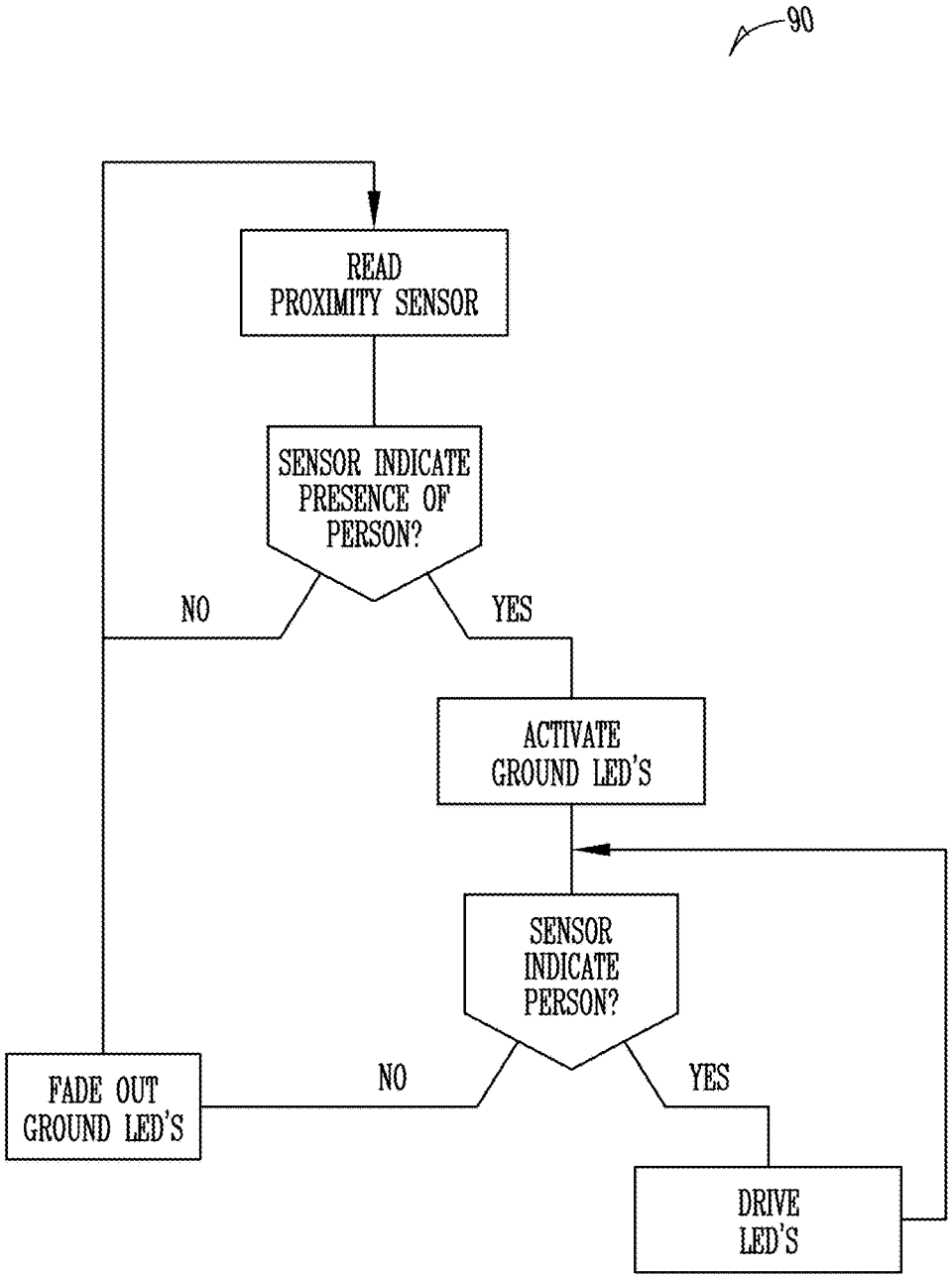
FIG. 5D is a control of algorithm for the light effect of FIGS. 5A-C.

FIG. 5D is an exemplary control loop algorithm 90 for this embodiment. It is dynamic in that the system steps through an algorithm that includes turning lights on automatically and controlling their effects. It is thus also passive. It fades out or otherwise turns the lights off once the person moves out of range.

Embodiment 6

Figure 6A:
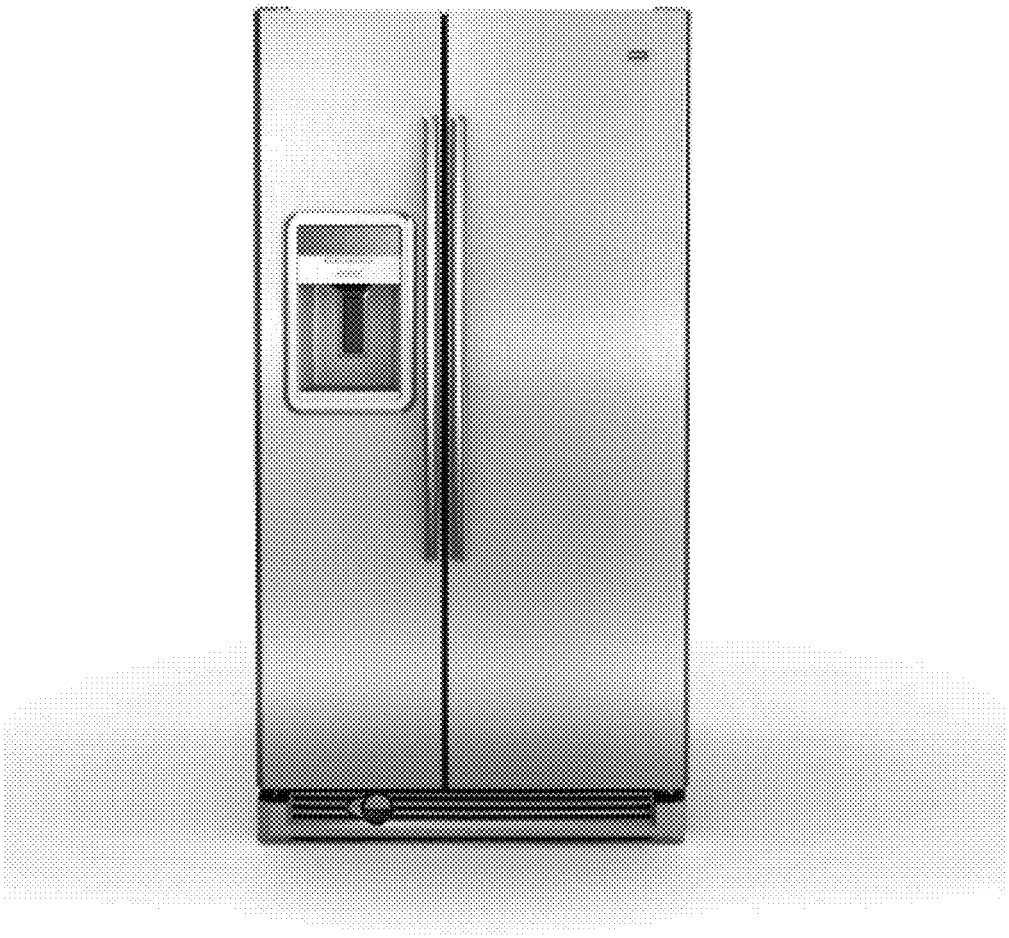
FIGS. 6A-C are photographic depictions of a sequence of lighting effects related to an ice/water dispenser exterior well for a refrigerated appliance according to an exemplary embodiment of the present invention.
Figure 6B:
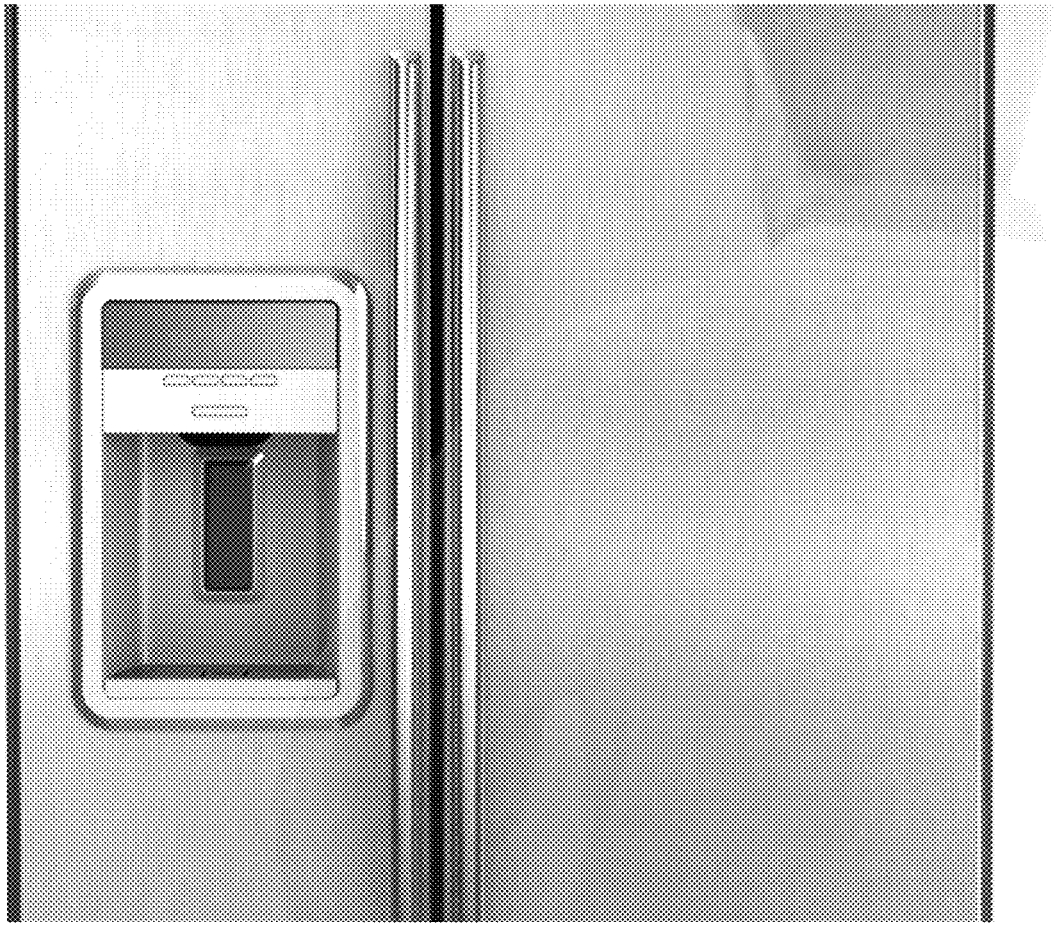
Figure 6C:
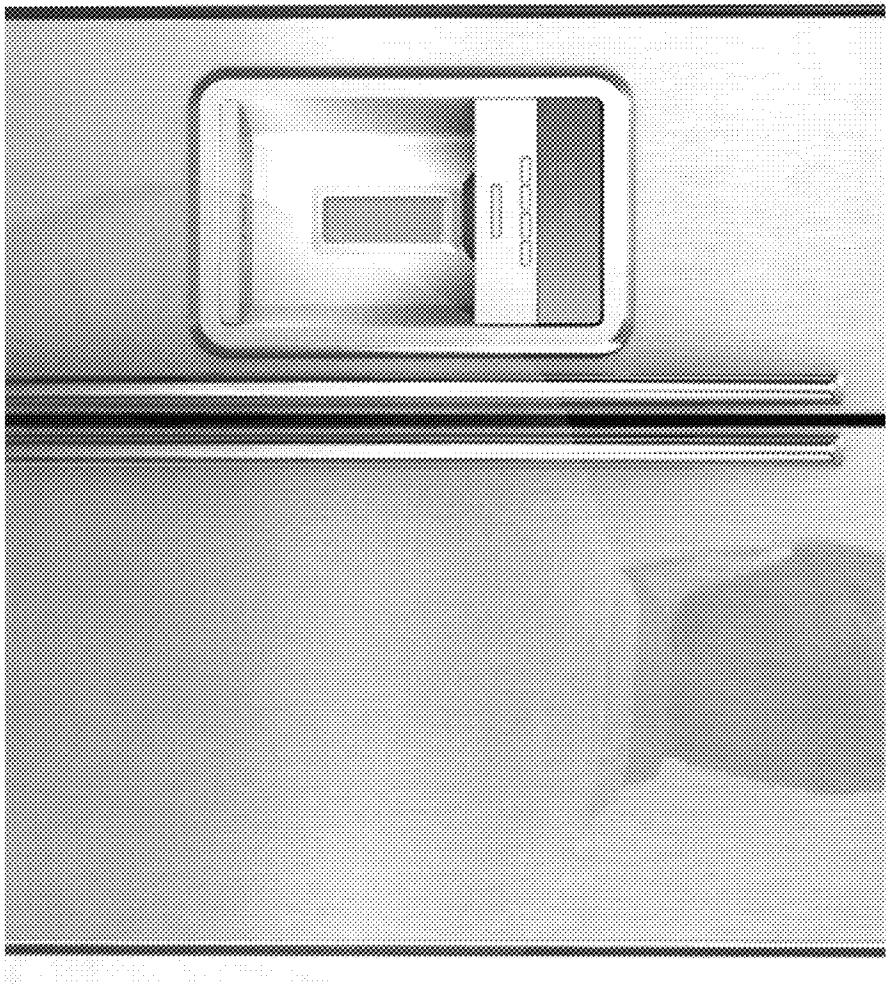

FIGS. 6A-C show instigation of automatic lighting of the well 104 of the exterior ice water dispenser 102 (FIG. 1A) of the appliance 10. In normal state (FIG. 6A) with no person or other triggering body is within range of a proximity sensor (see sensor 108 of FIG. 6D), the dispenser well is not illuminated. This remains true (FIG. 6B) in the presence of a human or other triggering body if not within calibrated range of the proximity sensor.

However, if a human or other triggering body gets within range, the proximity sensor is read by controller 20 and LEDs mounted under the top cross plate of the dispenser well are turned on at a preset or variable intensity and give a soft glow illumination of the well, even in daylight or high ambient light in the room.

Figure 6D:
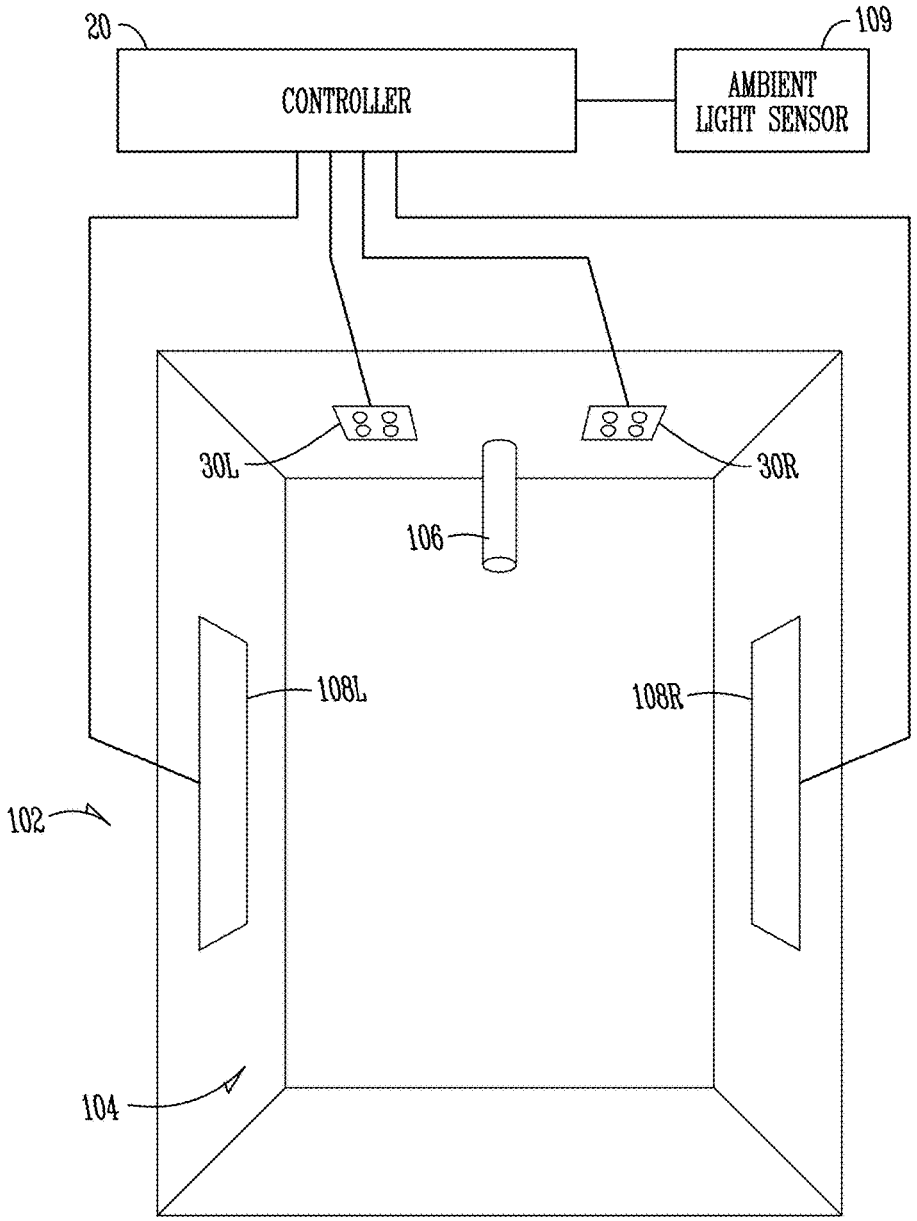
FIG. 6D is a diagrammatic view of the refrigerator dispenser well, plural lighting subassemblies, proximity sensor, ambient light sensor, and controller that can be used with the sequence of FIGS. 6A-C.

FIG. 6D illustrates that one or more sets of LEDs could be mounted inside the well 104 of the in-door dispenser 102. One or more proximity sensors (here two sensors 108L and 108R) could be placed at or around the well or in another location. Proximity sensor(s) would trigger controller 20 to turn one or more LED arrays 30L and 30R on if a person or triggering body comes within range of proximity sensors. This would help a user place a glass relative to, e.g., water spout 106.

Figure 6E:
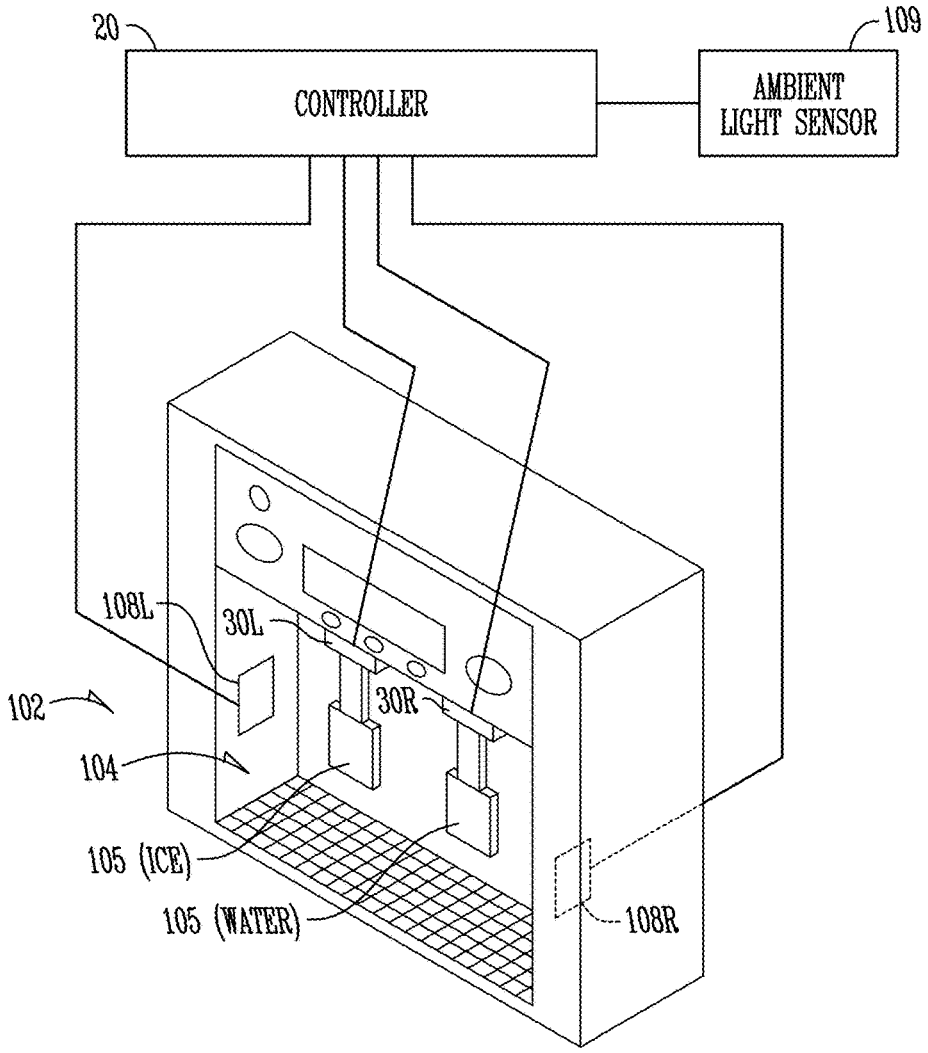
FIG. 6E is an alternative embodiment of an ice/water dispenser well that could be utilized with the lighting effect sequence of FIGS. 6A-C.

FIG. 6E illustrates an alternative embodiment of a well 104. Some models have paddles 105 (e.g., one for ice and one for water). Optionally two LED arrays 30L or 30R could be placed in the well, one above each paddle. When a user manually pushes on one of the paddles, controller 20 could read that activation and illuminate the LED array 30L or 30R above it (or both LED arrays). Upon release of the paddle to its normal state, the controller 20 could turn the lights off. An ambient light sensor 109 could also be monitored by controller 20 and dim any LEDs if night time or dark in the room.

Figure 6F:
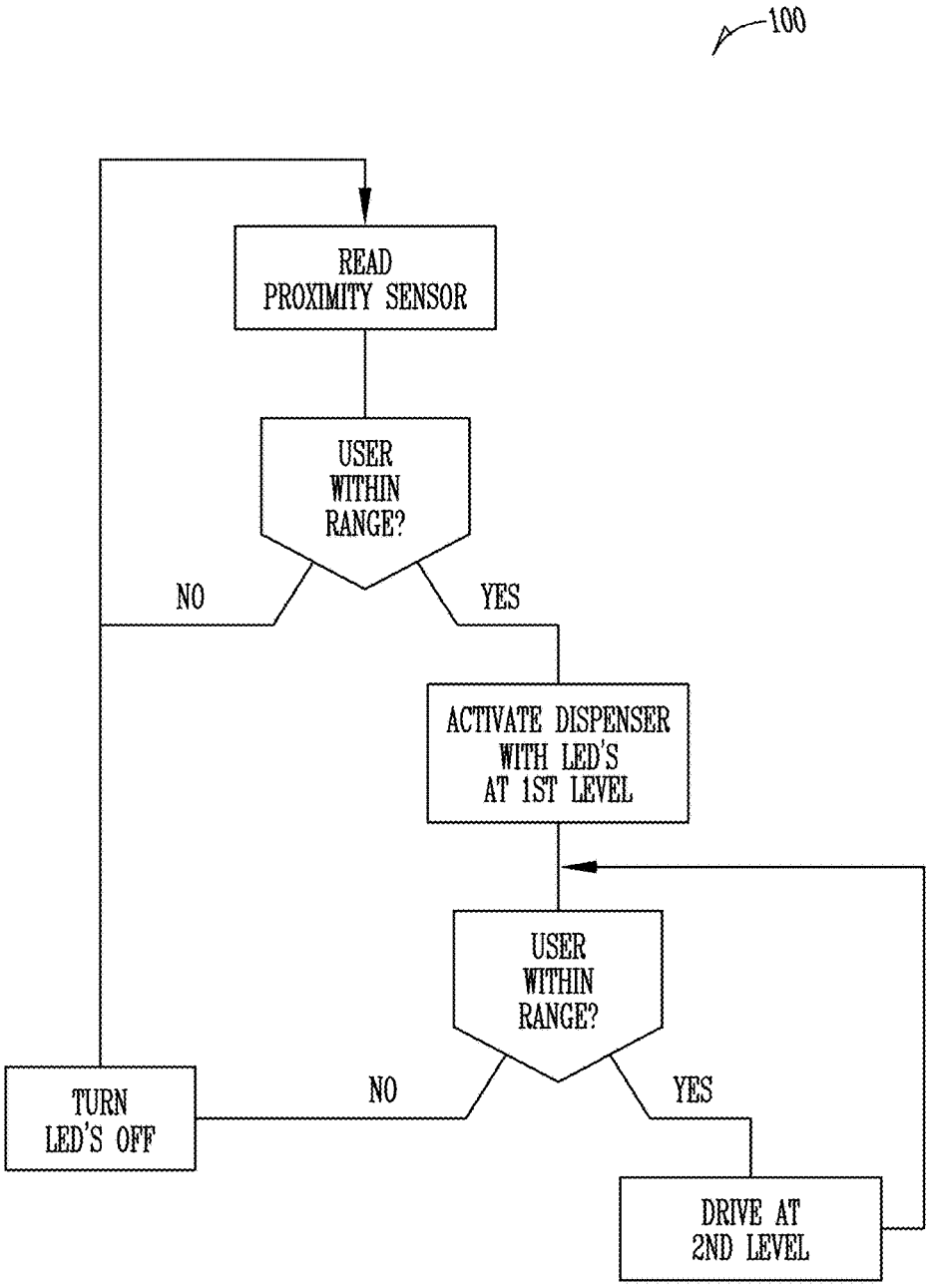
FIG. 6F is a block diagram flow chart of a controlled algorithm for the sequence of FIGS. 6A-C.

It is to be understood that FIG. 6F shows one exemplary control loop 100 for use with this embodiment. Not only could a trigger turn on low level intensity LEDs, it could then automatically vary intensity, flash them, vary the intensity, or have some other animation or effect.

Embodiment 7

Figure 7A:
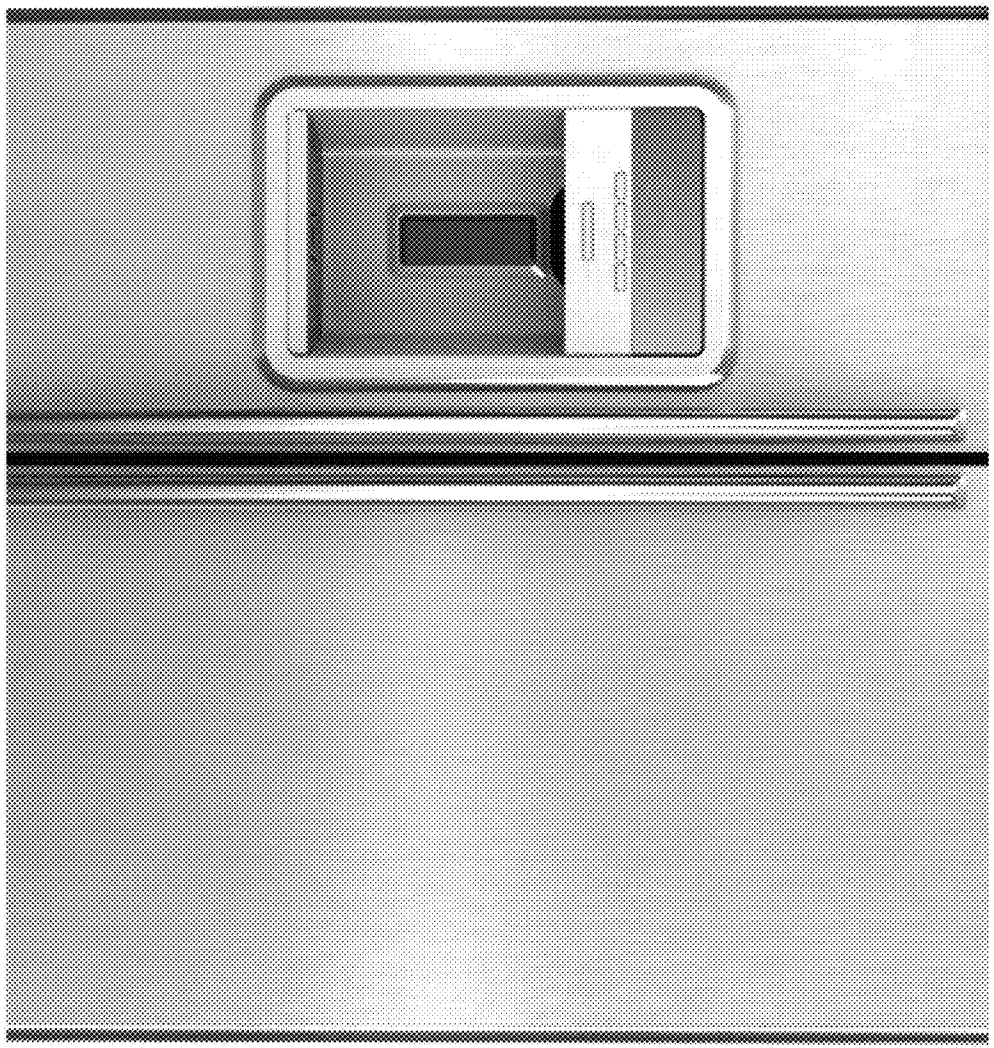
FIGS. 7A-B are still further exemplary embodiment lighting effect sequence (shown in photos) of a dispenser well.
Figure 7B:
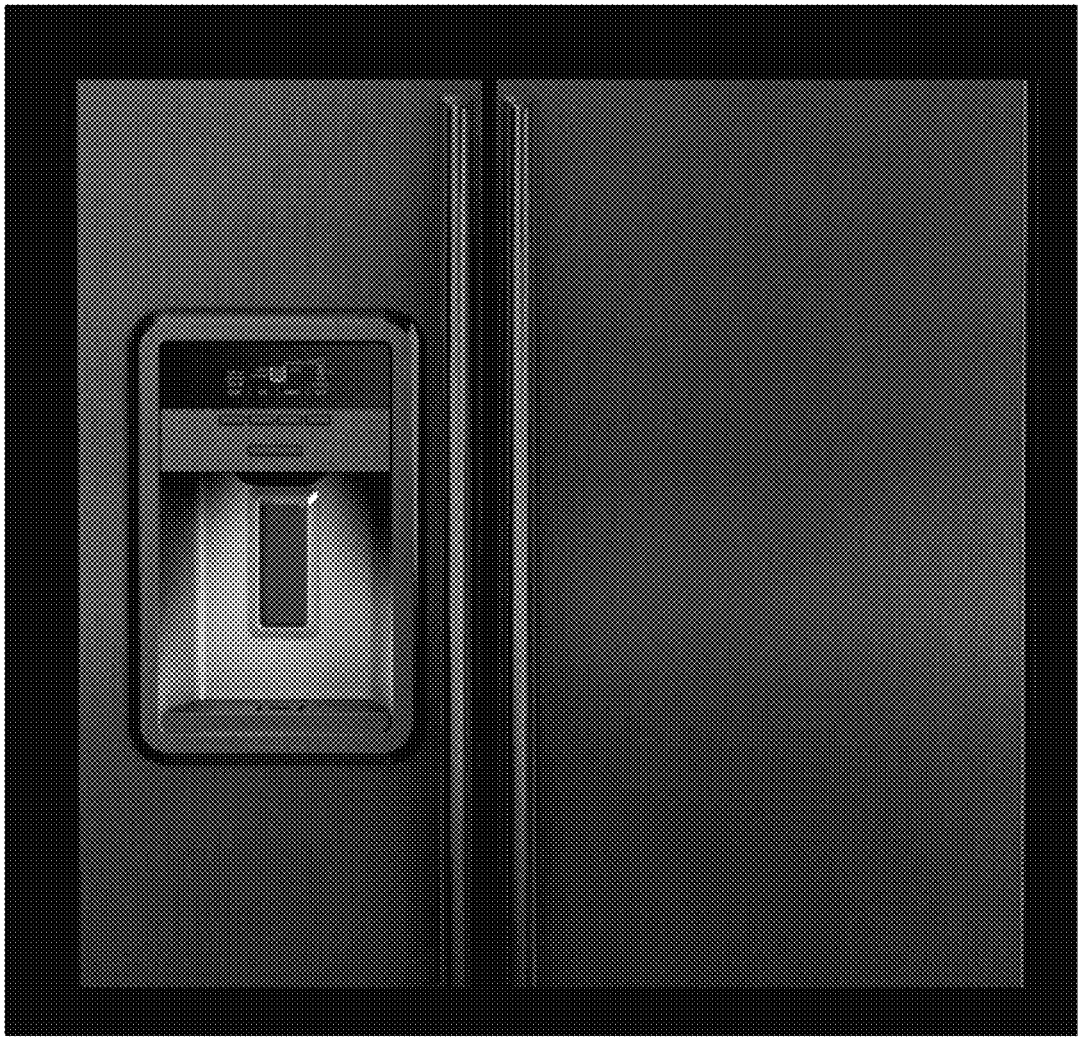
Figure 7C:
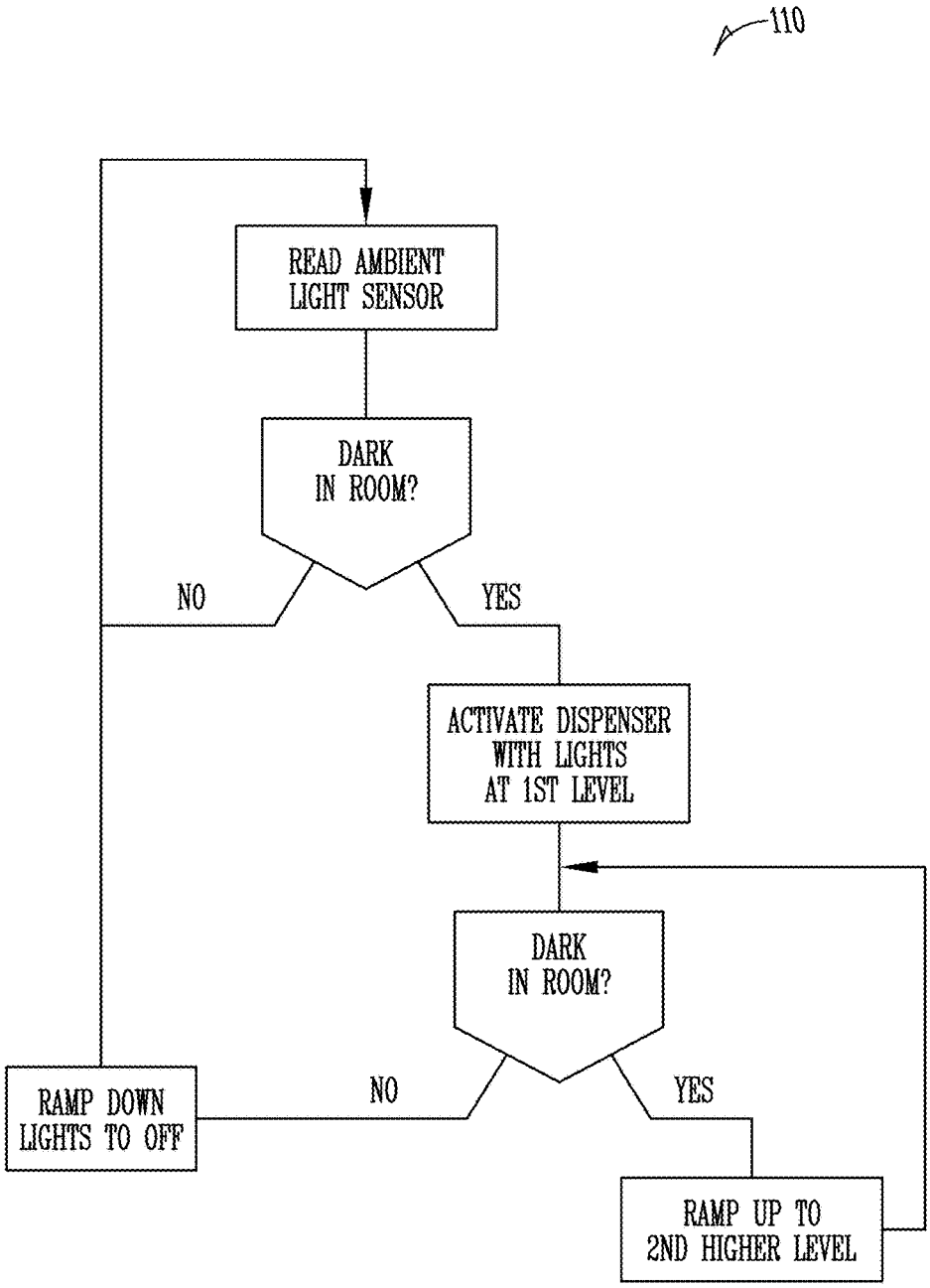
FIG. 7C is a control loop algorithm for the lighting effect of FIGS. 7A-B.

FIGS. 7A-C show that a control loop 110 (FIG. 7C) could shut the well lights off when ambient light sensor 109 (FIG. 6E) removes the trigger (FIG. 7A) (e.g., ambient light at the appliance is above a preset threshold). As with other embodiments, controller 20 could optionally add additional lighting events. For example an initial "on" intensity at nightfall could be ramped up once, twice, or more so long as a timer allows or according to some other criteria. Or it could jump in intensity if a proximity sensor indicated presence of a person or triggering body.

Similar to embodiment 6, a well light could be turned on (FIG. 7B) at a predetermined intensity (here relatively low glow) upon an ambient light sensor triggering controller 20 that light level has dropped below a threshold (such as nighttime and when no or little artificial lighting is on in the room around the appliance).

Control loop 110 could keep monitoring the light sensor and ramp down or otherwise control the lights when ambient light rises above the threshold.

Embodiment 8

Figure 8A:
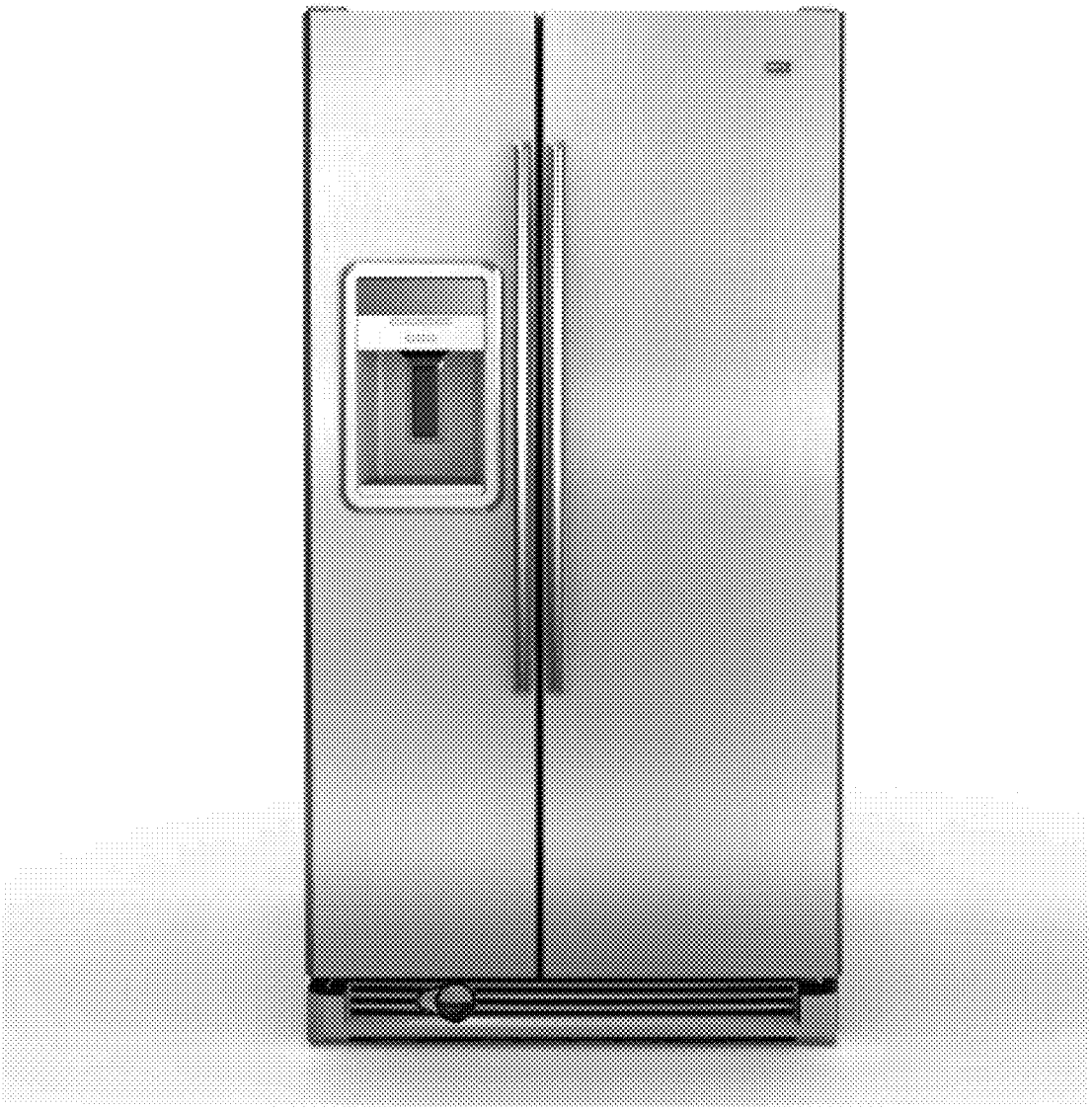
FIGS. 8A-B are photographs of a still further exemplary embodiment of a dispenser well lighting effect according to another exemplary embodiment of the present invention.
Figure 8B:
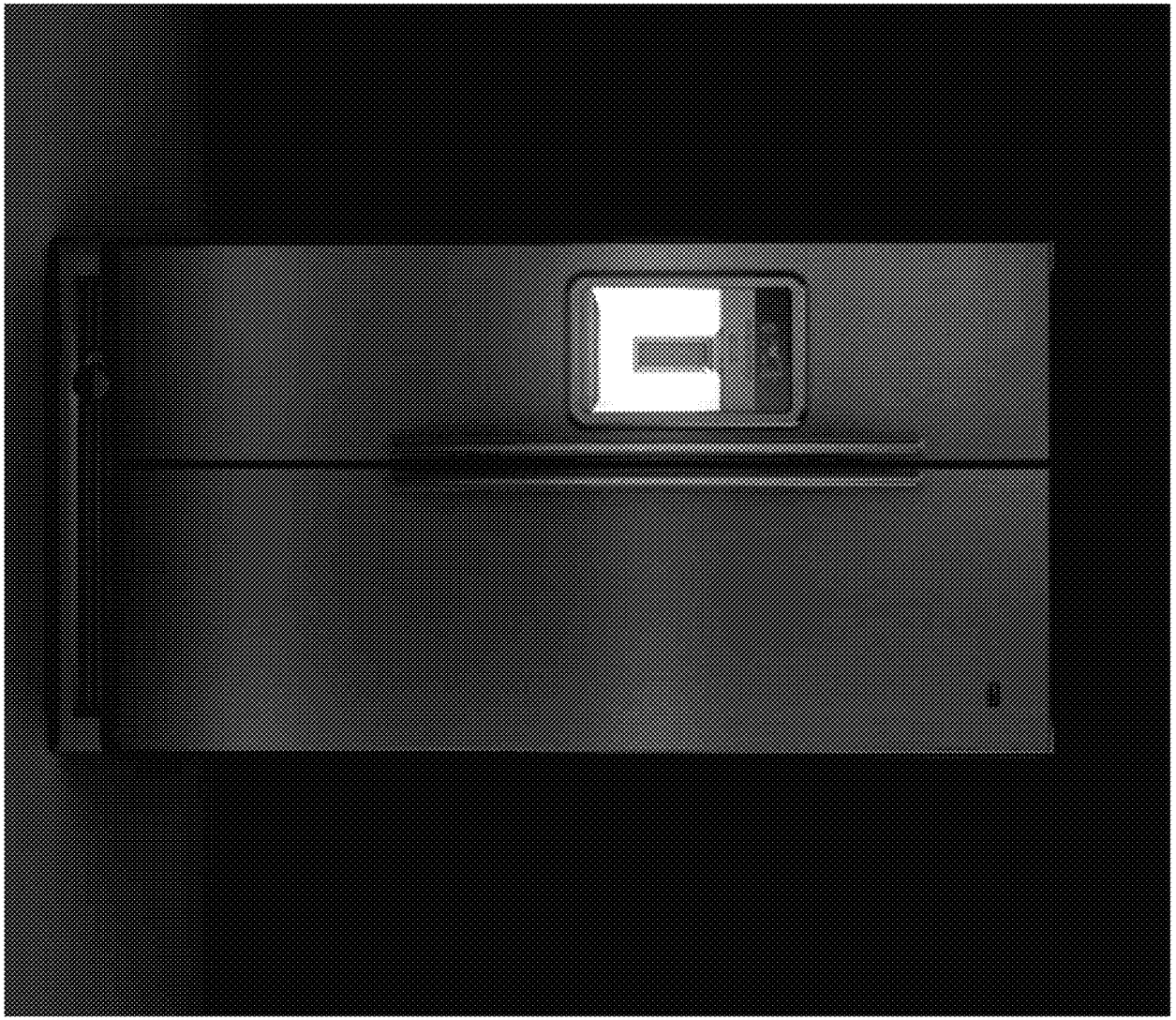

FIGS. 8A-B show a slightly different alternative regarding well lighting. A photo detector or ambient light detector could monitor ambient light and keep the dispenser well lights off (FIG. 8A) until it drops below a threshold (such as nighttime and when no artificial lighting above a level exists in the room). Upon triggering by the ambient light sensor, well lighting could slowly and stepwise ramp up over a number of steps until high brightness or much higher intensity than prior embodiments. This also could be selectable by a user. The user could select between two or more different final light intensities for the well light according to need or desire. It also could be combined with the proximity sensor to brighten only when a user's body or other triggering body is within range of the proximity sensor, and then when that is removed, return to a lower intensity until photo sensor senses withdrawal of the low light trigger.

Figure 8C:
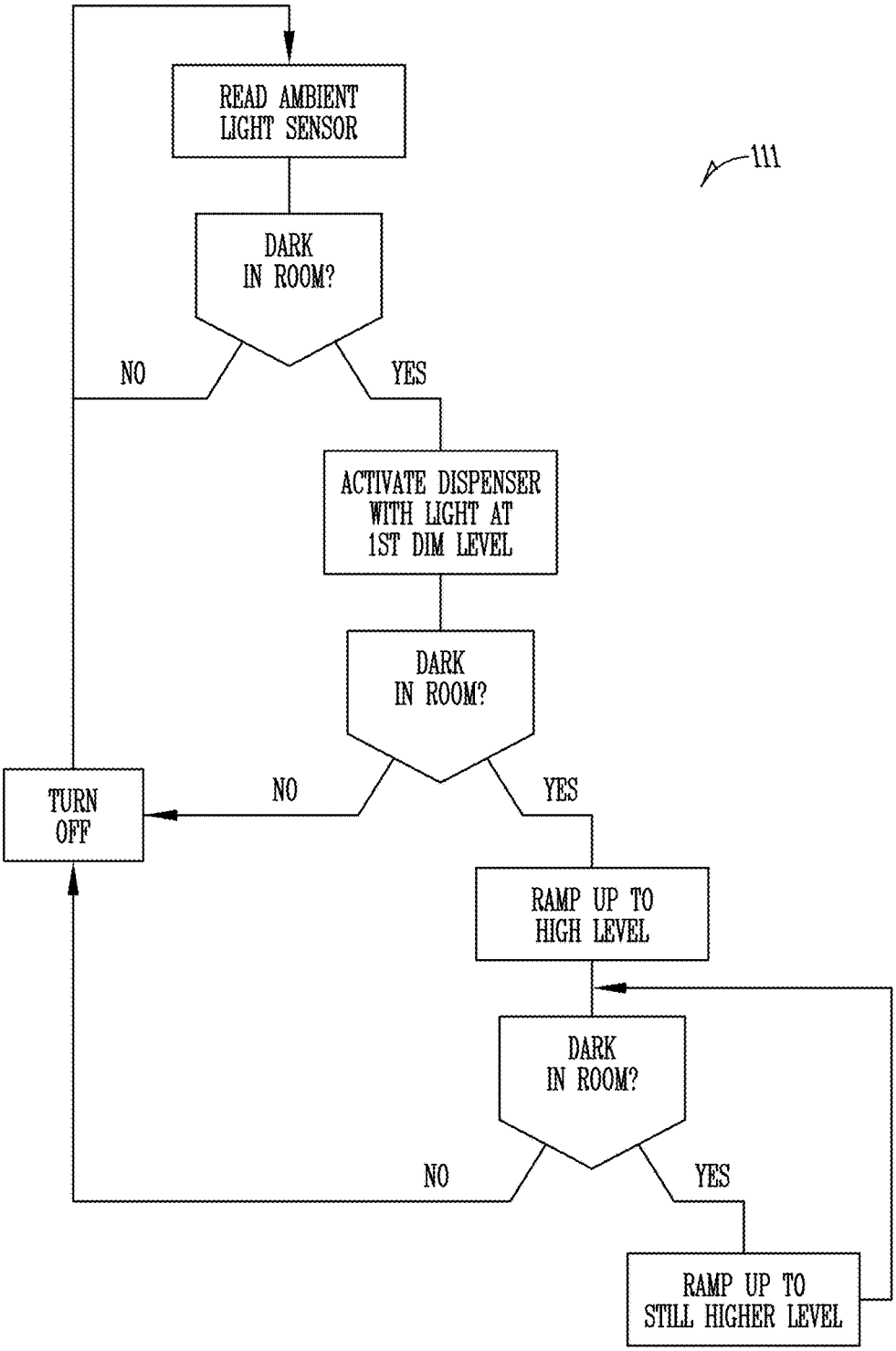
FIG. 8C is a control loop algorithm for the effect of FIGS. 8A-B.

FIG. 8C illustrates one possible control loop algorithm 111 for such lighting.

Embodiment 9

Figure 9A:
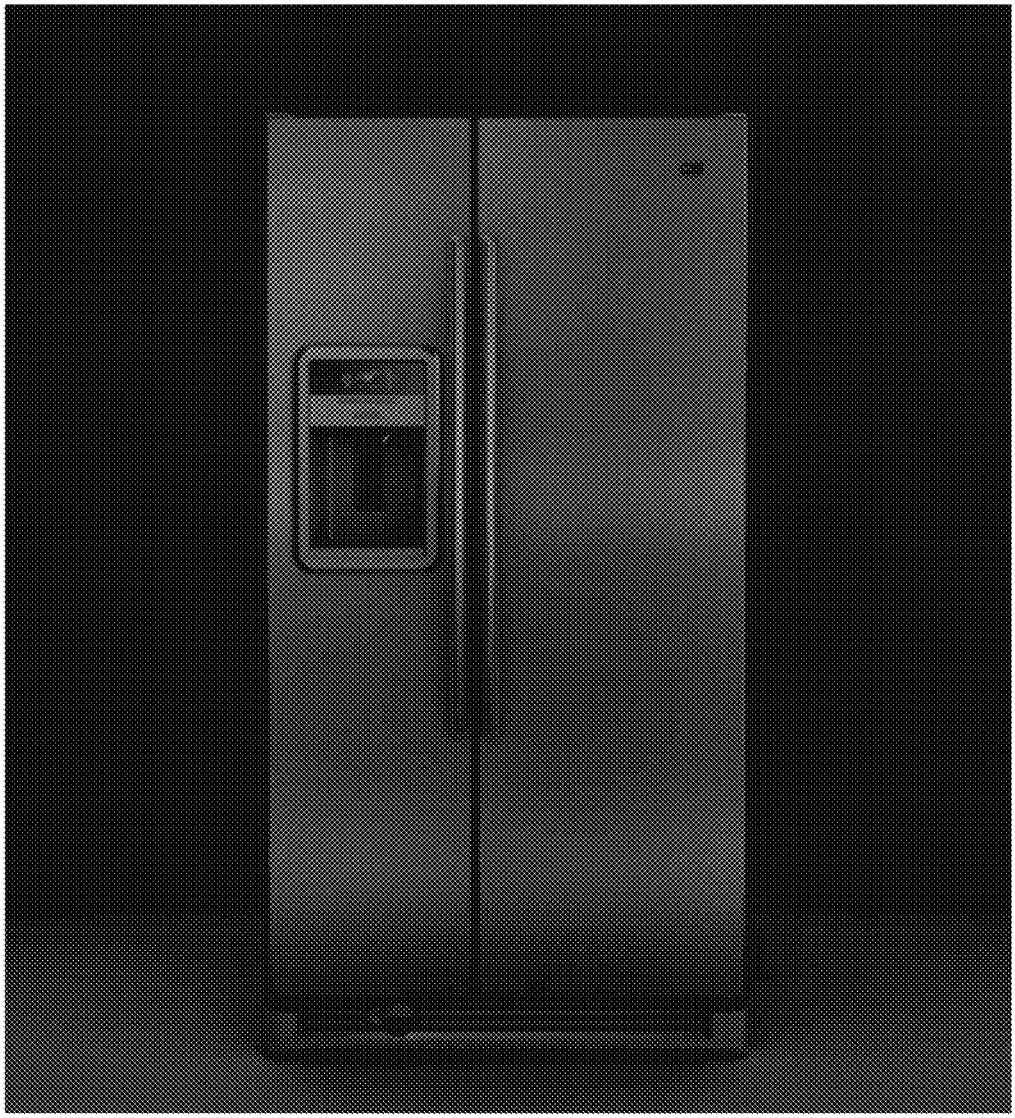
FIGS. 9A-B are photographs of still a further exemplary embodiment of a dispenser well lighting effect according to another exemplary embodiment of the present invention.
Figure 9B:
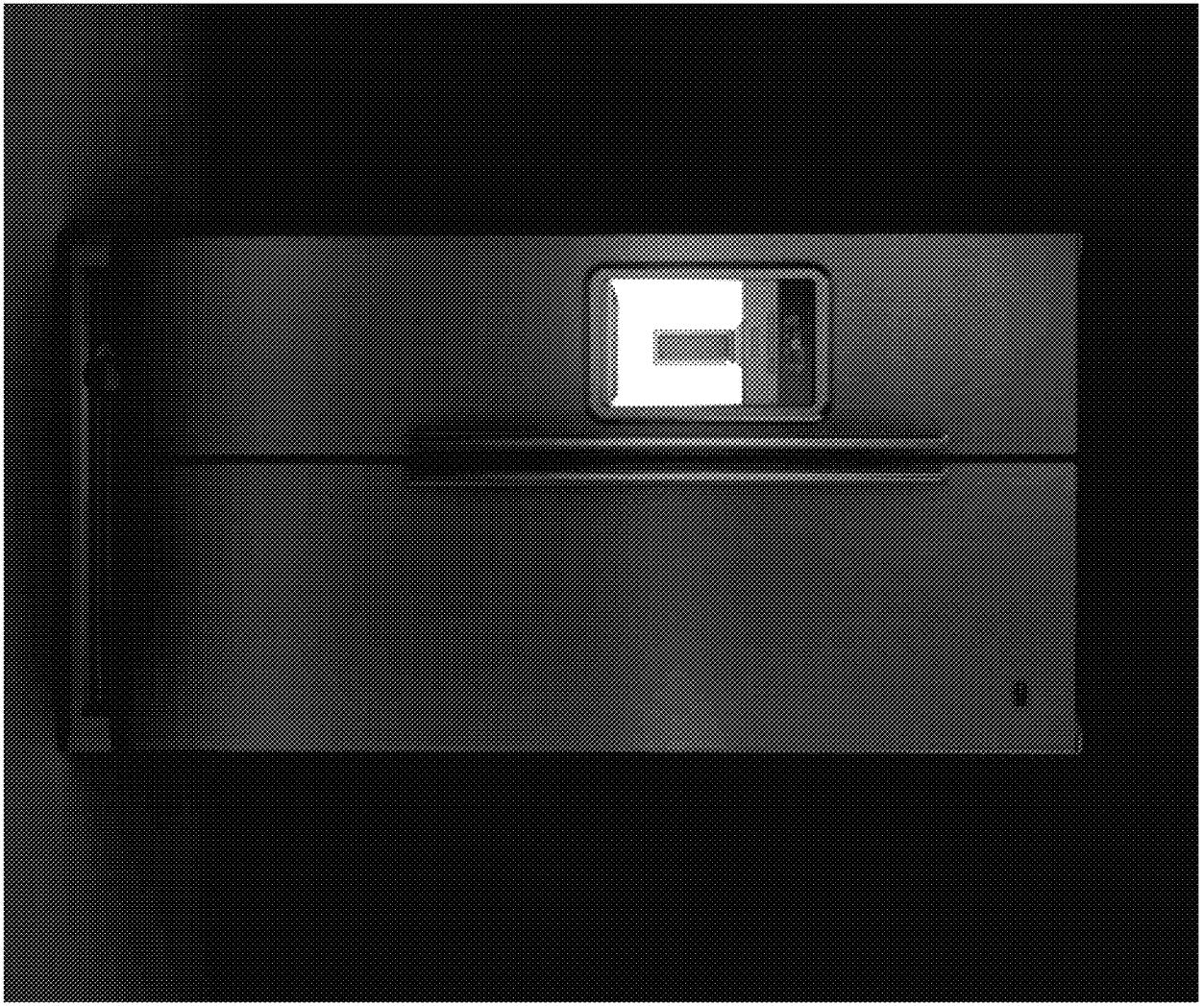

A slightly different trigger is used for this embodiment as opposed to that of the preceding embodiment. Instead of ambient light, an "on" time for dispenser well lights is simply preprogrammed into controller 20 or user-selectable from some user interface (e.g., touch screen, key pad, buttons, etc., such as are known in the art). For example, at some pre-set time (in this example approximately sunset), the well lighting comes on (FIG. 9B). Similarly, programming could turn it off at another time (e.g., just before dawn for the geographic location of the appliance) (FIG. 9A).

Figure 9C:
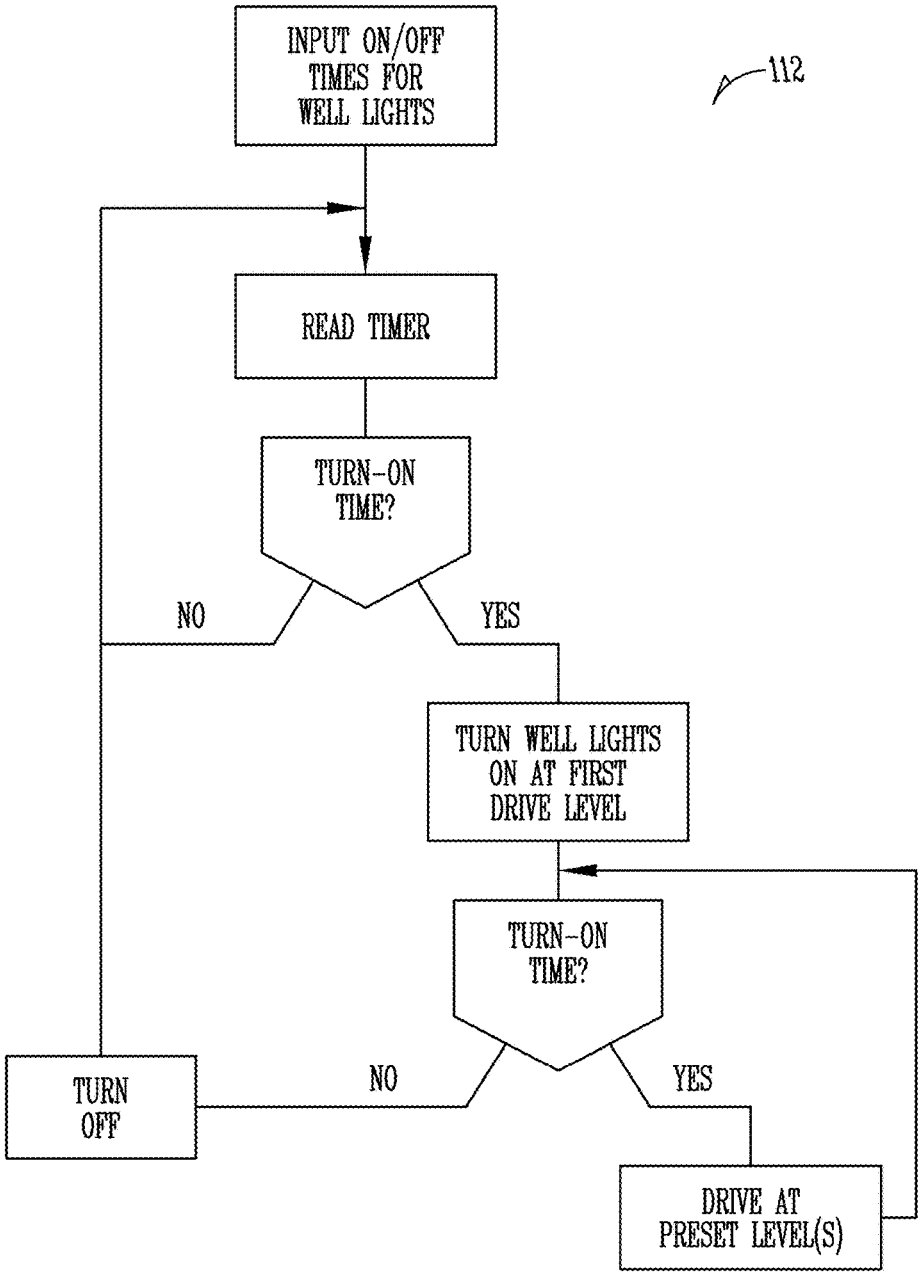
FIG. 9C is a control loop algorithm for the effect of FIGS. 9A-B.

Control algorithm 112 (FIG. 9C) illustrates this lighting effect regime.

Embodiment 10

Figure 10A:
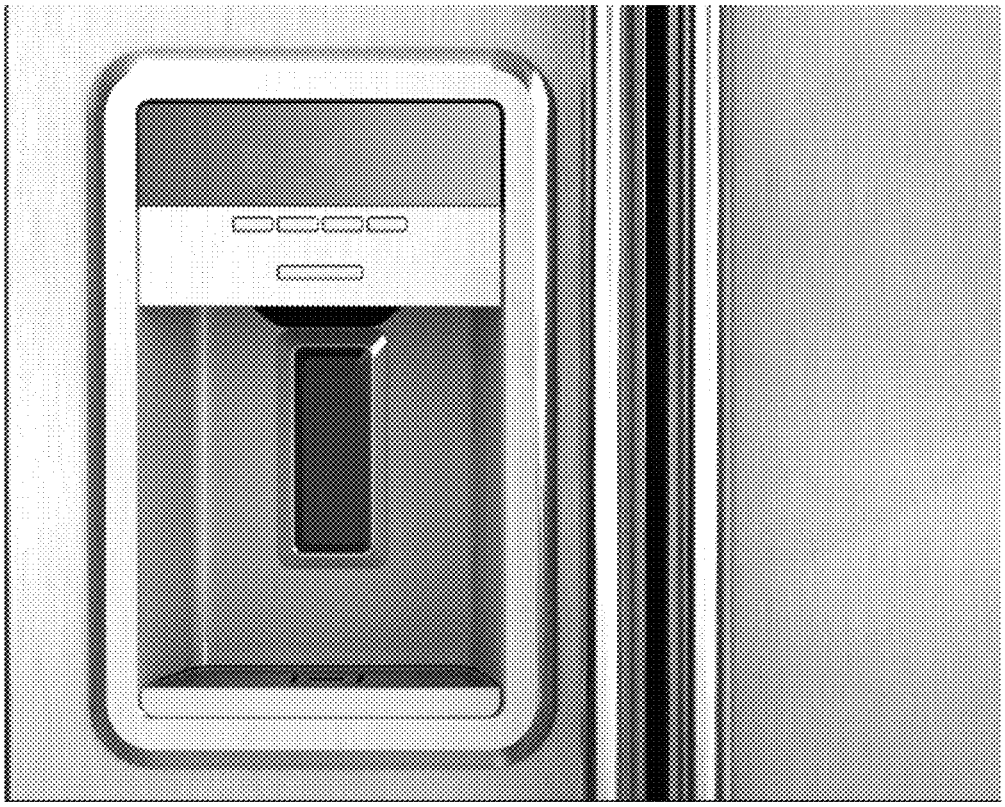
FIGS. 10A-C are photographic depictions of another dispenser well lighting effect sequence according to another exemplary embodiment of the present invention.
Figure 10B:
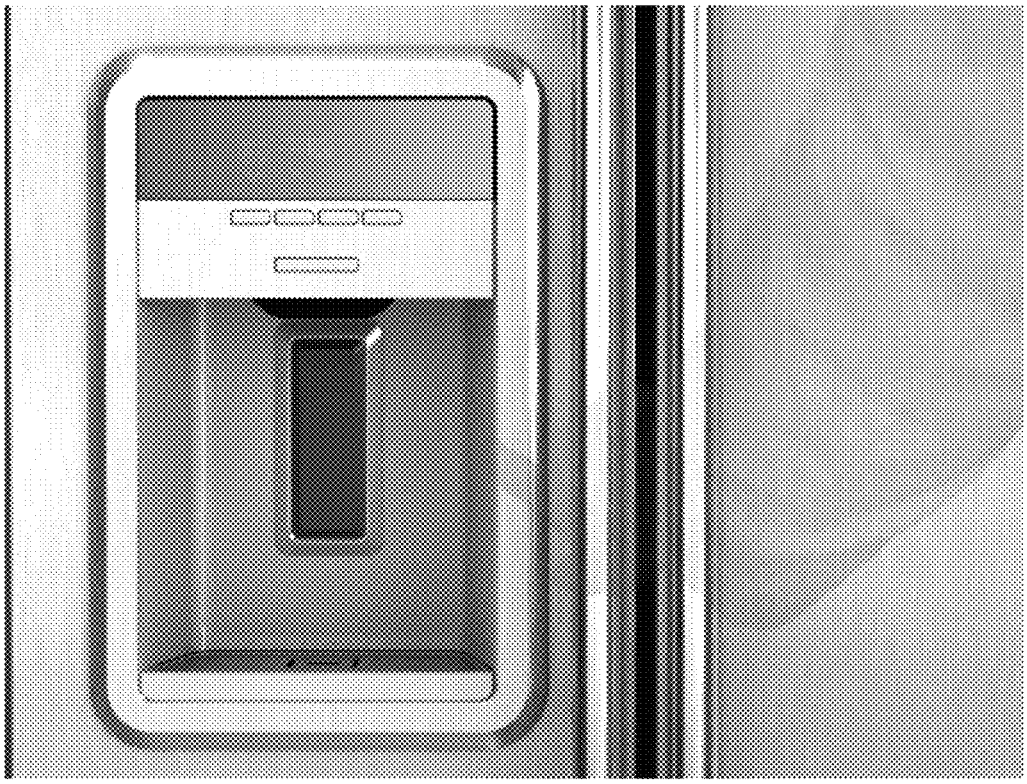
Figure 10C:
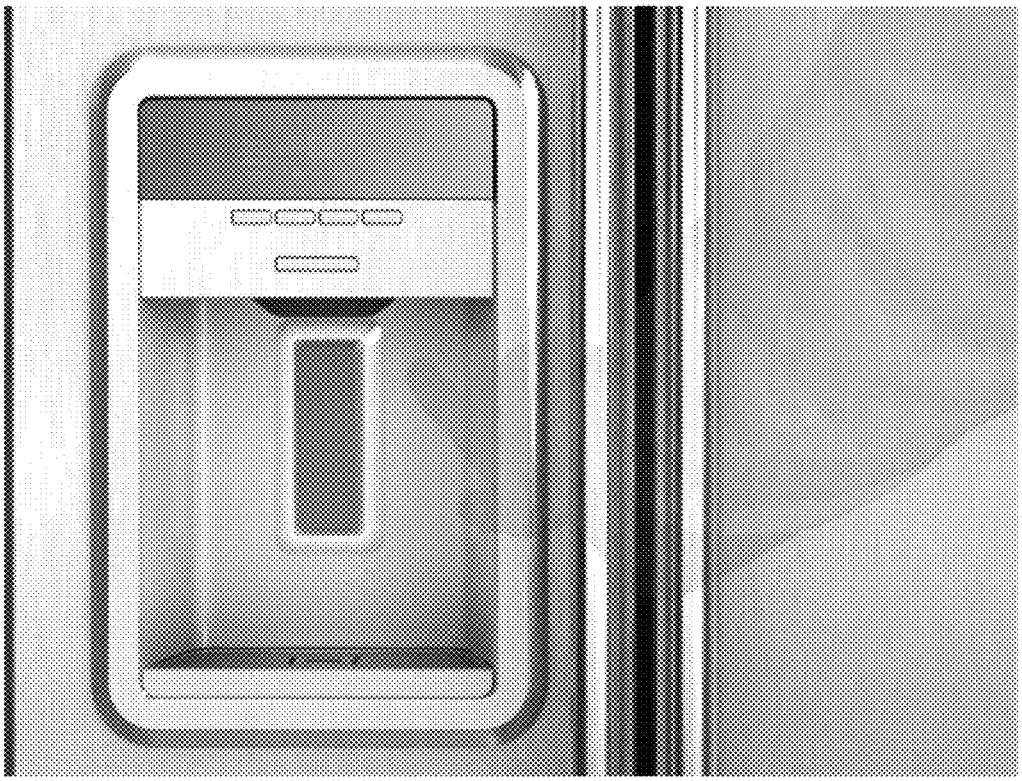

A still further variation on well lighting is shown in FIGS. 10A-C. Like some prior embodiments, the trigger could be a proximity sensor to trigger well lighting "on". In particular, certain proximity sensors can be positioned and calibrated to trigger only when something like a human hand (see also hand 115 in FIG. 11F) is in quite close proximity Thus, the well light is normally "off" (FIG. 10A). The proximity sensor would only trigger if a hand (or what the proximity sensor triggers upon) enters the well (compare FIG. 10B where the hand is not yet within sensor range and the well light does not yet turn on and 10C where the hand is within range and the well light turns on). The light would be automatically turned off once the hand goes out of range (FIG. 10B).

Embodiment 11

In a similar fashion to the preceding embodiment, a proximity sensor could be calibrated to sense immediate proximity of other than a human or part of a human.

Figure 11A:
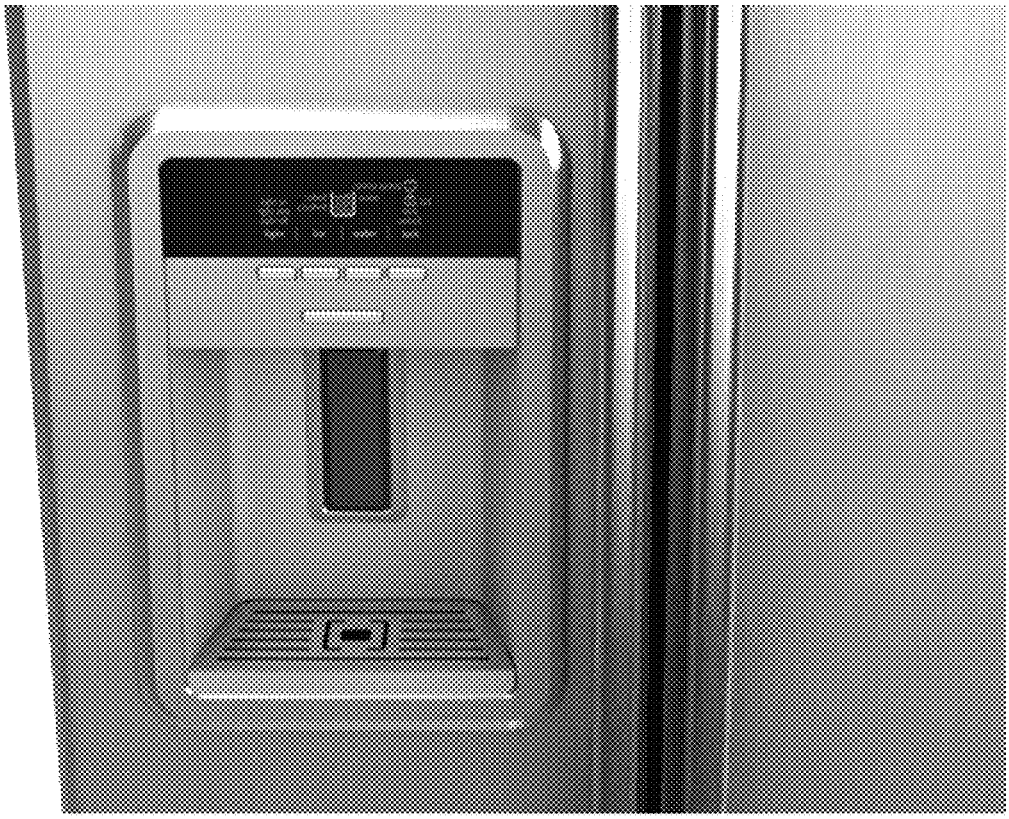
FIGS. 11A-E comprises a photographic sequence depicting a still further exemplary embodiment of the present invention, including several different dispenser functions.
Figure 11B:
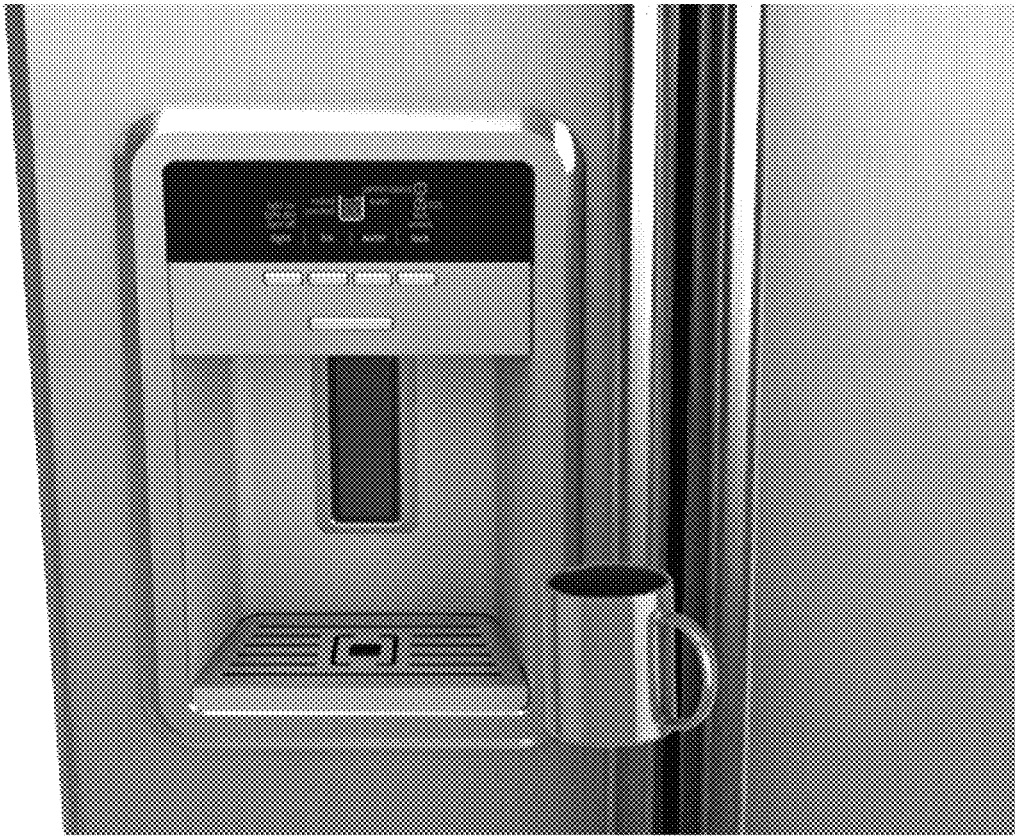
Figure 11C:
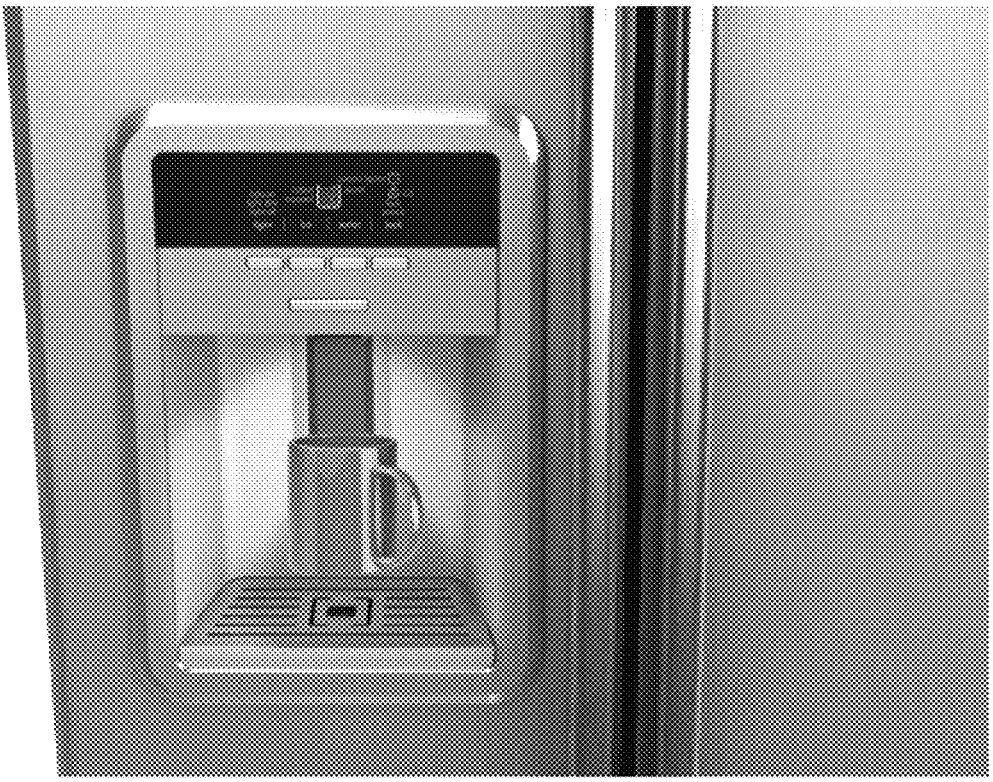

The well light is "off" in a normal of state (FIG. 11A). The sensor 118 is calibrated such that even though a cup 117 is near the well it does not trigger (FIG. 11B). However, if the cup is placed inside the well, controller 20 triggers on the well light(s) (FIG. 11C).

Figure 11D:
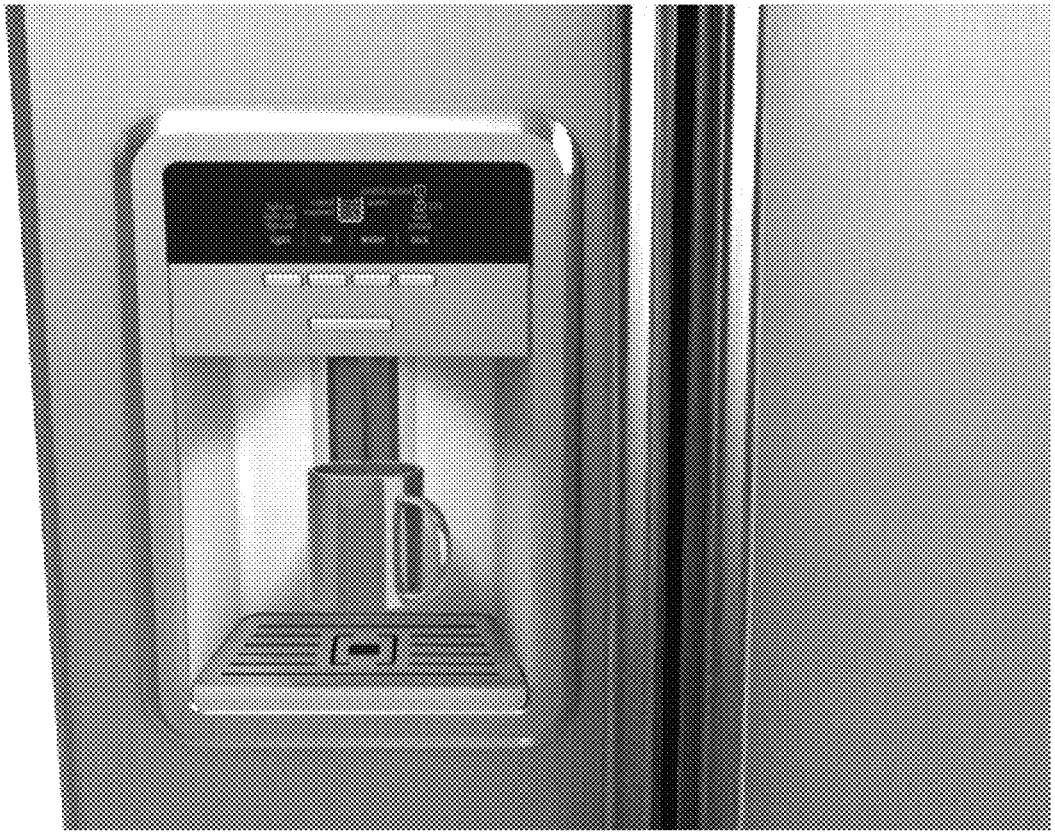
Figure 11E:
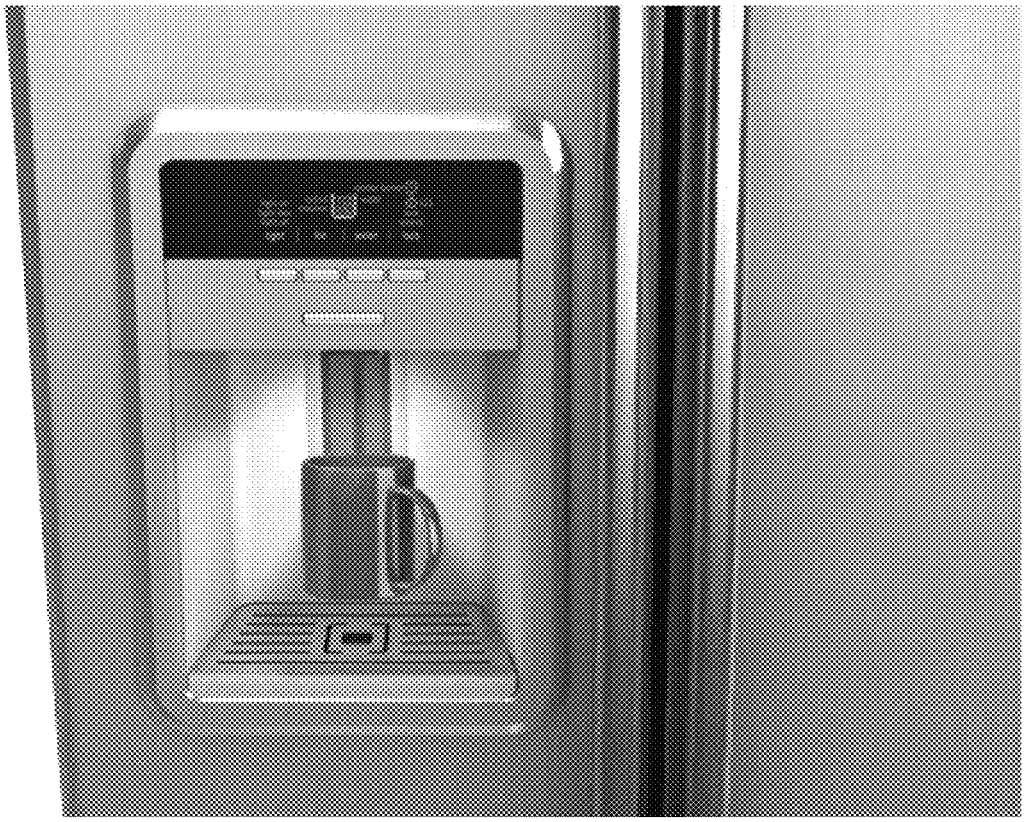
Figure 11F:
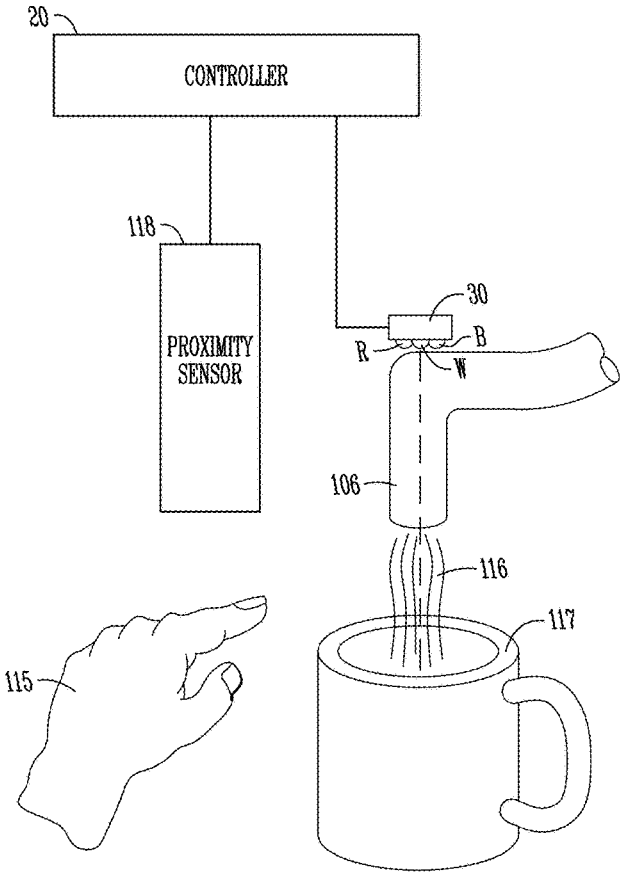
FIG. 11F is a diagrammatic view of a water dispenser nozzle, water stream lighting source, and triggering and control system for colored lighting of a water dispensing stream.
Figure 11G:
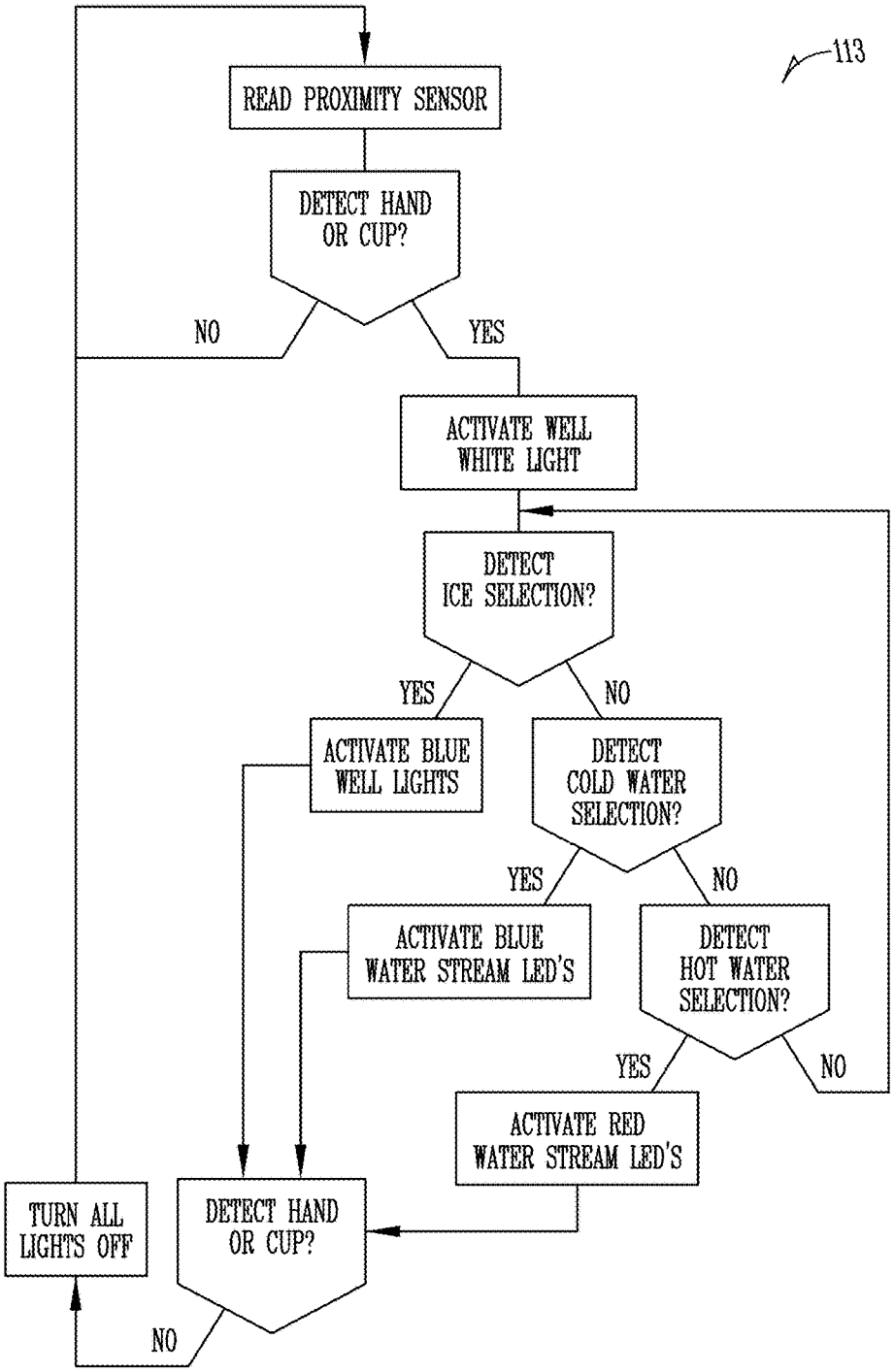
FIG. 11G is a block diagram flow chart of a control loop algorithm for the embodiment of FIGS. 11A-E.

An additional feature is illustrated in FIGS. 11D and E. Once the proximity sensor illuminates the well, the user can select from a user interface any of a number of things. In this embodiment this can range from ice (e.g., cubed or crushed), hot water, or cold water. This would be done by pushing a button on the user interface as is well known in the art. As shown in FIG. 11D, if the user selects cold water and the cup is sensed to be in the well (and the well light turns on), a further LED or set of LEDs blue in color output are switched on automatically by controller 20 (by knowing that cold water has been selected). These blue LED(s) have beam(s) that are at least substantially aligned with the water stream into the cup. The water stream is essentially colored blue (indicating cold water). As illustrated in FIG. 11E that array of LEDs 30 could include different colored LEDs (e.g., one white or "W", one red or "R", and one blue or "B"). When hot water is selected (FIG. 11E), the hot water exits the water spigot or nozzle 106 in a stream 116. The light output of the red LED is collimated and aligned with the water stream 116. As shown in FIG. 11E the water stream appears red. This signals the user that hot water is being delivered. It also provides an interesting aesthetic.

Alternatively if the cup must be touched to a switch in the well to start water flow, one or more LEDs aligned with water stream 116 would then be turned on by controller 20 to give a color to the stream.

Algorithm 113 illustrates one example of this type of dynamic lighting.

Embodiment 12

An alternative well lighting scheme is shown in FIGS. 12A-12E.

By utilizing an appropriate color LED in an LED array 30 (e.g. a red LED), and by utilizing an appropriate pattern plate 132 (see FIG. 12E) below that LED or array, upon an appropriate trigger, a red target of light in the shape of FIG. 12C (see also diagrammatic depiction in dashed lines at reference number 133 in FIG. 12D) can be projected to the floor 134 of the well.

Figure 12A:
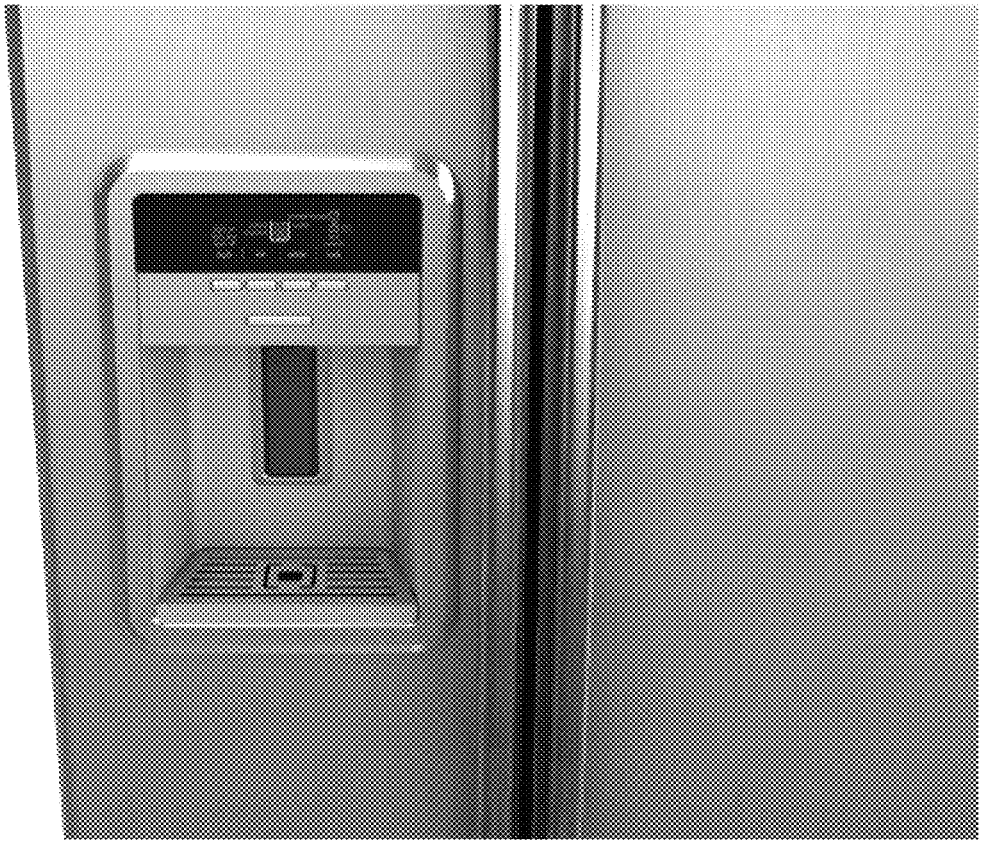
FIGS. 12A-C are photographs illustrating another exemplary embodiment according to the present invention.
Figure 12B:
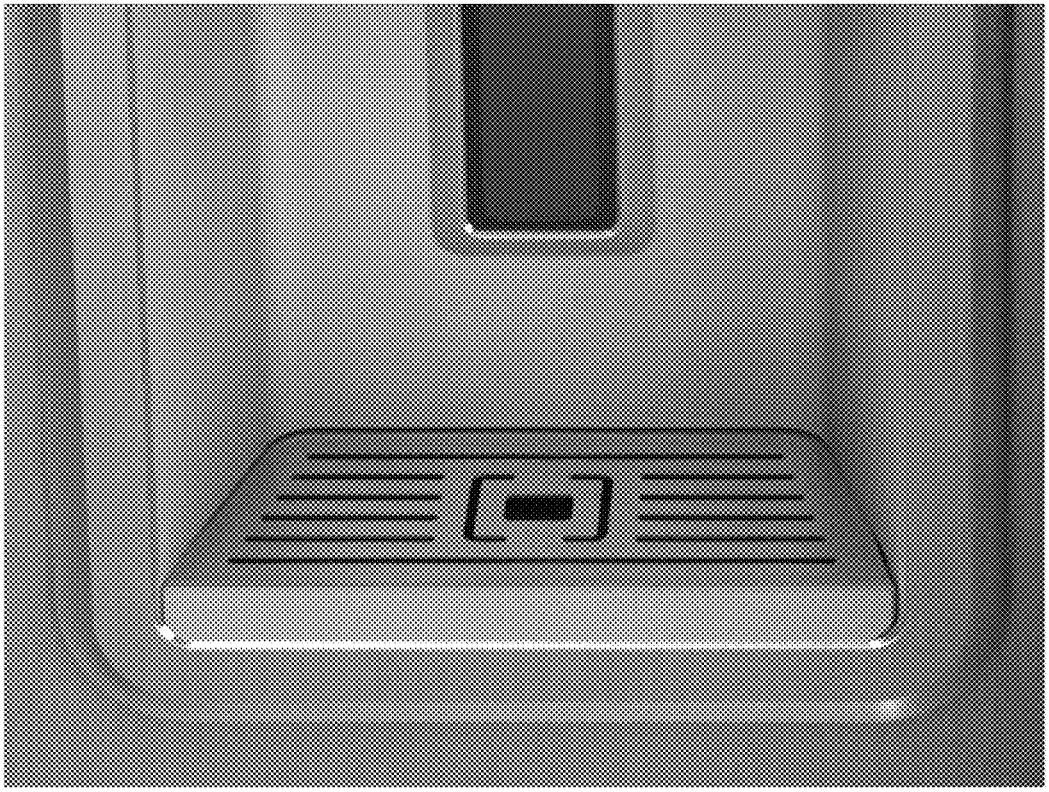
Figure 12C:
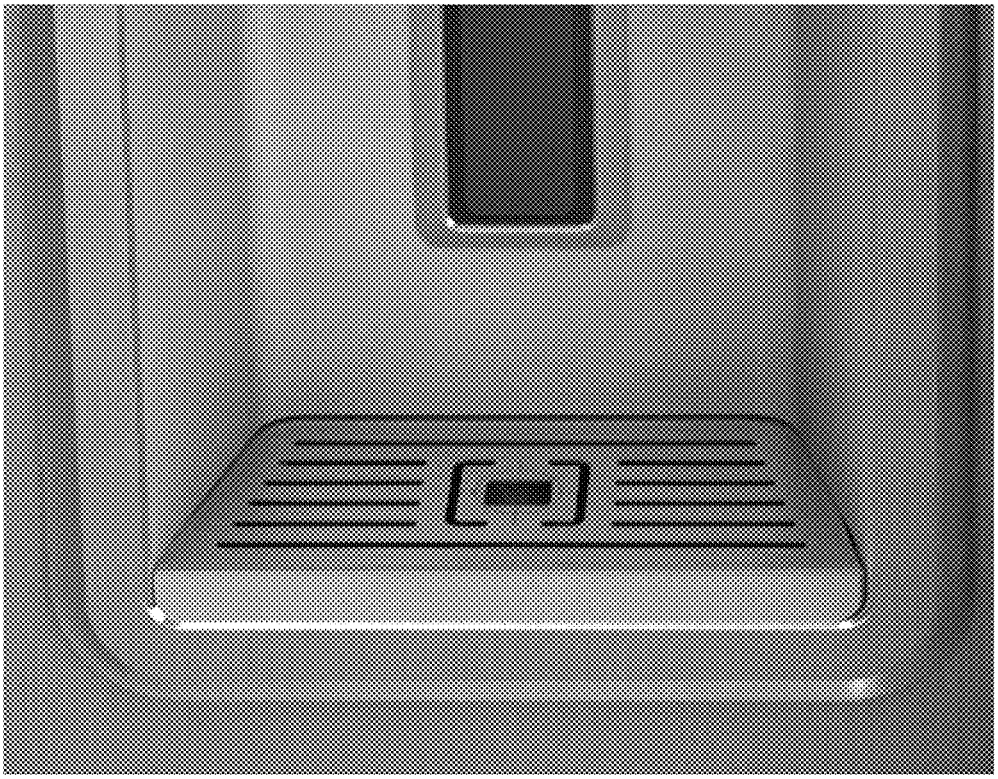
Figure 12D:
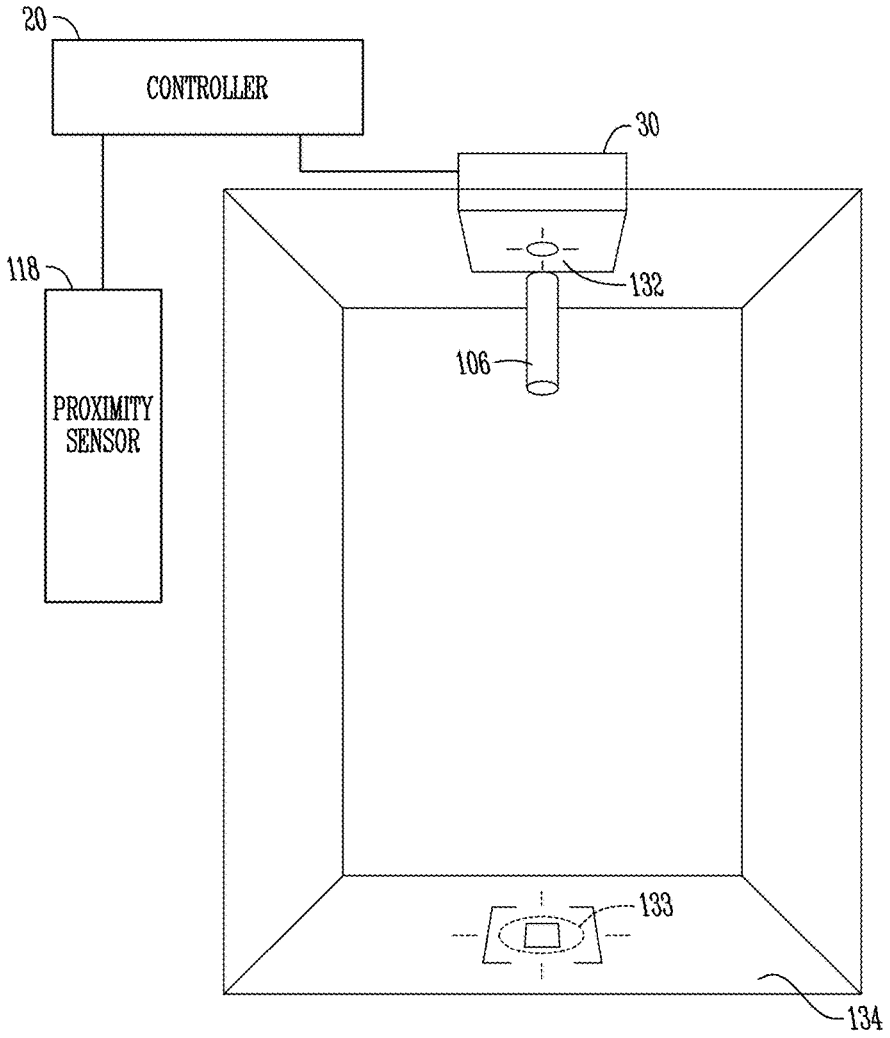
FIG. 12D is a diagrammatic depiction of the water spout and optical system for projecting a target for cup placement in an ice and water dispenser.

In FIG. 12A the pattern is not projected because no trigger has occurred. A close-up of the floor of the well is shown in FIG. 12B.

Upon a trigger, the red circular pattern with four orthogonal projecting lines is projected to the bottom of the well. This provides a visual indicator or target for a user to place a mug or container in the ice or water dispenser.

Figure 12E:
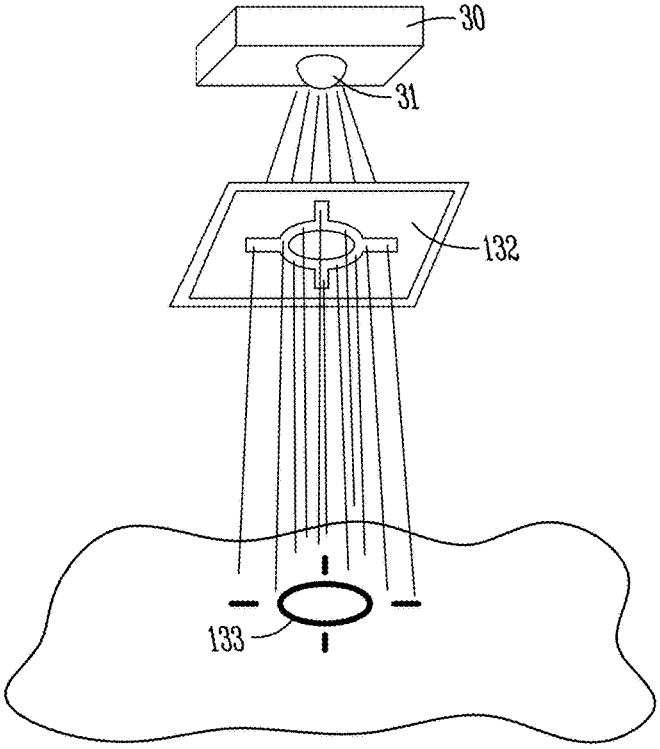
FIG. 12E is an enlarged diagrammatic view of how the target of FIG. 12D is projected.
Figure 12F:
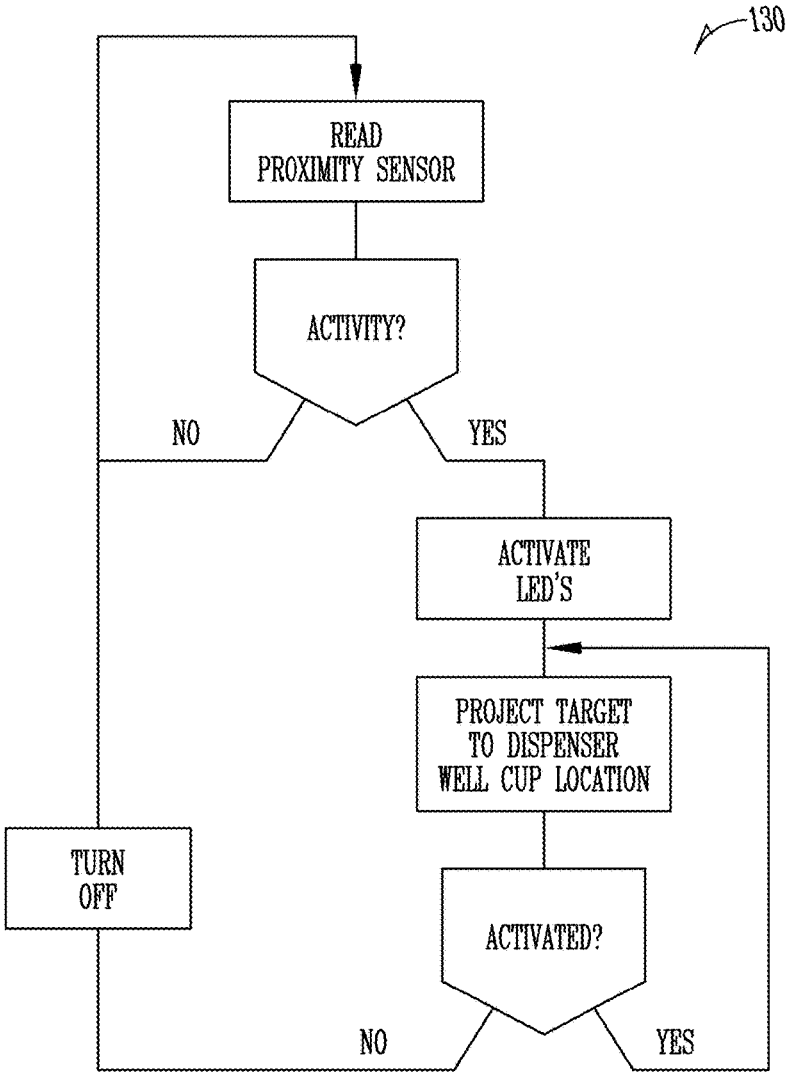
FIG. 12F is a block diagram control loop algorithm for the embodiment of FIGS. 12A-C.

The trigger, here, is a proximity sensor. It could sense the approach of a person or cup. The target could be projected before a hand or cup is inserted in the well to help the user understand proper placement of the cup or container. FIG. 12E diagrammatically illustrates how the pattern is generated. The beams from LED(s) 31 project to pattern plate 132. Pattern plate 132 is opaque except for the circle and cross hairs which allow light to pass. The result is a projection of light in the shape 133.

It could be projected and be steady state at a fixed intensity. Alternatively it could be at a dim or low intensity to start and then ramped up or jumped up. Additionally, it could be flashed.

Flow chart 130 in FIG. 12E illustrates one method of control.

Embodiment 13

Some refrigerators with dispensable water include an on-board water filter. Some of those refrigerators include a sensor that indicates the need of replacement of the filter. See U.S. Pat. No. 8,337,693, incorporated by reference herein. In that patent, a light can illuminate when the sensor 128 indicates need for replacement of the filter. This helps the user know of that filter status.

The embodiment of FIGS. 13A-G provides a dynamic control loop lighting scheme that differs as follows.

Figure 13A:
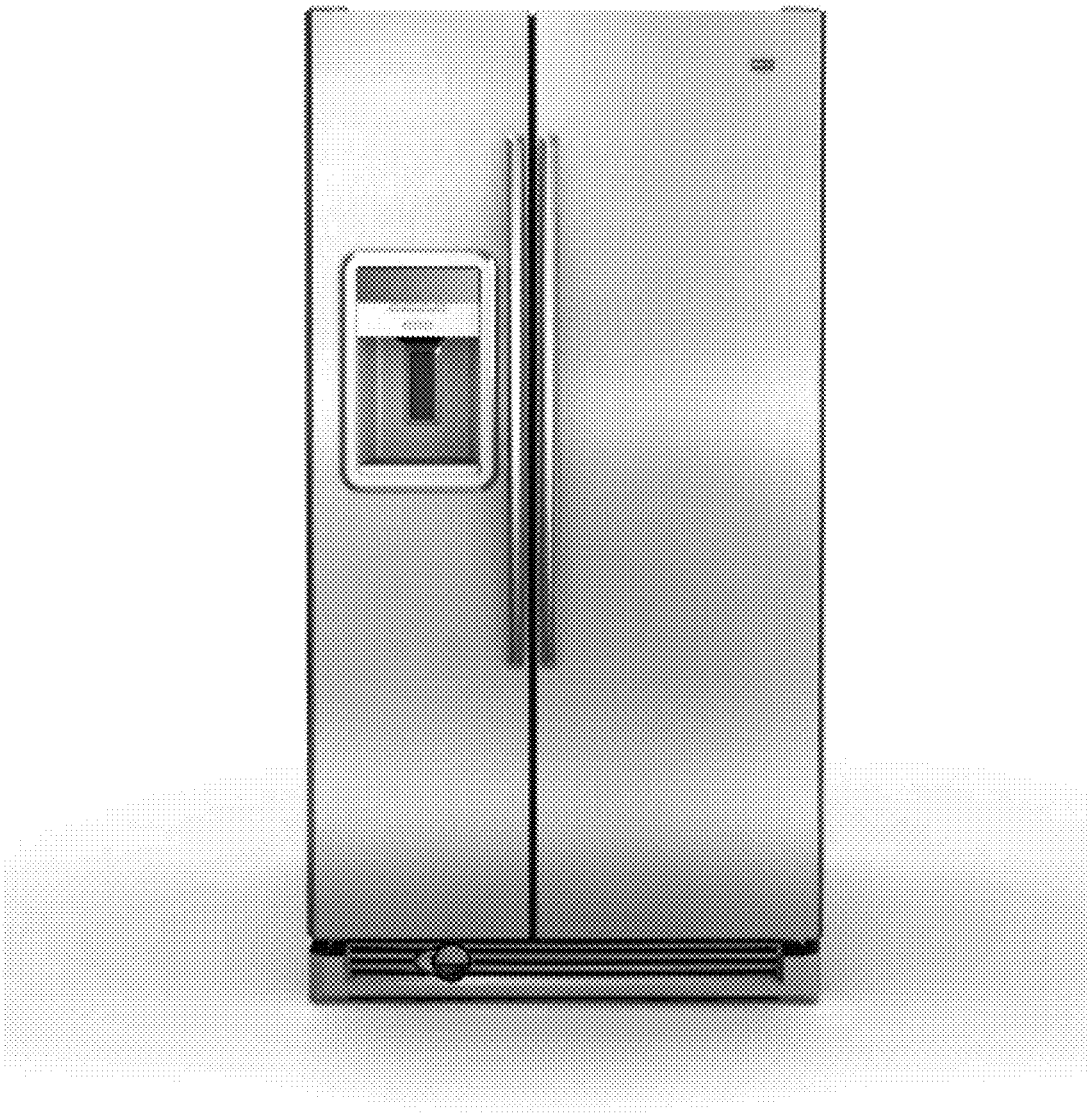
FIGS. 13A-E are photographs illustrating another exemplary embodiment of a dynamic lighting scheme according to the invention.
Figure 13B:
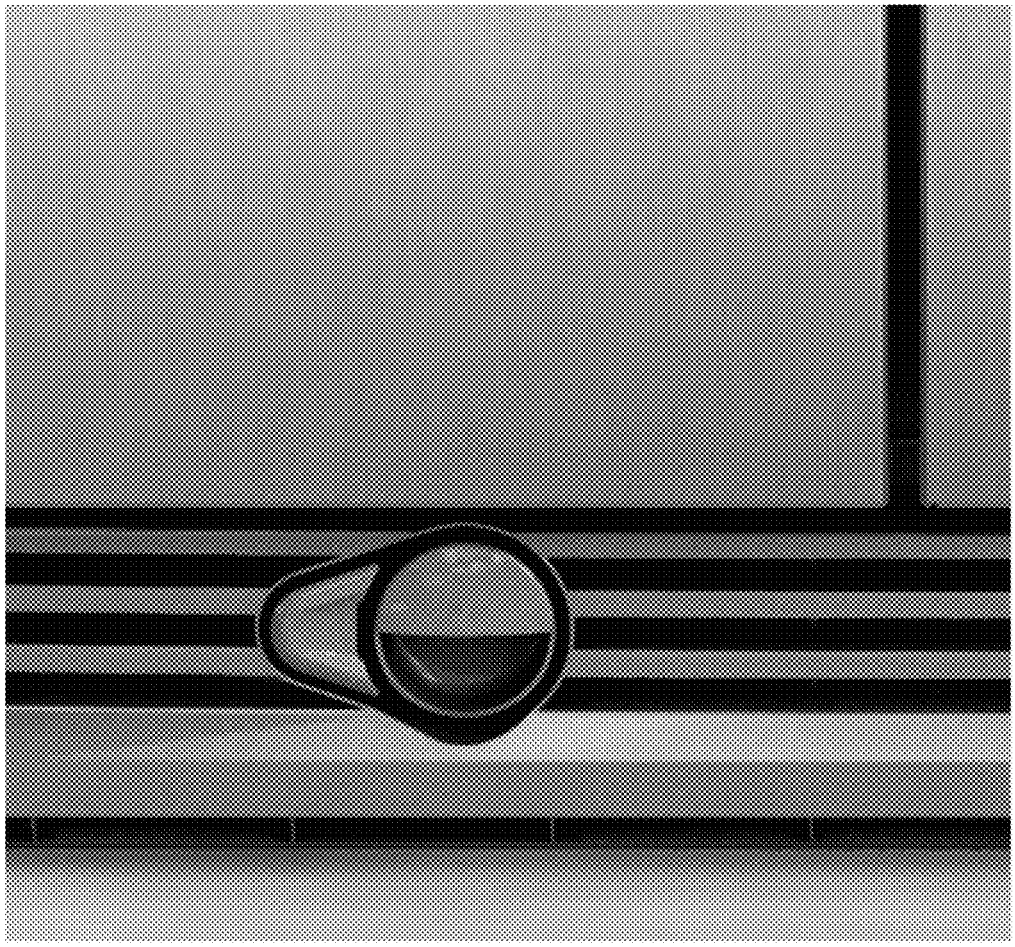
Figure 13C:
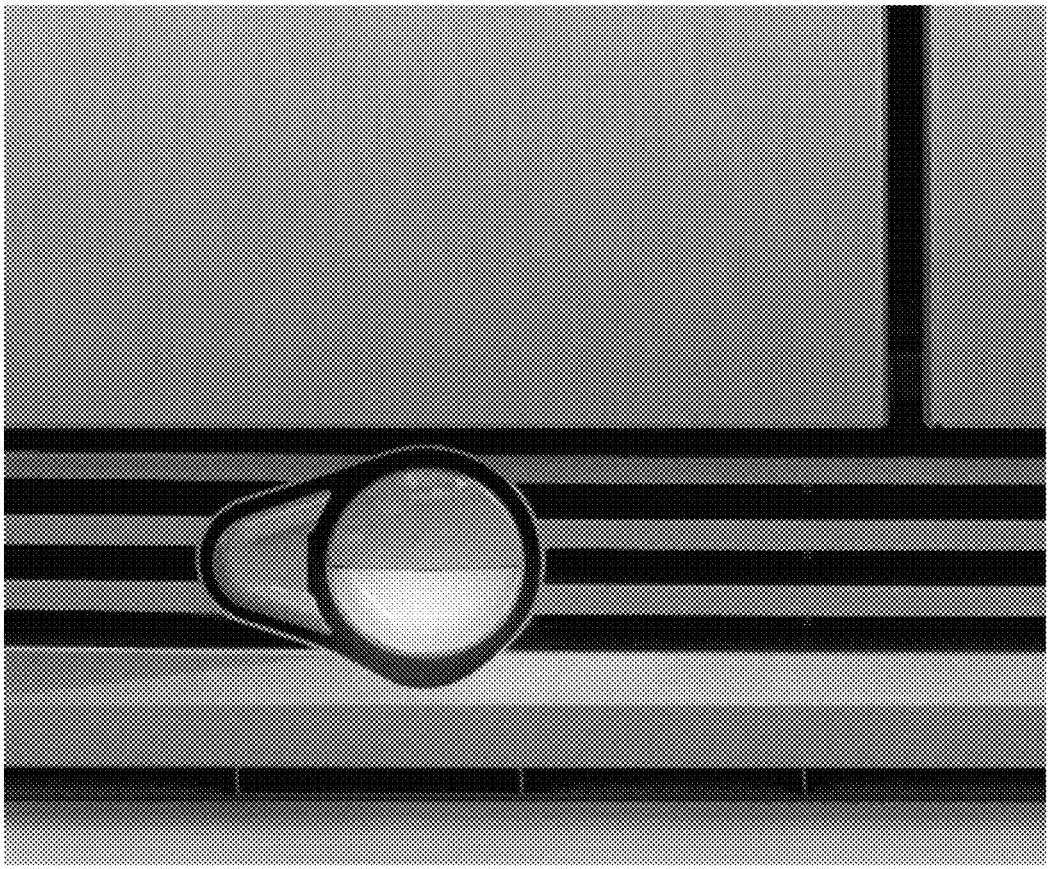
Figure 13D:
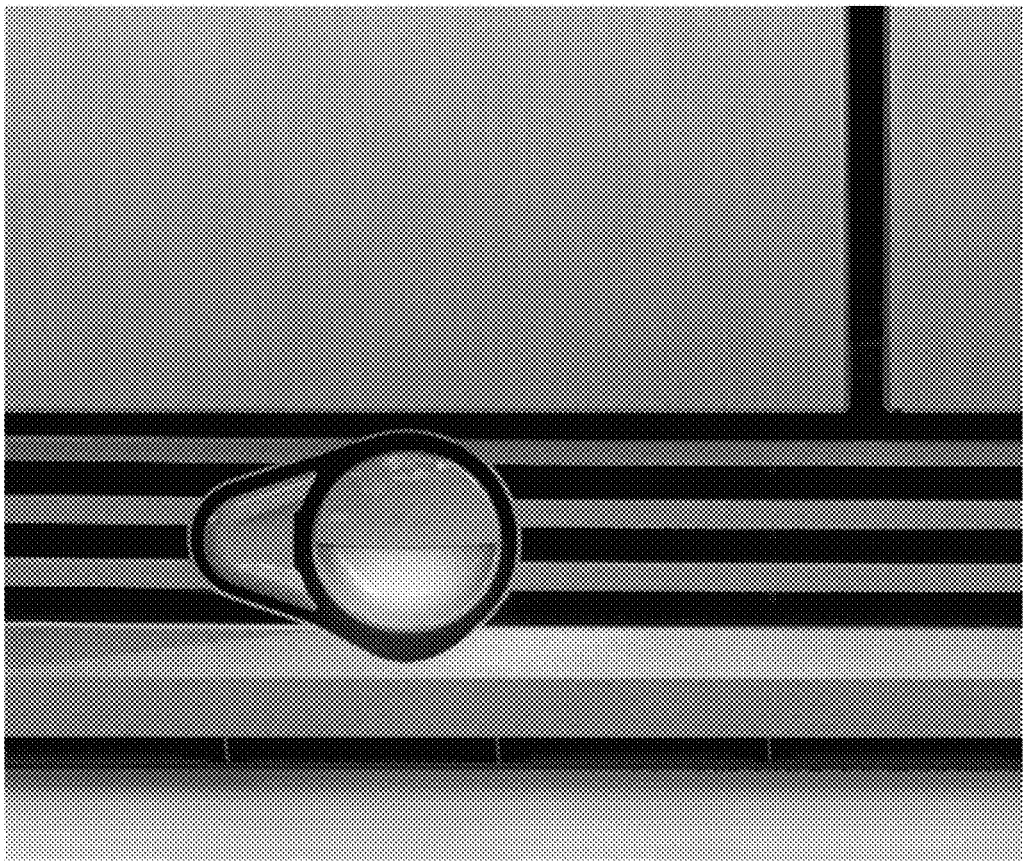
Figure 13E:
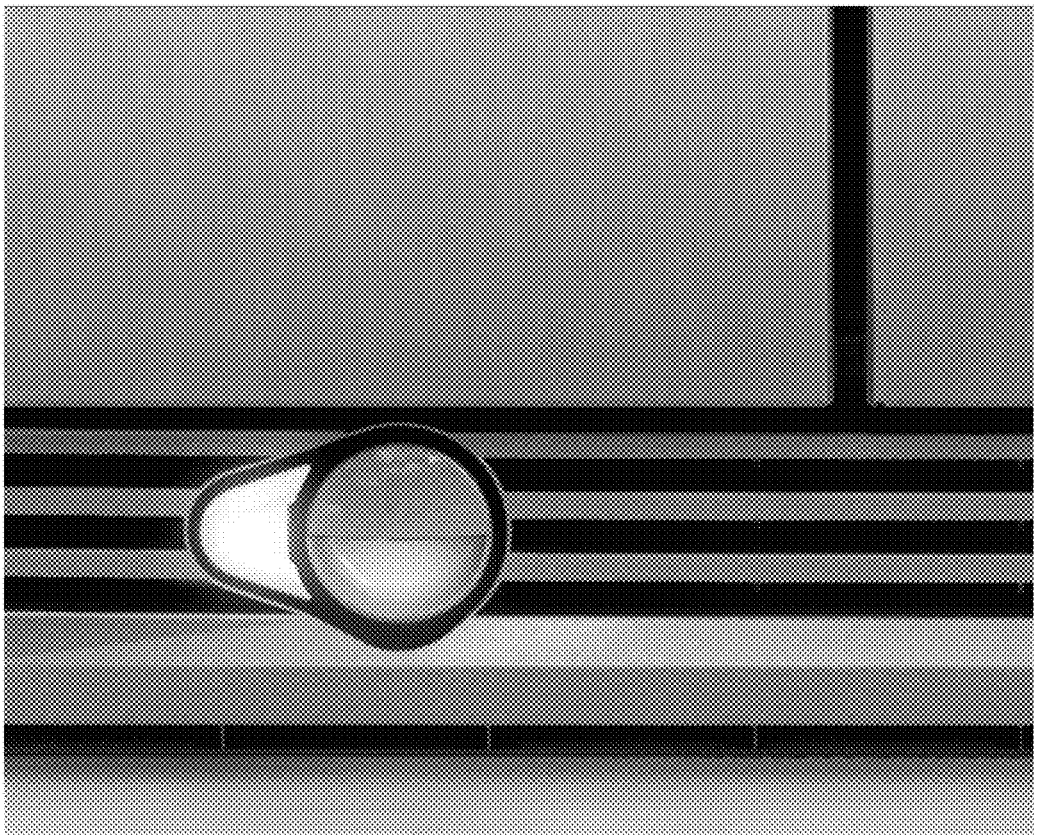
Figure 13F:
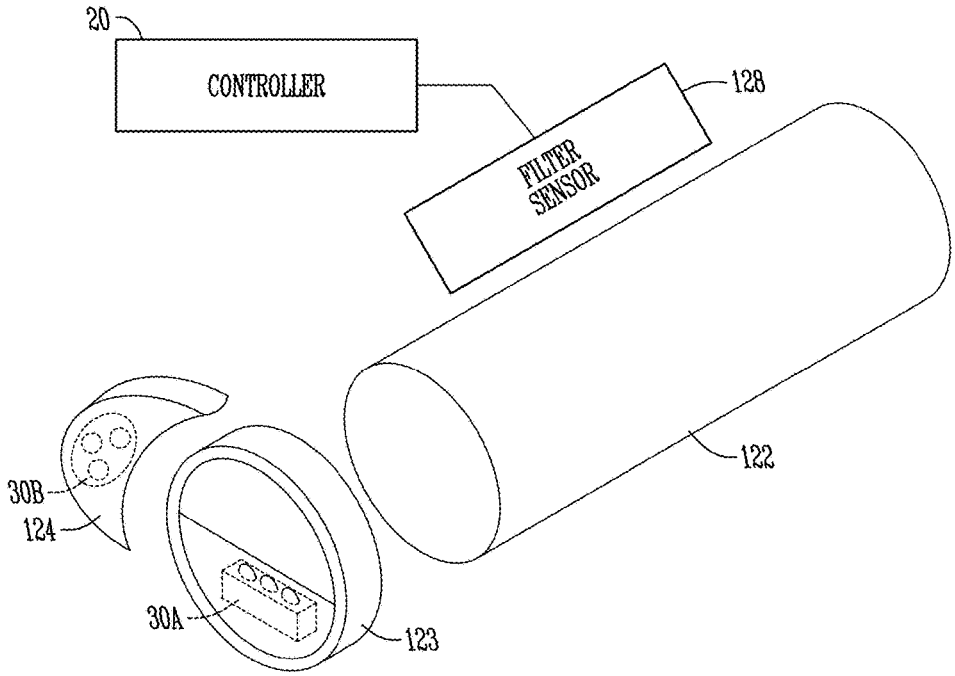
FIG. 13F is an enlarged exploded and diagrammatic view of refrigerator of filter, cover and release button according to this embodiment.

In this example, the elongated cylindrical filter 122 is at the bottom or ground level of the appliance (see FIG. 13F). A cover 123 is removable but holds filter 122 in operative position (see FIG. 1A). A release button 124 is to the left of cover 123 (see FIG. 1A). Manually pushing button 124 releases filter 122 from operative position for replacement. This might be either before or in addition to having cover 123 removed.

As shown in FIGS. 13A-E, and by reference to FIGS. 13F and G, in normal state no illumination at or around the filter is actuated (FIGS. 13A and B). If the filter sensor informs controller 20 that the filter is approaching need-for-replacement status, a yellow LED in LED array 30A mounted in cover 123 can be turned on. It can be turned on in steady state at a relatively low intensity as a warning light to the user that need for replacement is approaching (FIG. 13C).

If not replaced, the yellow LED can be turned off and a red LED in array 30A can be turned on by controller 20 (FIG. 13D). This gives another visual indication to the user of need-to-replace status for the filter. If not immediately replaced, after a certain preset time or by some other factor, an LED 30B behind release button 124 can be activated by controller 20. It could be flashed to bring further attention to the user of the appliance as to what to push to eject the filter for replacement. Once the filter is replaced with cover 123, filter sensor should be read by controller 20 and no lights are turned on.

Figure 13G:
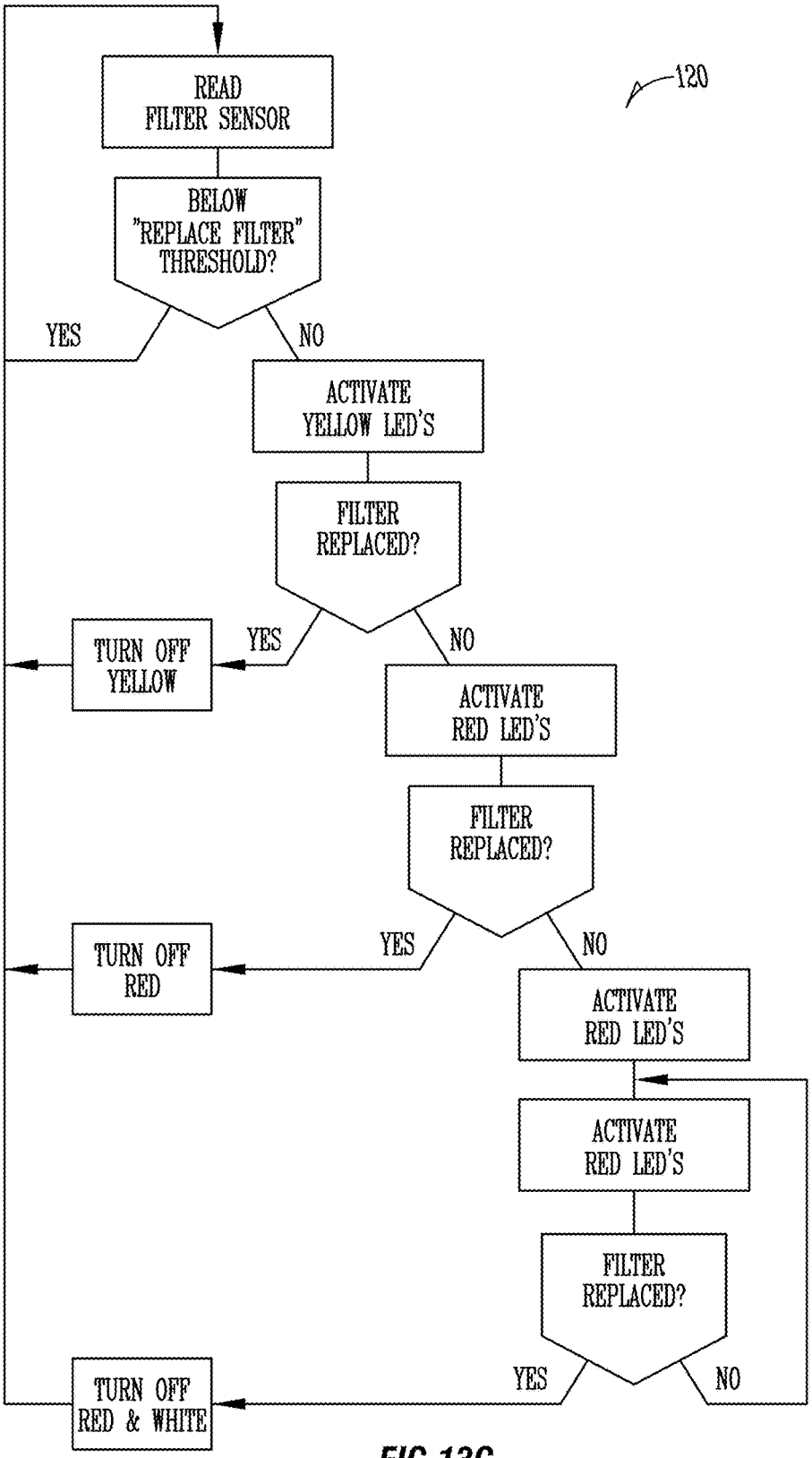
FIG. 13G is a control loop algorithm for this embodiment.

FIG. 13G is one example of a control loop dynamic lighting algorithm 120 that could be used with this embodiment.

Embodiment 14

Figure 14A:
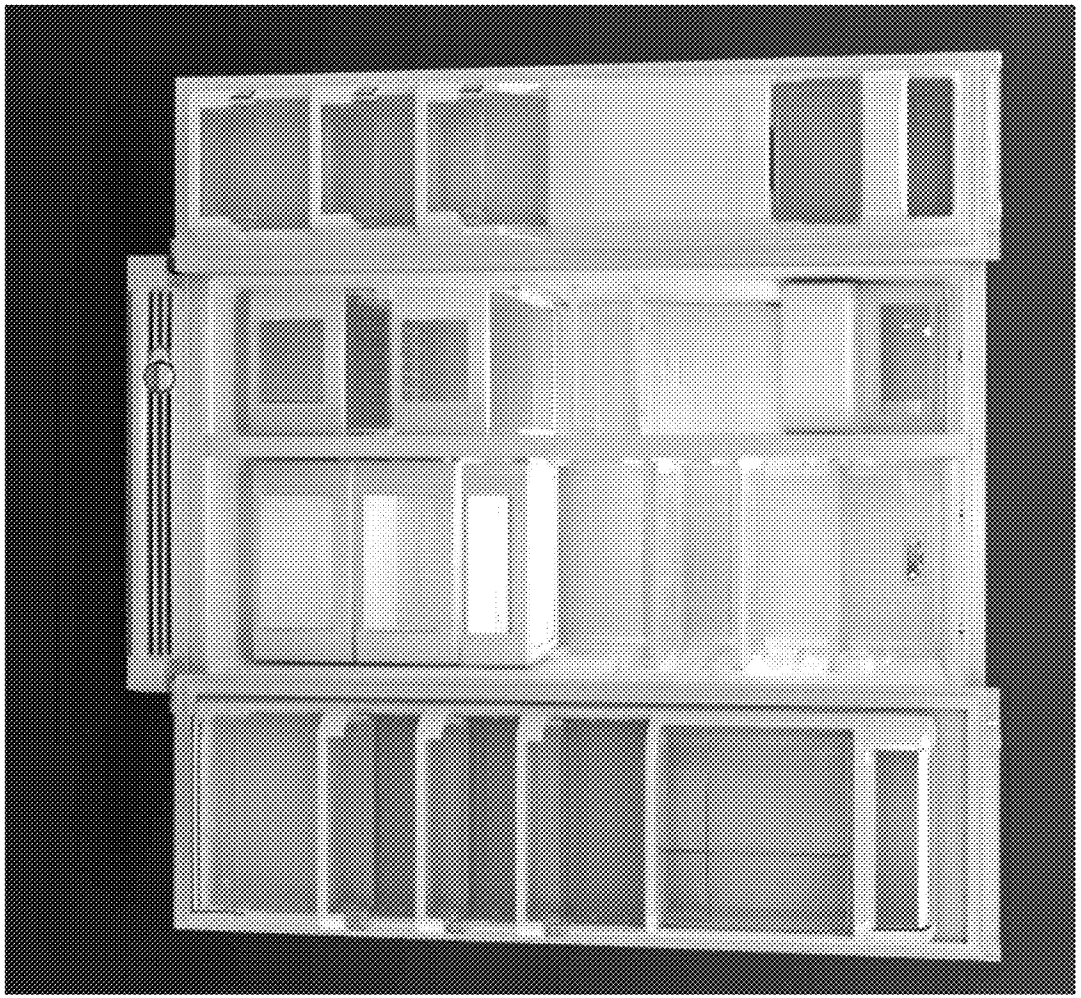
FIGS. 14A-C are sequence of photographic depictions showing a lighting sequence according to another exemplary embodiment of the present invention, for under shelf lighting of a refrigerator shelf.
Figure 14B:
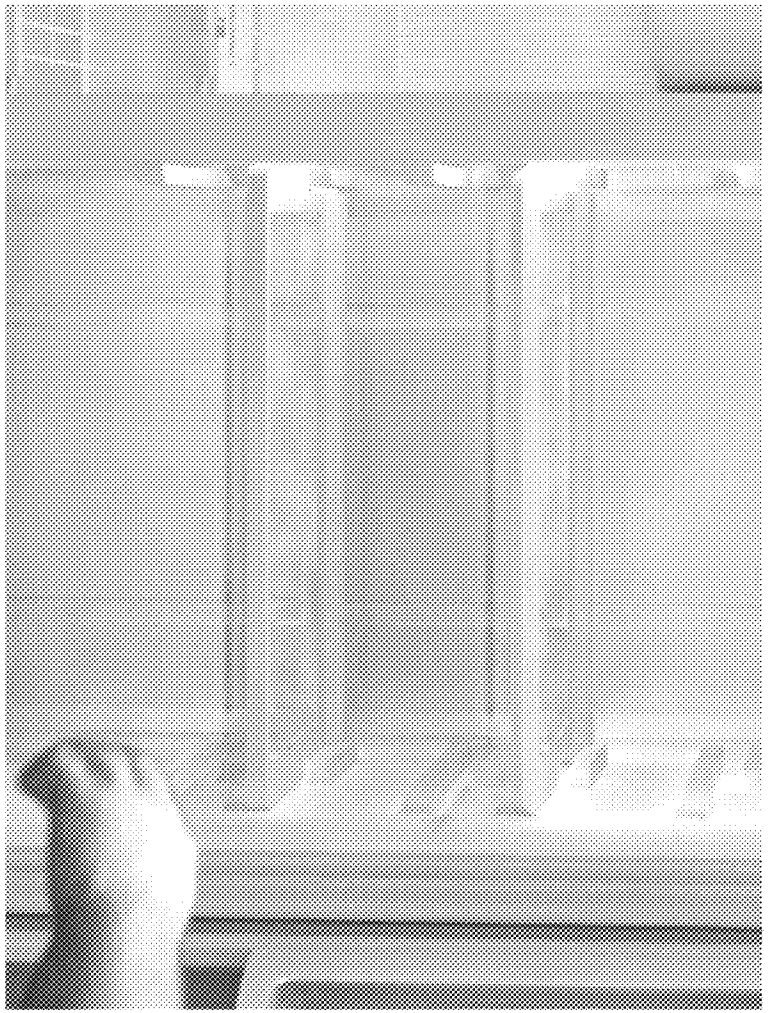
Figure 14C:
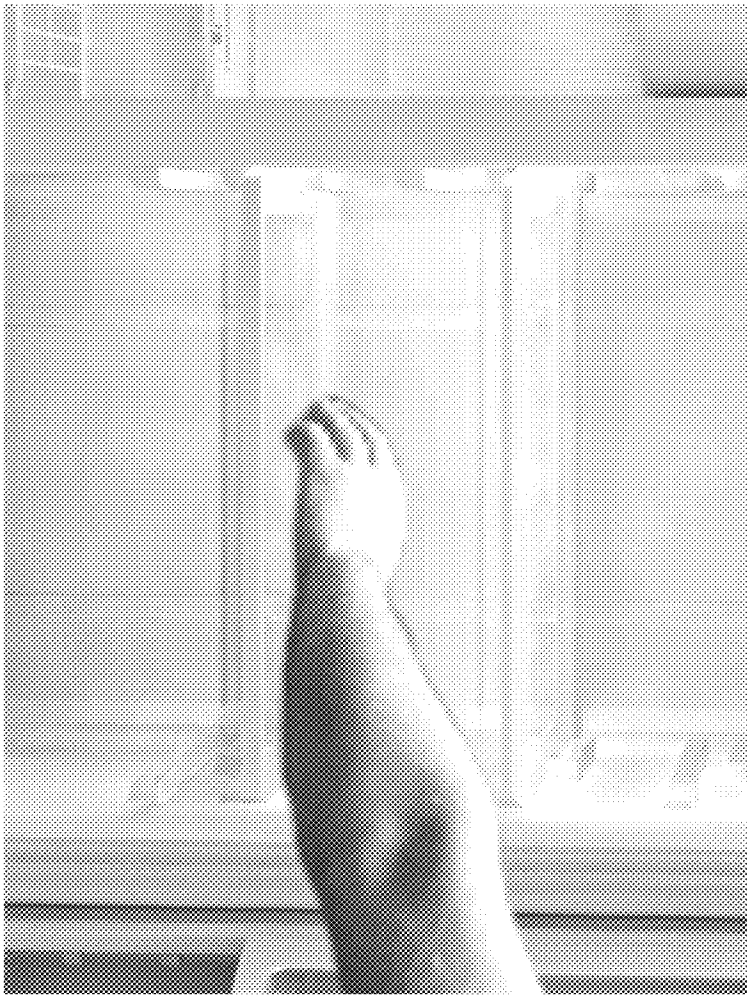
Figure 14D:
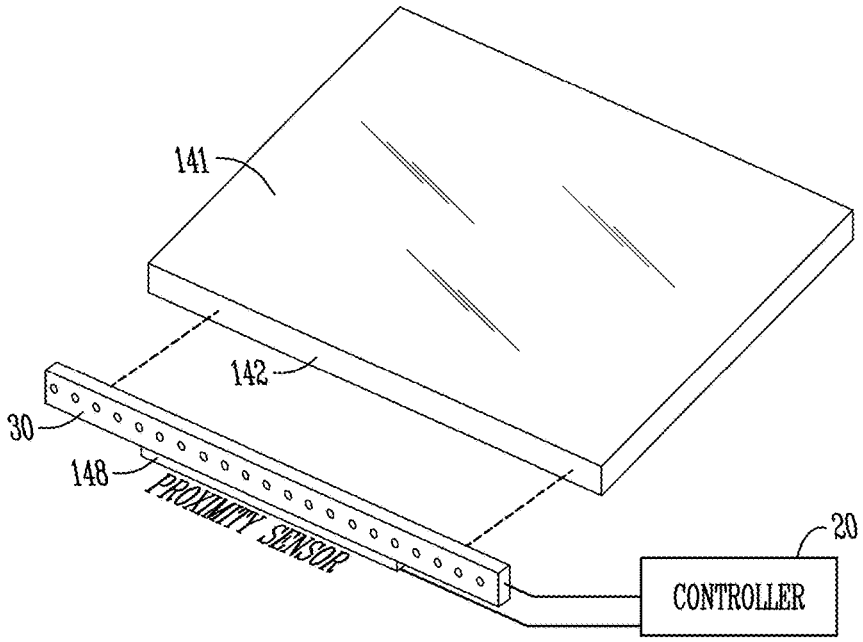
FIG. 14D is an enlarged diagrammatic perspective of a lighting subassembly for edge lighting refrigerator shelf for FIGS. 14A-C.

As a still further exemplary embodiment, individual refrigerator shelf lighting can be activated by detecting presence of a user's hand. As indicated in FIGS. 14A-C, when a refrigerator door is opened, any of a number of lighting schemes can be instigated. However, in this embodiment, at least one shelf has an LED array 30 along a front edge or side edge (FIG. 14D). The optical axes of each LED of array 30 are aligned directly into the edge 142 of a glass shelf 141. The glass shelf acts as a light guide which light travels through the plane of the glass. Some refracts outside the glass. The shelf edge lighting is normally "off" (FIG. 14A). A hand approaching the specific shelf but out of range of a proximity sensor 148 calibrated accordingly would not actuate that shelf's LED array (FIG. 14B). However, a hand that comes within range of the proximity sensor would cause controller 20 to actuate LED 30 and thus further highlight and provide an aesthetic lighting scheme for that particular shelf (FIG. 14C). Optionally it could illuminate areas around the shelf or other lighting if so designed.

FIG. 14D diagrammatically illustrates such an LED array 30. Another example can be seen at U.S. Pat. No. 7,338,180, incorporated by reference herein. The LED array could either be directed into the plane of the shelf (edge lid) or directed down below or directed above the shelf.

Figure 14E:
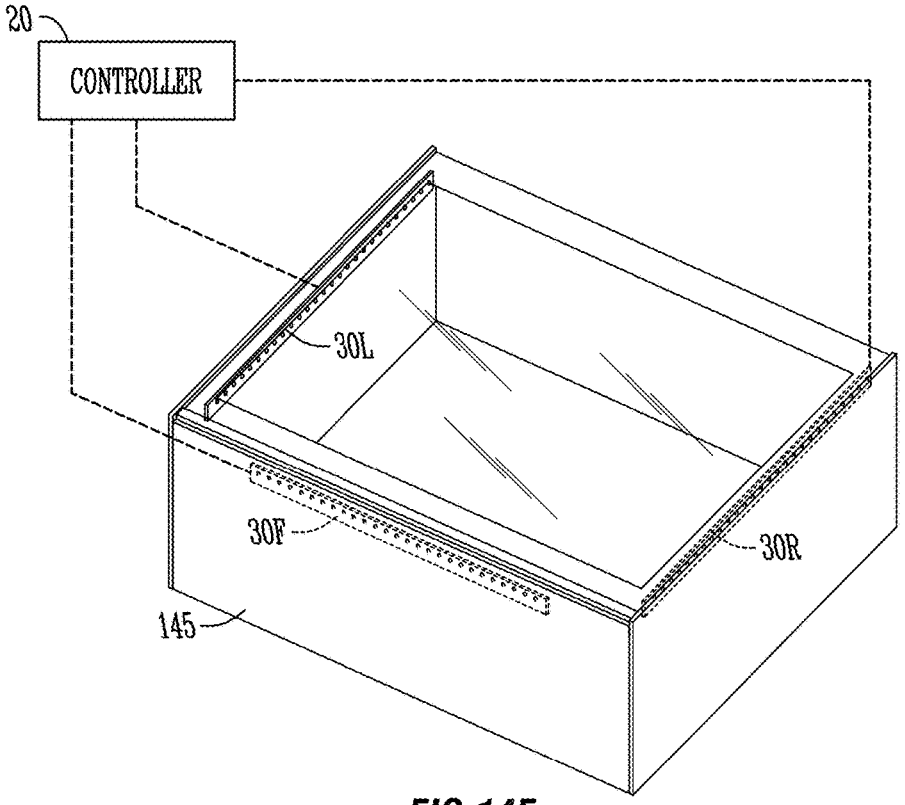
FIG. 14E is a diagrammatic perspective view of lighting subassemblies for a drawer of a refrigerator that could be analogously triggered and controlled.
Figure 14F:
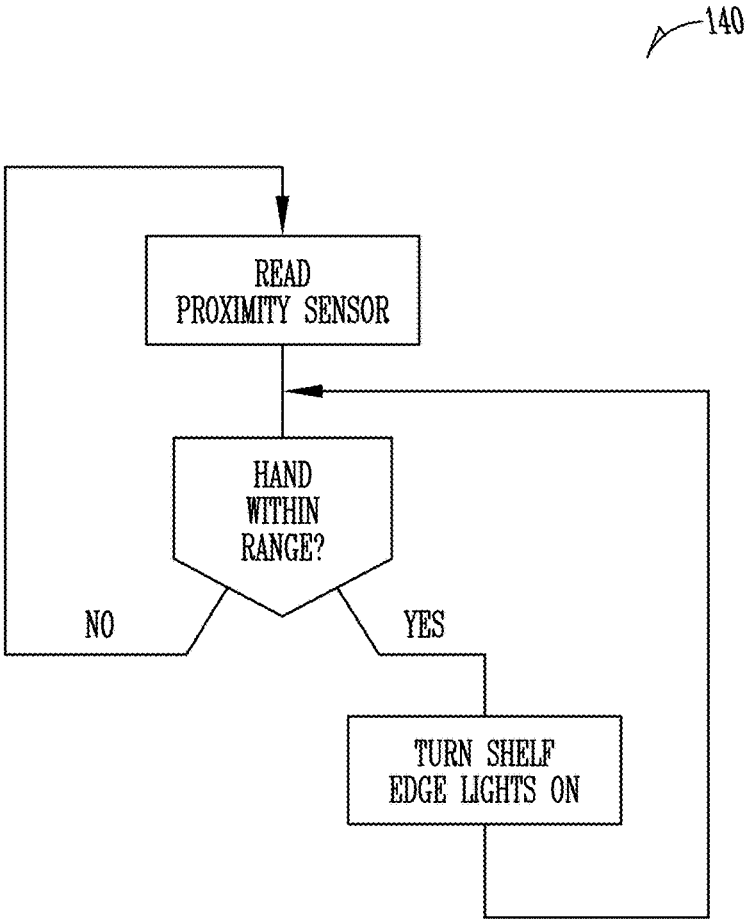
FIG. 14F is a control algorithm for the embodiment of FIGS. 14A-C.

Algorithm 140 shows an exemplary control loop for such lighting. FIG. 14E shows an alternative. Instead of shelf edge lighting, multiple lights (arrays 30F, 30L and 30R)

could be operated here for a drawer 145 or other compartment if, e.g., a hand is sensed in proximity by a sensor (e.g., proximity sensor 148 of FIG. 14D or other sensor).

Embodiment 15

Figure 15A:
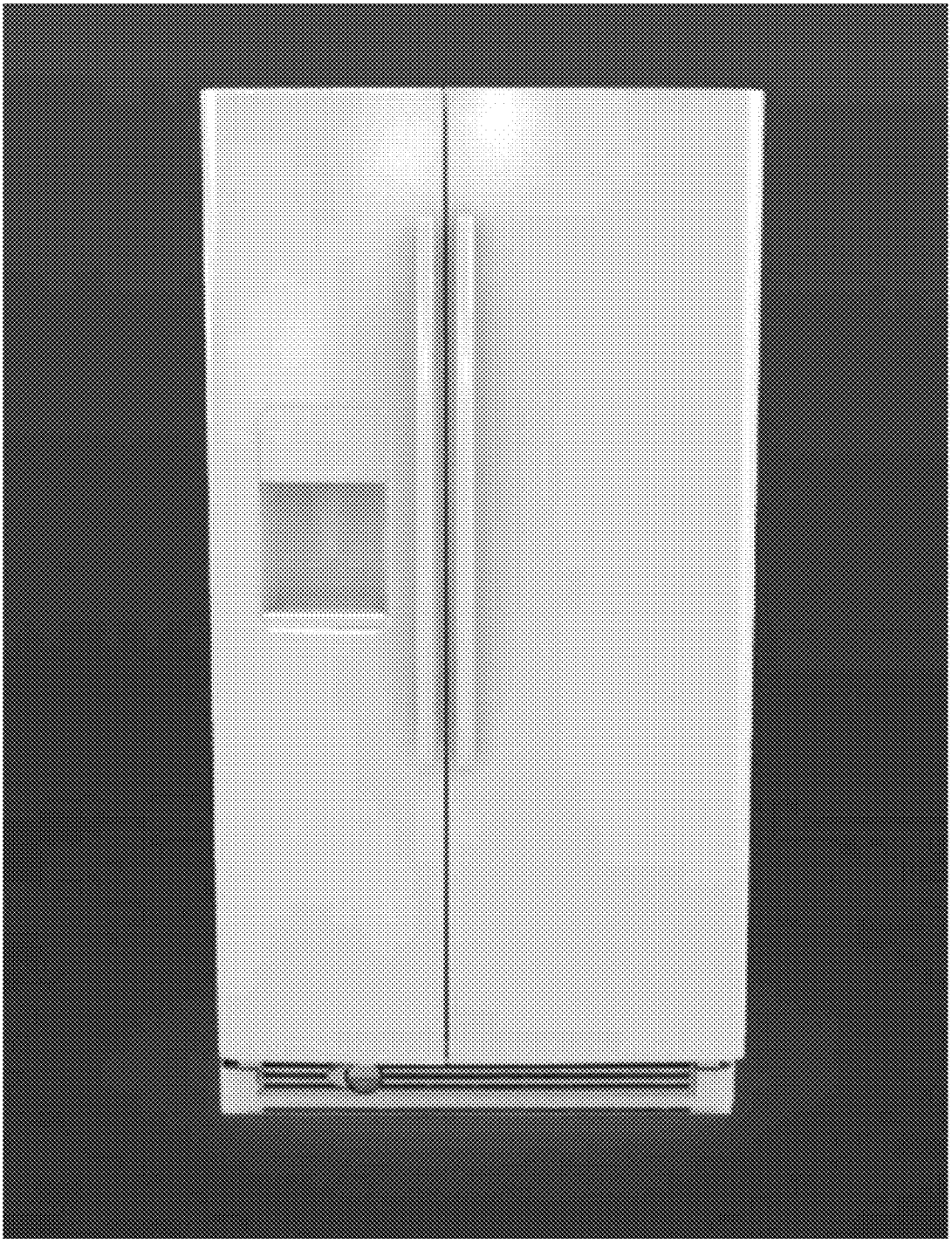
FIGS. 15A-Q are a sequence of photos illustrating still further exemplary embodiment according to the present invention; a plural lighting feature set for staged, dynamic lighting of the interior of a refrigerator.
Figure 15B:
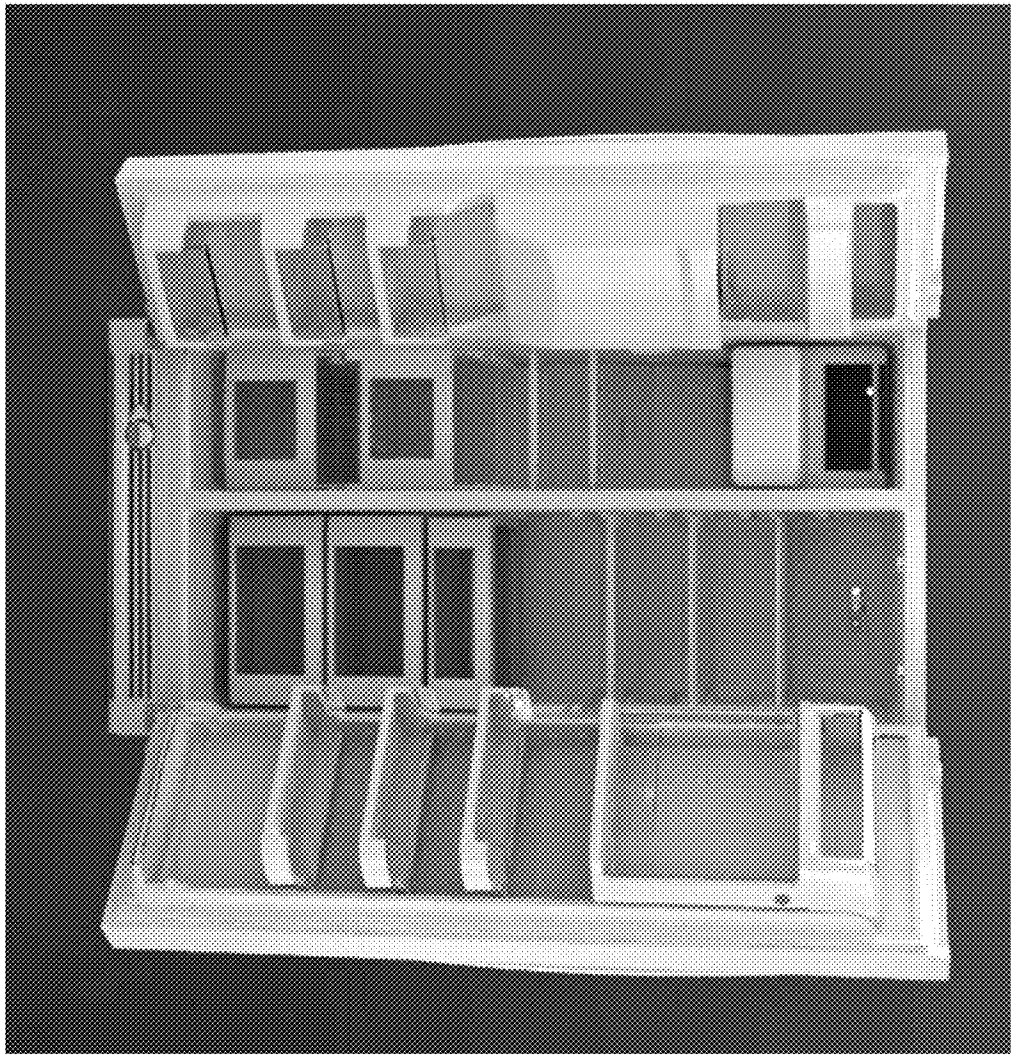
FIG. 15R is a diagrammatic perspective view of a refrigerator and lighting subassemblies that could be used with the lighting effects of FIGS. 15A-Q.
FIG. 15S is an isolated perspective view of an ice compartment of refrigerator of FIG. 15R.
FIG. 15T is an enlarged diagrammatic and block diagram view of a decal lighting system and scheme useful with the embodiment of FIGS. 15A-Q.
FIG. 15U is a control loop algorithm that could be used with the dynamic lighting scheme of FIGS. 15A-Q.
Figure 15C:
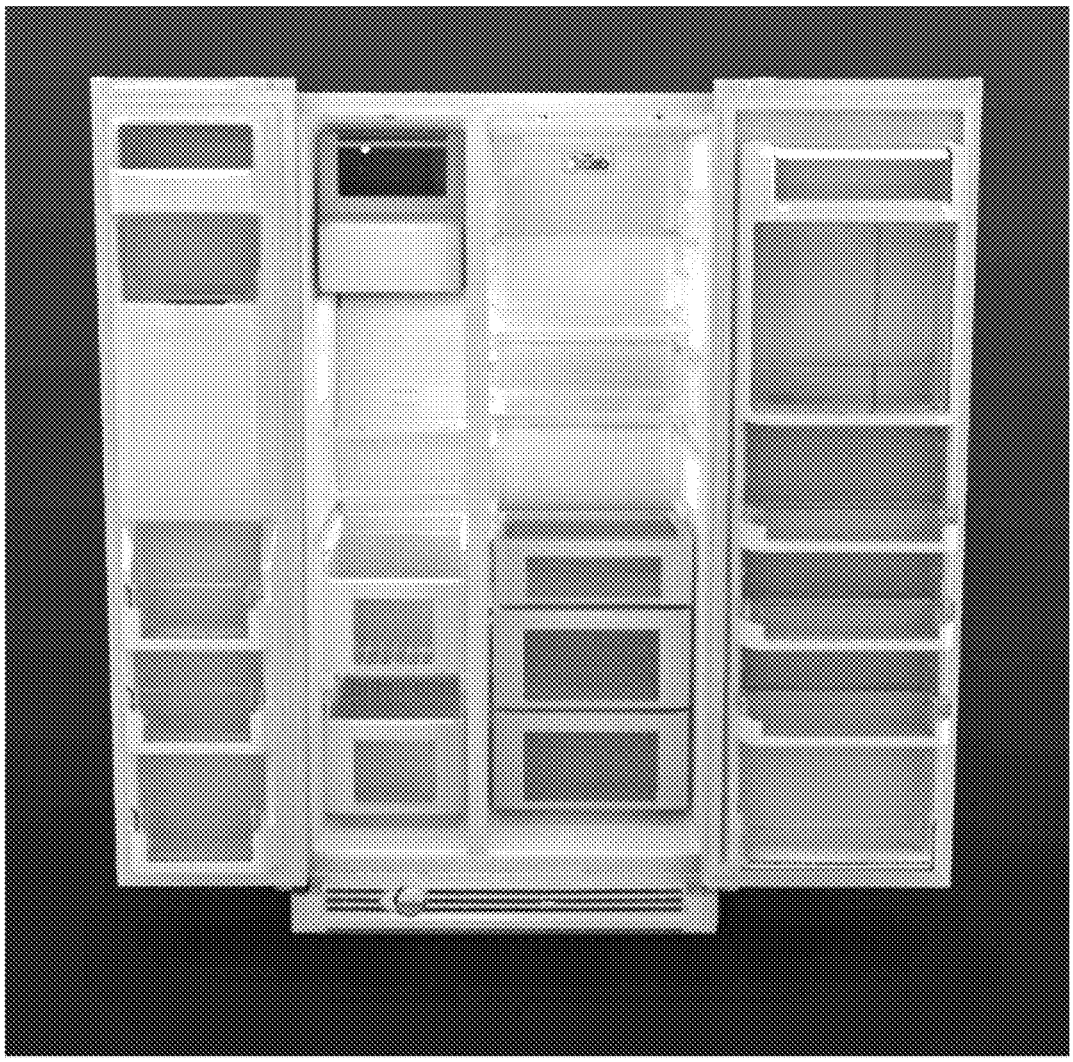
Figure 15D:
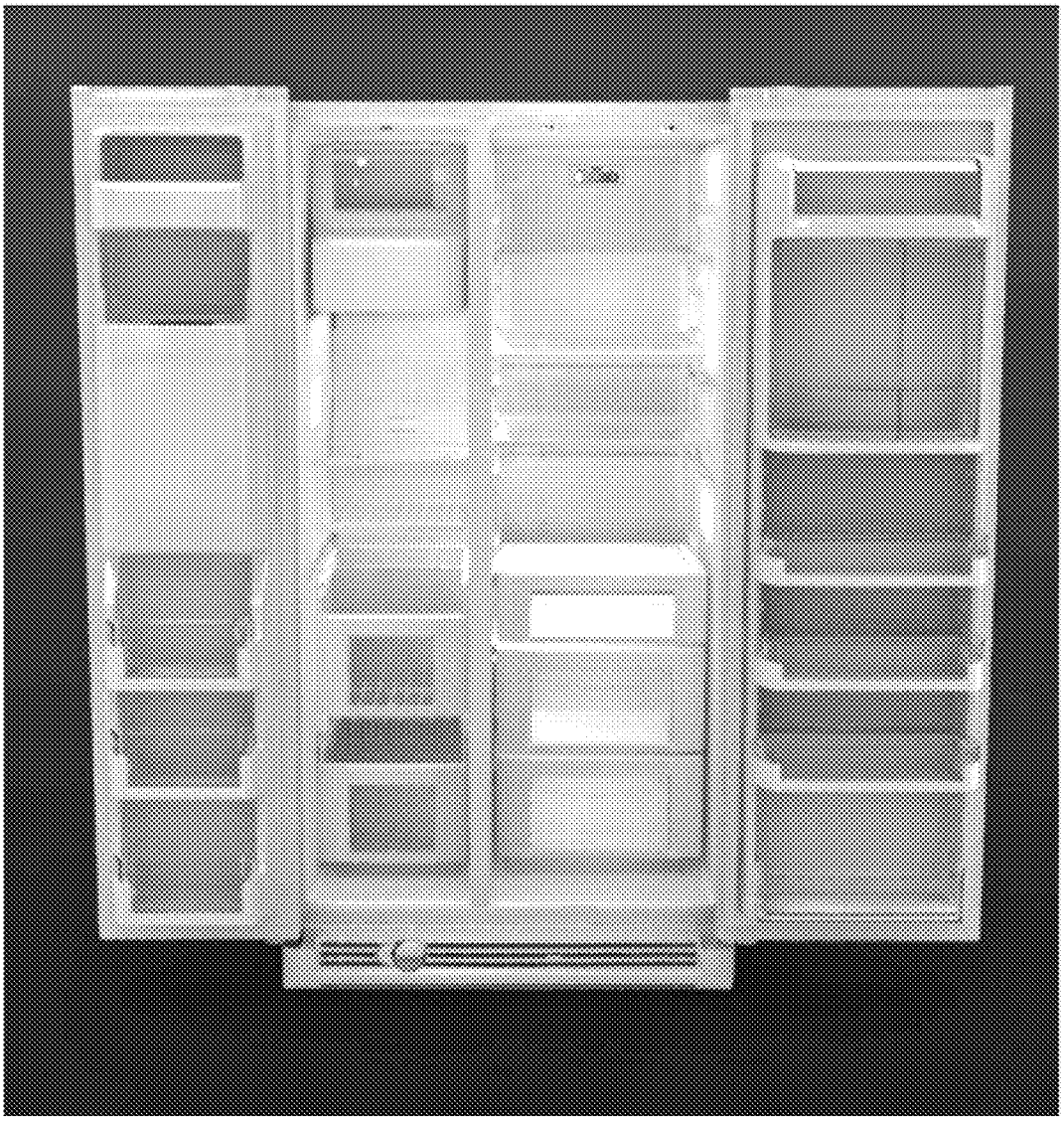
Figure 15E:
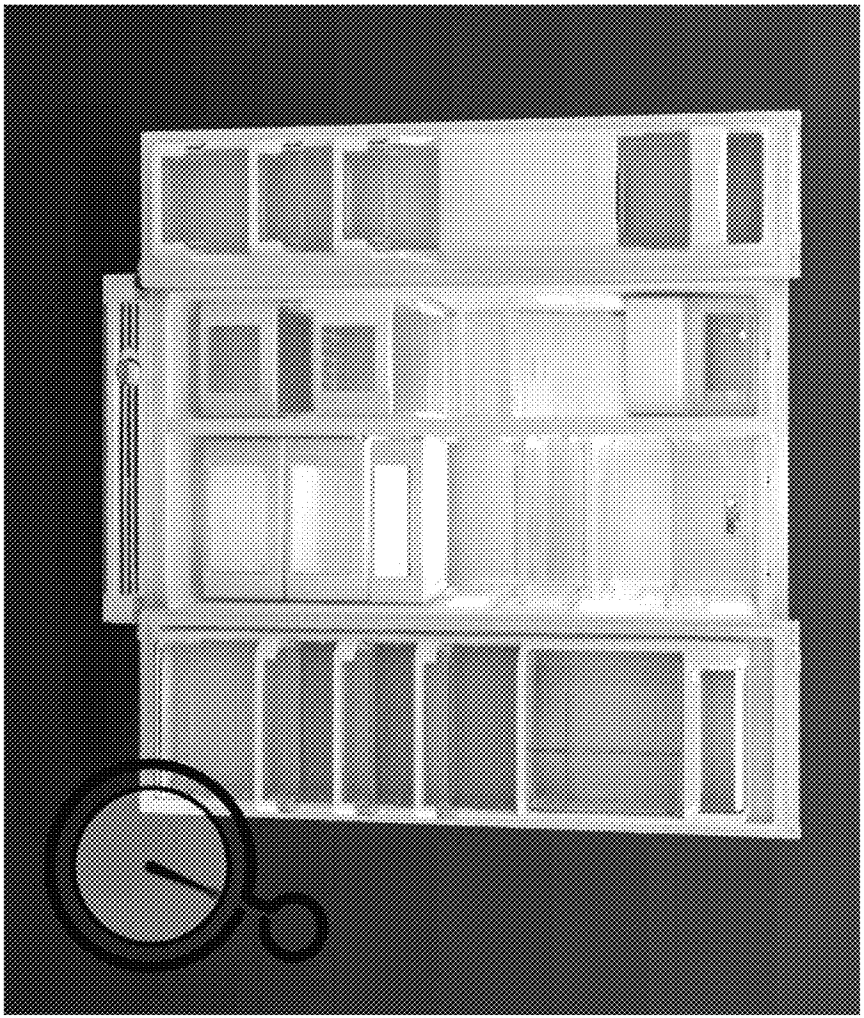
Figure 15F:
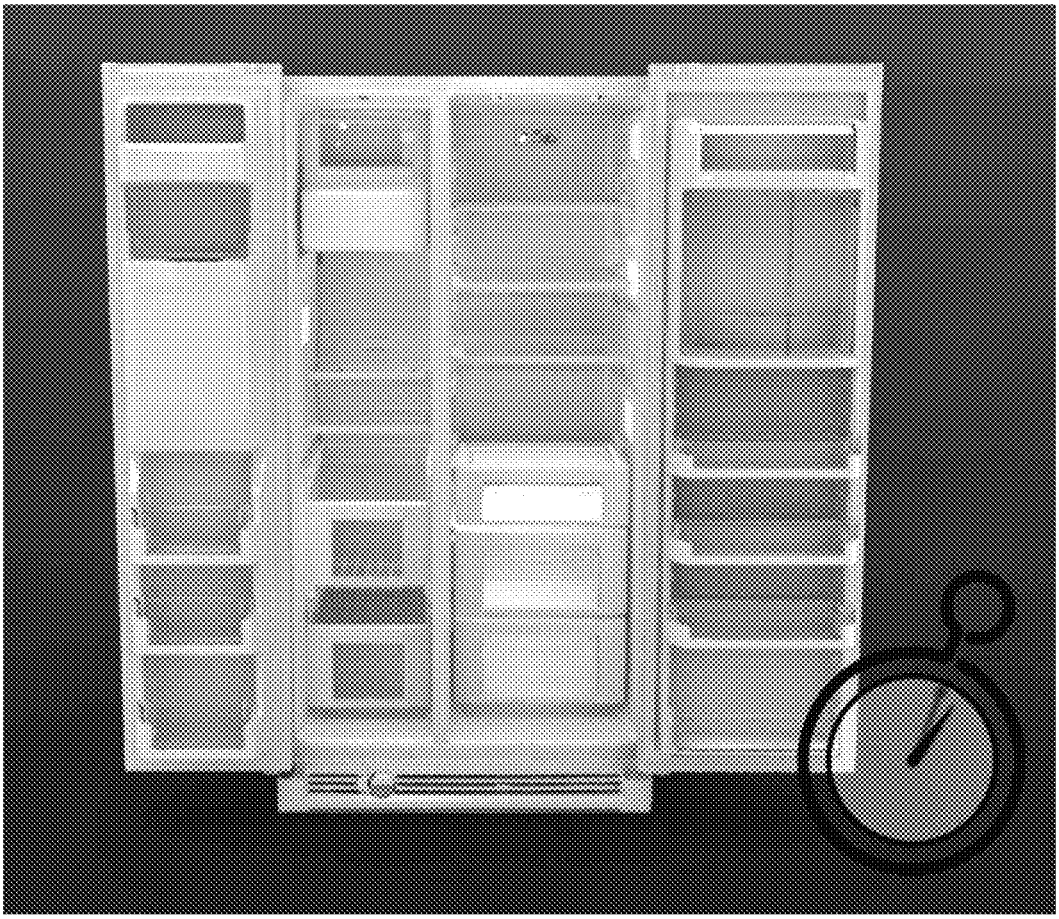
Figure 15G:
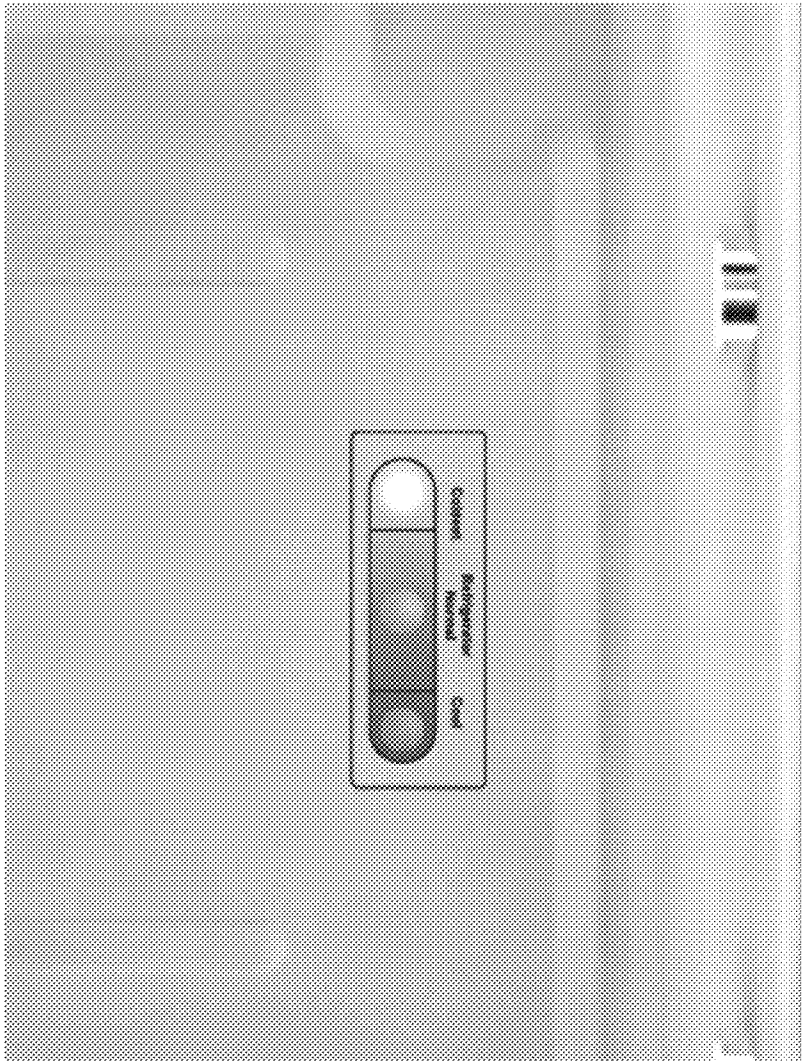
Figure 15H:
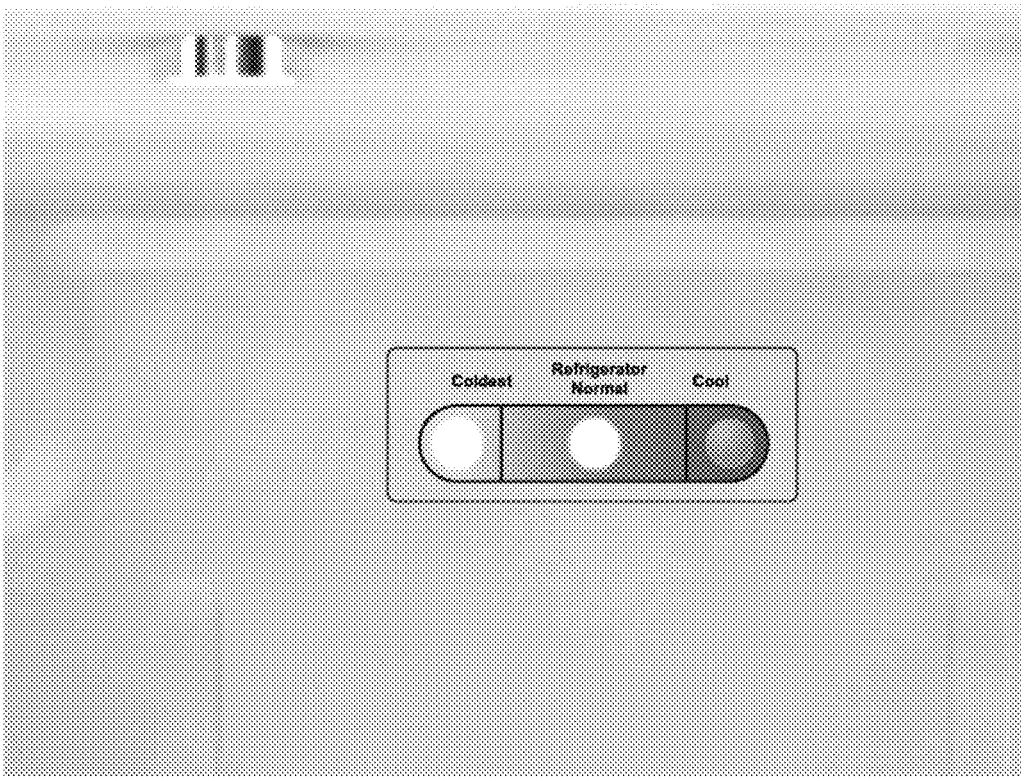
Figure 15I:
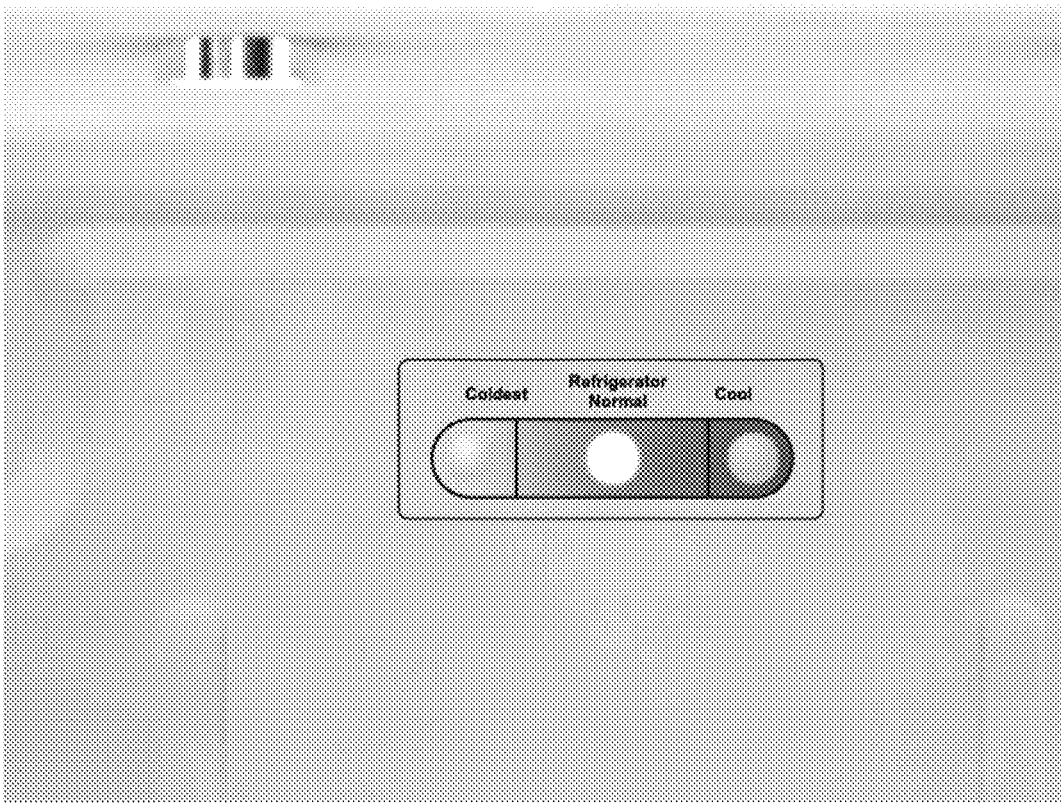
Figure 15J:
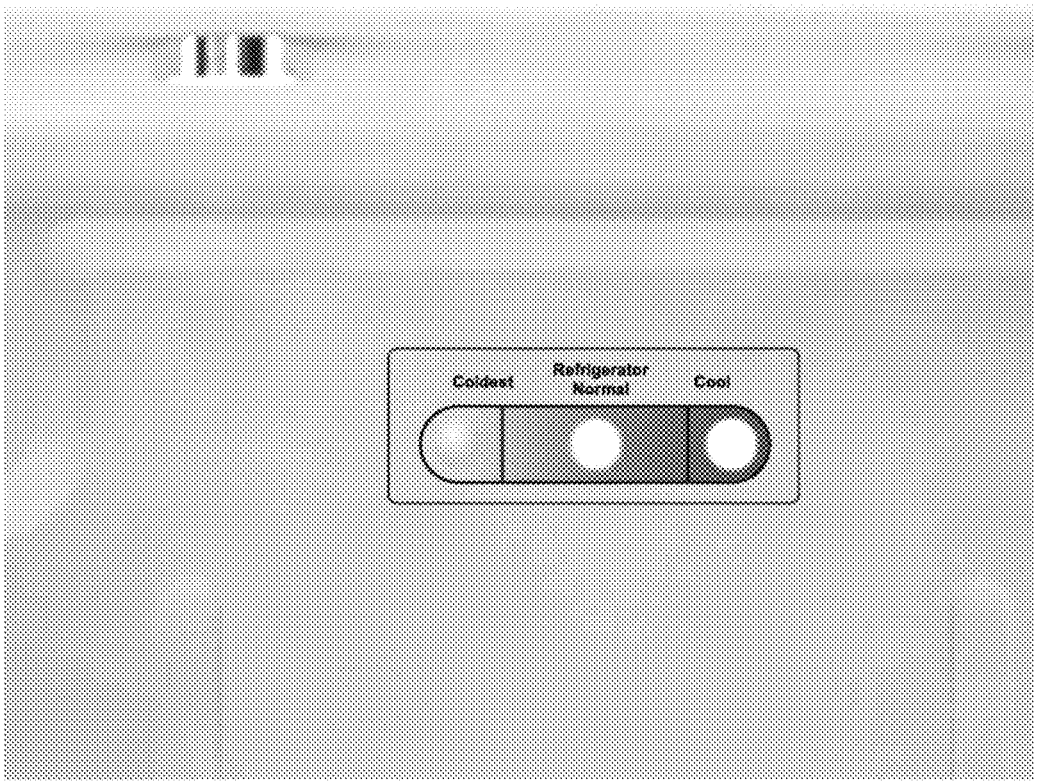
Figure 15K:
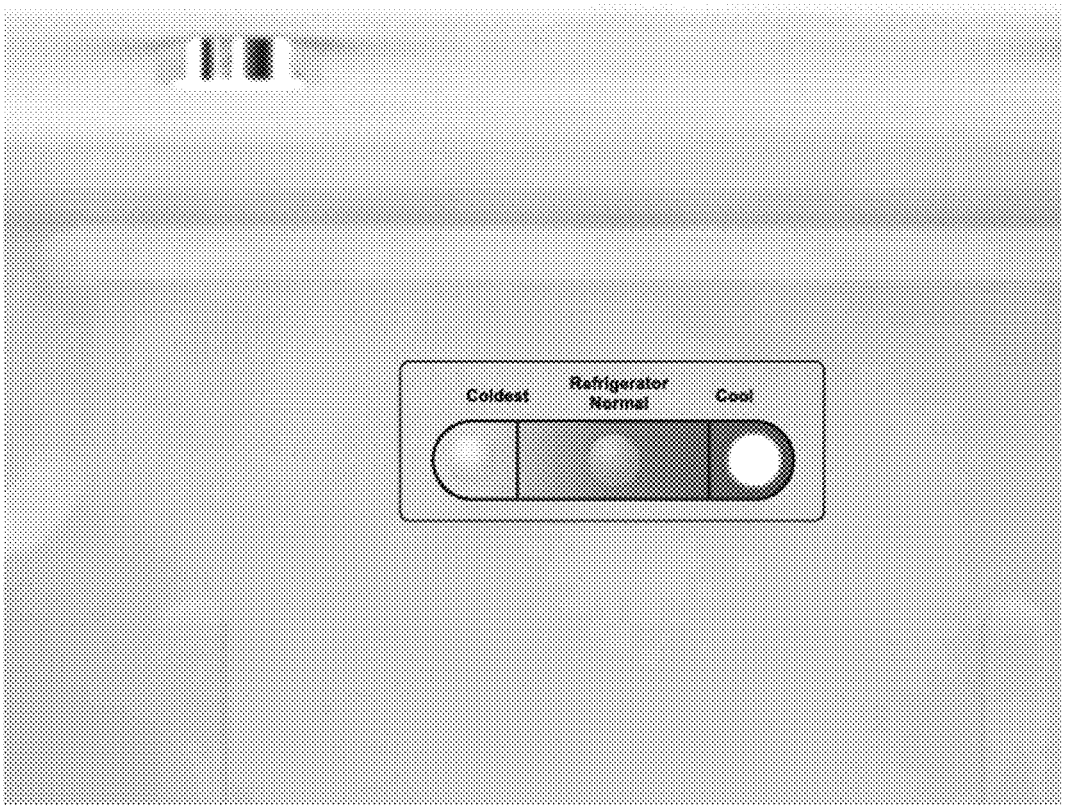
Figure 15L:
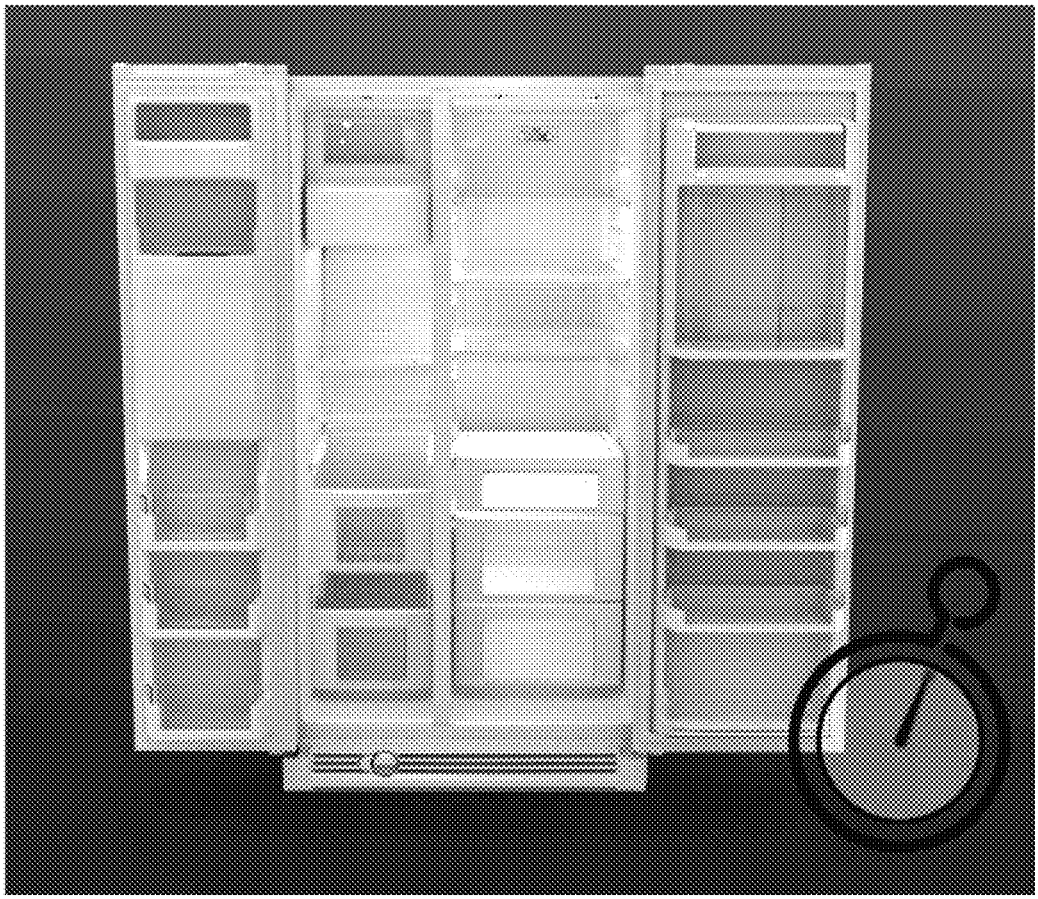
Figure 15M:
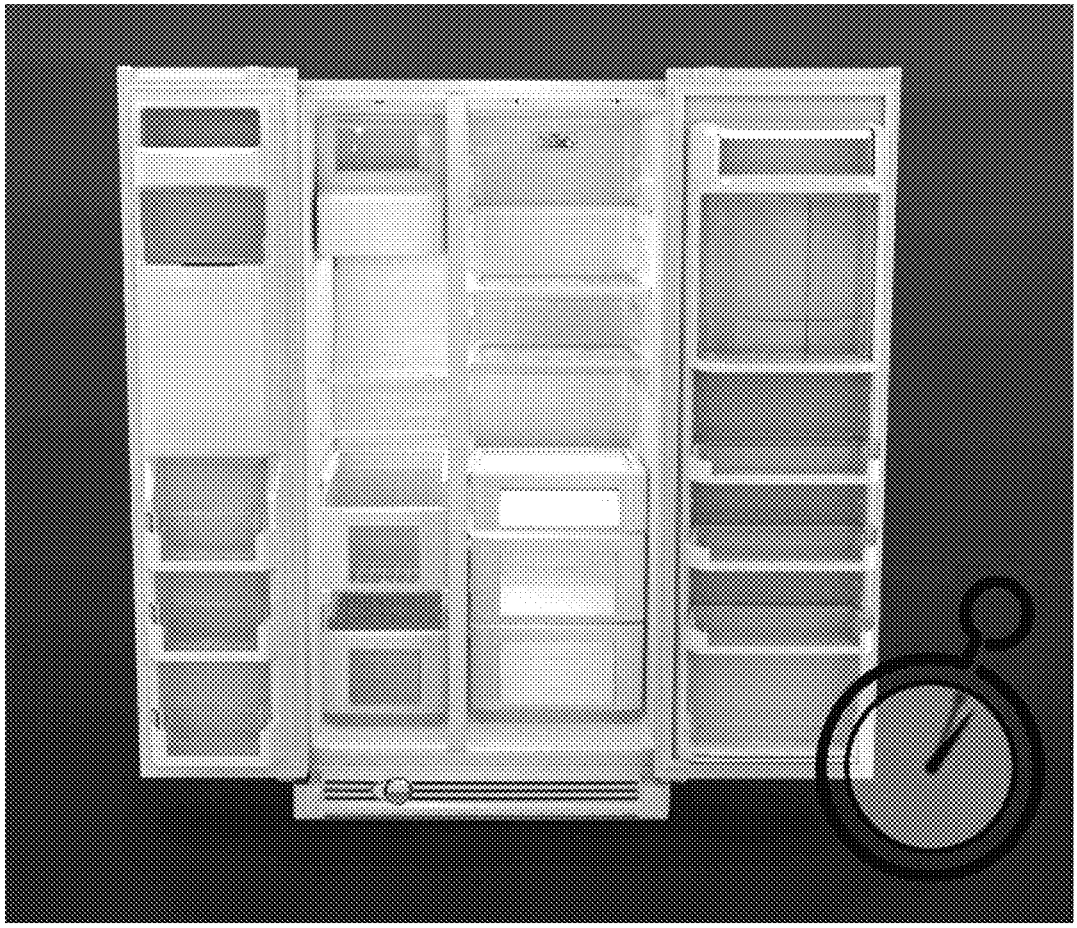
Figure 15N:
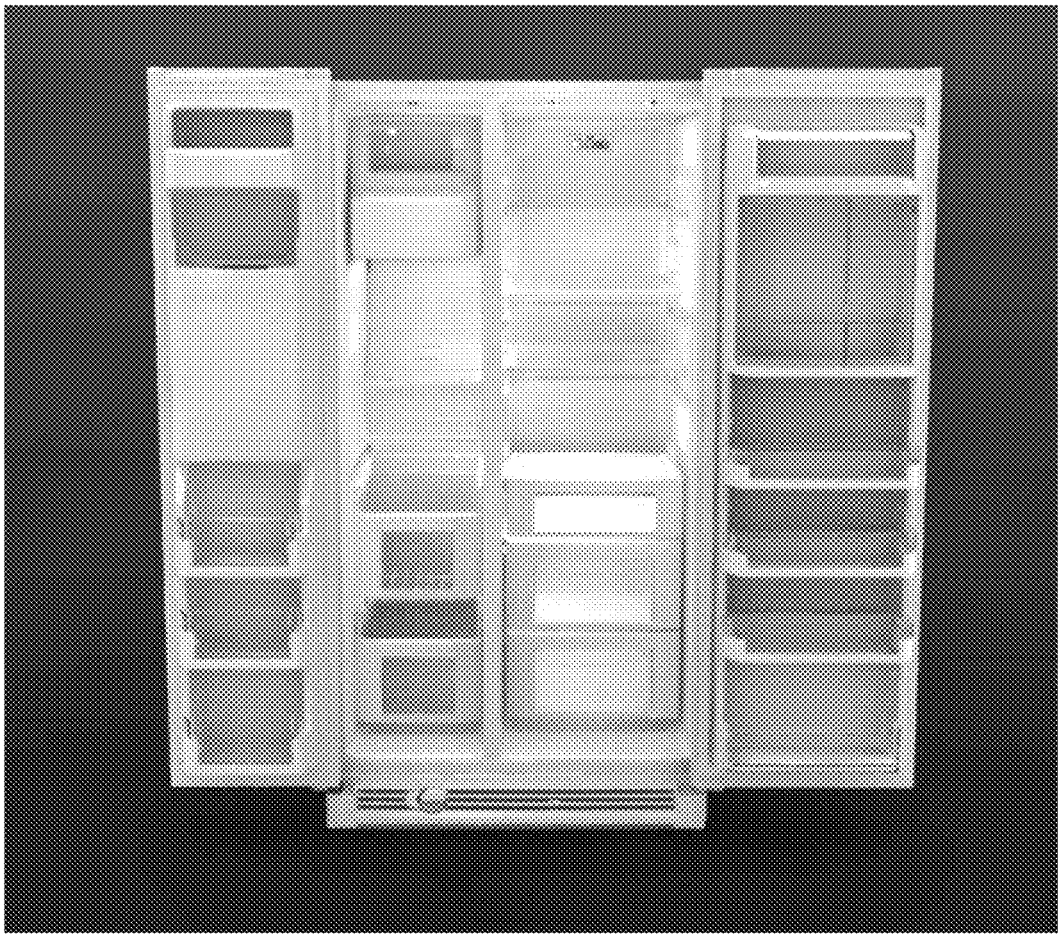
Figure 150:
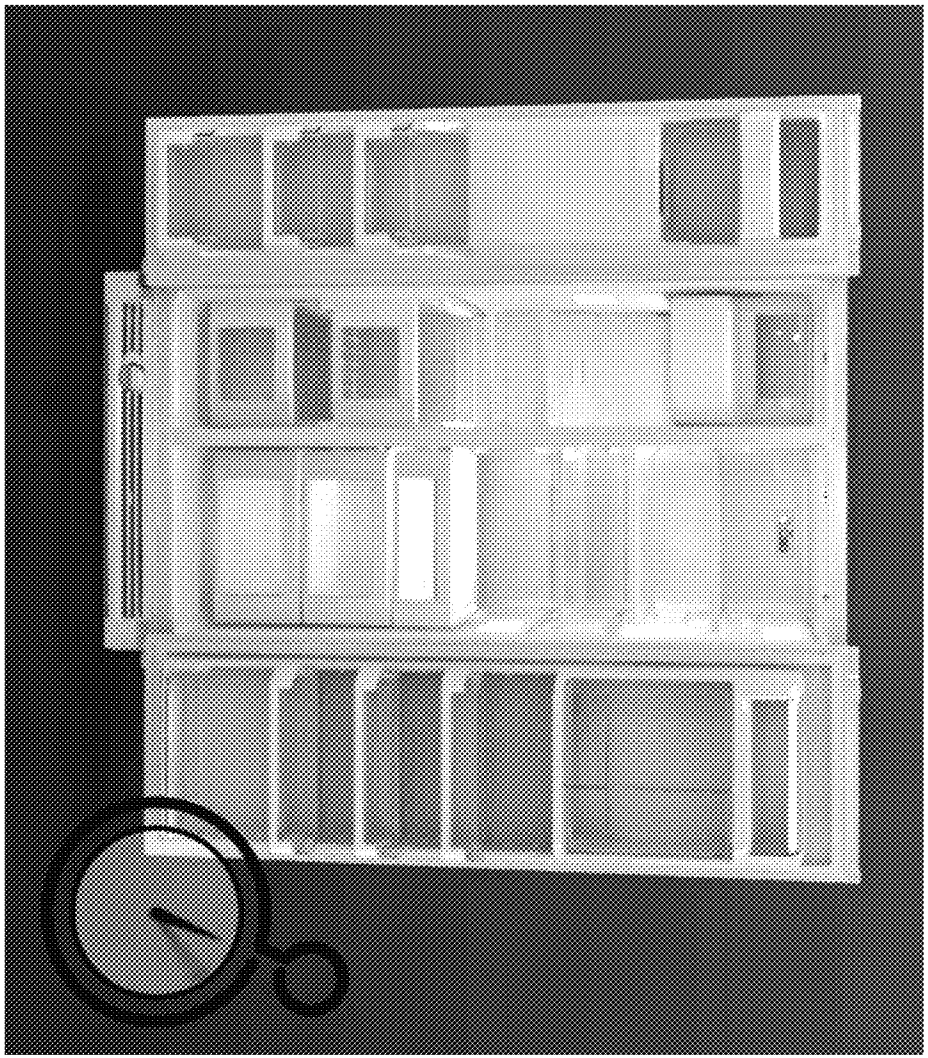
Figure 15P:
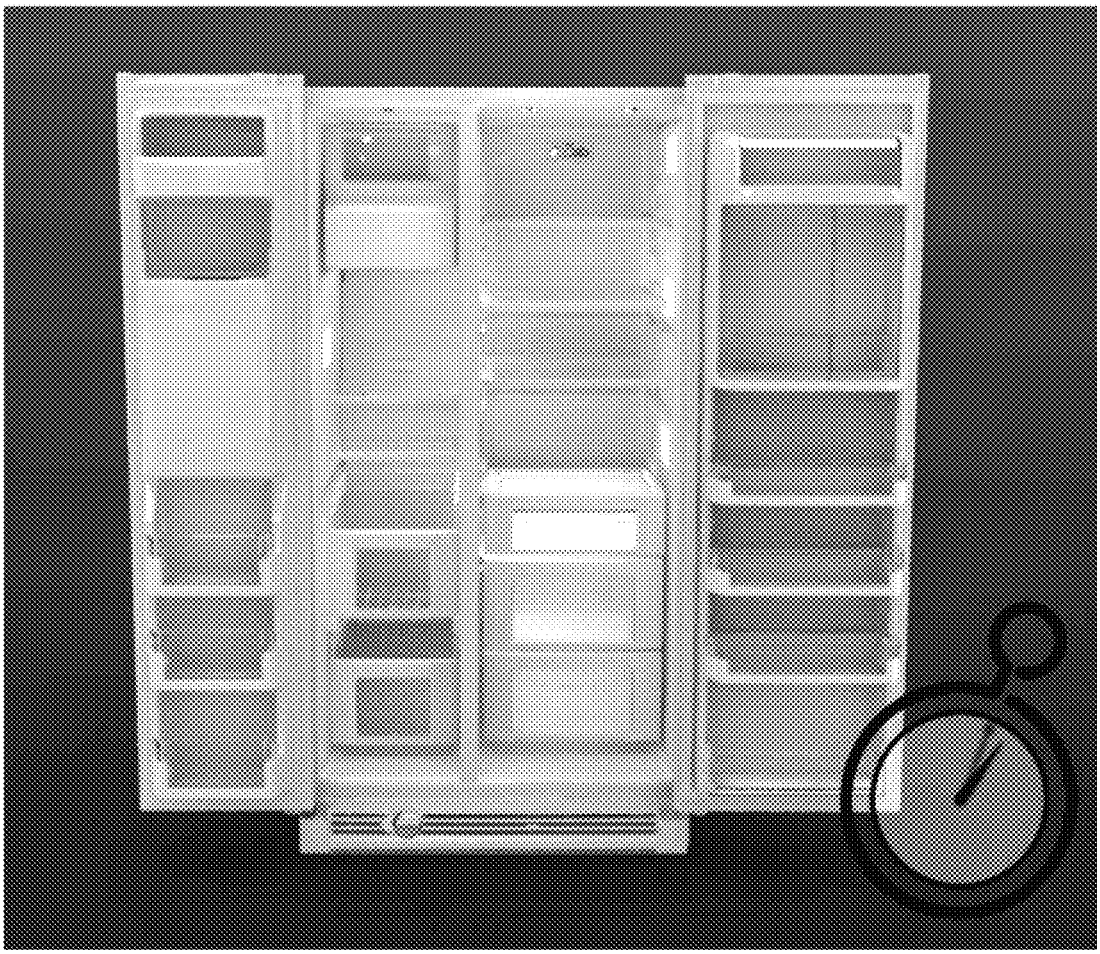
Figure 15Q:
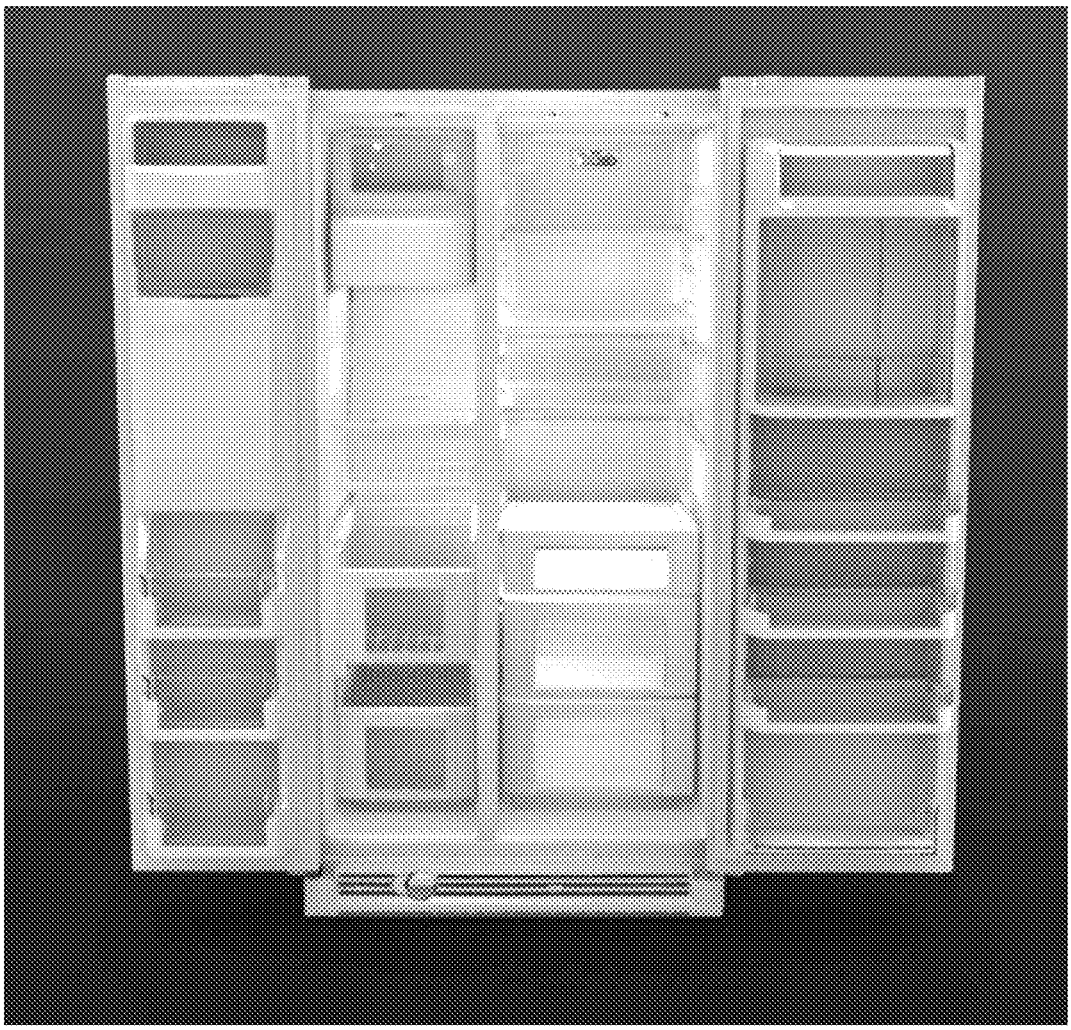

A more complex multi-stage lighting scheme for interior lighting of the refrigerator is shown in the photographs of FIGS. 15A-Q. As can be appreciated, one or more of the lighting stages or events can be utilized. Their order can be changed, or a subset of them can be utilized. They can also be interchanged or added to other lighting effects.

In a normal state (FIG. 15A) both refrigerator doors are closed. No lighting scheme interiorly is commenced.

When either door is opened, in controller 20 triggers a first lighting event or plural events by sensing the door is open. In the case of opening the freezer door (FIG. 15B) one or more blue LEDs are switched on in the ice compartment (e.g., ice compartment 17 of FIG. 1B) in the upper left hand portion of the freezer. This provides a soft blue glow from the window into ice compartment 17.

In the case of opening the fresh food door, the upper right hand part of the right side of the cabinet (the fresh food compartment) a decal along the top rear liner wall has a backlit plate or light transmissive plate and three round indicators. LEDs behind the decal can light certain indicators and backlight the plate according to temperature sensors monitoring temperature of the fresh food compartment, as will be further described later. This lighting scheme highlights the cold (sub-freezing) ice compartment 17 with a blue glow, and the decal lighting informs the user of the general temperature in the fresh food compartment.

If either or both doors are opened for longer than a certain time (monitored by a timer 21 and controller 20), several sets of white LEDs are turned on to illuminate the shelf areas of either or both freezer and the fresh food compartment (FIG. 15C).

If either door remains opened even longer, further white light LEDs can be turned on to illuminate one or more drawers or bins in a respective freezer and/or fresh food compartment (here just the fresh food bins are illuminated by dedicated LED arrays in each). Additionally, more or brighter blue illumination can be instructed at ice compartment 17 (FIG. 15D).

A timing algorithm (e.g. by timer 21 of controller 20 indicated diagrammatically in FIG. 15E) can then start (the diagrammatic clock is at zero seconds).

After the end of that time period (for example 50 seconds) one or more of the interior white LED arrays could increase in intensity or start to flicker or flash (FIG. 15F). This can indicate to the user the doors have been opened for a substantial amount of time. The flickering would continue until the user closes the doors. There could be selective lighting of any of the shelves based on proximity sensing, (e.g., if the user reaches to a specific shelf (not shown)).

FIGS. 15G, H, and I illustrate what could happen regarding the decal lighting if the doors are left opened for a substantial time.

In FIG. 15G, when the door is first opened, backlighting of the decal is white to the left (indicating "coldest"), blue in the middle (indicating "normal") and red to the right (indicating "cool"). The circular indicator under the term "coldest" is lit up. This tells the user the fresh food compartment is at a colder and of a temperature range for the compartment. The longer the door remains open, the temperature would try to equalize with ambient temperature and start to rise. FIG. 15H shows the middle light would become illuminated (both left and middle lights are illuminated) to indicate temperature is moving up the range.

FIGS. 15I and J illustrate how this can continue with first the middle circle alone being illuminated, then the middle and the right. Finally, in FIG. 15K it can move all the way to the right indicating that temperature is now on the higher side of the range than when the door was first opened. This gives the user an immediate lighting effect that informs the user of the temperature condition present in the compartment.

As can be appreciated, the lights can at any time flash or flicker for more attention by the user or the lights can change the color or the backlighting of the decal could change color according to temperature. In other words, backlighting or the illuminated circles could go from blue to white to red.

FIGS. 15L and M show as still further feature. If a door remains open for a still longer period of time (see diagrammatic view of timer starting at FIG. 15L and then expiring at 15M), white lighting in all or a part of the fresh food compartment could be changed to red. It could also flicker to let the customer know that there is some problem regarding temperature inside the cabinet.

FIGS. 15N-O illustrate other possible lighting effects. For example, the combination of lighting shown in FIG. 15N (blue ice compartment, decal, shelves and bins lit) could be displayed and a timer started (FIG. 15O). At the end of a pre-set or selected period (e.g., 1 minute), one or more of the lights could (a) change intensity, (b) flash, or (c) otherwise change (compare FIGS. 15R and 15Q).

Figure 15R:
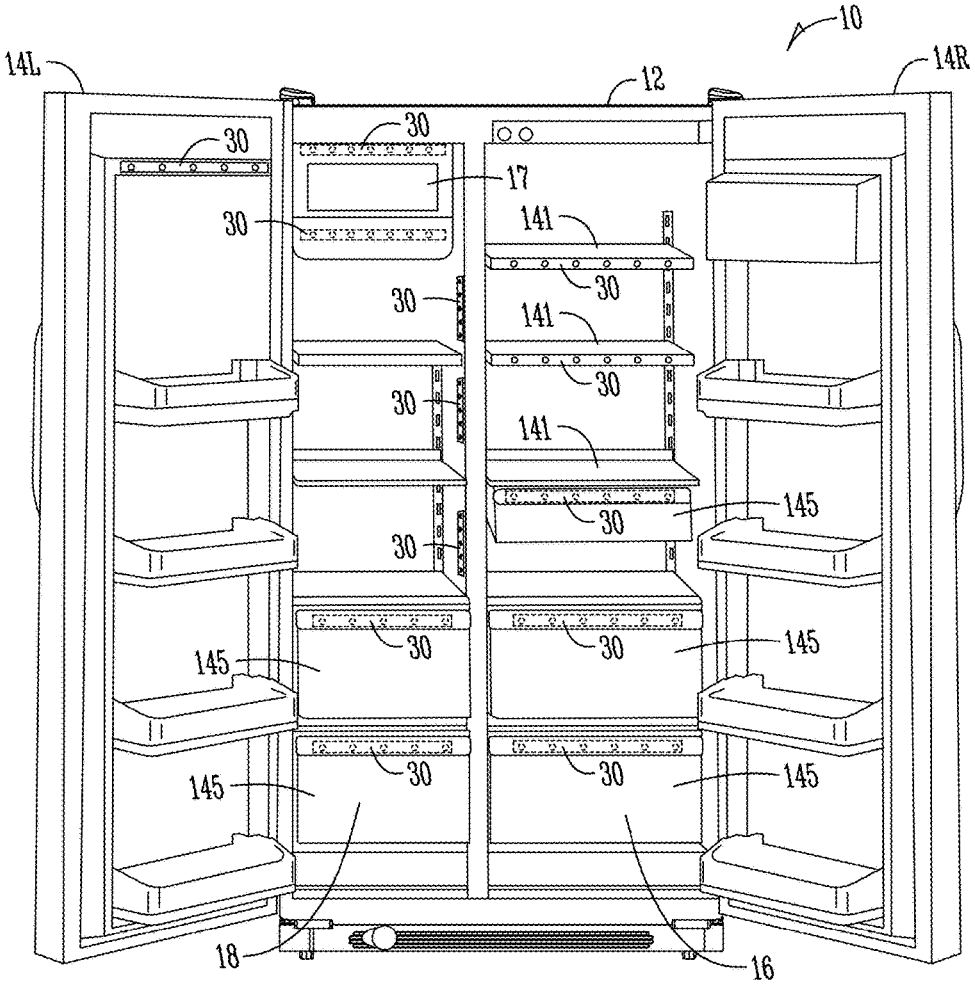

FIGS. 15R, S, and T diagrammatically show how various sets of LED arrays 30 could be placed relative to shelves 141 and drawers 145, or even on the inside of doors 14 of cabinet 12. Also LED arrays 30 could be placed inside of the cabinet liner and either extends outside of the plane of the liner so that their light output can illuminate the cabinet interior, or have some sort of light transmissive cover for protection.

Figure 15S:
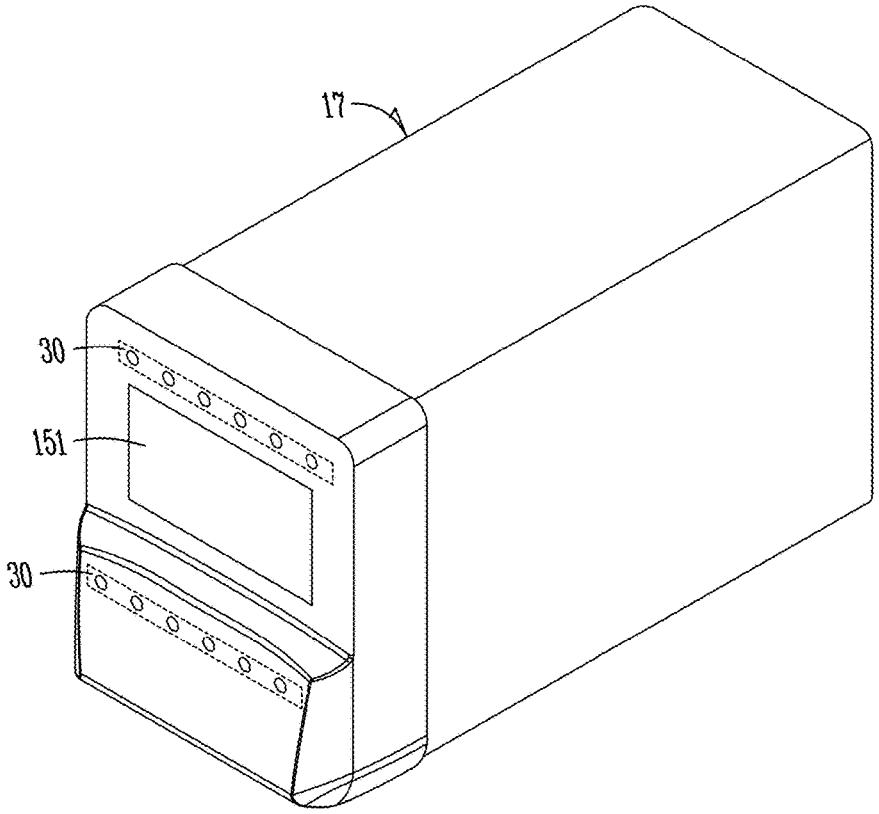

FIG. 15S illustrates how one or more LED arrays 30 could be placed in the ice compartment 17 such that turning them on could allow glow out of window 151. Having two or more LED arrays 30 could allow first set to be turned on to create a glow out of window 151 in a second set to provide greatly increased intensity.

Figure 15T:
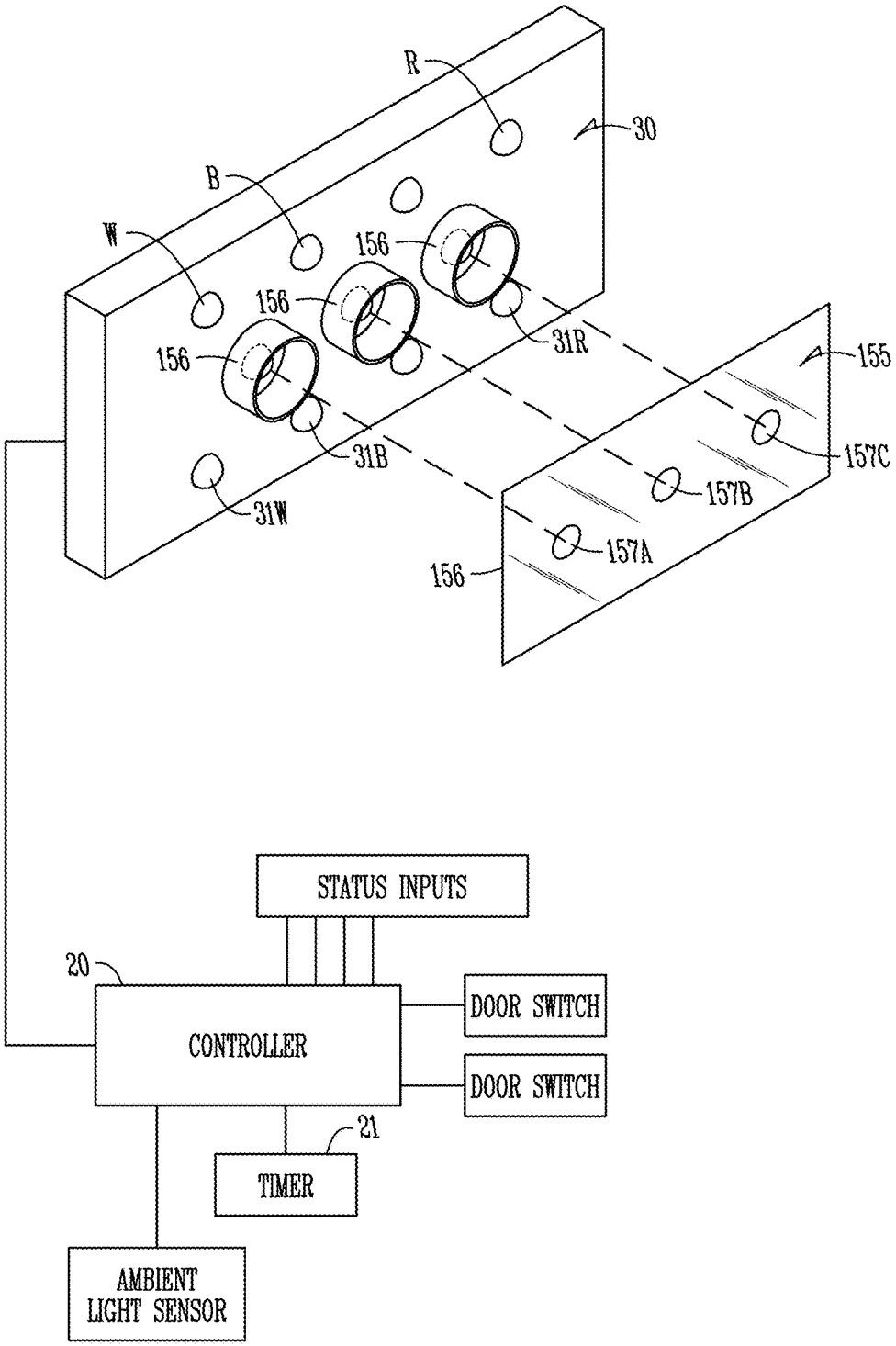

FIG. 15T illustrates diagrammatically how decal 155 could be illuminated. Light transmissive plate 156 could have the three light transmissive circles 157A, B and C and be placed on the cabinet liner. Behind that could be a printed circuit board 30 with multiple LEDs 31 of different colors (R is red, W is white, B is blue). Three of those LEDs could have a circular hood or visor 156 around them to direct light to the circles 157A-C.

In that manner, various inputs to controller 20 (in this case temperature inputs) could inform controller 20 how to backlight plate 156 and light up different openings 157A-C on board 30. As can be appreciated by those skilled in the art, as indicated with the examples in FIG. 1D, controller 20 can take any number of inputs and utilize them to trigger lighting effects. This could be from monitoring states of the appliance, switches related to the appliance, timers, and sensors. Those sensors could include but are not limited to sensors regarding proximity, temperature, chemical content in the air, light levels, sound, touch, to name a few.

Figure 15U:
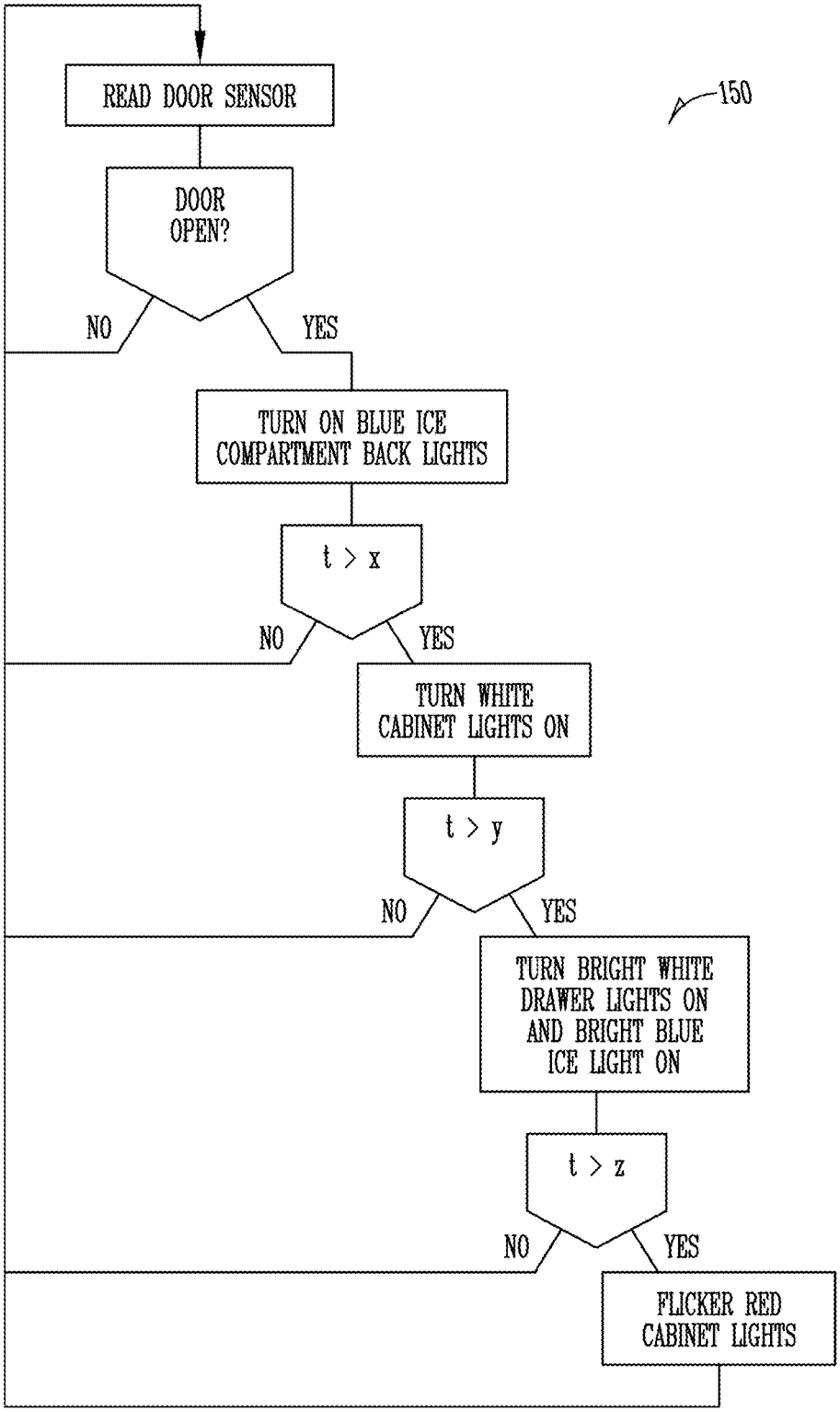

FIG. 15U illustrates one dynamic lighting control loop 150 that could be used with this embodiment.

Embodiment 16

Figure 16A:
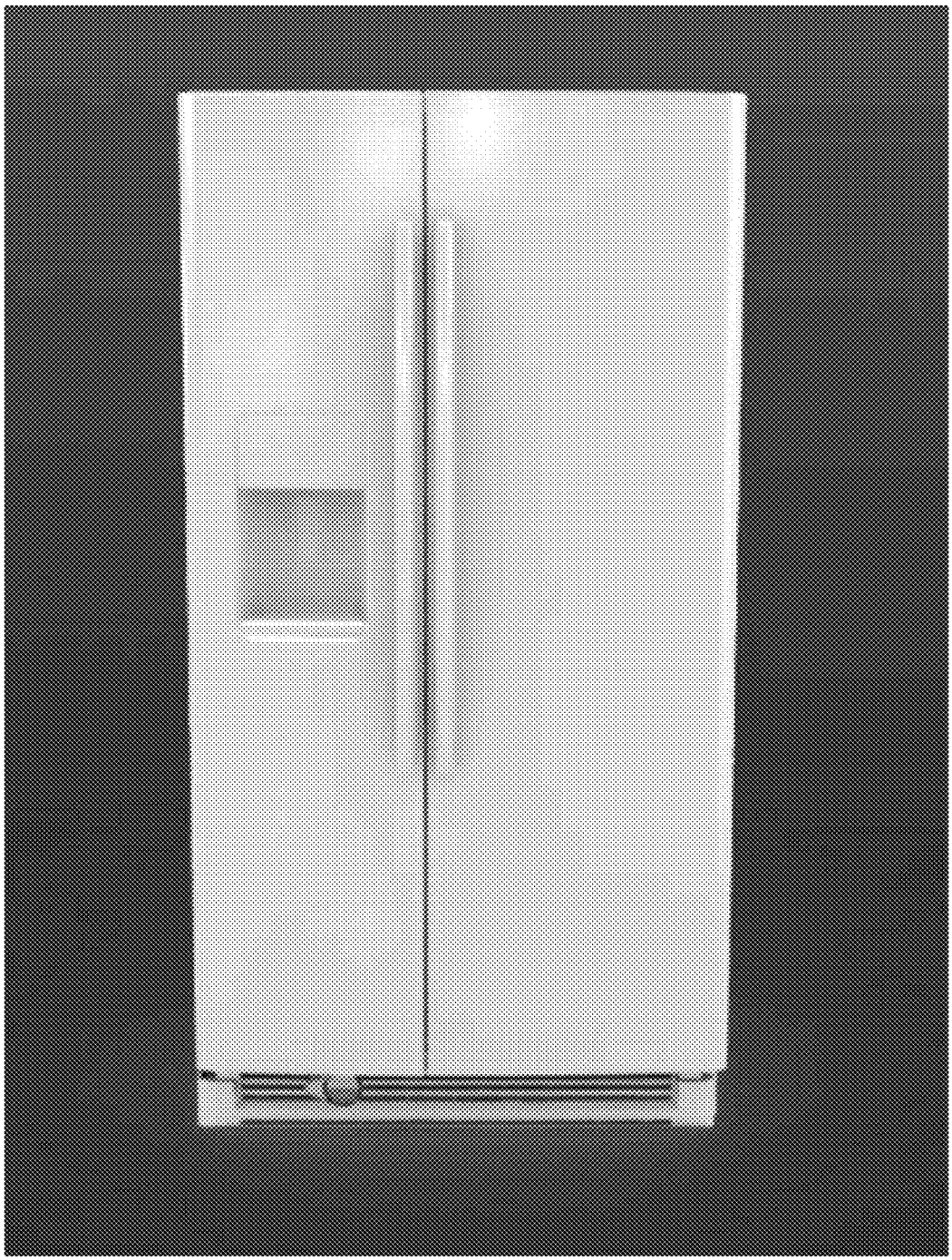
FIGS. 16A-O are a sequence of photos illustrating another exemplary embodiment of a stage, dynamic lighting scheme according to the present invention.

FIGS. 16A-O illustrate a similar sequence of lighting events that could be pre-programmed for a refrigerator 10.

Figure 16B:
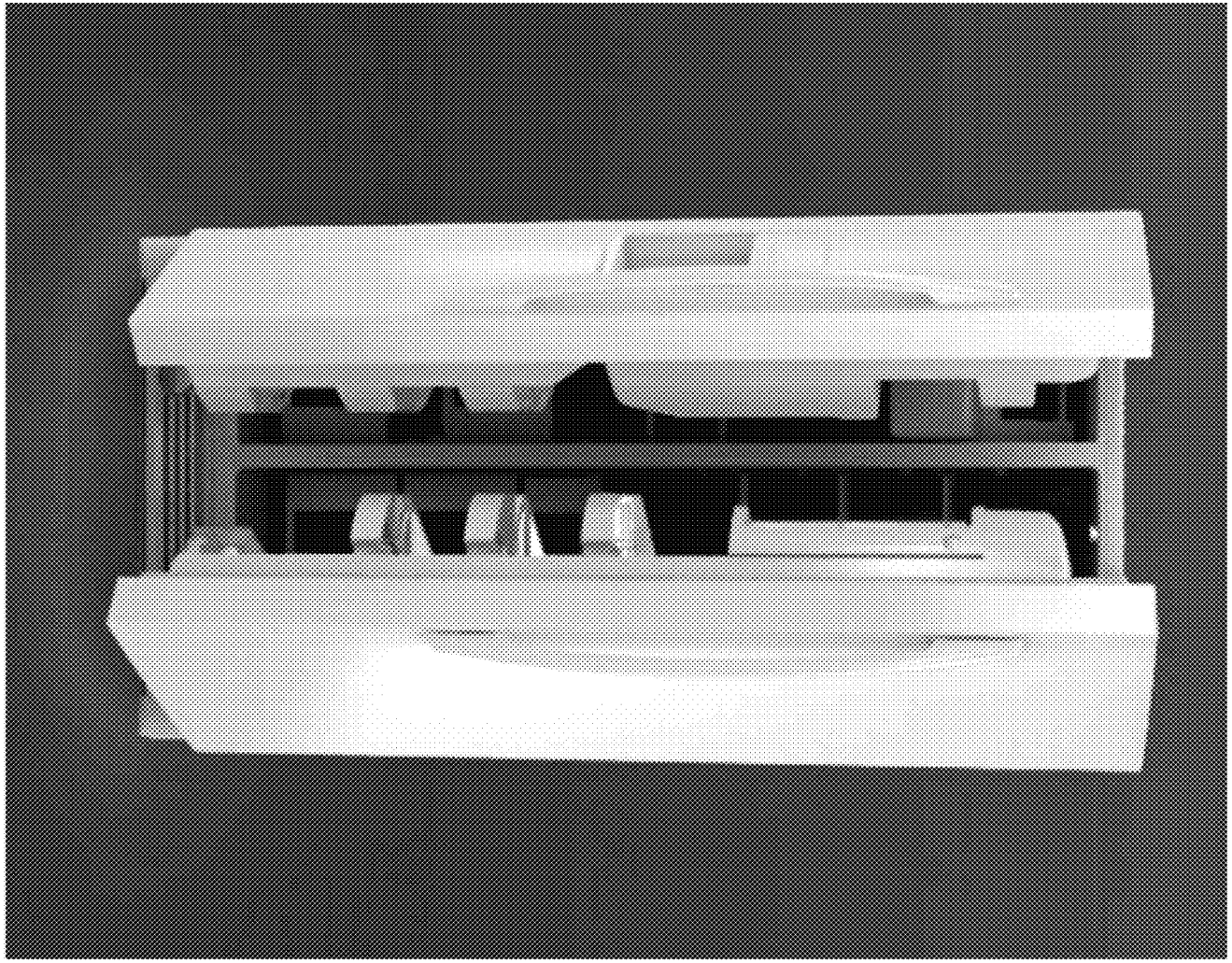
FIG. 16P is a control loop algorithm that could be used for the lighting scheme of FIGS. 16A-O.

In this embodiment, called reaction lighting, the events occur as follows. In low ambient lighting (night time or lights off in the room) and doors closed to an appliance, no interior lighting effects are instigated. External lighting events could be triggered or not. See FIG. 16A. If one or both appliance doors are opened, no internal lighting effects are commenced to save energy (FIG. 16B). However, when one or both doors are sensed sufficiently opened, interior lighting effects can be instigated in reaction to certain triggers.

Figure 16C:
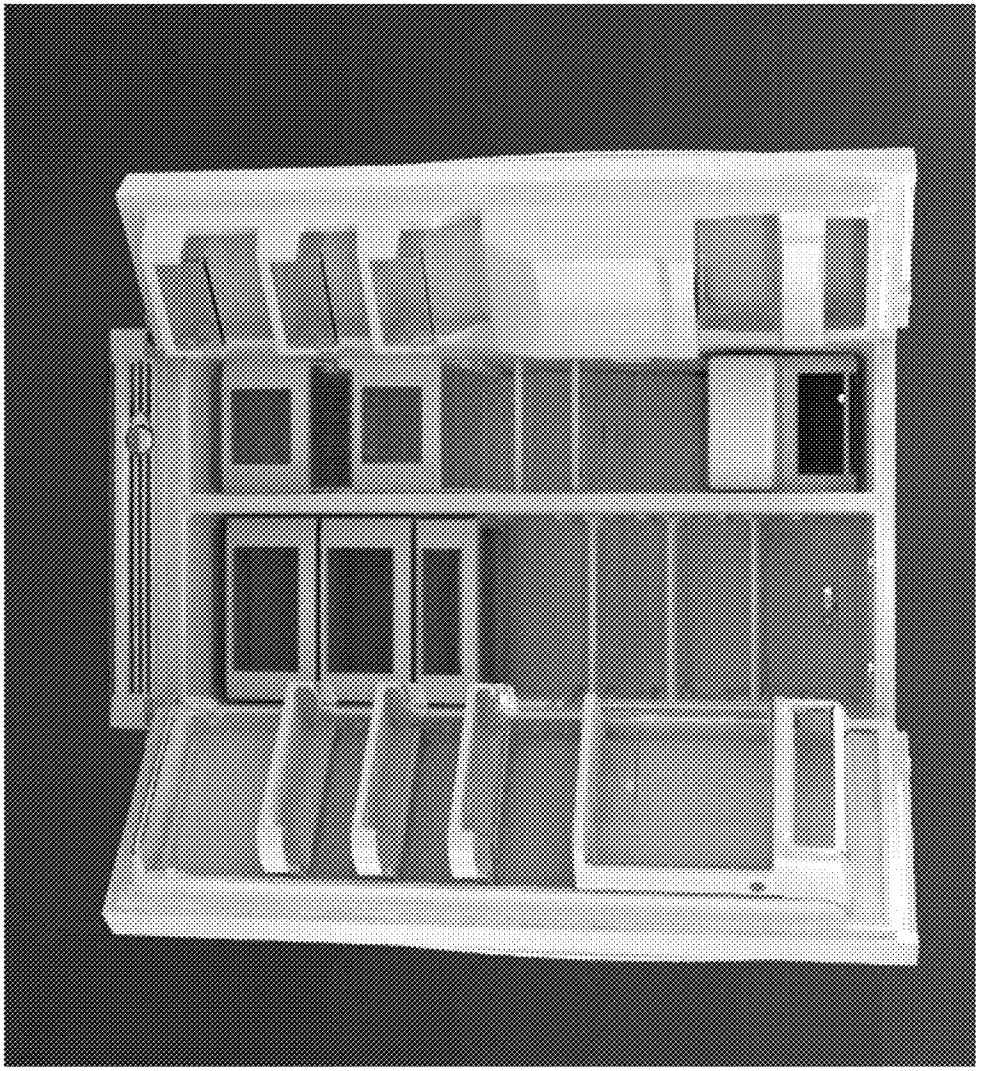

For example, the state of one or more of the appliance doors being sufficiently open can be sensed by switches or other devices and an initial lighting effect or effects automatically actuated in reaction to one or more doors being opened. An example would be FIG. 16C where a soft low intensity blue glow in the ice compartment is commenced and the decal temperature bar in the upper right hand back wall of the fresh food compartment is illuminated to inform the user of temperature in that compartment.

Figure 16D:
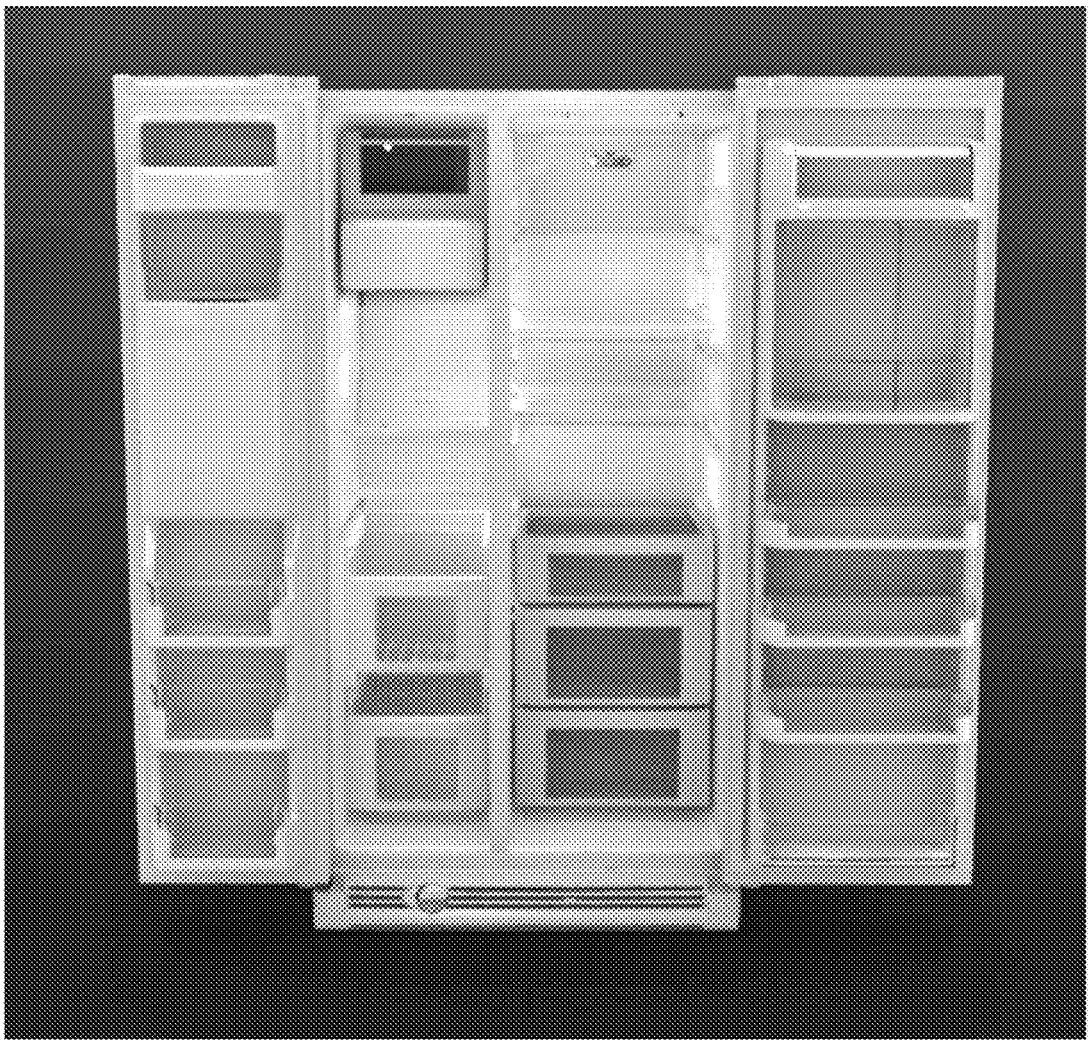
Figure 16E:
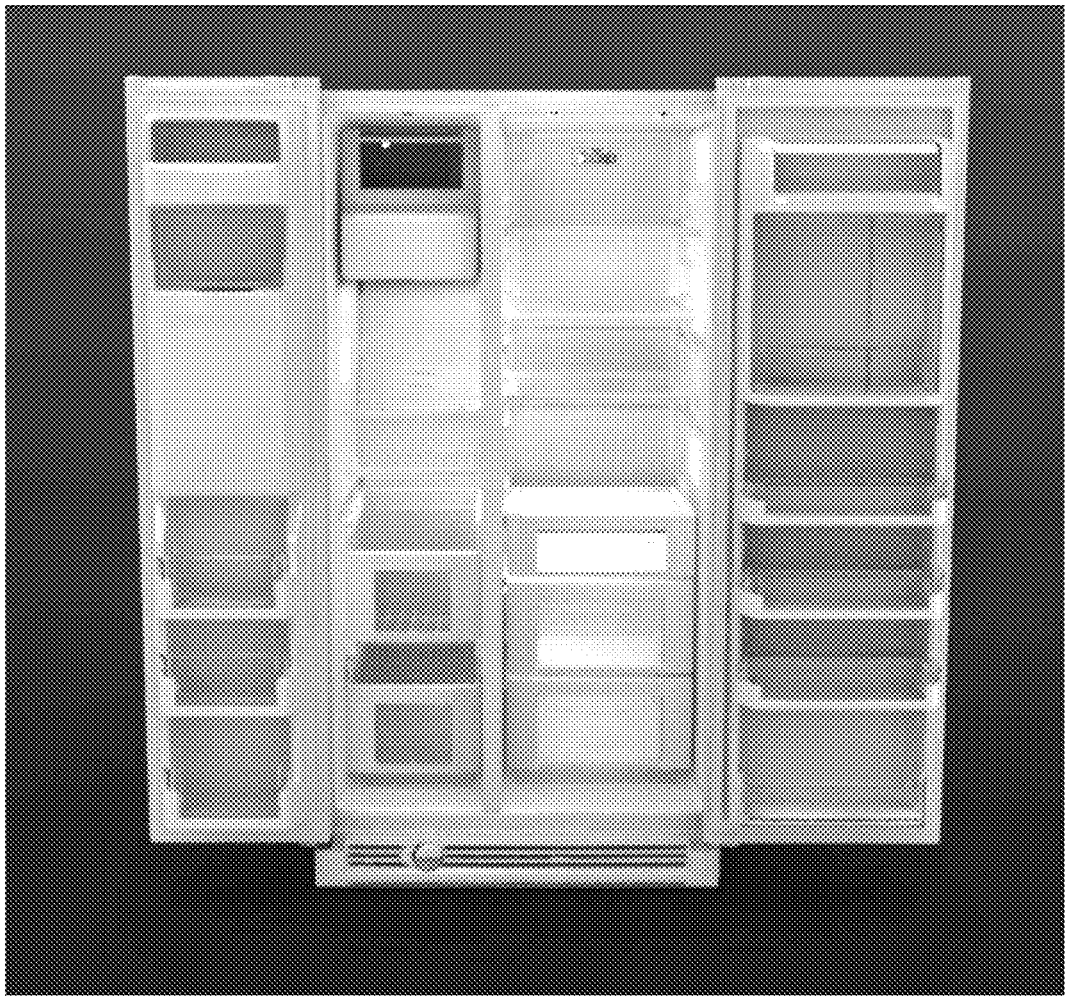
Figure 16F:
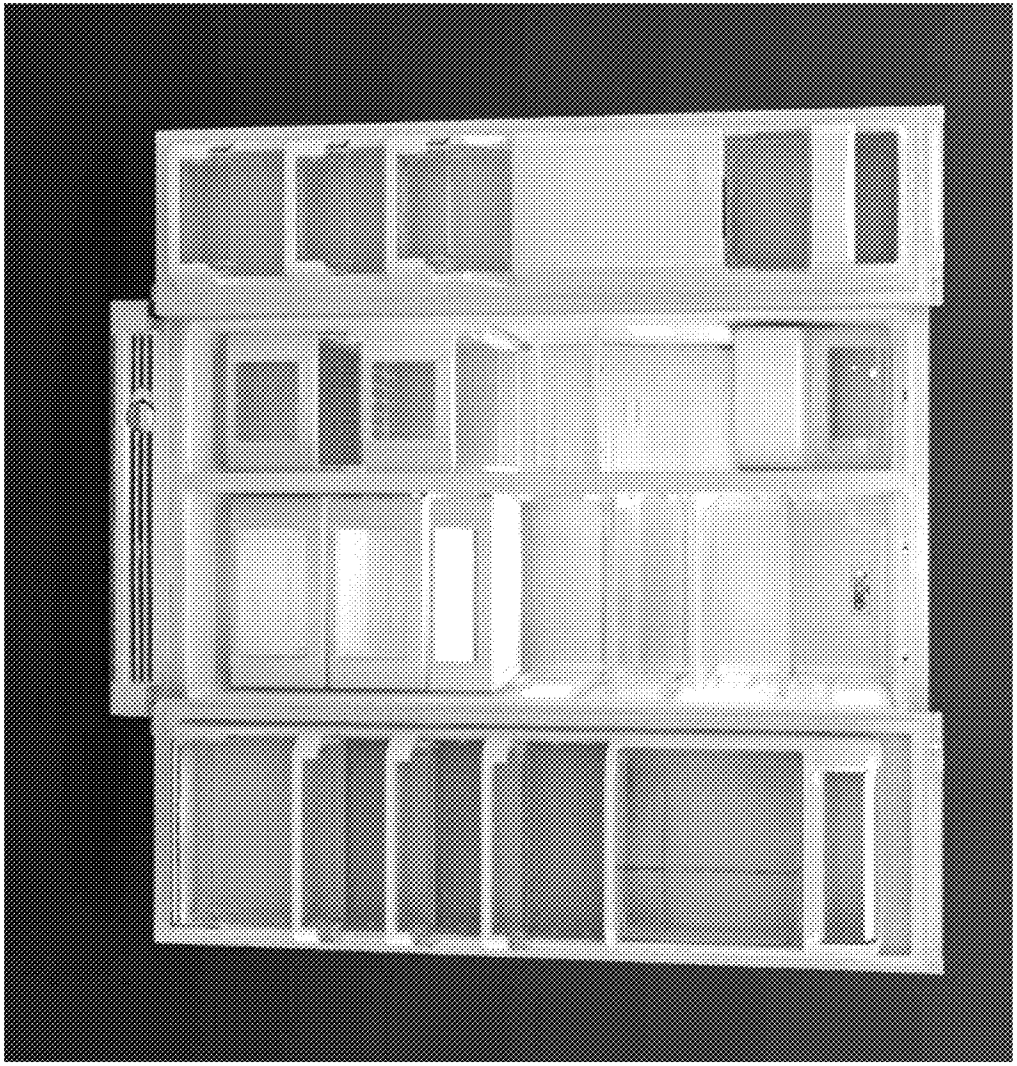

An ambient light sensor could also inform the controller of darkness in the room and commence a timed blue backlight of the ice compartment and some low level illumination of the interior (FIG. 16D). After more time, and in reaction to a door being opened for that additional time, the controller could increase intensity, for example, to the drawers. This is in reaction, again, to a door being open and trying to draw the user's attention to that location (FIG. 16E). After more time, increased intensity of the whole interior of the cabinet and an increased intensity or full interior lighting of the ice compartment with blue light could be commenced (FIG. 16F).

Figure 16G:
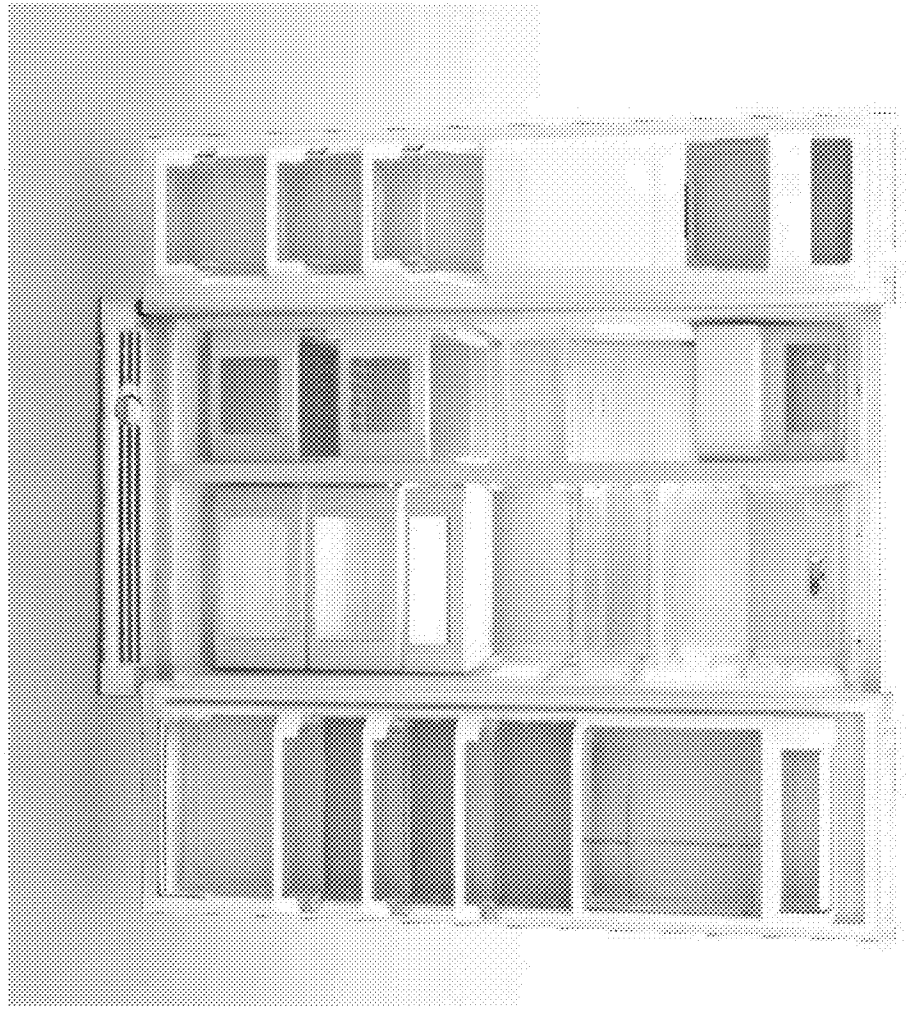
Figure 16H:
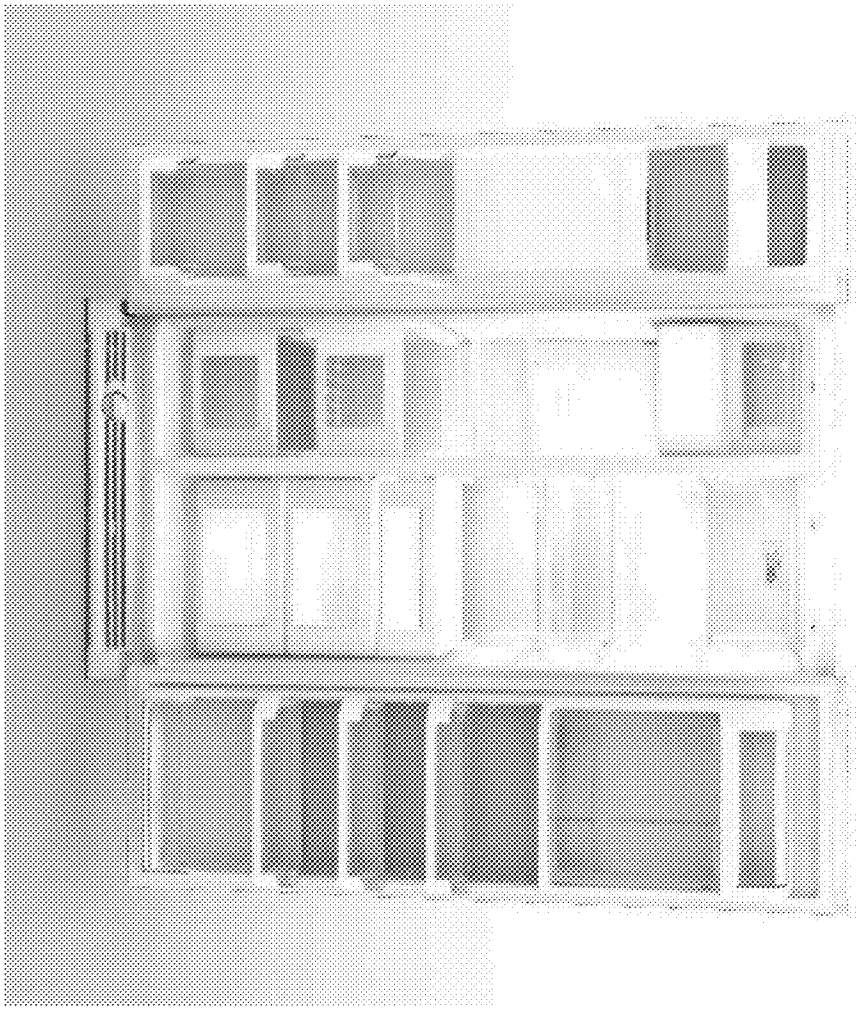

If the ambient light sensor senses a light turned on in the room or daylight, the controller could react and automatically increase intensity to any of the multiple lighting arrays or subassemblies in the appliance (FIG. 16G). Still further, the longer the doors are open the reaction could be to increase intensity of all or some of the illumination in the cabinet (FIG. 16H).

Figure 16I:
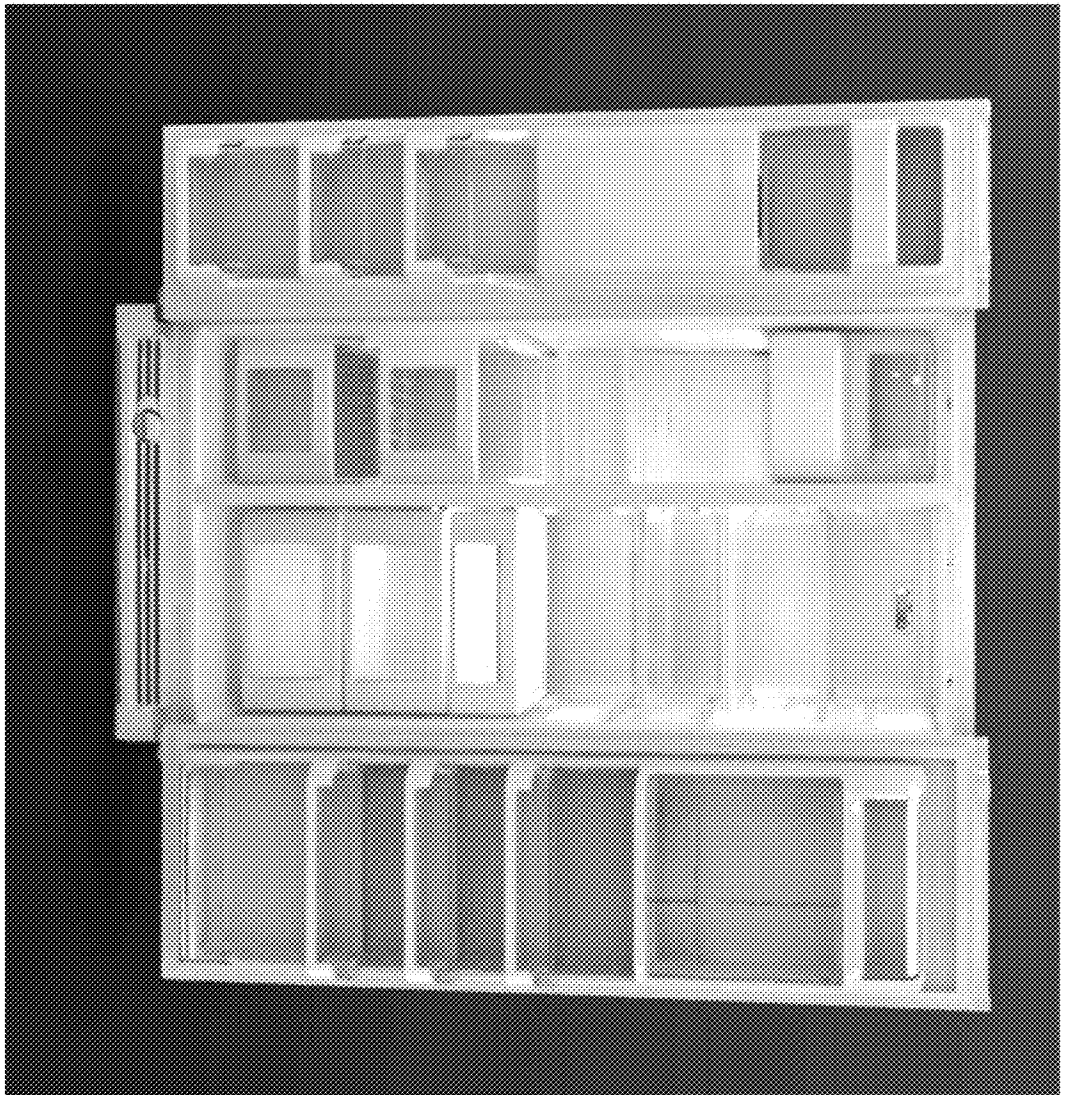
Figure 16J:
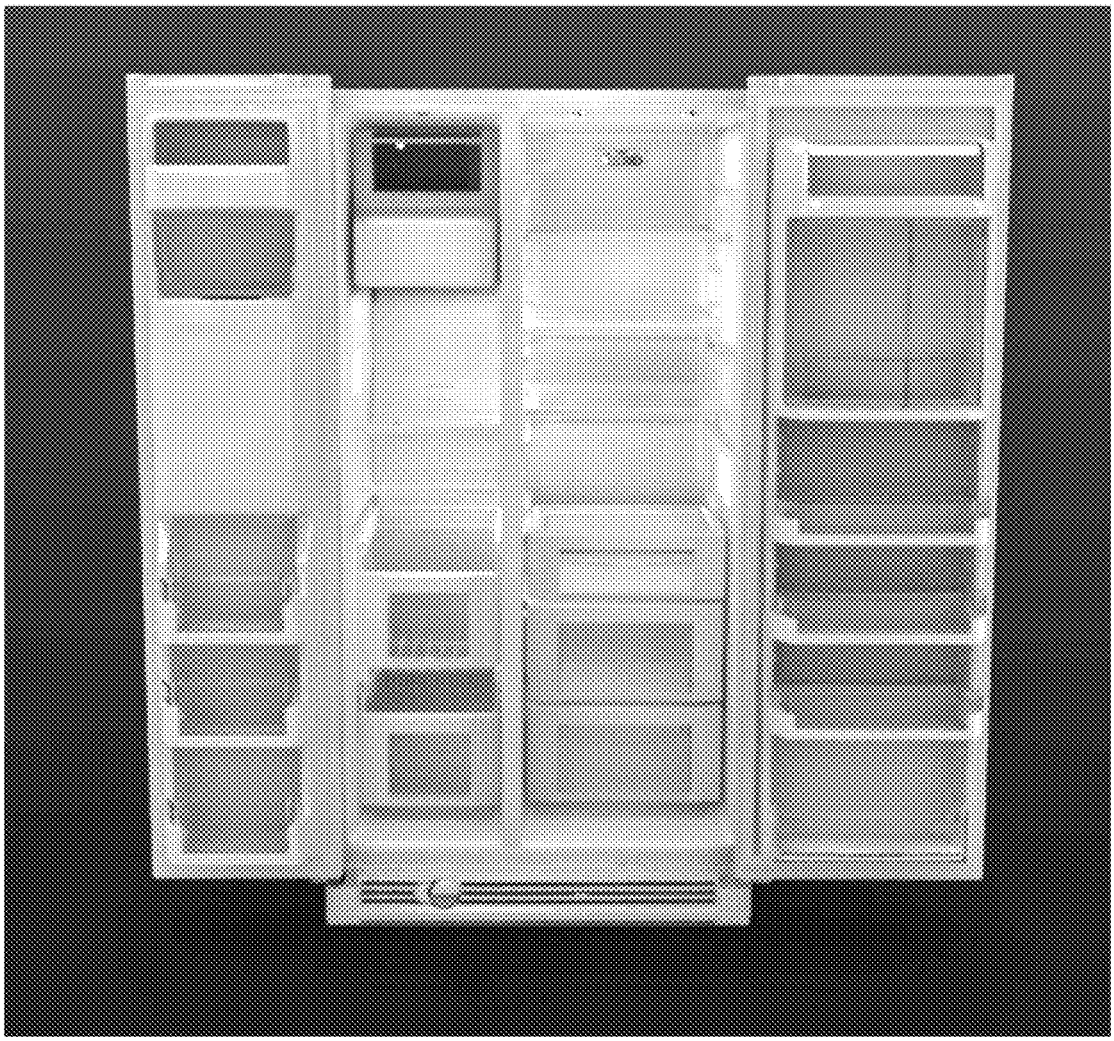
Figure 16K:
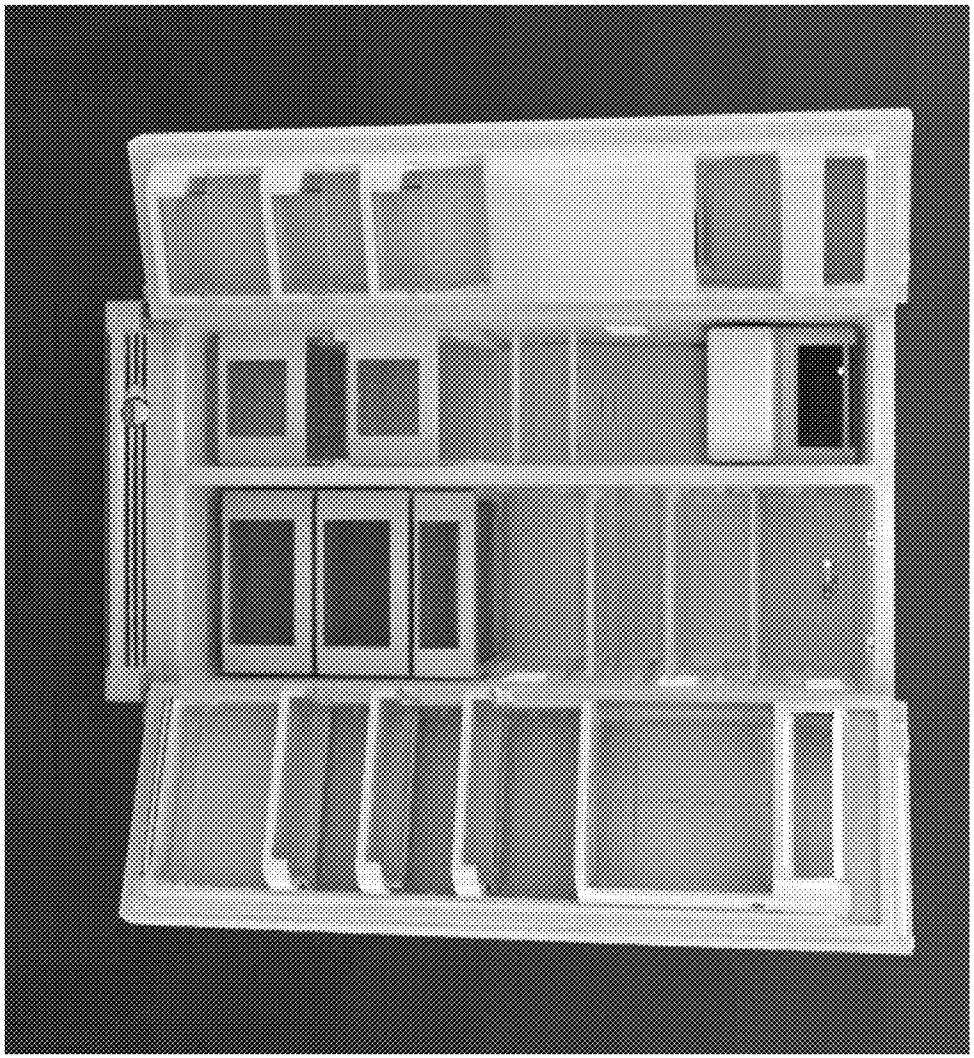
Figure 16L:
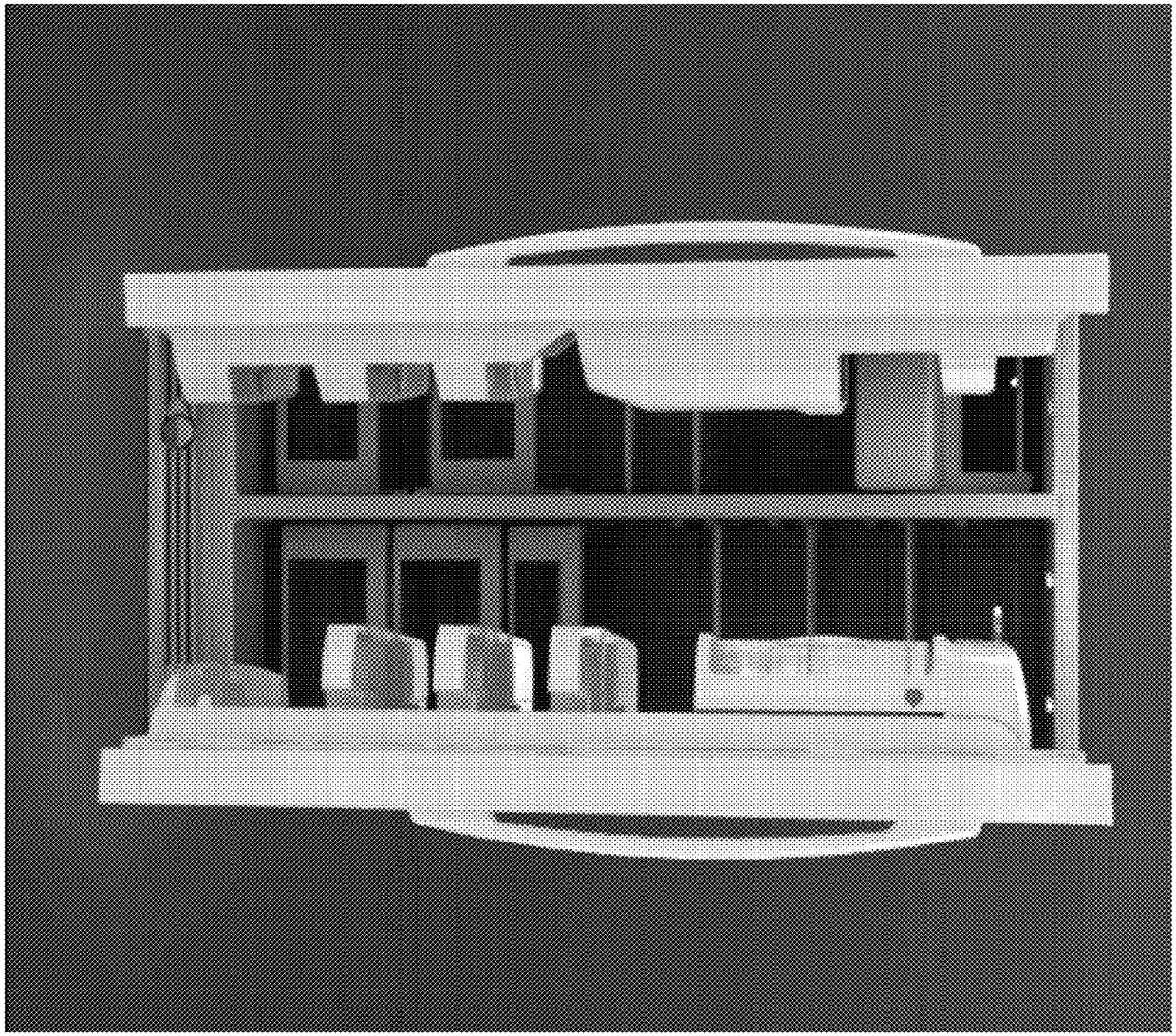
Figure 16M:
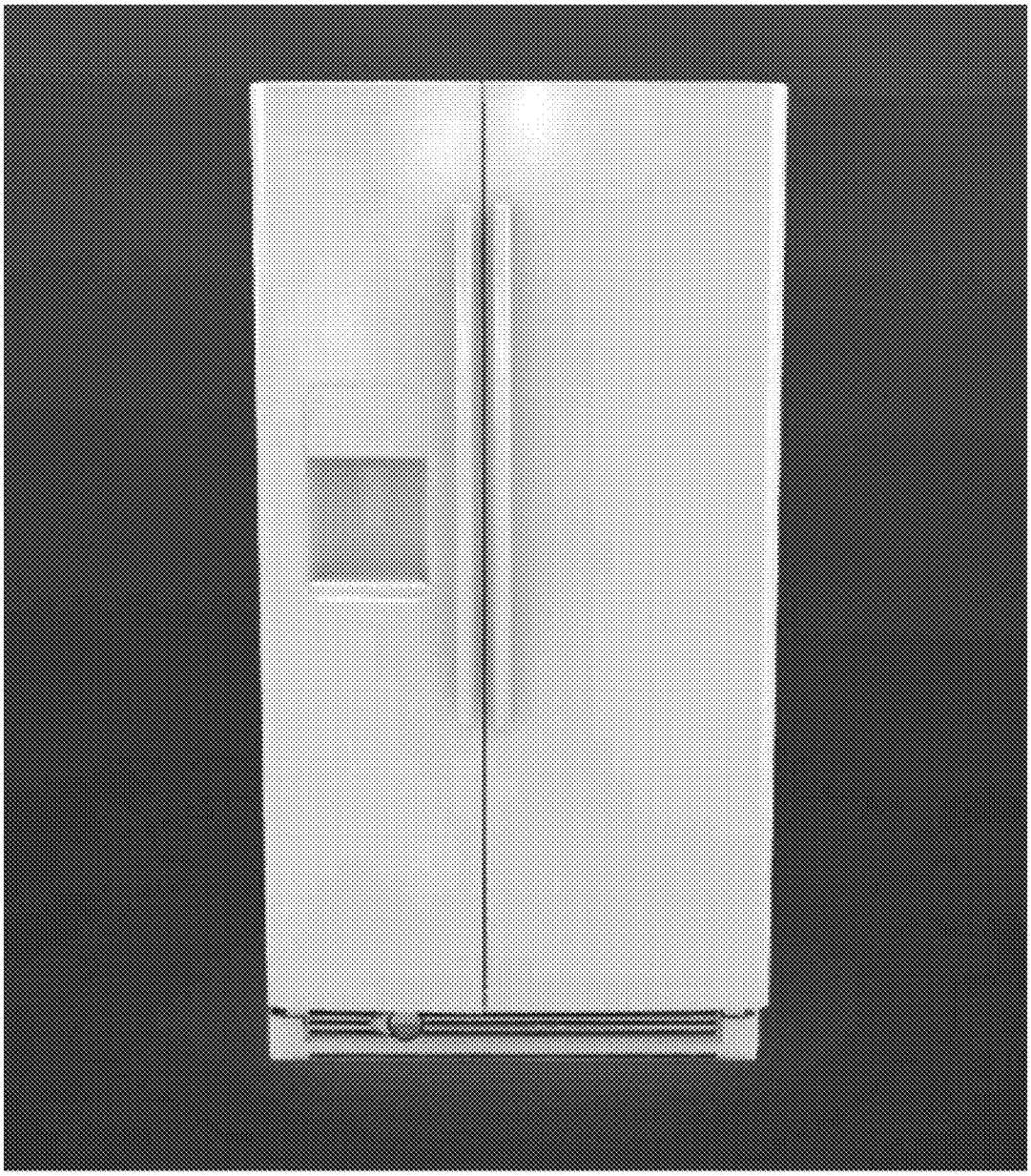

If the ambient light sensor then again senses lights have been turned off or down in the room or it is night time, the reaction could be what might be called spot illumination (here just drawers) (FIG. 16I). And by timing or otherwise, the controller could thereafter start turning down or off a certain lighting subassemblies; here turning everything down but maintaining the blue back light of the ice compartment (FIG. 16J and FIG. 16K). Then finally upon some other trigger such as the doors moving to close, the controller could turn out all illumination except for perhaps the temperature decal and low glow blue light at the ice compartment (FIG. 16L). Finally, upon doors completely closed, all internal illumination could be shut off to, inter alia, save energy (FIG. 16L).

Further examples of "reaction" are as follows. By including such things as proximity sensors at each shelf, drawer, or other area of the appliance, any time hand or object comes within range of the sensor, a lighting subassembly at that location could be actuated with an additional lighting effect. For example, as described in previous embodiments, the lighting subassembly at a shelf where a hand is sensed could turn on or increase in intensity to put more illumination at and around the location of where the hand is. Once the hand is removed, the lights would be shut off or decreased in intensity as a further automatic reaction. If the hand moves to a different shelf, in reaction, that subassembly could be actuated to light that shelf. This controlled dynamic in passive combination would give the appearance of the appliance being "intelligent". A lighting effect would automatically actuate where the hand is. Essentially, the light or increased light follows the hand, reacting to sensed location of the hand.

As previously mentioned, another "reaction" could be starting one lighting effect when a person is a first distance away from the appliance or part of the appliance and then changing that lighting effect at that lighting subassembly when the person is sensed to be closer. The "reaction" can be to different triggers (alone or in combination). For example, time, proximity, ambient light, and other triggers can be used sequentially or in correlation according to need or desire.

Figure 16N:
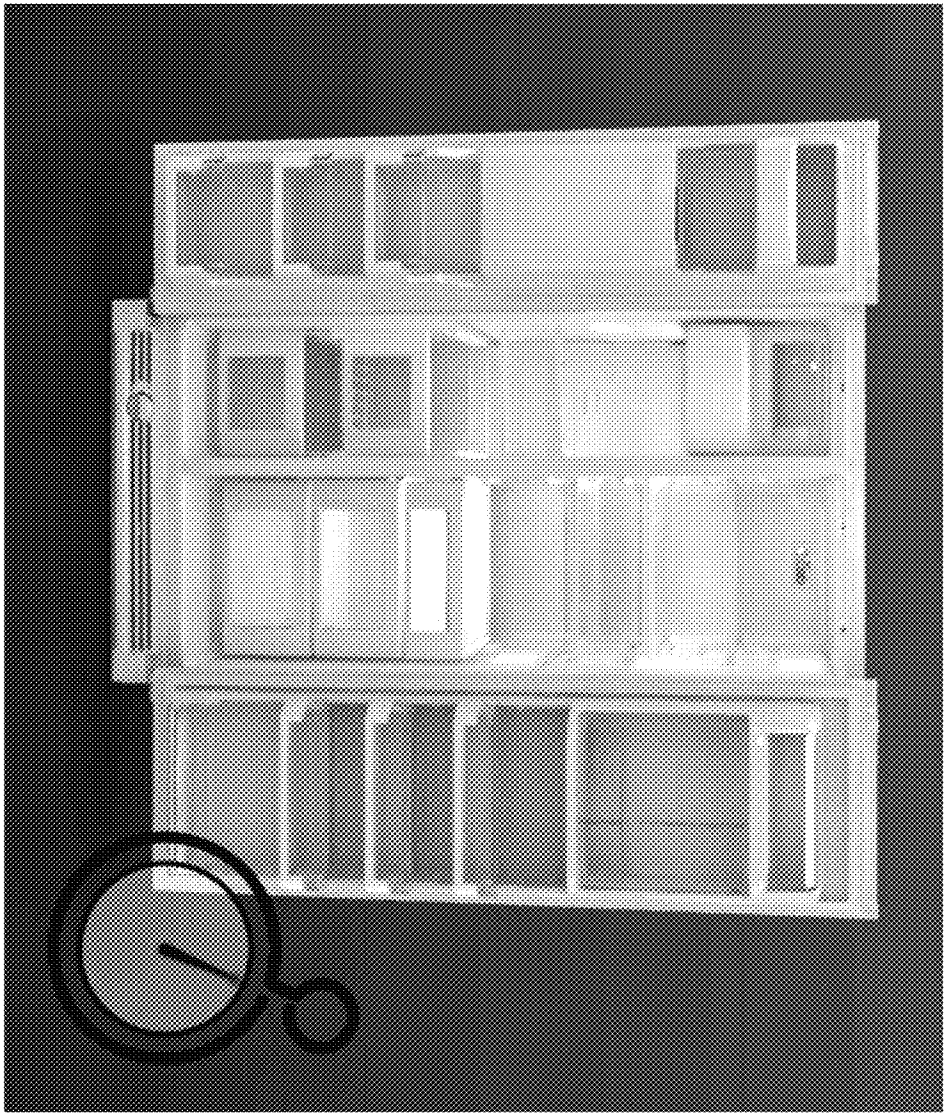
Figure 160:
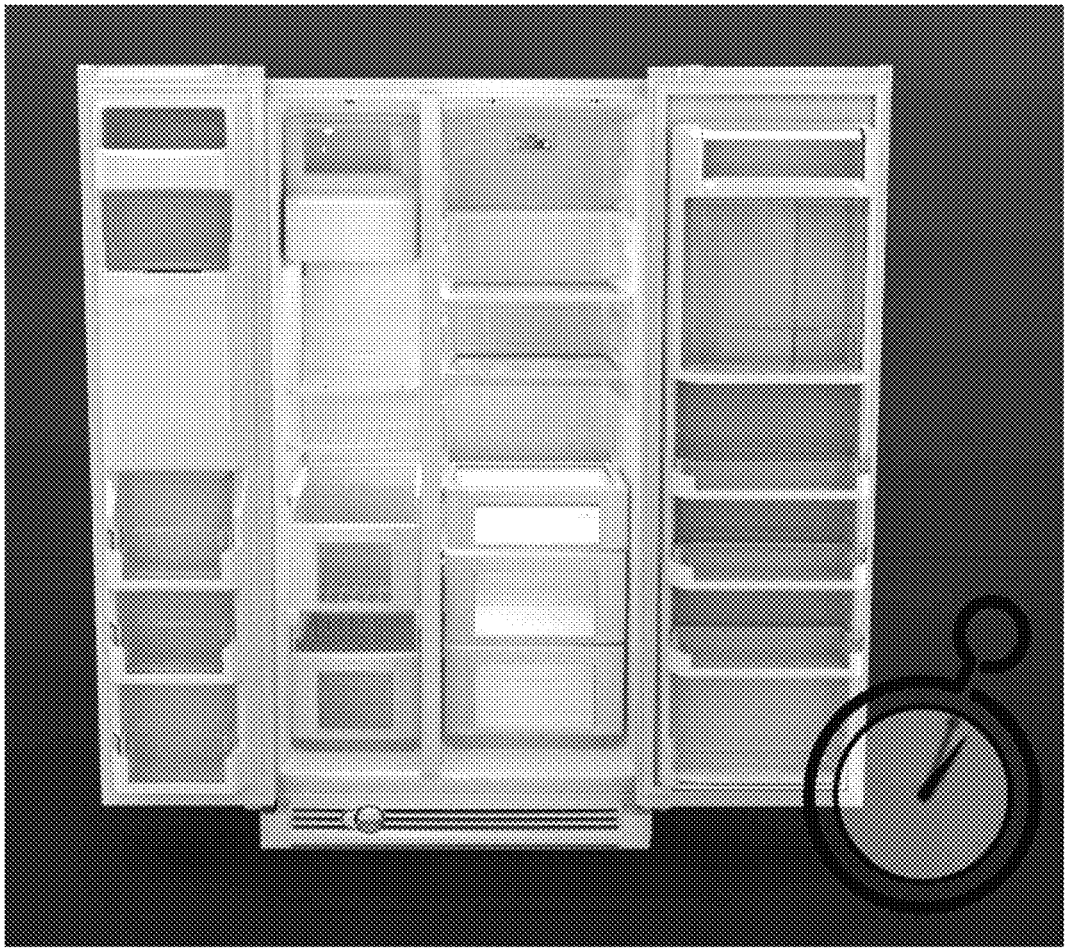
Figure 16P:
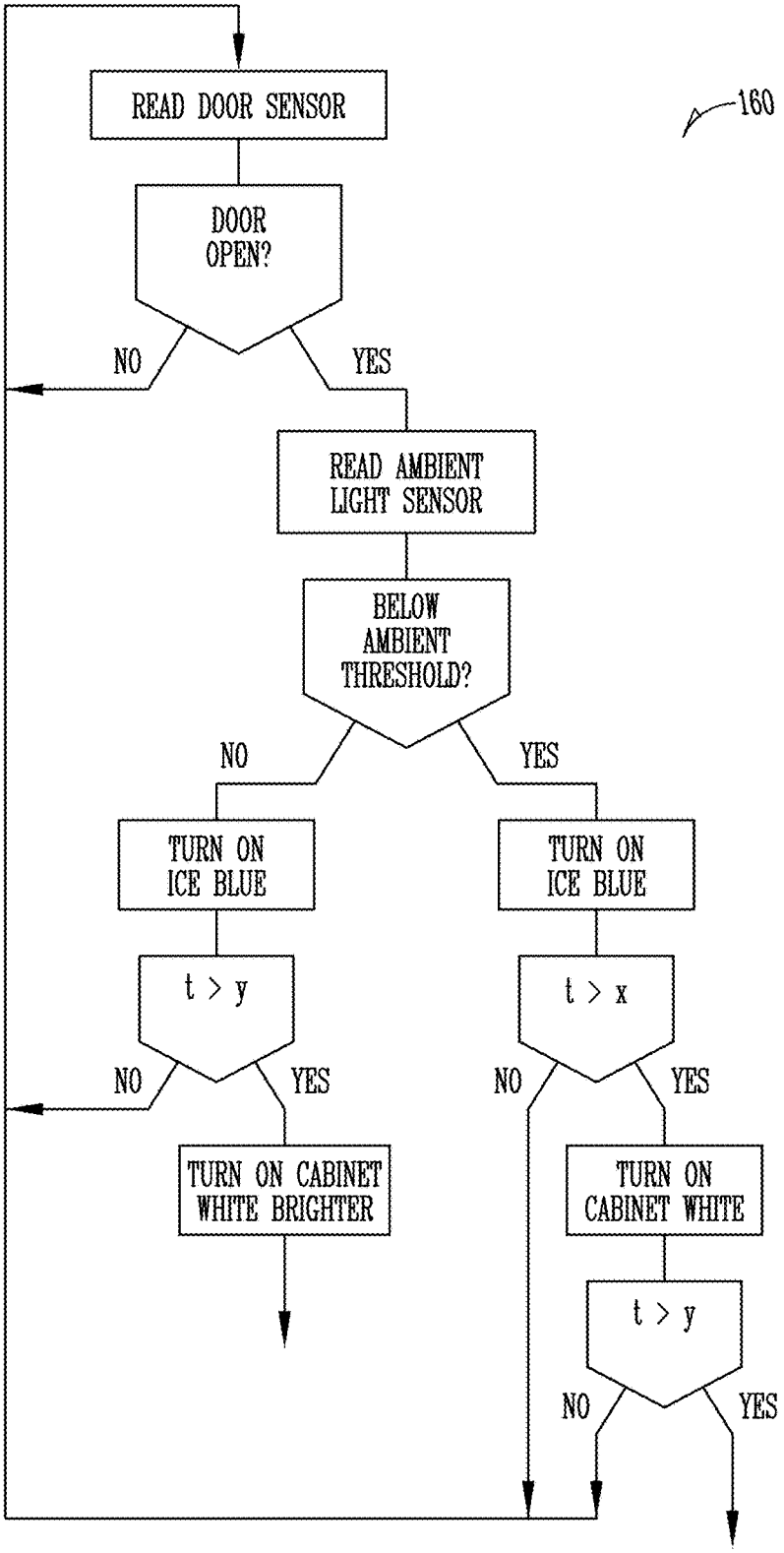

Another example of a reaction is as follows. Once a refrigerator door is open and a first lighting effect helps the user identify the contents of the interior, a timer could start (FIG. 16N). If the door remains open for a certain timed period, not only could the decal illumination such as has been previously described tell the user the temperature is increasing because of the opened door but the controller could, for example, change illumination colors in the compartment with the door open (e.g., turn on red LEDs) to also inform the user that temperature may be rising. This is in reaction to the door being opened and the attempt of equalization of temperature with ambient temperature. The designer could instigate a variety of different reaction lighting events according to desire or need. See FIG. 16O.

FIG. 16D is an algorithm 160 that illustrates how the reaction lighting can occur. Different lighting intensity can be instructed based on an ambient light sensor. For example, following the control loop of FIG. 15U, if an ambient light sensor senses that it has become daylight, or room light level has increased, the intensity of one or more sets of LEDs that are currently being illuminated, or additional LED sets can be turned on to increase the amount of illumination inside the cabinet for better visual acuity because ambient light levels have increased. Similarly, if the ambient light sensor senses a diminution of ambient light, it could return back to lower intensities.

Several reaction lighting effects have been previously discussed. Other individual reaction lighting effects or combinations could be designed. It makes the appliance look "intelligent" and could be programmed into the main control board controller or some other controller or combination of controllers.

Embodiment 17

Another exemplary embodiment of the present invention is illustrated in FIGS. 17A-E. Similar to other proximity sensing embodiments described earlier, this embodiment relies upon a graduated distance sensing by the proximity sensor to inform controller 20 when a user is at varying distances from the appliance. A different lighting effect can then be instructed for each of the different distances.

For example, an appliance in a room can be in a dormant state as far as lighting or sound effects when the proximity sensor does not detect anybody essentially in the room of the appliance. See FIG. 17A.

Figure 17A:
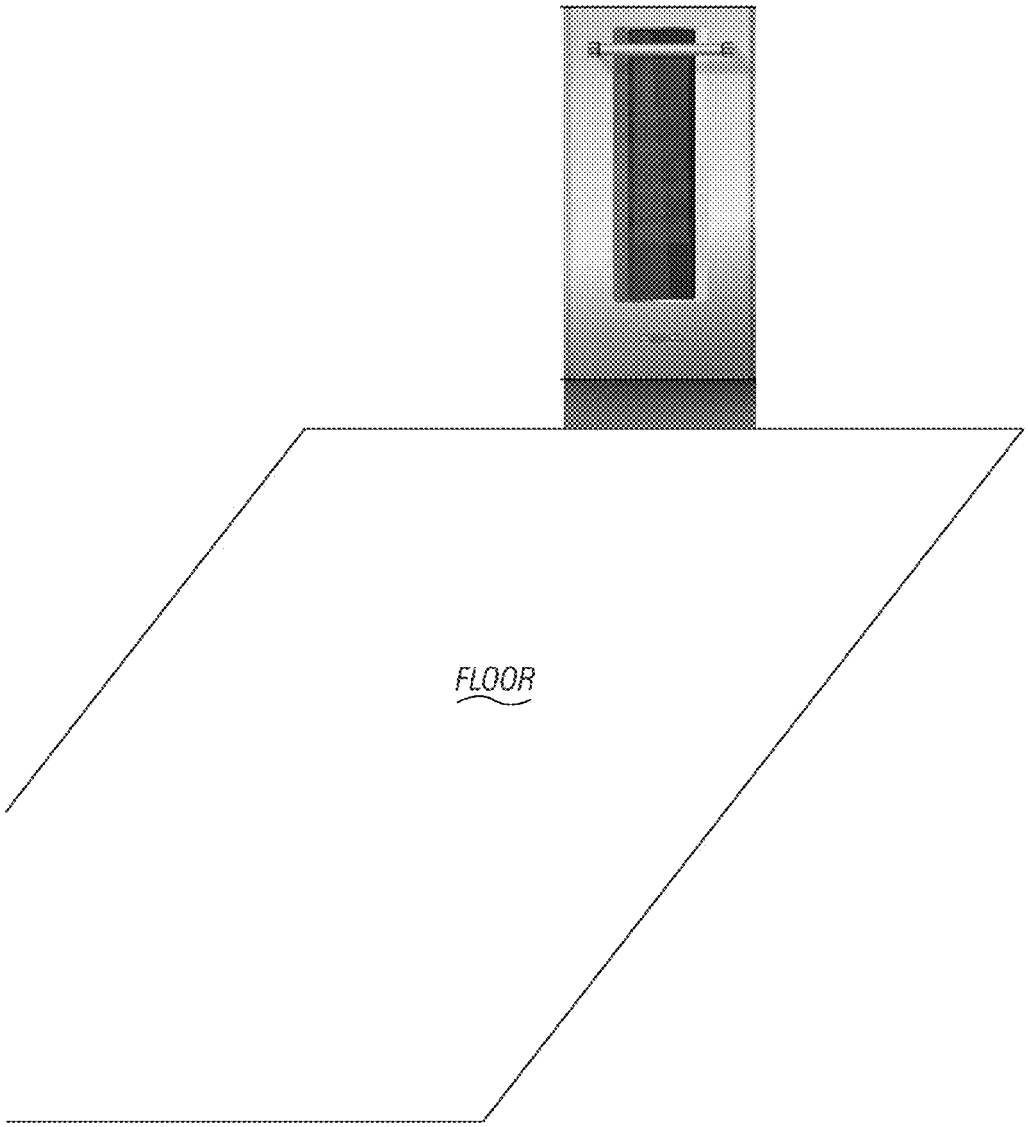
FIGS. 17A-D are a sequence of photographs of an appliance with diagrammatic depiction of a user approaching at different distances illustrating a further lighting scheme according to an exemplary embodiment of the invention.
Figure 17B:
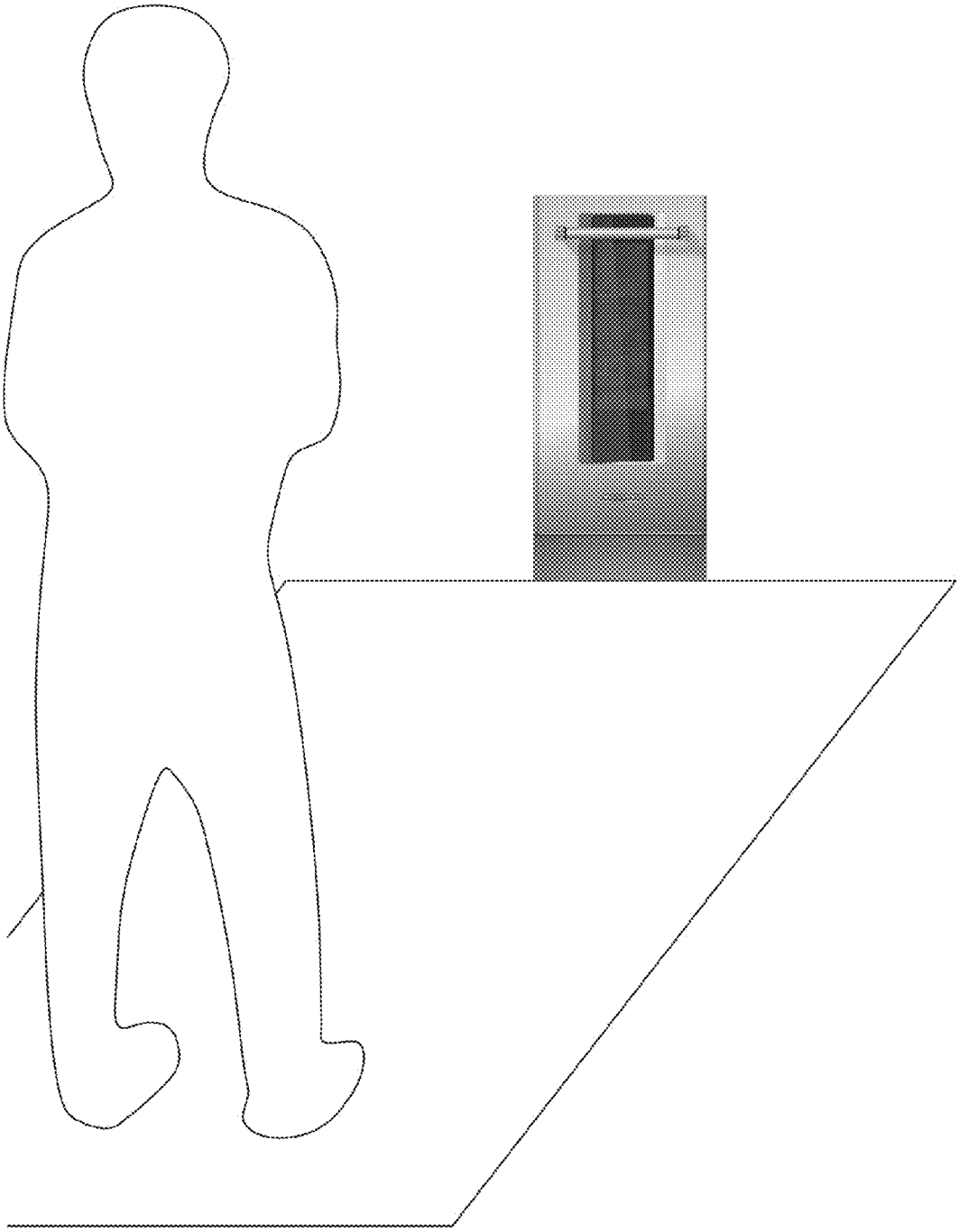

The proximity sensor senses a user entering the room at a substantial distance away (e.g., 20 feet) and informs controller 20 of the same (FIG. 17B). Controller 20 turns on base or floor LEDs along the bottom of the appliance (similar to FIG. 4B).

Figure 17C:
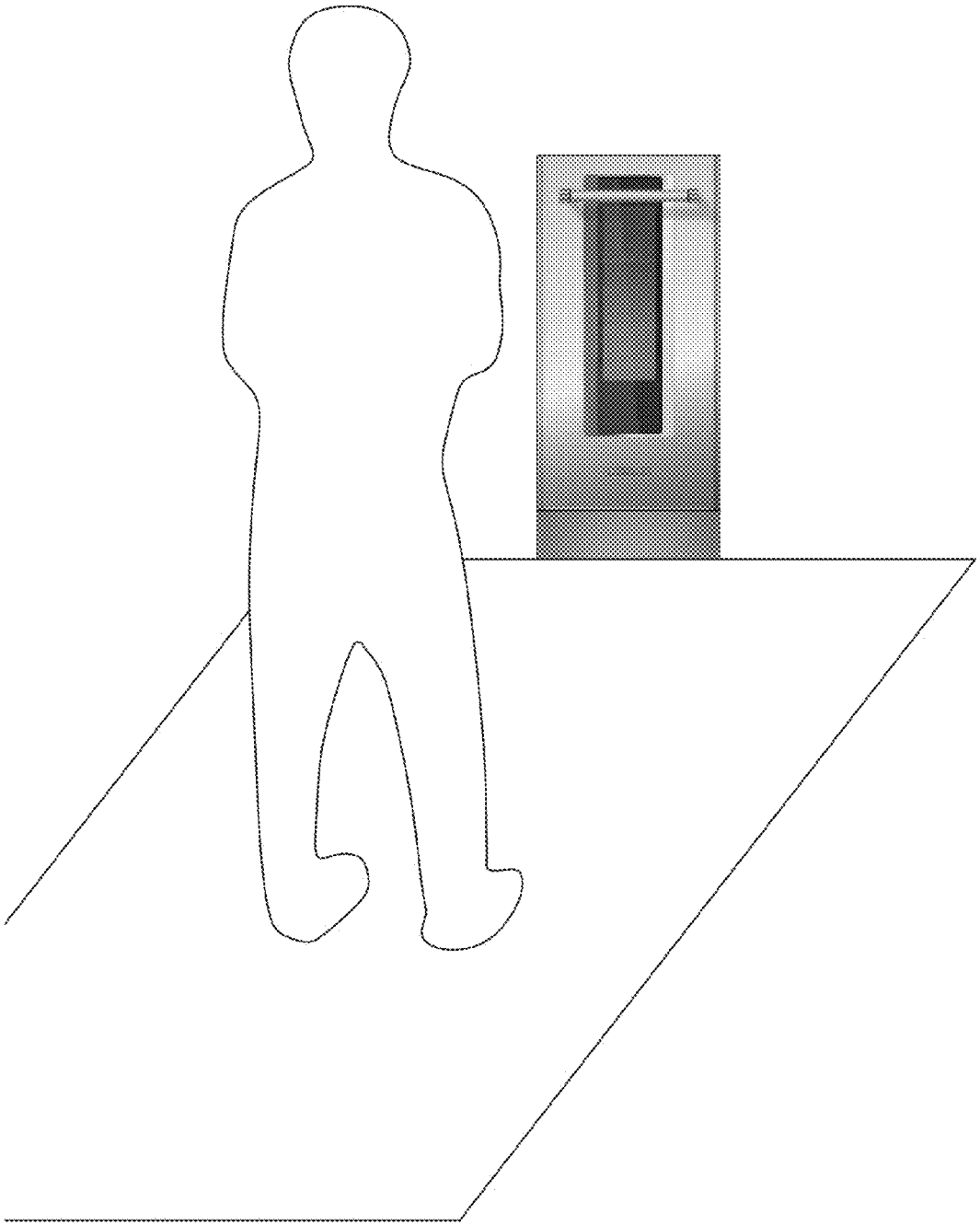

The proximity sensor triggers again upon a user approaching to a closer distance (e.g., 10 feet) and triggers interior lights at a dim level to turn on (FIG. 17C).

Figure 17D:
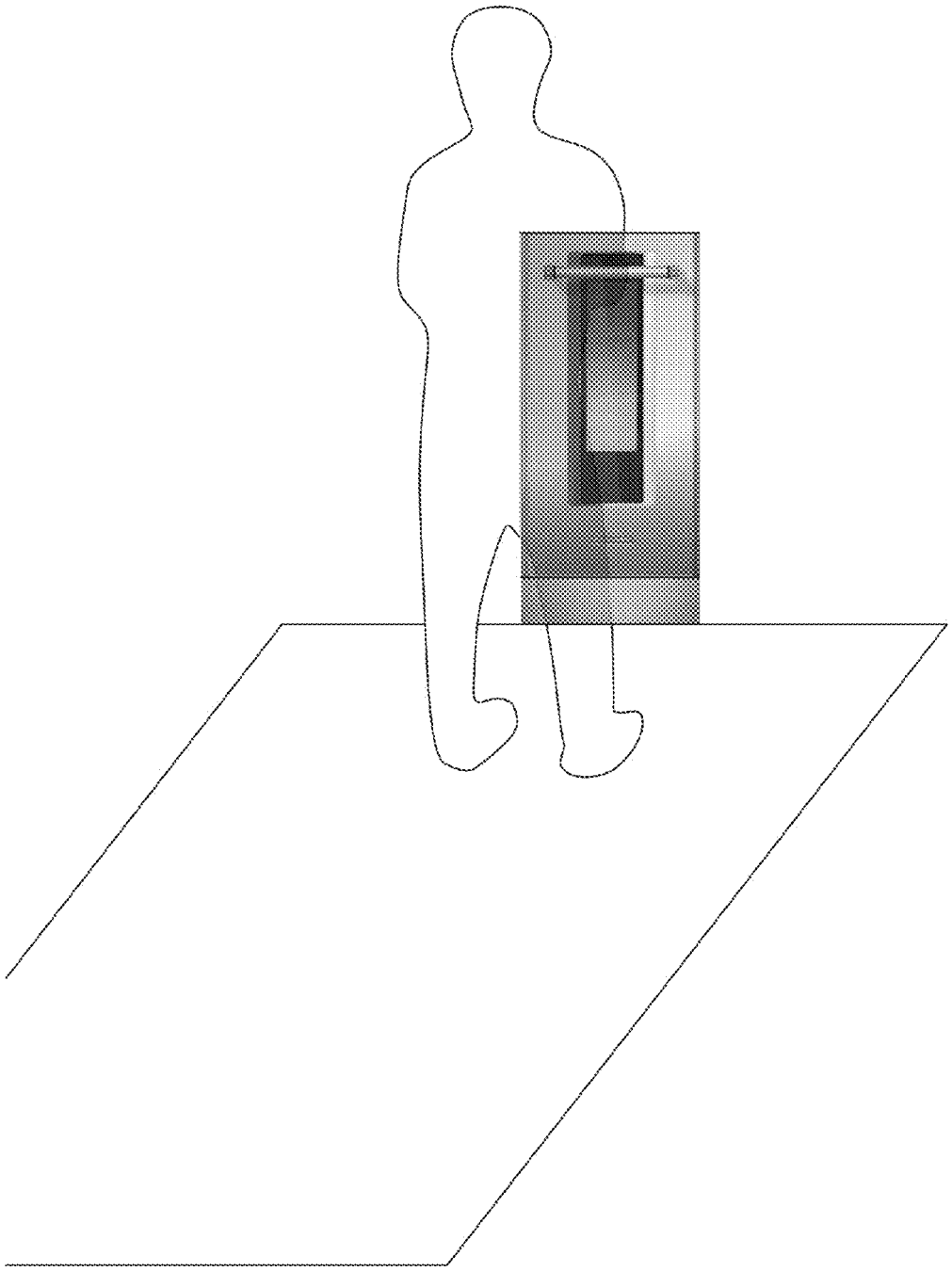

Upon the user approaching directly to the appliance (e.g., 2 feet) controller 20 raises the intensity of the interior lights (FIG. 17D).

Figure 17E:
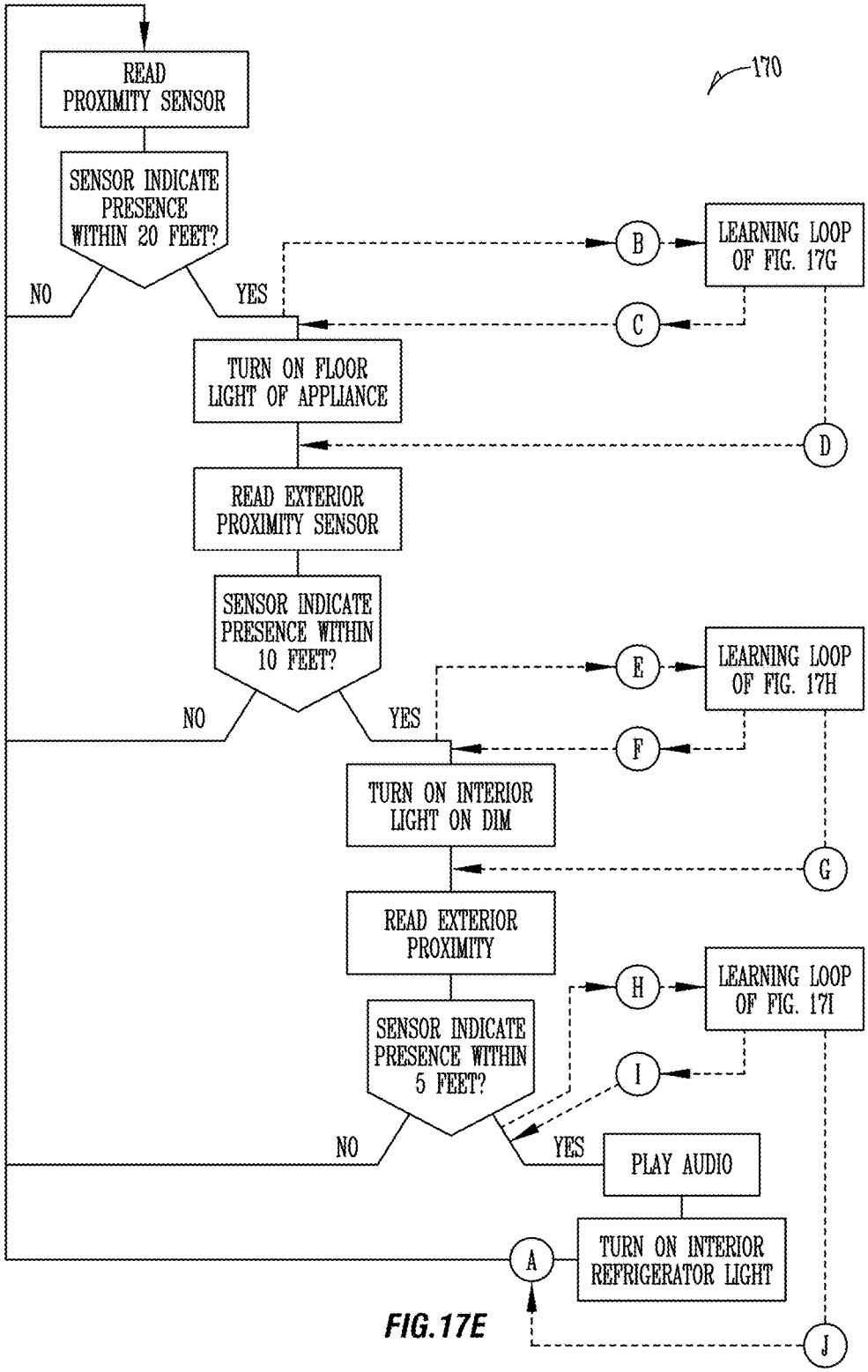
FIGS. 17E and F are a control loop algorithm for the embodiment of FIGS. 17A-D.

Algorithm 170 at FIG. 17E illustrates a closed loop for control algorithm for the foregoing. These triggered lighting effects give the appearance that the appliance is "smart" in that it changes the lighting effect passively but dynamically to acknowledge an increasingly close approach to that specific appliance by a user.

Examples of discussion of proximity sensors with graduated distance sensing can be seen at the following, each of which is incorporated by reference herein: U.S. Pat. No. 5,954,360; U.S. Pat. No. 8,400,209; US 2009/0256677; US 2012/0102630; and US 2013/0099909.

As can be appreciated, graduated distance proximity sensors can optionally have user settings or recalibration adjustability. This can allow a user to turn on or off the proximity sensor or features of it. For example, for plural graduated distance zones, the user could adjust sensing range for one or more of the zones. For example, instead of the two, ten, and twenty foot zone triggers described above, they could be one, three, and twenty-five feet, or others. In another example, the user could change from three sensing zones to two or one or none. It is to be understood that at least certain types of proximity sensors can have some directionality. There can be some adjustment of what direction or space the sensor would sense. For example, if a refrigerator is right across from a central kitchen island in a room, a proximity sensor could be directionally pointed towards a door to the right or left, or both, instead of looking just across to the kitchen island. This can also allow a user to exclude certain objects or areas in a room.

Not only can sensing of proximity to a single appliance be engaged at variable proximities, lighting effects based on different zones or variable proximities can be programmed. One example would be one or more lights beginning at a low intensity and increasing in intensity as the user gets closer to the appliance (e.g., sensed at closer and closer zones). As can be appreciated, the appliance can have one or more light sources. They can be exterior, interior, or control-type lights (e.g., providing information or state/status regarding the appliance).

As set forth in a number of prior examples, an array of LED lights can be positioned at various locations external or interior to the appliance. The entire array can be driven identically. Alternatively, each LED (or subsets of LEDs) in an array can be driven independently. This would allow further flexibility in lighting effects. For one example, instead of dimming an array and increasing its intensity the closer the user gets, a single LED of the array could be turned on when the farthest zone is sensed, two LEDs turned on when the user is sensed in an intermediate zone, and then all LEDs turned on when the user is sensed in the closest zone.

The lighting effects do not need to be linear. They could be varied according to any type of linear or nonlinear response. For but one non-linear example, at the farthest zone, LEDs in an array could be driven at a first dim light output (e.g. ⅓ of full intensity). At an intermediate proximity zone, light intensities for the array could be increased to ½ of full intensity. At the closest proximity zone, light intensity could be increased to full intensity.

How one or more LEDs are driven, how many LEDs or how many arrays are driven, where the arrays are (external, internal, etc.), and other factors such as color, steady state or flashing, etc. allow for a large variety of potential lighting effects available to the designer. This can heighten consumer awareness and can function to intuitively guide the consumer to more confident product interaction. An example would be to give dim floor lighting at a farthest-away proximity zone, give dim badge lighting at an intermediate proximity zone, and then flashing lighting of a door handle at a closer proximity zone.

Another example would be accent lighting (badge, floor, handle, etc.) at a farthest proximity zone, interior lighting (if a window exists in the appliance) at a closer zone, and some type of user interface (e.g. user control panel or display) lighting turning on when at arms' length. Examples of a user interface could be a water and ice dispenser on a refrigerator, temperature settings on a stove, keyboard settings on a dishwasher, etc.).

Additionally, as mentioned above, the same lighting could simply be ramped up in intensity based on how far the user is into a zone, providing an engaging experience with the appliance. For example, within a sensed zone, badge lighting could start dim and ramp up in intensity while the person is still in that zone. A different lighting effect or further ramping up of intensity of the badge could occur when the user is sensed in a closer zone, etc.

Another possible feature according to graduated distance sensing can include the following. There can be times when it would be beneficial that the system either learns or is programmed to account for certain things or events.

A first example is similar to that described above. If an island is present in a kitchen, a graduated distance sensing system in an appliance directly across from and only a few feet from the kitchen island could be programmed to automatically recognize or "learn" that there is a permanent obstruction near the appliance. As indicated at FIG. 17E, a learning loop could be programmed into the controller of the appliance. By referring to FIGS. 17G-I, the loop could time sensed presence of an object at any of its graduated zones. If, for example, the sensor triggers for over a certain amount of seconds, the system would automatically ignore, bypass, or alter the lighting events or sequence of lighting events. One illustration of this is as follows. If an appliance's proximity sensor "sees", senses or triggers for a long period of continuous time for one of its zones, it could be programmed to assume that there is a fixture or something other than a typical human user in the field of view of the proximity sensor for that zone. It could thus ignore it or only trigger on events that occur quicker than that time threshold. Alternatively, for example, if a kitchen island was in a zone that is farther away, the system could simply ignore triggering relative to that farther zone. It essentially would ignore triggering on anything sensed in that farther zone.

Another example would be temporary obstructions. Again, as indicated in FIGS. 17E and G-I, learning loops could time when a proximity sensor triggers in any of its zones. If the trigger stays on over a preset amount of time, the system could bypass, ignore, or take some other lighting effect or sequence of lighting events rather than the normal sequence (e.g., the normal sequence of algorithm 170 of FIG. 17E). This could be beneficial in the situation of a dog which walks up to and lies in the field of view of the proximity sensor of the appliance, a child's toy that is temporarily left in that field of view, or something else that the system would assume is not a human user of the appliance based on the fact that human users would not stay in one fixed position for substantial amounts of time relative to the appliance. As will be appreciated by those skilled in the art, algorithm 170 is but one of many possibilities.

One response of this system could be to time the trigger and if it exceeds a cumulative time threshold, and then adjust the lighting effects or shut them off until it senses that particular trigger has been removed. It could then reset to, for example, the sequence of FIG. 17E.

Other examples would be a kitchen remodeling. If a center kitchen aisle had not been in place in front of an appliance when the appliance was first installed, the appliance could "learn" of the presence of the new fixture by sensing its new presence and be programmed to adjust accordingly. Another example could be simply a table or other kitchen appliance or furniture temporarily moved into the field of view or zone of an appliance's proximity sensor. It could "learn" of this new presence and adjust accordingly.

As can be appreciated by reference to FIGS. 17E, G, H, and I, the designer has a variety of options regarding variable proximity sensing. A learning loop could occur at any or all of the different proximity sensor graduated zones. As indicated in FIG. 17E, if the sensor indicates presence of some object within, as one example, twenty feet, the learning loop of FIG. 17G could optionally be practiced. It would time the presence of the triggering. If it exceeds X seconds (X is a variable that could be set by the designer), the system would assume it is not a human user in the normal course and could disable the proximity sensor from triggering at the zone that begins at twenty feet. The variable x could be set by the designer based on empirial information about what is likely a human and not, or other factors. The lighting sequence of FIG. 17E would then continue to monitor the proximity sensor to see if a closer zone (e.g. beginning at ten feet) has triggered or a closer zone (e.g. beginning at five feet). The program would effectively disable any triggering of a lighting event based on sensing triggering at the zone beginning at twenty feet and ending at ten feet. The appliance therefore has instructed itself automatically or "learned" to disable that reach of the proximity sensor. Of course, it could be reprogrammed or reset by the user or a service technician.

Another example indicated in FIG. 17E relates to a second learning loop after a triggering by the proximity sensor at ten feet. Again, a preset time variable Y could be monitored. Variable y could be the same or different than variable x. If the ten foot trigger proximity sensing exceeds Y seconds, the lighting effect of turning an interior light on dim (as one example) could simply be ignored (see FIG. 17H). Triggering between ten and five feet would not be disabled, but for this part of the control algorithm of FIG. 17E, the lighting event would be ignored. The algorithm of FIG. 17E would proceed as indicated.

Figure 17F:
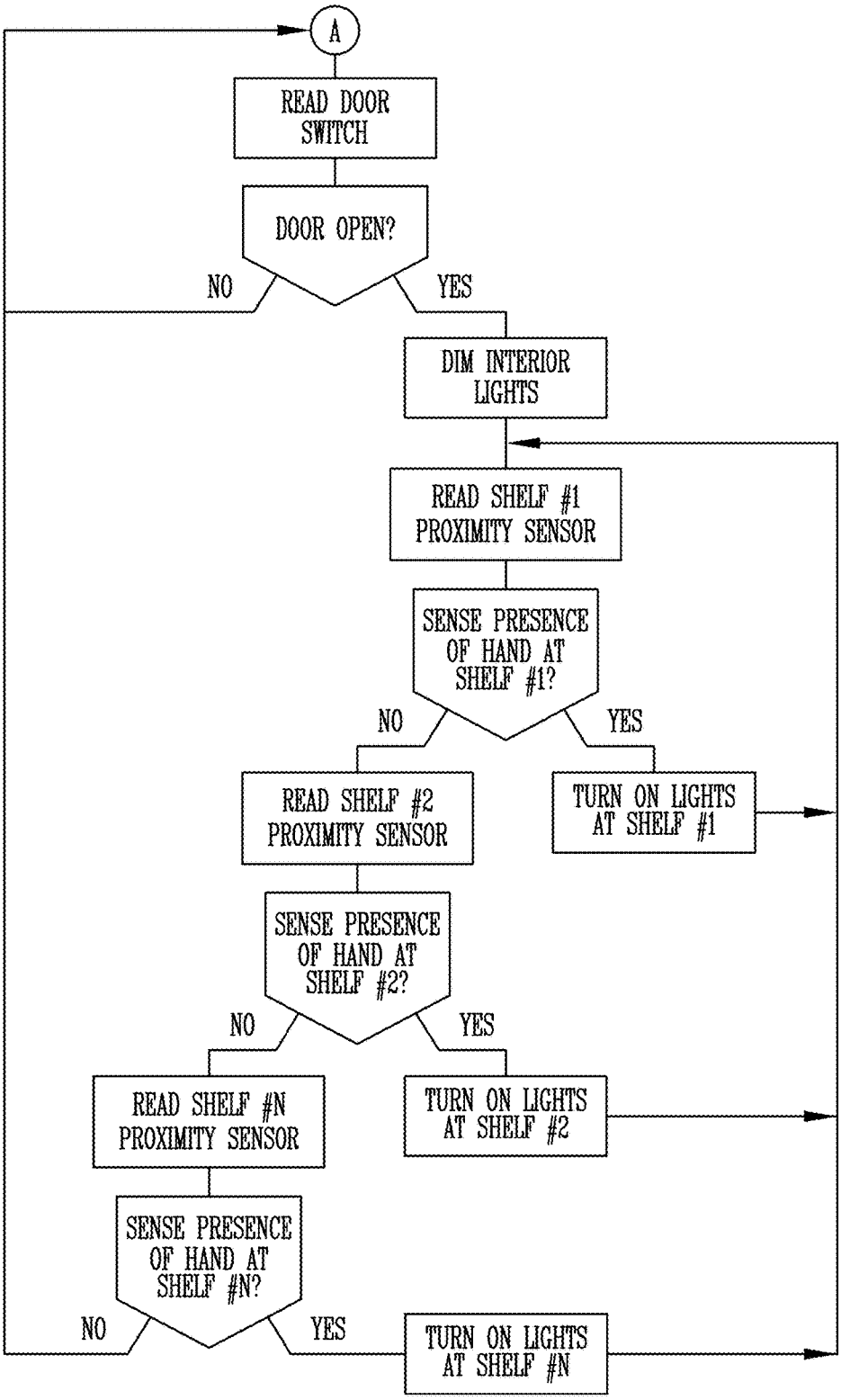
FIGS. 17G-I are specific examples of learning loop results.
Figure 17G:
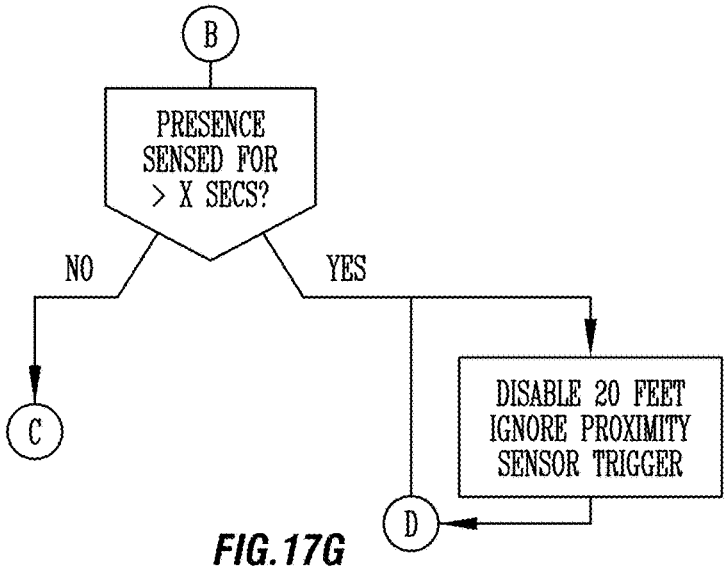
Figure 17H:
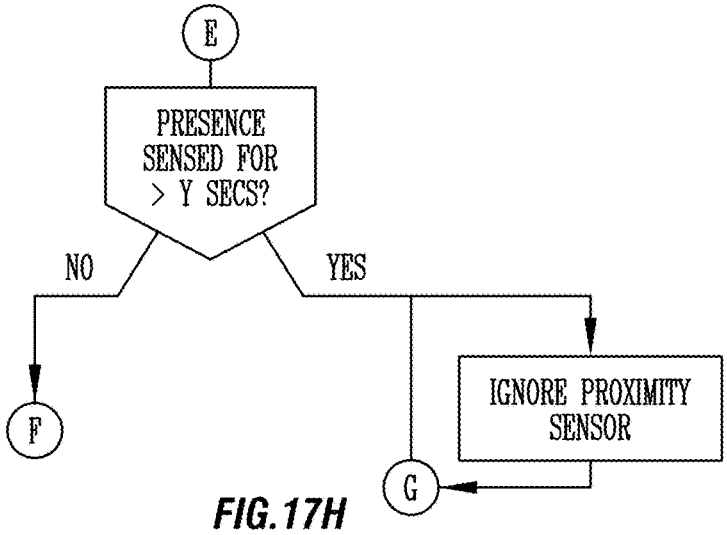
Figure 17I:
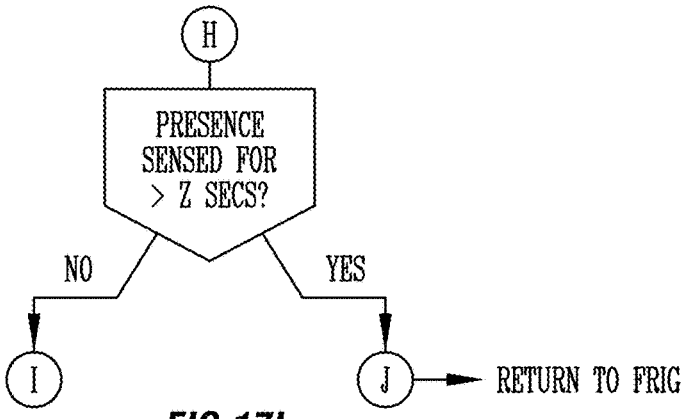

FIG. 17I shows a still further variation of a learning loop. If, for example, a proximity sensor is triggered by detection of some object within five feet (the closest zone), optionally the program could go through that learning loop. A timer would check if this sensed presence exceeds Z seconds (another variable of time). If time exceeds Z seconds, an audio and/or lighting event would simply be bypassed. Alternatively, some other change in what occurs can be programmed into the system.

It will be appreciated by those of skill in the art that any combination or variety of the foregoing, as well as different learning loops or options, are possible. It allows automatic or user-control adjustment of the lighting or other effects that occur. This again provides an enhanced level of product interaction for the consumer.

Embodiment 18

A still further exemplary embodiment, similar to that of FIGS. 17A-E, is shown at FIGS. 18A-E.

Any type of appliance could utilize a graduated distance sensing proximity sensor.

Figure 18A:
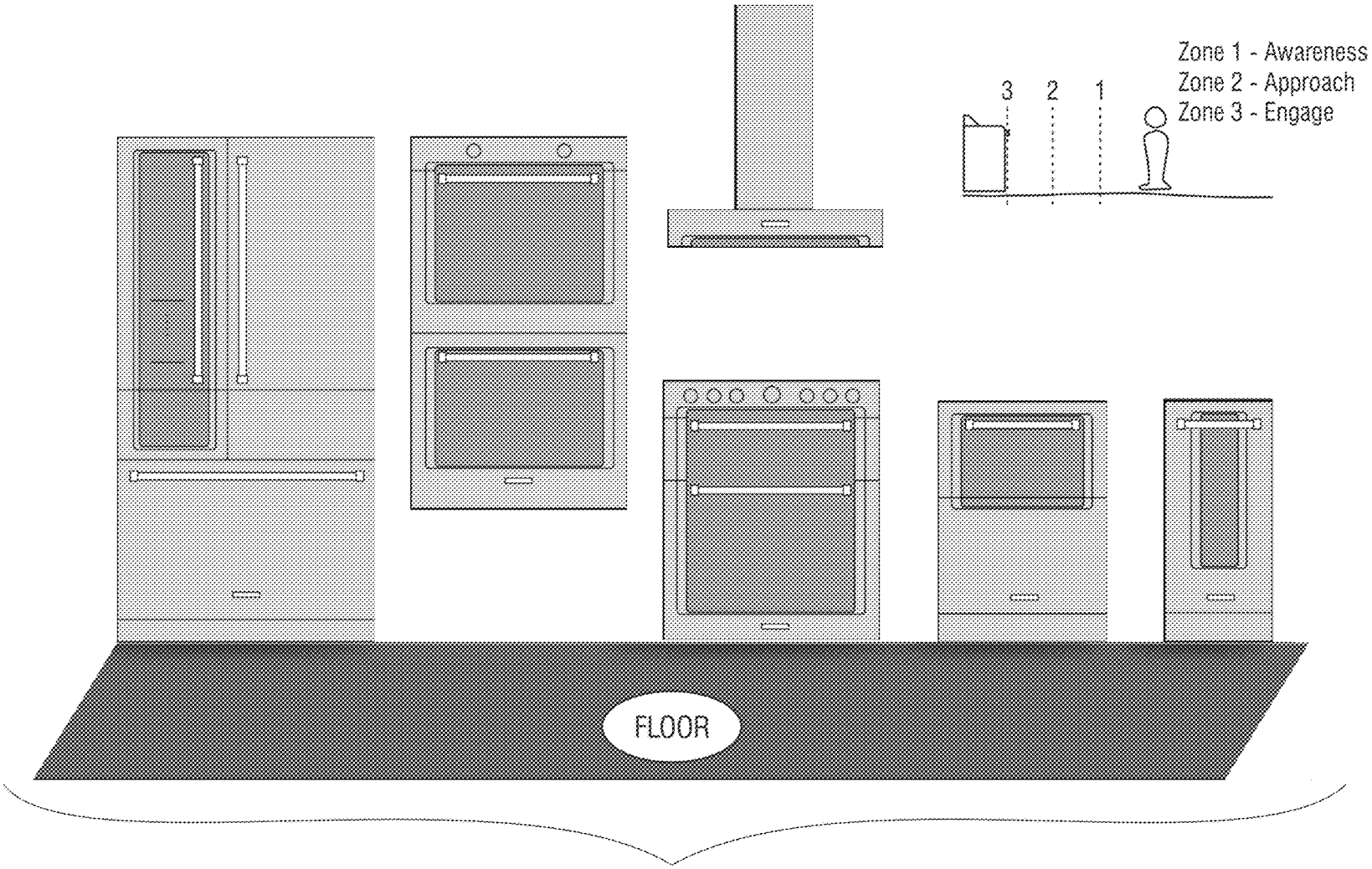
FIGS. 18A-D are a sequence of diagrams illustrating for different appliances a graduated distance sensing of a user and associated different lighting effects.

When no person (or anything like a person per the proximity sensor) is sensed in a room, a set of appliances would be in a dormant state as far as the effects that will be described herein (see FIG. 18A).

Figure 18B:
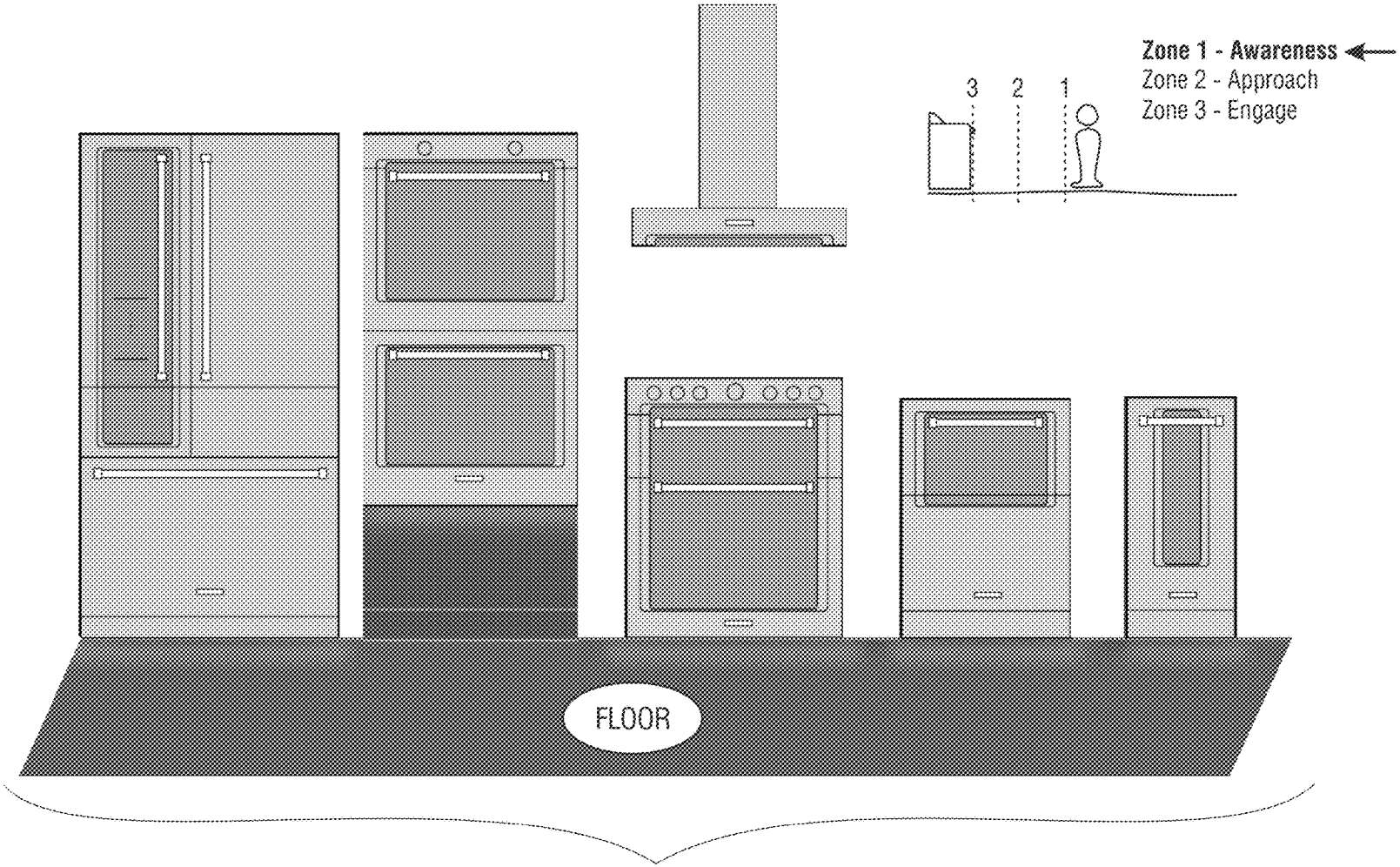

If one or more persons enters the room of the set of appliances, the proximity sensors could be set to what will be called a "zone one" or "awareness" setting such that each (or at least several) will have a set of light sources present a soft or dim glow at or near their bottom (FIG. 18B). This would essentially present to a user entering the room the recognition or awareness the person is in the room and the specific location of each (or most) of a set of appliances.

Figure 18C:
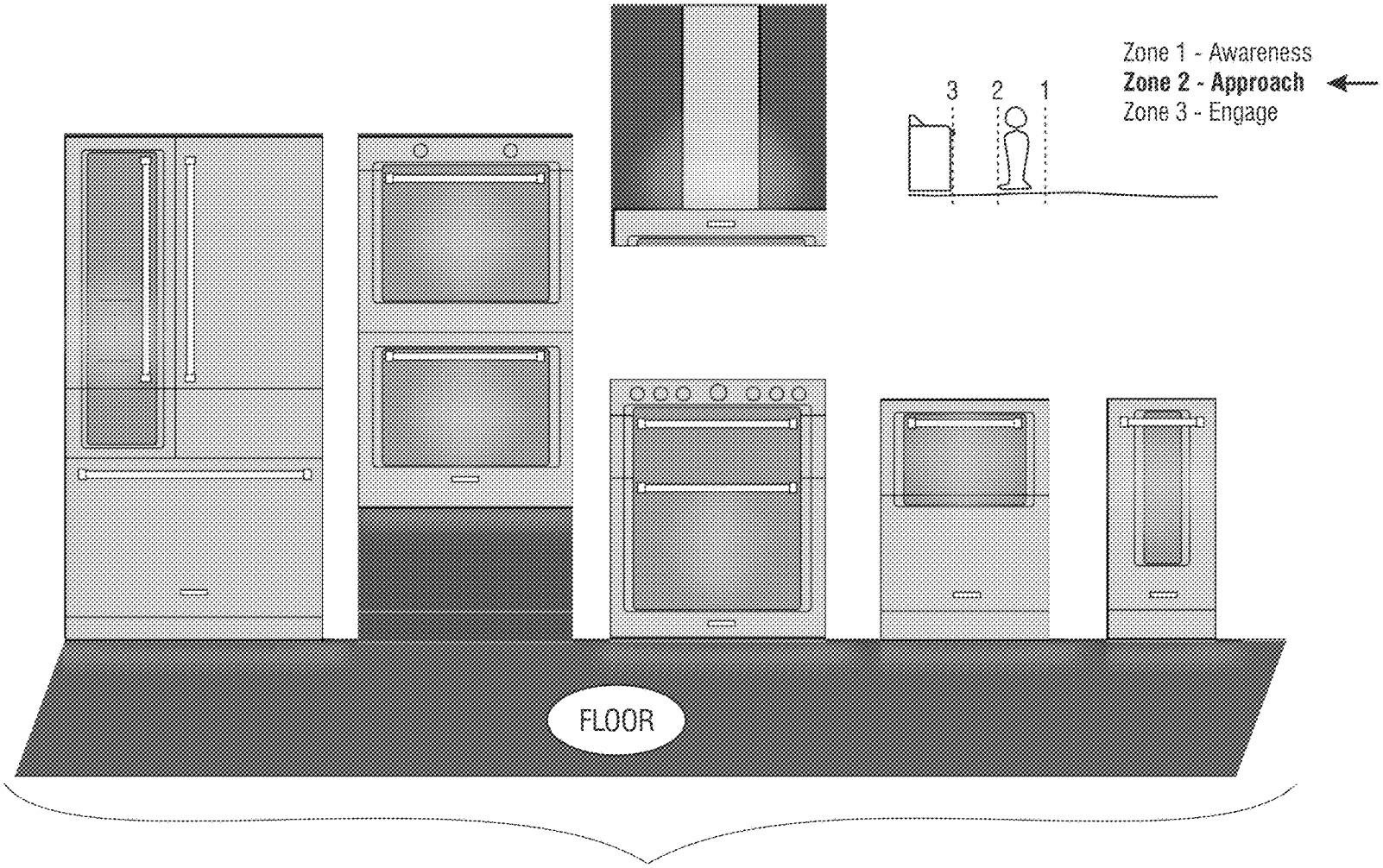

Upon entering a closer zone two or "approach" distance, a second one or different lighting effect will be instructed for any or all of the appliances within zone two (FIG. 18C). In FIG. 18C an example of that second triggered lighting effect would be a different set of lights or an increased intensity whether external or internal (particularly if there is a window into the interior). In the case of the exhaust fan, a dim illumination out of the top side of the horizontal fan housing is shown. It is to be understood that the proximity sensors could be to essentially all turn on lighting effect one of FIG. 18B when a person enters the room. Then, depending on how close that person is, only certain appliances might instigate lighting effect to FIG. 18C. In other words, if a user starts approaching a subset of appliances which are within a distance that has been calibrated to be a zone two distance, only those appliances would have the second lighting effect actuated. The other appliances would remain in the "awareness" lighting effect mode of FIG. 18B. It is possible, however, that zone two would be in proximity to all of the appliances such that all would instigate the second lighting effect of FIG. 18C.

Figure 18D:
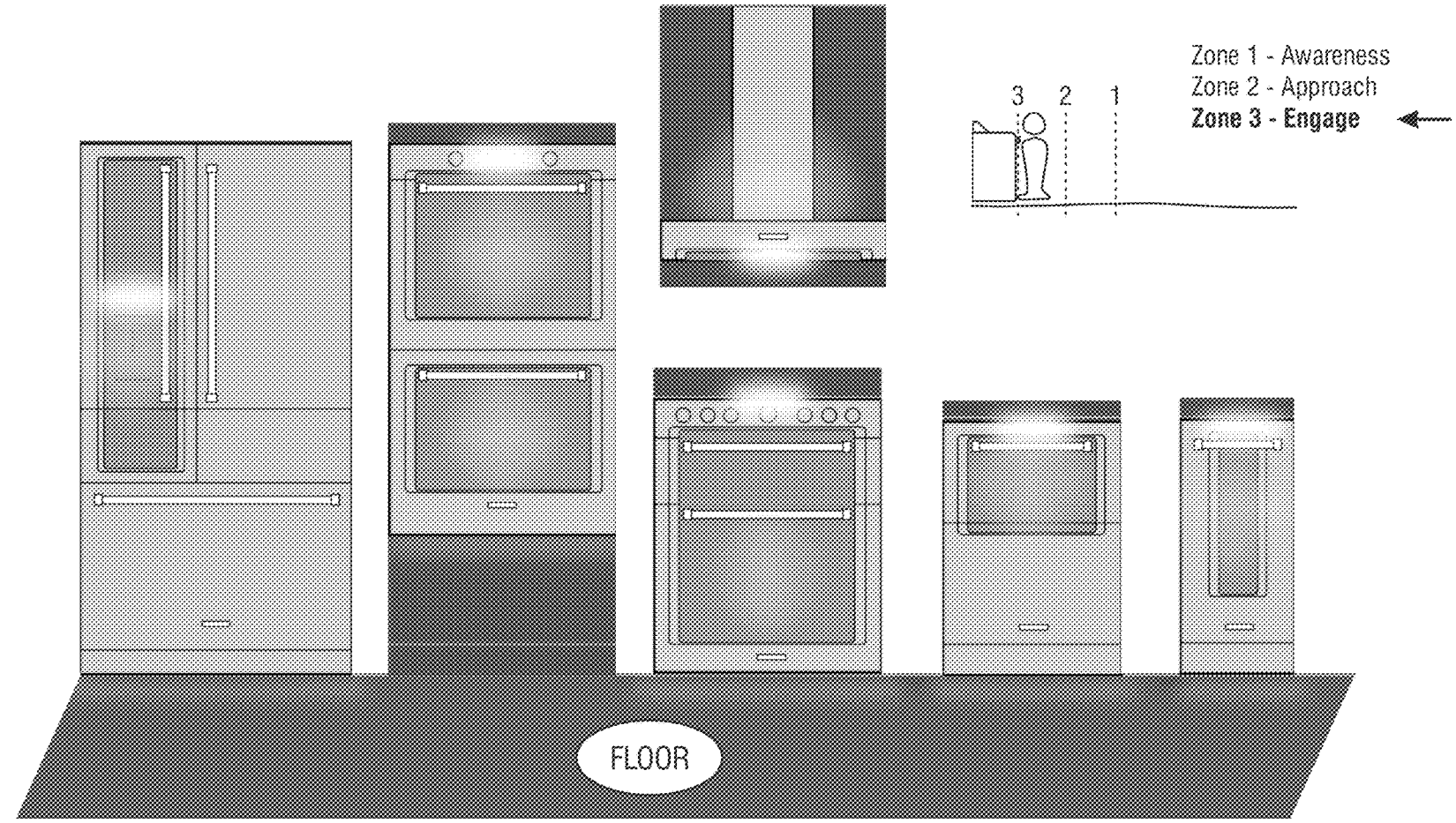

Then, a close approach into zone three, referred to here and in FIG. 18D as "engaged", would instigate a still further effect (e.g., lighting, sound, message display or a combination) for the particular appliance or appliances in which the user is in zone three relative to them. This zone three could be set to be essentially only within very close proximity of a single appliance so that only a single appliance would have the third lighting effect (FIG. 18D). An example would be a different set of lighting sources. They could be in a different position than the others, a different intensity, a different color, or even a different effect. It could also be the same light sources creating a different effect. As shown in FIG. 18D, the same light sources as FIG. 18C are driven brighter. Alternatively, different lights could be actuated. It could be at the handle or cooktop or more at eye level. As can be seen in FIGS. 18B and C, the other lighting effects can be lower or higher than eye level. Alternatively they could be more general lighting than target lighting or vice versa.

FIG. 17E gives one example of a closed loop control algorithm 170 that could be used by each appliance according to FIGS. 18A-D. Of course, a number of variations or additions are possible according to need or desire.

As indicated in FIG. 17E, combinations of various graduated proximity sensing triggers could be utilized. Reference letter "A" in a circle in FIG. 17E is intended to indicate an option that not only could there be the graduated distance sensing of a user relative to an appliance to trigger different lighting effects, there could be a still further sequence of lighting effects once an appliance door is opened (see FIG. 17F).

By referring to FIG. 17E, after the graduated distance sensing lighting effects of FIGS. 17A-D or FIGS. 18A-D occurs, if the user opens the door of an appliance with the door, the algorithm of FIG. 17F could commence. A door switch or other sensor indicating the opening of the door could start a lighting effect such as dimming what had been a brightening of interior lighting from the graduated lighting sensor. Then, proximity sensors or graduated distance sensors inside the appliance could inform the controller where in the appliance the user reaches. In the example of a refrigerator (see FIG. 17F), if the user reaches to a first shelf in the refrigerator, the triggered lighting effect could be bright lights mounted at or near that specific shelf. This would provide better illumination at the location the user is reaching inside the appliance. If the user then moves his or her hand to a different shelf (shelf number two for example) shelf number one shelf lights would turn off or diminish or shelf number two lights would brighten. This could be the same for all shelves in the interior.

Once the hand is withdrawn, all the shelf lights would go back to a normal state. Once the door is closed, those individual shelf lights would be disabled and it could revert back to just the graduated external proximity sensing.

In analogous ways, reaching into an oven, a wine cooler, a dishwasher, or other appliance could utilize any of these closed loop control algorithms with commensurate proximity sensors and lights.

As mentioned earlier, the dynamic changes in lighting effects could be complimented with other effects. One example would be audio. For example, as a user reaches the "engaged" or "zone three" position relative to an appliance, the bright light effect can be instigated and a recorded voice could be played to the user such as "the dishwasher is ready for use" or "what food item would you like to select?". In a similar manner, if the door is open, an audio recording could be played such as "what food item would you like?" if reaching into a refrigerator. If reaching to a specific shelf, those shelf lights could be turned on and a recording could say something like "this is the meat and cheese shelf".

Figure 18E:
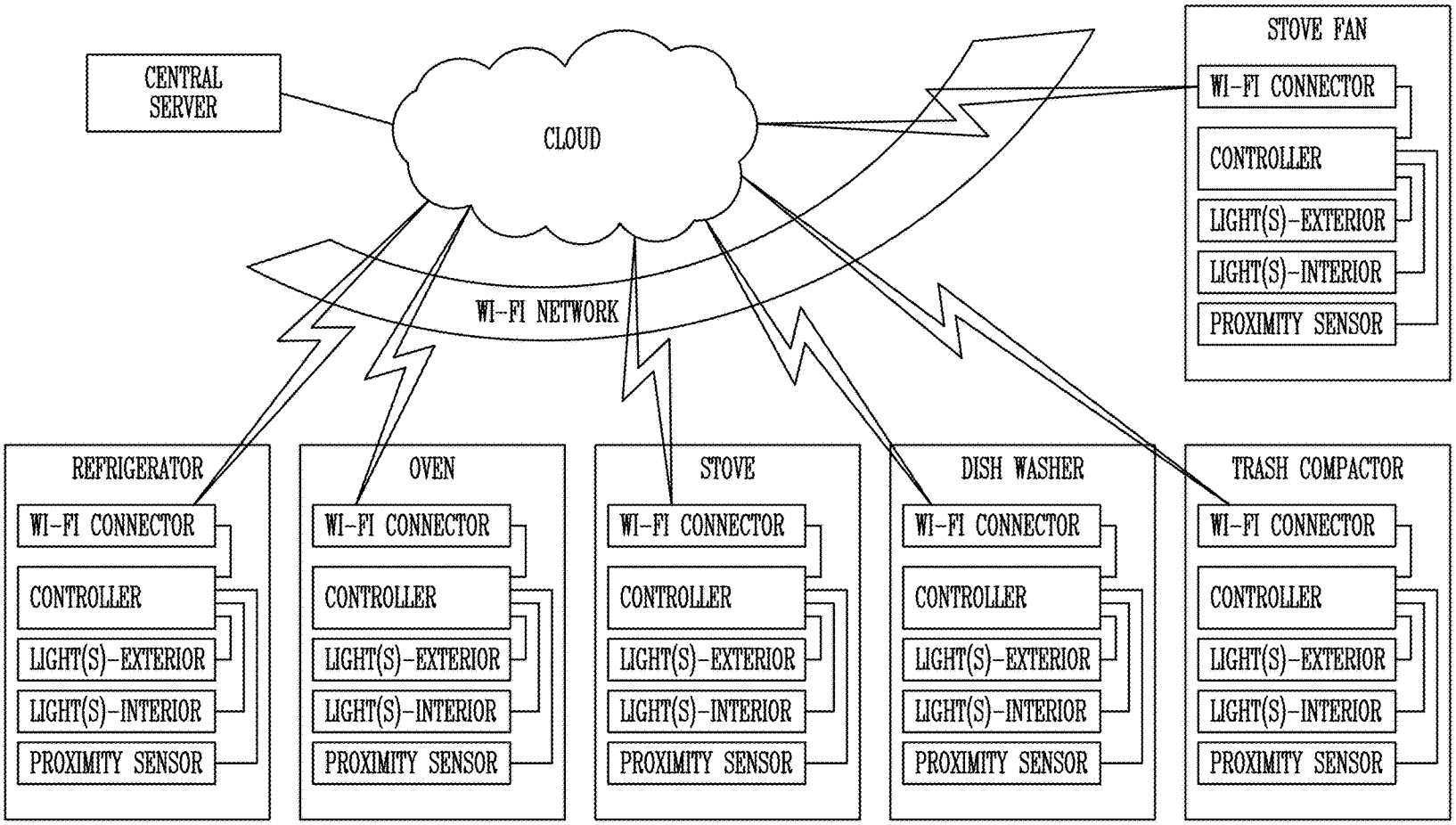
FIG. 18E is a block diagram illustration of networked appliances for the embodiment of FIGS. 18A-D.
Figure 18F:
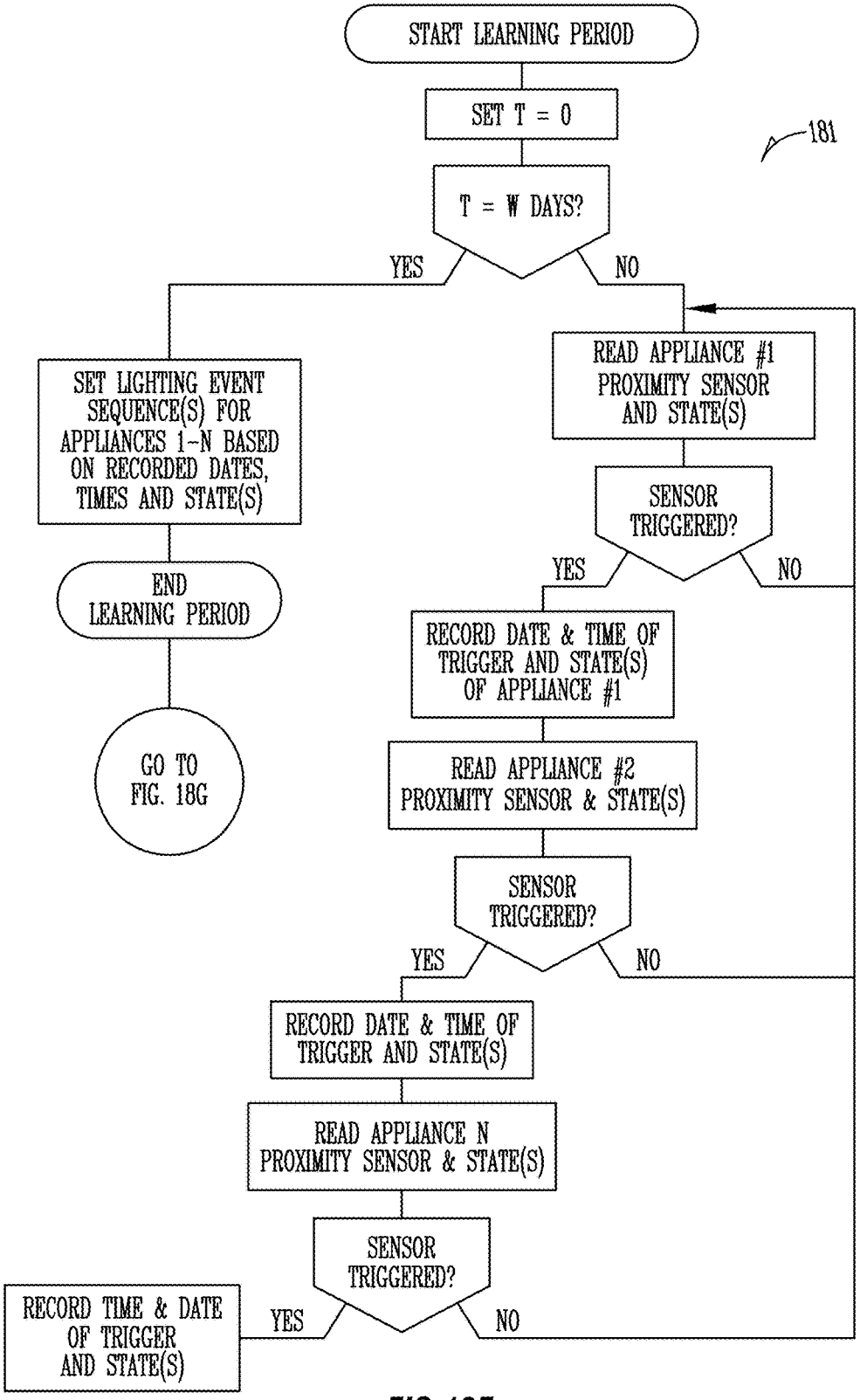
FIG. 18F is a learning period algorithm for the networked or linked appliances of FIG. 18E.
Figure 18G:
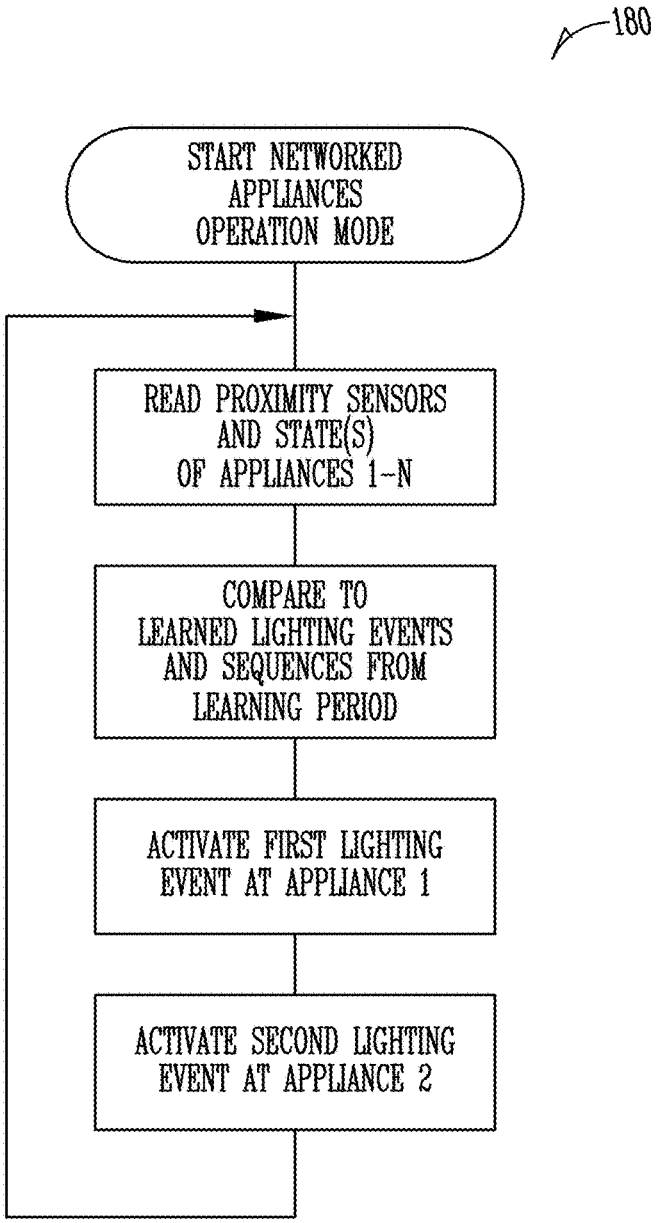
FIG. 18G is a control loop algorithm for operation of the networked appliances of FIGS. 18A-F.

FIGS. 18E-G illustrate diagrammatically a still further potential feature regarding a set of appliances. Using the example of FIGS. 18A-D (a set of kitchen appliances comprising, left to right in FIG. 18A, a refrigerator, a wall-mounted double oven, a stove with exhaust fan above it, a dishwasher, and a trash compactor, coordinated lighting effects for these plural appliances are possible.

Each appliance could include some type of programmable controller, exterior and/or interior lights or sets of lights, a proximity sensor, and a Wi Fi connection. A Wi Fi network could either be local to that home or could connect to the Internet or to cloud-based services (see FIG. 18E). In this manner, the appliances can communicate between one another. It is also possible that they could communicate out to a central location such as a central server. The central server could be maintained by a third party or the appliance manufacturer.

As indicated at FIG. 18G, similar to previous embodiments, the overall system of FIG. 18E could go through a reading of a proximity sensor of each of the plural appliances 1-n (FIG. 18G, closed loop algorithm 180 Step 1). Optionally it could also read the status or state(s) of each appliance (see FIG. 1D as one example the types of states the controller of a refrigerator could monitor). As previously discussed, the status(es) or state(s) of an appliance could include such things as whether or not a door is open or a control is pressed, or some function has occurred in or at the appliance. For example, it could relate to whether or not a washing machine lid has been opened, the washing machine start button has been pressed to start a wash cycle, or whether or not the end of a certain segment of the wash cycle has occurred. Analogous state(s) or status(es) for other types of appliances exist.

FIG. 18F is but one example of what is called a "learning period" algorithm 181 that could be programmed into all of the appliance controllers of FIGS. 18A-E. At the start of the learning period, a timer would be set to begin timing (e.g. t=0). That time period could be a matter of hours, days, weeks, or other time period. In this example it is set at w days (w being a variable). During the learning period, a proximity sensor or state(s) of appliance 1 is/are read. Learning algorithm 181 would loop back through to look for a trigger or a certain state in appliance 1. If a proximity trigger or a certain state is sensed, it would be recorded as to date and time. The learning algorithm 181 continues through each appliance 1 through n in a similar manner.

At the end of the learning period (when t>w days), the programming would set the type of lighting events or sequence(s) that will occur for appliances 1-n in the future based on those recorded dates, times, and states. The learning period would then end. Examples of lighting events or other sequences for specific appliances are described below for illustration. Many others are of course possible.

FIG. 18G shows operation of the plural appliances 1-n after the learning period 181. The proximity sensor and state of each appliance would be continuously monitored and continuously compared to the learned lighting events and sequences of FIG. 18F. When a proximity sensor or state at a first appliance is triggered, a first lighting event would be activated according to that sequence, followed by a second or more lighting events. As can be appreciated, any number of lighting events in the sequence over and above two is possible.

Some specific examples will illustrate these features.

If during learning period 181 it is recorded that a particular user of the refrigerator always approaches and opens the refrigerator door (a "state" monitored by the controller of that appliance) in close proximity of time to their using the oven, the proximity sensors and/or state sensors would know this. Algorithm 181 could then automatically set a sequence of lighting events or effects at both of these appliances based on this learned knowledge. One example of a sequence of lighting events would be as follows. If the proximity sensor of the refrigerator triggers, it will light up the interior of the refrigerator and then, after a certain time period (or concurrently), would light up the interior of the oven. This would provide better usability and enhanced customer experience for the set of appliances. It recognizes and/or guides the user in his/her normal pattern of use of those appliances. It is possible by programming and networking of the appliances.

Another example would be in the context of a laundry washer and dryer (not shown). If the user is found to always or frequently go near the dryer after opening the washer lid, just the dryer could turn on its cavity light or user interface once the proximity sensor of the washer triggers to help the user assess his/her next steps. The washer and dryer (and other appliances) would be networked like FIG. 18E.

Another example could be more complex. If proximity or state sensors show user approach or use of the refrigerator, stove, and the oven is typically followed by dishwasher use, the learning period 181 could inform the appliances that an average amount of time between last use of the combination of refrigerator, oven, and stove and typical starting of the dishwasher is one hour. A lighting event sequence set by program 181 could be any type of sequence of events at refrigerator, oven, and stove (and stove fan); and then at or around approximately one hour after the last sensed use of the foregoing, lighting at the dishwasher. An example of lighting events or effects at the dishwasher would be a first dim lighting of the interior of the dishwasher followed by a lighting of the user interface (control keyboard) of the dishwasher. The same or similar data-gathering or learning 181 regarding any of the set of foregoing appliances relative to operating the trash compactor could be programmed in a similar manner. At a programmed period of time after dishwasher commencement, some lighting event at the trash compactor can be automatically actuated if the "learning" 181 senses the trash compacter is typically operated every day at 10 pm, or 10 minutes after the dishwasher is started, or some other correlation.

A few additional examples will help with understanding of the variety of possibilities regarding the network approach. A learning period could sense that this user typically accesses the refrigerator first, the stove second, the dishwasher third, and the trash compactor fourth. Based on some preset sequence of lighting events in each appliance, some learned time span, or some other criteria, the user can be guided between each of those appliances sequentially by automatically instigated lighting effects. Again, a lighting effect could be a single light source or array in each appliance that is changed in driven intensity based on proximity, time, or other factor. Or it could be different light sources or arrays of light sources actuating or providing different lighting effects at each appliance.

Another possible feature of networked appliances could occur even if all the appliances are not in the same room. An example would be laundry dryer and washer in the basement (not shown) and the appliances of FIG. 18A in the kitchen. The state of a clothes dryer operating in the basement could be monitored. A user of the stove in the kitchen could be informed by a lighting effect or audible sound (or some type of message displayed at the user interface of the oven) that the clothes dryer cycle is done in the basement. This can stretch the user interface of one appliance to wherever the consumer is within his/her house. This can be accomplished by each appliance (including the washer and dryer) having either a wired or wireless connection to the other appliances whether directly or indirectly. As indicated at FIG. 18E, any number of wireless local area networks (similar to how personal computers, printers, and peripherals could be wirelessly intercommunicated in a household) can be set up for this purpose. Such communication networks and components for the same are commercially available from multiple sources.

Alternatively, as also indicated at FIG. 18E, wireless communication through the internet could be to a third party service that could collect the data from the appliance sensors and the learning periods, and set the lighting event sequences either learned, programmed or assigned by a consumer, and then instigate the appropriate lighting sequences, audio or messaging, or other alerts or instructions to any or all of the networked appliances.

Another example would pertain to energy savings. Some appliances have visual displays at the user interface, lights, or some other function that constantly utilizes electrical power. An example would be a digital clock display on an oven. Appliance clocks are conventionally always on (and thus constantly draw electrical power). Utilizing the networked appliances of FIG. 18E, each appliance has a proximity sensor. If the oven is farthest from the door into the kitchen, the proximity sensor on the closest appliance to the door (for example the refrigerator) could sense when the user is entering the kitchen. It could then communicate the same to the oven. The clock on the oven could be turned off until the refrigerator senses a user is in the kitchen and communicates the same to the oven. The user can then see the clock display on the oven even before the proximity sensor on the oven senses the user is in the kitchen. But the clock would turn off (and save energy) when no proximity sensor of any appliance is triggered (indicating no person is in the kitchen). This technique could be used for any and all of the appliances. Even though such a clock may not use substantial instantaneous electrical power, over long periods of time it can add up. Turning power-drawing functions off that are not needed until a user is in the room can save energy and energy costs.

The connected network could have other advantageous features. If one appliance loses connectivity to the network, some message, alarm (visual or audible) or other notification could be sent to or displayed on one of the other appliances, to a centralized router at the home, or to the central server of a third party cloud base service. For example, the home consumer or a maintenance service or other third party could be notified of the connectivity issue or lights in/on the appliance losing connectivity could flash to indicate it is not networked. Another example would be loss of power to an appliance. There could also be messaging about status of the electrical grid for the location of the appliances. For example, information about high consumer electrical power usage (e.g., during very hot or very cold days) could be available to the networked appliances. A message could be given to the user to avoid appliance use until later. Or lighting effects could be temporarily disabled until off-peak hours.

It can be seen from the examples of the embodiments of FIGS. 17A-I and 18A-G that programming of the closed loop algorithm type for different lighting effects can essentially give the appearance of "reaction" lighting. By this it is meant that the appliance or appliances appear "smart". They are reacting to the user. This reaction can be not only instantaneous but based on the gathered data from, for example, a learning period or learning loop(s). It can also be relative to outside data. One example would be GPS or time zone status. A third party cloud-based service could inform appliances in any part of the world of relevant local time. This factor could be included when determining lighting sequence. For example, if it is typical that a trash compactor is operated at 7:30 p.m. local time in a household, a lighting event or a sequence of events could be automatically instructed at the trash compactor every day at or around 7:30 p.m. local time. Or if the learning period indicates laundry is done typically on a certain day and time of the week, either the washer/dryer could have a lighting event, message, or audible signal. Alternatively (or in addition) the user interface of any of the other appliances that are networked (including in different rooms) could signal the user it is the typical time to do laundry.

Options and Alternatives

As can be appreciated by those skilled in the art, the invention can take many forms and embodiments. Variations obvious to those skilled in the art will be included with the invention.

Some examples of options and alternatives are as follows.

Applications. Exemplary embodiments are described in the context of a refrigerator freezer. They can be applied as well to other appliances or other devices that could use or would be desirable to include lighting. As can be appreciated, the side-by-side refrigerator shown in the figures is just one example of a refrigerated appliance and how it is configured into different compartments. Bottom freezer type, French door type or other configurations are equally possible and other appliances or cabinets can utilize at least some aspects of the foregoing.

Control of operation of the light sources. Foregoing embodiments have been discussed in the context of a refrigerator controller such as are known in the art. They are basically programmable microprocessors. As indicated, the LED boards themselves could have some form of microprocessor, including some with at least some programmability. Therefore, some functions (e.g. varying driving of LEDs by LED drivers) could be controlled right at the lighting boards. A variety of alternatives are possible. There could be other types of intelligent control. In some cases there could be at least partial analogue circuitry that accomplishes at least some of the control loop functions. It is further emphasized that one of the dynamic lighting schemes can be applied to the device or two or more, or any combinations thereof. Individual schemes could be operated concurrently but with independent triggers and control loops. Depending on the programmability of the main control board or controller 20, and its inputs and outputs, a variety of different controlled loop, dynamic, and passive lighting effects can be designed.

The designer would select type of lights, position, output distribution pattern, color, and control to create desired lighting effects. For example, as indicated in certain embodiments, light can be targeted (e.g. at and around a certain shelf) or could be more generalized (e.g. around or in a compartment). Utilizing sensors can trigger certain lighting effects and can contribute to the appliance appearing to be "intelligent".

Location. As can be seen, the light sources or single sources can be placed exteriorly or interiorly or both. They can have light output distribution patterns that are more directional or focus (e.g. task lighting) or more general area lighting. They can either relate to illumination or indications or both. They can be in the cabinet, on a shelf, drawer, or rack in the cabinet, on a door, or exteriorly.

Type of lighting. The exemplary embodiments are described regarding LEDs as the light sources. Other solid state sources are possible. Other types of sources including incandescent, fluorescent, HID, or others might be possible depending on configuration and location. In the case of LEDs, heat management can be achieved in a variety of ways. One would be that such light sources would be on a relatively short time and thus cumulatively not generate a lot of heat. Secondly, a typical way of driving LEDs is with a duty cycle which can diminish the need for heat management. Heat sinks and other heat management techniques can be utilized if needed. Still further, the light sources can be relatively low power in some situations.

As indicated, all light sources could be one color. Alternatively, different boards could have different colors. The same board could have different colors.

Additionally, optics or optical devices or surfaces could be utilized with the light sources for different lighting effects. For example, lenses, diffusers, or pattern plates can be placed in front of one or more LEDs to alter their output. Additionally, reflectors, light absorbing surfaces, visors, or shields could be utilized with one or more light sources.

Triggers. A number of triggers or inputs have been described that can be utilized with these embodiments. Others are possible. A variety of different types of sensors have been mentions in the preceding description. The designer can select those, or others, based on desire or need.

What is claimed is:

1. An appliance having at least one learning loop which recalibrates or provides automatic adjustment of sensors relative to a changed environment relating to an appliance, the appliance comprising: a. a housing; b. an illumination source on or in the housing; c. a triggering component; d. one or more sensors d. a programmable controller operatively connected to the triggering component and illumination source to instigate a controlled dynamic passive illumination control loop in reaction to one or more triggers;

wherein once the dynamic passive illumination control loop is activated by one or more triggers, an algorithm is instigated that goes through a closed learning loop of steps which provide more than one lighting scheme or change in response to the control loop running through all stages in response to the trigger;

wherein the programmable intelligent controller is programmed to automatically execute a plurality of illumination controls which alter an event or sequence of events by discontinuing, bypassing or ignoring sensor input using the at least one learning loop; thus providing an enhanced level of product interaction, relative to a changed environment around the appliance.

2. A method of illuminating the appliance of claim 1 comprising:

a. sensing the presence of one or more triggers, b. automatically instigating a first controlled dynamic passive illumination control loop in reaction to the one or more triggers to alter an event or sequence of events through the use of closed learning loops; and c. dynamically adjusting the lighting event; and d. automatically instigating a second controlled dynamic passive illumination control loop in reaction to one or more triggers through the use of closed learning loops.

3. The appliance of claim 1 wherein the housing comprises a refrigerated cabinet.

4. The appliance of claim 1 wherein the illumination source comprises one or more LEDs.

5. The appliance of claim 1 wherein the trigger comprises: a. ambient light level; b. proximity of a user; c. an open door; d. sound level e. temperature, or f. expiration of a period of time.

6. The appliance of claim 1 wherein the dynamic passive illumination control comprises one or more of: a. automatic activation or deactivation of one or more elements of the illumination source; b. increase or decrease in intensity of the illumination source; c. flashing of the illumination source; d. changing color of illumination.

7. The appliance of claim 1 wherein the illuminate source is associated with: a. an exterior badge; b. a ground light; c. an ice/water dispenser well light; d. a door handle; e. a water filter status indicator; f. an interior shelf light.

8. The appliance of claim 1 wherein the illumination control comprises a plurality of sequenced illumination effects and audio output.

9. The appliance of claim 1 wherein the proximity sensor is a graduated distance proximity sensor that can sense proximity regarding a plurality of zones of different distances from the sensor.

10. The appliance of claim 9 wherein the variable distance proximity sensor is adjustable regarding sensing distances.

11. The appliance of claim 9 wherein the variable distance proximity sensor instigates different lighting effects based on different sensed distances.

12. The appliance of claim 9 further comprising a timer to time triggering of the variable distance proximity sensor at each sensing distance and using triggered time to alter lighting event or sequence of events through the at least one closed learning loop.

13. The appliance of claim 1 in combination of one or more additional set appliances networked together in a communication network.

14. The appliance of claim 13 wherein a triggering event at one appliance instigates a dynamic passive illumination control loop and response to the trigger at that appliance or one or more of the other appliances in the communication network.

15. The appliance of claim 14 wherein data regarding triggering events or states of the appliances are monitored and used for a learned sequence of lighting effects at one or more of the network of appliances.

16. The method of claim 2 wherein the first lighting event comprises activating one or more light sources.

17. The method of claim 16 wherein the dynamically adjusting comprises altering the driving of the one or more light sources.

18. The method of claim 16 further comprising activating an audio output before, during, or after the first lighting event.

19. The method of claim 2 further comprising instigating a first lighting event by graduated distance proximity sensing wherein the first lighting event is triggered by a first sensed distance and a second lighting event is triggered by sensing of a second distance.

20. The method of claim 19 further comprising monitoring for a condition indicative of other than a conventional human user of the appliance after triggering by the graduated distance proximity sensor and, if so, altering the lighting event or sequence of lighting events.

21. The method of claim 2 further comprising networking a plurality of said appliances and upon a triggering event at one appliance instructing a lighting event at a second appliance.

* * * * *